US006712122B2

(12) United States Patent
Suzuki et al.

(10) Patent No.: US 6,712,122 B2
(45) Date of Patent: Mar. 30, 2004

(54) METHOD FOR ESTIMATING AND CONTROLLING FLOW PATTERN OF MOLTEN STEEL IN CONTINUOUS CASTING AND APPARATUS THEREFOR

(75) Inventors: Makoto Suzuki, Fukuyama (JP); Masayuki Nakada, Fukuyama (JP); Jun Kubota, Fukuyama (JP); Noriko Kubo, Fukuyama (JP); Junichi Monda, Fukuyama (JP); Yuichi Yamaoka, Kasaoka (JP); Yoshimitsu Isobe, Fukuyama (JP)

(73) Assignee: NKK Corporation, Tokyo (JP)

( * ) Notice: Subject to any disclaimer, the term of this patent is extended or adjusted under 35 U.S.C. 154(b) by 15 days.

(21) Appl. No.: 09/944,029

(22) Filed: Aug. 31, 2001

(65) Prior Publication Data

US 2002/0079083 A1 Jun. 27, 2002

Related U.S. Application Data

(63) Continuation of application No. PCT/JP00/01161, filed on Feb. 29, 2000.

(30) Foreign Application Priority Data

Mar. 2, 1999 (JP) ..... 11-054630
Mar. 3, 1999 (JP) ..... 11-054998
Mar. 10, 1999 (WO) ..... PCT/JP99/01158

(51) Int. Cl.[7] ..... B22D 11/18; B22D 2/00

(52) U.S. Cl. ..... 164/453; 164/151.5; 164/450.3; 164/155.6

(58) Field of Search ..... 164/452, 453, 164/151.4, 151.5, 449.1, 450.3, 155.6

(56) References Cited

U.S. PATENT DOCUMENTS

| | | | | | |
|---|---|---|---|---|---|
| 2,743,492 | A | * | 5/1956 | Easton | 164/502 |
| 4,553,604 | A | * | 11/1985 | Yaji et al. | 164/453 |
| 4,556,099 | A | * | 12/1985 | Yamamoto et al. | 164/451 |
| 4,774,998 | A | * | 10/1988 | Matsushita et al. | 164/453 |
| 4,949,777 | A | * | 8/1990 | Itoyama et al. | 164/453 |
| 5,020,585 | A | * | 6/1991 | Blazek et al. | 164/452 |
| 5,158,128 | A | * | 10/1992 | Inoue et al. | 164/151.5 |
| 5,904,202 | A | * | 5/1999 | Adamy | 164/151.5 |
| 6,179,041 | B1 | * | 1/2001 | Pleschiutschnigg | 164/452 |
| 6,494,249 | B1 | * | 12/2002 | Kollberg et al. | 164/452 |

FOREIGN PATENT DOCUMENTS

| | | | |
|---|---|---|---|
| FR | 2693136 A1 | * | 1/1994 |
| JP | 55084259 A | * | 6/1980 |
| JP | 56-95460 A | | 8/1981 |

(List continued on next page.)

*Primary Examiner*—M. Alexandra Elve
*Assistant Examiner*—Kevin McHenry
(74) *Attorney, Agent, or Firm*—Frishauf, Holtz, Goodman & Chick, P.C.

(57) ABSTRACT

The method for controlling flow pattern of molten steel in continuous casting, comprises the steps of: (a) continuously casting a molten steel injected through an immersion nozzle; (b) measuring temperatures of a copper plate on longer side of the mold in width direction thereof at plurality of points; (c) detecting a flow pattern of the molten steel in the mold based on the time-sequential variations of temperatures of the copper plate at individual measurement points; and (d) controlling the flow pattern to establish a specified pattern on the basis of the detected result. The temperatures of mold copper plate are measured by plurality of temperature measurement elements buried in the rear face of the mold copper plate for continuous casting. The temperature measurement elements are arranged in a range of from 10 to 135 mm distant from the melt surface in the mold in the slab-drawing direction.

35 Claims, 60 Drawing Sheets

FOREIGN PATENT DOCUMENTS

| | | | | |
|---|---|---|---|---|
| JP | 56095460 | A | * | 8/1981 |
| JP | 56095461 | A | * | 8/1981 |
| JP | 62-252650 | A | | 11/1987 |
| JP | 3-60852 | A | | 3/1991 |
| JP | 03060852 | A | * | 3/1991 |
| JP | 3-275256 | A | | 12/1991 |
| JP | 03275256 | A | * | 12/1991 |
| JP | 4-84650 | A | | 3/1992 |
| JP | 04084650 | A | * | 3/1992 |
| JP | 4-105756 | A | | 4/1992 |
| JP | 04105756 | A | * | 4/1992 |
| JP | 4-284956 | A | | 10/1992 |
| JP | 11-216550 | A | | 8/1999 |

* cited by examiner

| | |
|---|---|
| ● | MEASUREMENT POINT WHERE NO TEMPERATURE CHANGE OCCURRED |
| ◎ | MEASUREMENT POINT WHERE TEMPERATURE INCREASED |
| × | MEASUREMENT POINT WHERE TEMPERATURE DECREASED |

FIG. 22

| PATTERN NO. | FLOW PATTERN OF MOLTEN STEEL | TEMPERATURE DISTRIBUTION OF COPPER PLATE ON LONGER SIDE OF MOLD |
|---|---|---|
| 0 | 109 116 122 120 121 | WIDTH CENTER |
| 1 | | |
| 2 | | |
| 2.5 | | |
| 3 | | |
| 3.5 | | |
| 4 | | |

| PATTERN NO. | MOLTEN STEEL FLOW PATTERN | TEMPERATURE DISTRIBUTION ON COPPER PLATE ON LONGER SIDE OF THE MOLD |
|---|---|---|
| 0 |   |  |
| 1 |  |  |
| 2 |  |  |
| 3 |  |  |

METHOD FOR ESTIMATING AND CONTROLLING FLOW PATTERN OF MOLTEN STEEL IN CONTINUOUS CASTING AND APPARATUS THEREFOR

This application is a continuation application of International Application PCT/JP00/01161 filed Feb. 29, 2000 which was not published under PCT Article 21(2) in English.

FIELD OF THE INVENTION

The present invention relates to a method for continuous casting of steel, particularly to a method for estimating and controlling flow pattern of molten steel in continuous casting and apparatus therefor.

BACKGROUND OF THE INVENTION

Continuous casting of steel is carried out by injecting a molten steel at high speed into a mold via an immersion nozzle. The injected flow induces a molten steel flow in the mold, which molten steel flow gives significant influence on the surface and internal characteristics of produced slab. For example, when the surface flow speed of the melt surface in the mold, (hereinafter referred to simply as "meniscus"), is excessively high, or when vertical eddies are generated in the meniscus, mold powder is trapped into the molten steel. In addition, it is known that the floatation of deoxidized products such as $Al_2O_3$ in the molten steel depends on the flow of molten steel. The mold powder and the deoxidized products which are trapped into the slab induce defects caused from the non-metallic inclusions on products.

Flow of molten steel in a mold varies during casting depending on the adhesion of $Al_2O_3$ to inside surface of the immersion nozzle, the erosion of the immersion nozzle, the opening of sliding nozzle, and other variables, even under the same casting condition. The phenomenon is an important issue for improving the quality of slab. To this point, there are many proposed methods to detect the flow of molten steel, to control the intensity and direction of the magnetic field to be applied based on the detected state of the molten steel flow, thus to control the flow of molten steel in the mold.

For example, Japanese Unexamined Patent Publication No. 62-252650, (hereinafter referred to simply as "the Prior Art 1"), discloses a method for controlling flow of molten steel. According to the Prior Art 1, thermocouples are buried in a copper plate on shorter side of a mold to detect the difference in molten steel level between the right side and the left side to the immersion nozzle, and the direction of agitation and the thrust of agitation of the magnetic agitator are controlled to zero the level difference.

Japanese Unexamined Patent Publication No. 3-275256, (hereinafter referred to simply as "the Prior Art 2"), discloses a method for controlling deflected flow of molten steel. According to the Prior Art 2, thermocouples are buried in a copper plate on longer side of a mold to measure the temperature distribution on the copper plate on longer side of the mold, and the generation of deflected flow of molten steel is detected on the basis of the temperature distribution at the right half width and the left half width of the mold, thus controlling separately the current being applied to each of the two magnetic brakes of DC magnet type, located on the rear face of longer side of the mold, responding to the detected direction and magnitude of the generated deflected flow of molten steel.

Japanese Unexamined Patent Publication No. 4-284956, (hereinafter referred to simply as "the Prior Art 3"), discloses a method for controlling the speed of injection flow from an immersion nozzle in a magnetic agitator. According to the Prior Art 3, two non-contact distance meters are located above the meniscus between the immersion nozzle and the short side of the mold to measure the variations of melt level at the meniscus, and the propagation speed of the surface waves is derived from a mutual correlation function of these two measured values, thus controlling the injection flow speed from the immersion nozzle so as the propagation speed not to exceed a specified value.

The Prior Art 1 and the Prior Art 2 detect the flow of molten steel based on the temperature distribution on the mold copper plate, and control the flow on the basis of the detected molten steel flow. The variations in the temperature distribution on the mold copper plate are generated not solely caused from the variations of the flow state of molten steel, and they are generated also by the variations of the state of contact between the mold and the solidified shell, by the variations of inflow state of the mold powder, and other variables. Since there occur variations of temperature distribution on the mold copper plate owing to variables other than the flow of molten steel, the Prior Art 1 and the Prior Art 2 that detect the flow of molten steel from solely the temperature distribution on the mold copper plate cannot detect precisely the flow of molten steel.

Although no detail description is given here, investigations carried by the inventors of the present invention confirmed that, for reducing the amount of mold powder and of deoxidized products, solely the prevention of deflected flow in the mold to establish a flow symmetrical in right half width and left half width is not sufficient, and that an optimum flow pattern exists among several flows symmetrical in right half width and left half width.

The Prior Art 3 is an effective means of method for flow control. The Prior Art 3, however, controls only the flow speed of molten steel at meniscus, and is insufficient to detect the flow pattern of molten steel in the mold. In addition, both the Prior Art 1 and the Prior Art 2 cannot detect the flow pattern.

DISCLOSURE OF THE INVENTION

It is an object of the present invention to improve and stabilize the quality of slab manufactured by continuous casting, in particular to improve and stabilize the quality thereof through the prevention of dragging the mold powder, which is induced from a flow pattern of molten steel in the mold, thus assuring feed of good slab to succeeding stages.

In this regard, the present invention provides a method for controlling flow pattern of molten steel to maintain an optimum flow pattern in continuous casting, and further provides a temperature measurement device for mold copper plate to accurately estimate the flow state of molten steel, and a method for estimating the flow state of molten steel in the mold using the temperature measurement device.

To achieve the object, firstly, the present invention provides a method for estimating flow pattern of molten steel in continuous casting, which comprises the steps of:

- continuously casting a molten steel injected into a mold through an immersion nozzle;
- measuring temperatures of a copper plate in width direction thereof on longer side of the mold at plurality of points using a temperature measurement device; and
- estimating a flow pattern of the molten steel in the mold based on the distribution of the copper plate temperatures at individual measurement points.

The method for estimating the flow pattern of molten steel preferably further comprises a step of applying a magnetic field to the molten steel that was injected into the mold so as the detected flow pattern to establish a specified pattern. The magnetic field applied is preferably a moving magnetic field that moves in the horizontal direction.

Furthermore, the method for estimating the flow pattern of molten steel preferably further comprises the steps of:

determining a heat flux being transferred from the molten steel in the mold to a cooling water for the mold copper plate using the mold copper plate temperatures measured by the temperature measurement device, thickness of the mold copper plate, distance between the surface of the mold copper plate on the molten steel side and the tip of a temperature measurement element, temperature of the cooling water for the mold copper plate, thickness of a solidified shell, thickness of a mold powder layer, and temperature of the molten steel in the mold;

deriving a convection heat transfer coefficient, corresponding to the heat flux, between the molten steel and the solidified shell; and determining flow speed of the molten steel along the solidified shell based on thus derived convection heat transfer coefficient.

The method for estimating the flow pattern may further comprise the step of correcting the temperatures of copper plate on longer side of the mold.

The step of correcting the temperatures of copper plate comprises the steps of:

measuring the surface shape of the solidified shell in the slab-width direction below the lower end of the mold;

estimating the heat transfer resistance between the copper plate on longer side of the mold and the solidified shell based on thus measured surface shape; and correcting the temperature of copper plate on longer side of the mold at every measurement point based on the estimated heat transfer resistance.

The temperature measurement device for determining the temperatures of mold copper plate applied to the method for estimating the flow pattern preferably comprises plurality of temperature measurement elements which are buried in rear face of the mold copper plate for continuous casting. The temperature measurement elements are preferably located in a distance range of from 10 to 135 mm from the level of molten steel in the mold to the direction of slab-drawing. The distance between the surface of the mold copper plate on the molten steel side and the tip of the temperature measurement element is preferably 16 mm or less, while keeping not more than 200 mm of intervals of the temperature measurement elements in the mold width direction and allotting thereof over a range corresponding to the whole width of the slab.

The step of estimating the flow pattern is preferably either one step selected from the group given below.

(A) Based on the variations of temperature of copper plate on longer side of the mold with time, the distribution of measurement points where the temperature of copper plate on longer side of the mold increases is determined. Then, based on thus determined distribution of the measurement points of temperature increase, the flow pattern of the molten steel in the mold is estimated.

(B) Based on the variations of temperature of the copper plate on longer side of the mold with time, the distribution of measurement points where the temperature of copper plate on longer side of the mold decreases is determined. Then, based on thus determined distribution of the measurement points of temperature decrease, the flow pattern of the molten steel in the mold is estimated.

(C) Based on the variations of temperature of the copper plate on longer side of the mold with time, the distribution of measurement points where the temperature of copper plate on longer side of the mold increases and decreases, respectively, is determined. Then, based on thus determined respective distributions of the measurement points of temperature increase or decrease, the flow pattern of the molten steel in the mold is estimated.

(D) Based on the number and positions of the peaks of the temperatures of mold copper plate in mold width direction, the flow pattern of molten steel in the mold is estimated.

(E) The deflected flow of the molten steel in the mold is estimated by comparing maximum value and the position of the maximum value of the temperatures of mold copper plate at right half width with maximum value and the position of the maximum value of the temperatures of mold copper plate at left half width of the mold to the center position thereof based on the measured temperatures.

Secondly, the present invention provides a temperature measurement device for mold copper plate, which comprises:

plurality of temperature measurement elements buried in tear face of a mold copper plate for continuous casting;

the temperature measurement elements being located in a distance range of from 10 to 135 mm from the level of molten steel in the mold to the direction of slab-drawing, and the distance between the surface of the mold copper plate on the molten steel side and the tip of the temperature measurement element being 16 mm or less, while keeping not more than 200 mm of intervals of the temperature measurement elements in the mold width direction and allotting thereof over a range corresponding to the whole width of the slab.

In the temperature measurement device, the temperature measurement element is preferably placed passing through a pipe which is isolated from a cooling water in a water box, and a seal packing is preferably applied around the place where the temperature measurement element is placed.

Thirdly, the present invention provides a method for judging surface defect on an slab obtained by continuous casting, which comprises the steps of:

locating plurality of temperature measurement elements in a distance range of from 10 to 135 mm from the position of meniscus in the mold to the direction of slab-drawing along the width direction of rear face of the mold copper plate;

measuring the distribution of temperatures of the mold copper plate in width direction thereof; and judging the surface defect on the slab on the basis of the distribution of temperatures in the mold width direction.

The judgment of the defect is carried out either one selected from the group given below.

(A) The surface defect of slab is judged on the basis of the maximum value in the temperature distribution in the mold width direction.

(B) The surface defect of slab is judged on the basis of the minimum value in the temperature distribution in the mold width direction.

(C) The surface defect of slab is judged on the basis of the average value in the temperature distribution in the mold width direction.

(D) The surface defect of slab is judged on the basis of the difference between the average value of the temperature distribution in the mold width direction and the average value of a typical temperature distribution in the mold width direction at the slab-drawing speed.

(E) The surface defect of slab is judged on the basis of the larger value of, centering the immersion nozzle located at center of the mold, the difference between the maximum value and the minimum value in the temperature distribution at left half width of the mold and the difference between the maximum value and the minimum value in the temperature distribution at right half width of the mold.

(F) The surface defect of slab is judged on the basis of the absolute value, centering the immersion nozzle located at center of the mold, between the maximum value in the temperature distribution at left half width of the mold and the maximum value in the temperature distribution at right half width of the mold.

(G) The surface defect of slab is judged on the basis of the maximum value of temperature variations per unit time among the temperatures measured by every temperature measurement element.

Fourthly, the present invention provides a method for detecting the flow of molten steel in continuous casting process, which comprises the steps of:

locating plurality of temperature measurement elements orthogonally to the direction of slab-drawing at rear face of the mold copper plate for continuous casting;

measuring mold copper plate temperatures using these plurality of temperature measuring elements;

applying low pass filter treatment to each of thus measured mold copper temperatures assuming a range of cut-off space frequency of larger than [2/(mold width W)] and less than 0.01, in which the space frequency f of the molten steel flow is defined by f=1/L, where L designates varying wave length (mm); and estimating the state of flow of molten steel in the mold on the basis of the temperature distribution of the mold copper plate, which temperature distribution was treated by the low pass filter.

The method for detecting the flow of molten steel preferably adjusts the distance between adjacent temperature measurement elements to a range of from more than 44.3/3 mm and less than [0.443×(mold width W)/6] mm.

Furthermore, the method for detecting the flow of molten steel preferably applies low pass filter treatment using a data series which is extended by doubling back the acquired data at each of both edges of the mold width.

Fifthly, the present invention provides a method for detecting the flow of molten steel in continuous casting, which comprises the steps of:

locating plurality of temperature measurement elements orthogonally to the direction of slab-drawing while keeping the distance between adjacent temperature measurement elements to a range of from 44.3/3 mm to [0.443×(mold width W)/6] mm;

measuring temperatures of a mold copper plate using thus located temperature measurement elements;

deriving a spatial movement average of thus measured mold copper plate temperatures; and estimating a state of molten steel flow in the mold based on the temperature distribution of the spatial movement average mold copper plate temperatures.

Sixthly, the present invention provides a method for evaluating irregularity in heat-release in the mold in continuous casting, which comprises the steps of:

locating plurality of temperature measurement elements orthogonally to the direction of slab-drawing at rear face of the mold copper plate for continuous casting;

measuring temperatures of the mold copper plate using thus located temperature measurement elements;

applying low pass filter treatment to each of thus measured mold copper temperatures; and evaluating the irregularity in heat-release in the mold on the basis of the difference between the measured mold copper plate temperature and the mold copper plate temperature that was treated by the low pass filter.

Seventhly, the present invention provides a method for detecting the flow of molten steel in continuous casting, which comprises the steps of:

locating plurality of temperature measurement elements orthogonally to the direction of slab-drawing at rear face of the mold copper plate for continuous casting;

measuring temperatures of the mold copper plate using thus located temperature measurement elements;

sampling thus measured individual mold copper plate temperatures at intervals of not more than 60 seconds; and estimating the state of molten steel flow in the mold on the basis of the mold copper plate temperatures sampled at the intervals.

Eighthly, the present invention provides a method for controlling the molten steel flow in continuous casting, which comprises the steps of:

measuring temperature distribution in the width direction of the copper plate on longer side of the mold by locating plurality of temperature measurement elements in the width direction of and on rear face of the copper plate on longer side of the mold for continuous casting; and adjusting one or more of the variables of the magnetic field intensity of a magnetic field generator attached to the mold, the slab-drawing speed, the immersion depth of the immersion nozzle, and the Ar gas injection rate into the immersion nozzle, so as the difference between the maximum value and the minimum value in thus determined temperature distribution to become 12° C. or less.

In the method for controlling the molten steel flow, it is preferable that one or more of the variables of the magnetic field intensity of the magnetic field generator attached to the mold, the slab-drawing speed, the immersion depth of the immersion nozzle, and the Ar gas injection rate into the immersion nozzle, are adjusted so as the difference between the maximum value and the minimum value in the measured temperature distribution to become 12° C. or less, and so as the temperature difference between symmetrical positions in the right half width and the left half width to the immersion nozzle in width direction of the copper plate on longer side of the mold to become 10° C. or less.

In the method for controlling the molten steel flow, it is preferable that the intensity of magnetic field of the magnetic field generator attached to the mold is adjusted separately in the right half width and the left half width of the mold to the immersion nozzle to each other.

Ninthly, the present invention provides a method for controlling the molten steel flow in continuous casting, which comprises the steps of:

measuring temperature distribution in the width direction of the copper plate on longer side of the mold by locating plurality of temperature measurement elements in the width direction of and on rear face of the copper plate on longer side of the mold for continuous casting;

deriving molten steel flow distribution in width direction of the copper plate on longer side of the mold by determining the flow speed of the molten steel at each measurement point on the basis of thus measured temperatures;

adjusting one or more of the variables of the magnetic field intensity of the magnetic field generator attached to the mold, the slab-drawing speed, the immersion depth of the immersion nozzle, and the Ar gas injection rate into the immersion nozzle, so as the difference between the maximum value and the minimum value in the determined molten steel flow distribution to become 0.25 m/sec or less.

In the method for controlling the molten steel flow, it is preferable that one or more of the variables of the magnetic field intensity of the magnetic field generator attached to the mold, the slab-drawing speed, the immersion depth of the immersion nozzle, and the Ar gas injection rate into the immersion nozzle are adjusted so as the difference between the maximum value and the minimum value in the derived molten steel flow distribution to become 0.25 m/sec or less, and so as the difference in flow speed of molten steel between symmetrical positions in the right half width and the left half width to the immersion nozzle in width direction of the copper plate on longer side of the mold to become 0.20 m/sec or less.

In the method for controlling the molten steel flow, it is preferable that the intensity of the magnetic field generator attached to the mold is adjusted separately in the right half width and the left half width of the mold to the immersion nozzle to each other.

BRIEF DESCRIPTION OF THE DRAWINGS

FIG. 22 illustrates flow patterns of molten steel in the mold and temperature distributions of mold copper plate in the mold width direction of the Embodiment 2.

EMBODIMENT FOR CARRYING OUT THE INVENTION

Embodiment 1

Method for Controlling the Flow Pattern of Molten Steel

Figure 1:
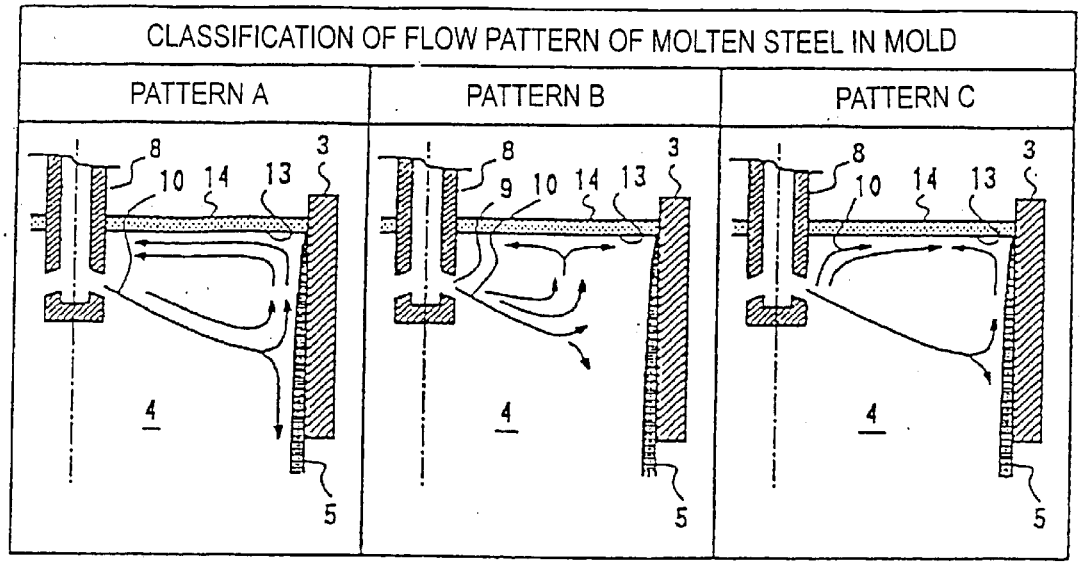
FIG. 1 is a schematic drawing of flow patterns of molten steel in the mold of the Embodiment 1.

Flow pattern of molten steel in a mold varies in complex modes caused from the influences of ascending Ar bubbles and of applied magnetic field even in a symmetrical flow in right half width and in left half width in the mold to the immersion nozzle without deflection. The flow patterns are largely classified to three patterns: Pattern A, Pattern B, and Pattern C, which are illustrated in FIG. 1. In the figure, the reference number 3 designates the shorter side of the mold, 4 designates the molten steel, 5 designates the solidified shell, 8 designates the immersion nozzle, 9 designates the injection hole, 10 designates the injected flow, 13 designates the meniscus, and 14 designates the mold powder.

According to the Pattern A, the injected flow 10 coming from the immersion nozzle 8 reaches to and collides against the solidified shell 5 on shorter side 3 of the mold, then separates in two flows. One flow proceeds along the solidified shell 5 on shorter side 3 of the mold and ascends to the meniscus 13, further proceeds along the meniscus 13 from shorter side 3 of the mold toward the center portion of the mold (toward the immersion nozzle 8). The other flow becomes, after colliding against the solidified shell 5, a descending flow toward the lower portion of the mold.

According to the Pattern B, the influence of ascending Ar bubbles or the influence of applied magnetic field on the injected flow 10 makes the injected flow 10 fail to reach the solidified shell 5 on shorter side 3 of the mold, and the flow is dispersed between the injection hole 9 and the solidified shell 5 on shorter side 3 of the mold to create an ascending flow and a descending flow. At the meniscus 13, centering an intermediate position between the immersion nozzle 8 and the shorter side 3 of the mold, there are created a flow toward the center portion of the mold (the immersion nozzle 8 side) at the immersion nozzle 8 side and a flow toward inversely the shorter side 3 of the mold at the side of shorter side 3 of the mold.

According to the Pattern C, the flow includes an ascending flow of the injected flow at near the immersion nozzle 8. That type of flow is created mainly by the influence of ascending coarse Ar bubbles, the influence of applied magnetic field, or other influence. In the Pattern C, main stream is the flow from the center portion of the mold (at the immersion nozzle 8 side) toward the side of shorter side 3 of the mold.

Figure 2:
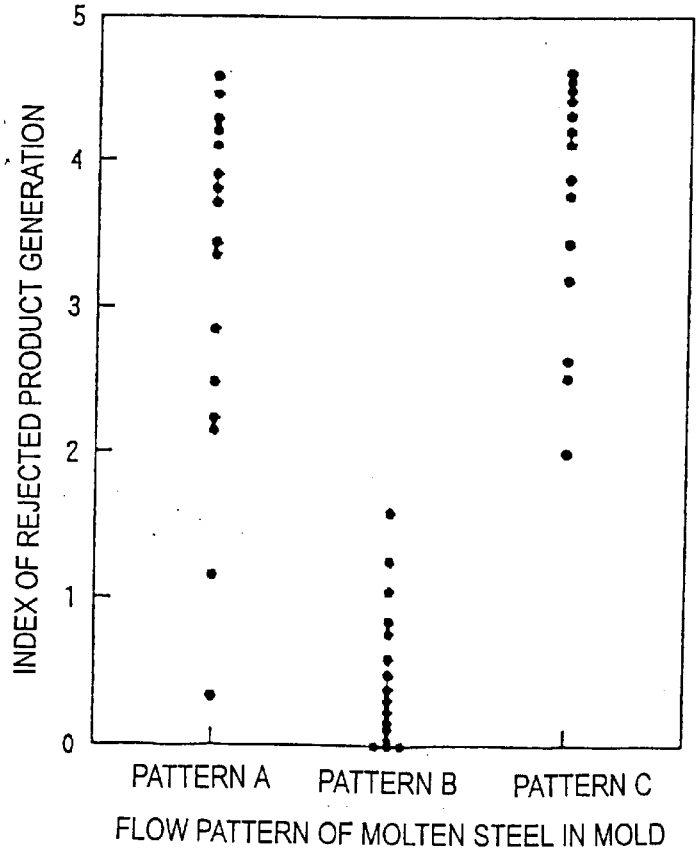
FIG. 2 is a graph showing the relation between the flow pattern of molten steel in the mold and the occurrence of rejected products of the Embodiment 1.

The inventors of the present invention investigated the generation of rejected products caused from mold powder in the thin steel plates products. FIG. 2 shows the result. As seen in the figure, when the flow pattern of the molten steel in the mold is the Pattern B, the quality of slab is the best giving less defects caused from mold powder among the three patterns. The reason is presumably the following.

For the case of Pattern A, vortexes which induce inclusion of mold powder into the molten steel likely occur at the meniscus in a range of from the center of mold to a position distant from the center by a distance of one fourth of the mold width. Furthermore, when the flow speed at the surface of molten steel is high, the mold powder is peeled by the surface flow of the molten steel, which likely induces the inclusion of mold powder. In the case of Pattern C, the ascending flow of the molten steel in the vicinity of the immersion nozzle and the ascending coarse Ar bubbles induce fluctuation and disturbance of the meniscus, which generates the inclusion of mold powder. In addition, when the flow speed at the surface of molten steel is high, vertical vortexes are generated at near the shorter side of the mold, which also causes the inclusion of mold powder. To the contrary, for the case of Pattern B, there is no generation of vortex and of strong surface flow on the meniscus, thus creating a flow condition that hardly induces the inclusion of mold powder.

Accordingly, by establishing the Pattern B in the flow pattern of the molten steel in the mold, the degradation in quality of slab is prevented, and the reduction in degrading product quality and the improvement of the rate of slab free from correction are actualized. As described before, however, the flow pattern of the molten steel in the mold varies during casting even under the same casting condition. If the flow pattern can be detected during the casting stage, a deviated flow pattern from a specified level can be returned to the specified flow pattern by varying the intensity of applied magnetic field.

To this point, the inventors of the present invention found that the flow pattern of the molten steel in the mold is detected by measuring the temperatures of copper plate on longer side of the mold. That is, the temperature of copper plate on longer side of the mold nearby the meniscus of the mold increases at a position corresponding to the ascending flow of the molten steel, thus varying the position of high temperature of copper plate on longer side of the mold responding to the variations of the flow pattern. For example, in the case of Pattern A, an ascending flow is formed at near the shorter side of the mold, thus increasing the temperature of copper plate on longer side of the mold at near the shorter side of the mold. This is because that the injected flow has higher temperature than that of the molten steel in the mold so that the temperature of the molten steel increases to enhance the heat transfer owing to the flow of molten steel at a position of ascending injected flow, which results in the increase of heat transfer rate to the copper plate on longer side of the mold to increase the temperature of copper plate on longer side of the mold.

However, the temperature of copper plate on longer side of the mold varies not only by the influence of the flow of molten steel but also by the state of contact between the mold and the solidified shell, by the state of inflow of mold powder, and the like. As a result, detection of the flow of molten steel solely by the distribution of absolute values of temperature of copper plate on longer side of the mold in the slab width direction may result in wrong detection. That is, accurate flow pattern detection cannot be attained unless the influence of these variables, other than the flow of molten steel, on the temperature of copper plate on longer side of the mold is removed.

The inventors of the present invention found that the influence of the variables, other than the flow of molten steel, on the temperature of copper plate on longer side of the mold is minimized by focusing on the changes in temperature with time at every measuring point to determine the temperature of copper plate on longer side of the mold with time, or by selecting increasing speed and decreasing speed of the temperature at a certain interval as the index, thus assuring precise flow pattern detection. This is because the temperature variations of copper plate on longer side of the mold caused from the variables, other than the flow of molten steel, occur relatively slowly.

In that case, it was also found that further precise detection is attained by determining the distribution of measurement points of increasing and of decreasing the temperature of copper plate on longer side of the mold, and by detecting the flow pattern based on the distribution of measurement points of increasing the temperature and/or the distribution of measurement points of decreasing the temperature. This is because the variations in flow pattern induce the variations in the temperature of copper plate on longer side of the mold at a certain distribution.

Furthermore, if the surface shape of the solidified shell in the slab width direction is determined beneath the lower end of the mold, if the heat transfer resistance between the copper plate on longer side of the mold and the solidified shell is estimated based on the surface shape of the solidified shell, and if the temperature of copper plate on longer side of the mold is corrected based on the estimated heat transfer resistance, the influence of the contact state between the mold and the solidified shell on the temperature of copper plate on longer side of the mold can be reduced, thus the flow pattern is more precisely detected. In this case, the surface shape of the solidified shell, which was determined beneath the lower end of the mold, is fed back to the measured value of temperature of copper plate on longer side of the mold in the vicinity of the meniscus. Accordingly, the data of surface shape of the solidified shell, which are fed back, cover the time range of the progress of solidified shell from nearby position of meniscus to the point of measuring the surface shape. Even if the point of measuring the surface shape is at 1.5 meter below the meniscus, the necessary time is around 50 seconds if the slab-drawing speed is 1.8 m/min. Regarding the control of flow of molten steel in the mold, the control at a long cycle to some extent is suitable because the control in short time intervals, for example, the change of applied magnetic field, likely disperses the data. Therefore, the time difference of that degree is not a problem, and satisfactory flow control is attained.

As for the magnetic field applied to the injected flow, it is preferable to use a moving magnetic field which moves in the horizontal direction. This is because that the moving magnetic field freely controls the flow speed and flow pattern of the magnetic field, compared with the static magnetic field, by applying selected suitable intensity of the magnetic field.

Figure 3:
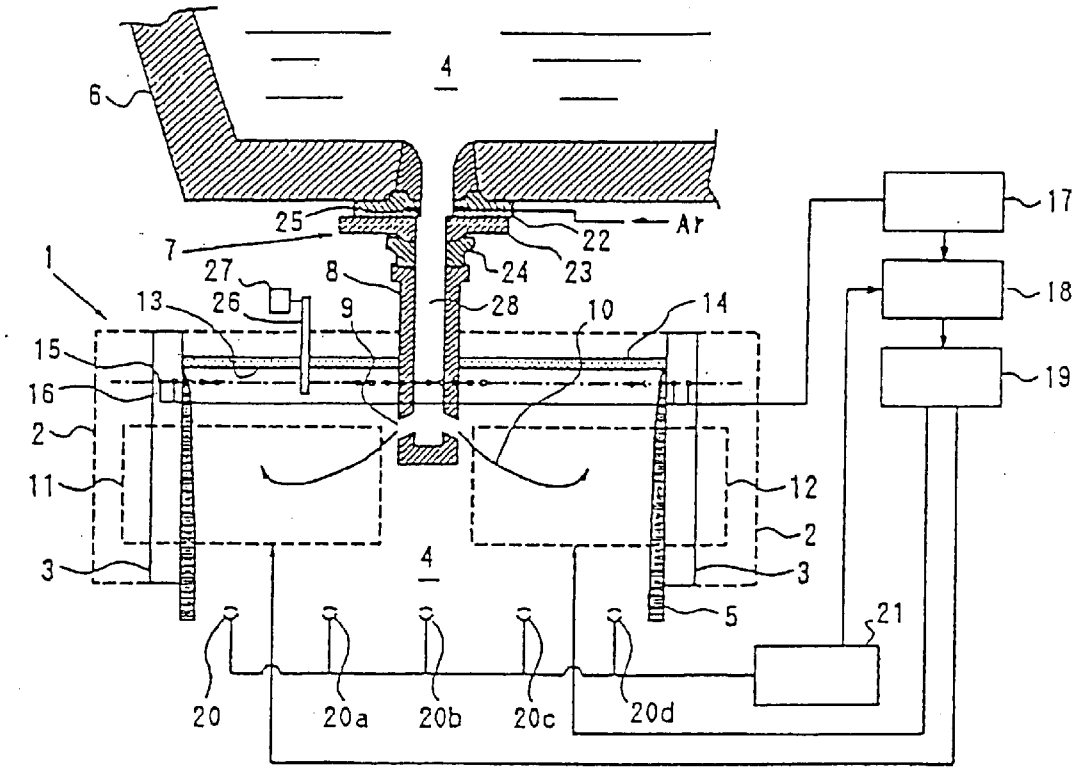
FIG. 3 is a schematic drawing of cross sectional front view of the casting section of the continuous casting machine of the Embodiment 1.
Figure 4:
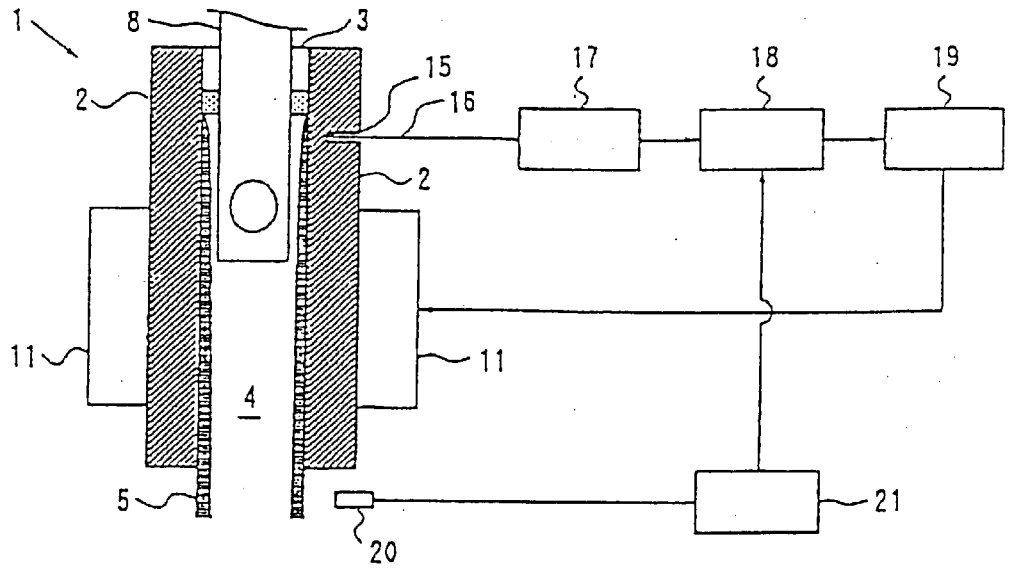
FIG. 4 is a schematic drawing of cross sectional side view of the casting section of the Embodiment 1.

The present invention is described referring to the drawings. FIG. 3 is a schematic drawing of cross sectional front view of the casting section of a continuous casting machine, showing a mode to carry out the present invention. FIG. 4 is a schematic drawing of cross sectional side view of the casting section of FIG. 3.

As seen in FIGS. 3 and 4, a tundish 6 is located above a mold 1 which comprises a pair of longer sides 2 of the mold and a pair of shorter sides 3 of the mold, which shorter sides are held between the longer sides 2 of the mold. Each of the longer sides and each of the shorter sides faces to each other, respectively. At the bottom of the tundish 6, a sliding nozzle 7 comprising a fixing plate 22, a sliding plate 23, and a streaming nozzle 24 is located. Furthermore, an immersion nozzle 8 is attached to bottom face of the sliding nozzle 7.

Thus, a tapping hole 28 of molten steel leading from the tundish 6 to the mold 1 is formed. The molten steel 4 which was poured from a ladle (not shown) to the tundish 6 is injected in the mold 1 as an injected flow 10 toward a shorter side 3 of the mold through an injection hole 9 that is located at lower portion of the immersion nozzle 8 and that is immersed in the molten steel 4 in the mold 1, via the tapping hole 28 of the molten steel. The molten steel 4 is cooled in the mold 1 to form a solidified shell 5, which is then drawn downward from the mold 1 to become an slab.

A porous brick 25 is fitted to the tapping hole 28 of the molten steel on the fixing plate 22. To prevent adhesion of $Al_2O_3$ onto the wall surface of the tapping hole 28 of the molten steel, Ar gas is introduced through the porous brick 25 into the tapping hole 28 of the molten steel. The introduced Ar gas enters the mold 1 along with the molten steel 4 via the immersion nozzle 8, passes through the molten steel 4 in the mold 1 to ascend to a meniscus 13, then penetrates a mold powder 14 added onto the meniscus 13 to diffuse in atmosphere.

On the rear face of longer side 2 of the mold, a magnetic field generator 11 and a magnetic field generator 12 are located in the width direction of longer side of the mold, separating in the right half and the left half in width of longer side 2 of the mold centering the immersion nozzle 8, to each other. Each of the magnetic field generator 11 and magnetic field generator 12 is located on each of the longer sides of the mold facing to each other, respectively, positioning the center of the magnetic field generators 11, 12 in the casting direction in a range of from the lower end of the injection hole 9 to the lower end of the mold 1. The magnetic field generators 11, 12 are connected to a magnetic field power source controller 19. The magnetic field power source controller 19 controls the intensity of applied magnetic field separately for each of the magnetic field generators 11, 12. The intensity of the magnetic field of the magnetic field generators 11, 12 may be a common industrial one that has the maximum intensity of magnetic field in an approximate range of from 0.2 to 0.4 tesla.

The magnetic field applied from the magnetic field generators 11, 12 may be a static magnetic field given from DC power. However, a moving magnetic field that moves in the horizontal direction is more preferable, as described above. Since a moving magnetic field can separately control not only the intensity of the magnetic field but also the moving direction of the magnetic field, the flow control becomes easier. In a moving magnetic field, the injected flow 10 is decelerated by changing the moving direction of the moving magnetic field from the side of shorter side 3 of the mold to the immersion nozzle 8 side. Inversely, the injected flow 10 is accelerated by changing the moving direction of the moving magnetic field from the immersion nozzle 8 side to the side of shorter side 3 of the mold. For the case of the moving magnetic field, each pair of the magnetic field generators 11, 12 are not necessarily facing to each other across the longer side 2 of the mold, and the injected flow 10 can be controlled only by allotting the magnetic field generators 11, 12 on rear face of the longer side 2 of the mold on one side thereof. However, allotment of the magnetic field generators 11, 12 on rear face of the mold only on one side thereof results in attenuation of the intensity of the magnetic field, so that it is necessary to mount the moving magnetic field generators having strong magnetic field intensity.

On the copper plate on longer side 2 of the mold, plurality of holes are drilled in the width direction on longer side 2 of the mold as the measurement points 15 that measure the temperature of copper plate on longer side 2 of the mold. A thermocouple 16 is inserted into each of the measurement points 15 as the temperature measurement element contacting the bottom of the hole on the copper plate. With the configuration, the temperatures of copper plate on longer side of the mold are determined using a thermometer body 17 connected with each of the thermocouples 16. Preferably the temperature measurement points 15 are arranged along a horizontal line at 200 mm or less of distance between the measurement points and 300 mm or less of distance between each point and the meniscus. If the distance between the measurement points 15 exceeds 200 mm, the number of the measurement points becomes less to fail in precise detection of the flow pattern. If the distance between each point and the meniscus exceeds 300 mm, the temperature of copper plate on longer side 2 of the mold is influenced by the injected flow 10 that flows in the horizontal direction, which also results in inaccurate detection of flow pattern.

Temperature of copper plate on longer side of the mold measured by the thermometer body 17 is sent to a data analyzer 18, where the rate of increase and decrease in temperature of the copper plate at each temperature measurement point 15 is analyzed. At the same time, the distribution of the temperature measurement points 15 which have resembled variations of temperature of copper plate in the width direction of longer side 2 of the mold is analyzed. On the basis of these analyzed data, the data analyzer 18 detects the flow pattern of molten steel in the mold 1, and transmits the detected flow pattern signals to the magnetic field power source controller 19. Based on thus transmitted flow pattern signals, the magnetic field power source controller 19 controls the intensity of magnetic field applied from the magnetic field generators 11, 12, thus controls so as the flow pattern to become the Pattern B. Adjustment of the intensity of magnetic field is carried out by increasing/decreasing the current supplied to the magnetic field generators 11, 12. For the case of the moving magnetic field (using AC power source), the adjustment of intensity of magnetic field is available also by changing the current frequency. On controlling the flow pattern, for the case of Pattern A, increase in the intensity of magnetic field to decelerate the injected flow 10 attains the Pattern B, and for the case of Pattern C, weakening the intensity of magnetic field in the deceleration direction or increasing the intensity of magnetic field in the acceleration direction to increase the injected flow 10 attain the Pattern B.

At directly beneath the mold 1, displacement meters 20, 20*a*, 20*b*, 20*c*, and 20*d* are located to measure the surface shape of the solidified shell 5, each of which displacement meters is connected to a computing unit 21. Each of the displacement meters is movable in the slab width direction by a moving unit (not shown) to enable the measurement of surface shape of the solidified shell 5 over the whole width of the slab. A range finder such as a vortex range finder is used to derive the distance between the solidified shell 5 and each of displacement meters 20, 20*a*, 20*b*, 20*c*, and 20*d*. The computing unit 21 analyses and processes thus derived distances to determine the surface shape such as irregularity in the width direction of the solidified shell 5. Then, the computing unit 21 estimates the heat transfer resistance between the copper plate on longer side 2 of the mold and the solidified shell 5 in the slab width direction on the basis of the determined surface shape, and transmits thus estimated heat transfer resistance to the data analyzer 18.

Using the transmitted heat transfer resistance data, the data analyzer 18 corrects the temperatures of copper plate on longer side 2 of the mold. Based on the corrected temperatures of copper plate, the data analyzer 18 can detect the flow pattern of molten steel in the mold 1. As described before, the configuration of the data analyzer 18 can detect the flow pattern of the molten steel 4 from the temperatures of copper plate measured without using the heat transfer data. Nevertheless, detection from the corrected temperatures of copper plate provides further accurate values. Particularly when the carbon steel has a hypo-peritectic domain of 0.1 to 0.15 wt. % carbon, the thickness of solidified shell 5 likely becomes irregular in width direction of the slab, thus generating irregularity on the surface of the solidified shell 5. Consequently, use of corrected temperatures of copper plate allows the detection of accurate flow pattern.

Regarding the method for correcting the temperatures of copper plate, the concavity on the solidified shell 5, for example, shows insufficient contact with the copper plate on longer side of the mold, worsens the heat transfer resistance, and decreases the temperatures of copper plate on longer side of the mold by the amount of reduced heat transfer resistance. To this point, when the heat transfer resistance at concavity of the solidified shell 5 is corrected to equalize with that at convex of the solidified shell 5, the temperatures of copper plate on longer side of the mold at concavity are corrected to higher temperature side. Before beginning the casting, the casting conditions such as the injection angle and injection cross sectional area of the injection hole 9 of the immersion nozzle 8, the immersion depth of the immersion nozzle 8, the pouring rate of molten steel 4 per unit time into the mold 1, the intensity of applied magnetic field, and the injection rate of Ar gas are adequately selected, thus the flow pattern of the molten steel in the mold 1 is formed to the B pattern.

According to the mode for carrying out the present invention, a refractory rod 26 which is immersed in the meniscus 13 to about 100 mm of depth, and a pressure-receiving sensor 27 which detects the force applied to the refractory rods 26 are provided. The surface flow speed is measured based on the force induced on the refractory rod 26 by the surface flow of molten steel 4 at several positions on the meniscus 13, and the flow pattern is checked to establish a specified pattern. Since each of the three flow patterns gives different surface slow speed distributions, the flow pattern is identified. Both the refractory rods 26 and the pressure-receiving sensors 27 are arranged for checking, and they are not necessarily used for carrying out the present invention.

According to the above-given description, the magnetic field generators 11, 12 are divided centering the immersion nozzle 8 in the width direction of longer side 2 of the mold. The present invention, however, may be carried out using only one magnetic field generator that covers the whole area in width direction of longer side 2 of the mold. In that case, when a moving magnetic field is applied, it is necessary that the moving magnetic field is connected with the magnetic field power source controller 19 so as the right half and the left half magnetic fields in the mold width to move opposite directions to each other. Compared with the divided magnetic field generators 11, 12, a single magnetic field generator is somewhat difficult in flow control. The above-given description explained the use of five displacement meters, the number of displacement meters may be determined on the basis of slab width, moving speed of displacement meter, and other variables.

EXAMPLE 1

Example 1 is described below relating to the continuous casting machine shown in FIG. 3 and FIG. 4. The slab had 250 mm in thickness and 1,600 mm in width. A low carbon Al-killed steel was cast at 2.5 m/min of drawing speed. The applied magnetic field was a moving magnetic field. The center of the magnetic field generator in the casting direction was set to 150 mm from the lower end of the injection hole. The Ar gas injection rate into the tapping hole of the molten steel was 9 Nl/min. Holes were drilled on the copper plate on longer side of the mold at 130 mm from top of the copper plate (50 mm from the meniscus) at 50 mm of intervals. Thermocouple was inserted in each of the holes to measure the temperature of copper plate on longer side of the mold.

Figure 5:
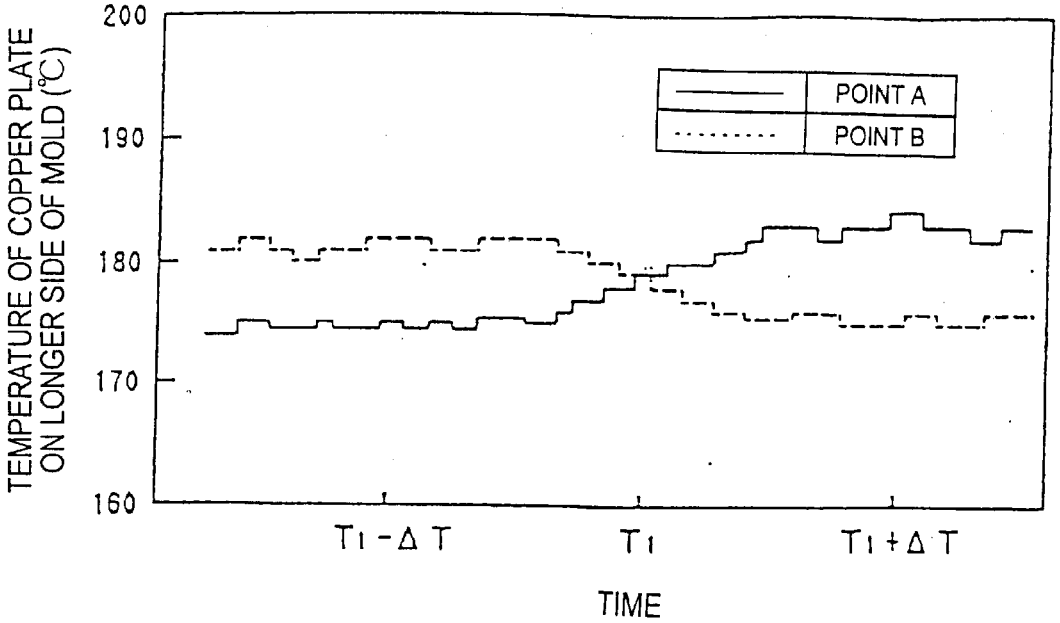
FIG. 5 is a graph showing temperature variations with time at two different measurement points in Example 1 of the Embodiment 1.

FIG. 5 shows examples of measured temperatures of copper plate on longer side of the mold at two measurement points, A and B. As seen in the figure, the temperature at the Point B at a time ($T_1-\Delta T$) was higher than the temperature at the Point A. Shortly before the time $T_1$, however, the temperature at the point A began to increase, and the temperature at the Point B began to decrease. Then, at around the time $T_1$, the level of the temperature at the Point A and the temperature at the Point B was inverted to each other. After that, at a time ($T_1+\Delta T$), the temperature of both the Point A and the Point B was stabilized in the inverted state.

Figure 6:
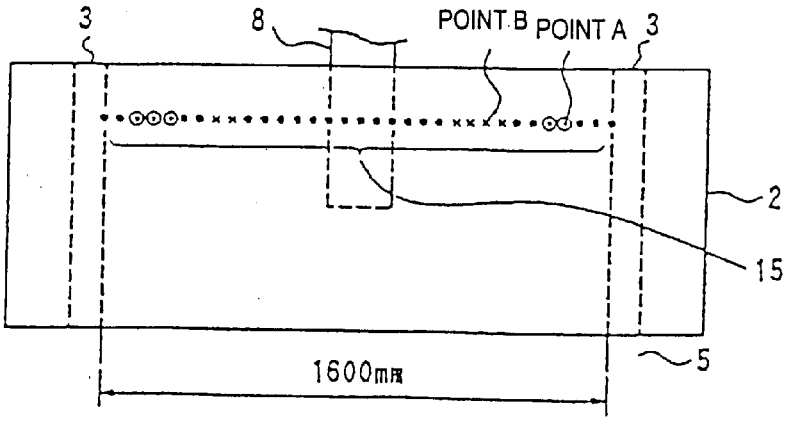
FIG. 6 is the plot of individual measurement points showing temperature variations with time derived from the observation result of Example 1 of the Embodiment 1.

FIG. 6 shows the time-sequential temperatures at each measurement point over the whole width on longer side of the mold before and after the time $T_1$. In the figure, the symbol ● designates the measurement point 15 where no temperature change occurred at around the time $T_1$, the symbol ◎ designates the measurement point 15 where the temperature increased, and the symbol × designates the measurement point 15 where the temperature decreased. As shown in the figure, the measurement points where the temperature increased are distributed to the side of shorter side 3 of the mold, and the measurement points where the temperature decreased are distributed at middle section between the immersion nozzle 8 and the side of shorter side 3 of the mold. Thus, the measurement points of temperature increase and the measurement points of temperature decrease show a characteristic distribution. FIG. 6 also gives two measurement points of A and B given in FIG. 5.

Figure 7:
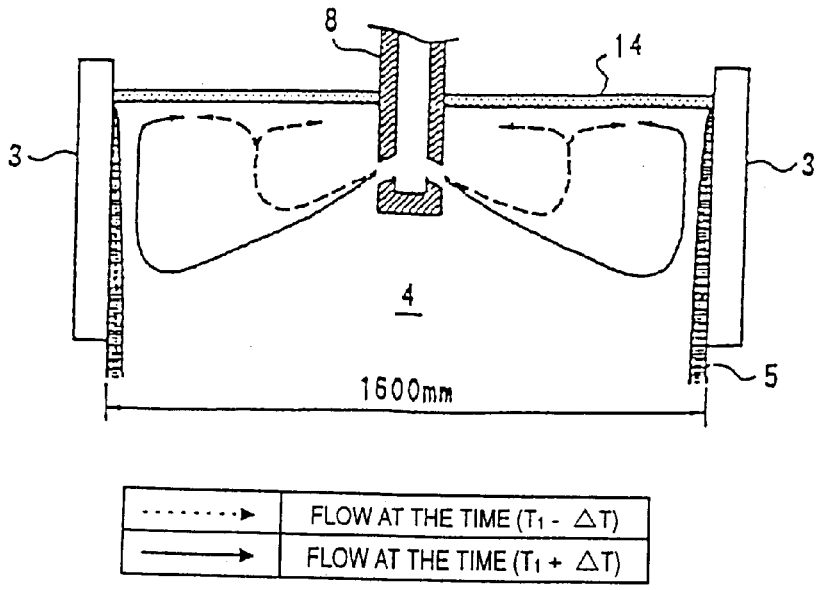
FIG. 7 illustrates the flow pattern detected from the result of temperature analysis in Example 1 of the Embodiment 1.

FIG. 7 shows the result of detected flow pattern of molten steel in the mold derived from the above-given temperature analysis. As seen in the figure, at the time ($T_1-\Delta T$) , the Pattern B was established, and at the time ($T_1-\Delta T$), the Pattern A was established.

Figure 8:
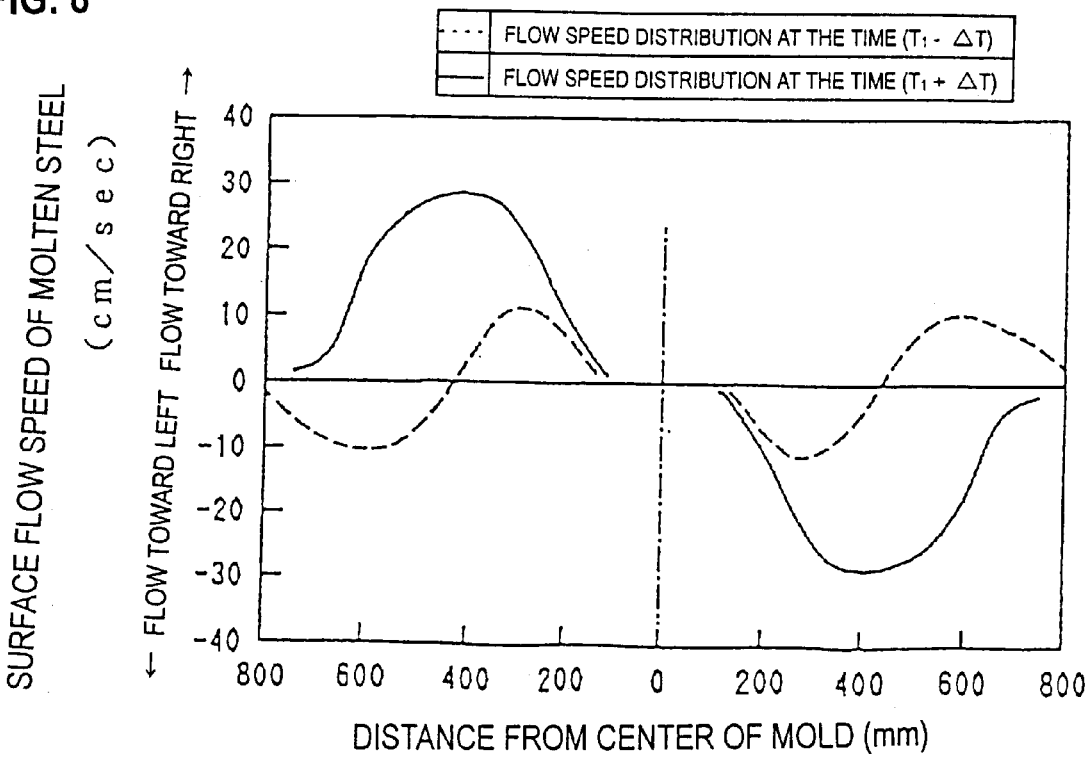
FIG. 8 shows the distribution of flow speed of molten steel at surface thereof in the mold measured by refractory rods in Example 1 of the Embodiment 1.

FIG. 8 shows a distribution of surface flow speeds of the molten steel in the mold, which was measured by the refractory rods at the same time with the above-described observation. At the time ($T_1-\Delta T$), centering the intermediate position between the immersion nozzle and the shorter side of the mold, a flow directing the center of the mold was established at the immersion nozzle side, and inversely, a flow directing the shorter side of the mold was established, or totally the Pattern B was established, at the side of shorter side of the mold. However, at the time ($T_1+\Delta T$), the surface flow changed from the flow directing from the shorter side of the mold to the center of the mold, or the Pattern A was established. In this manner, also from the distribution of surface flow of the molten steel, there was identified the Pattern B at the time ($T_1-\Delta T$) and the Pattern A at the time ($T_1+\Delta T$), which proved that the pattern detected from the measurement of temperatures of copper plate is accurate.

Figure 9:
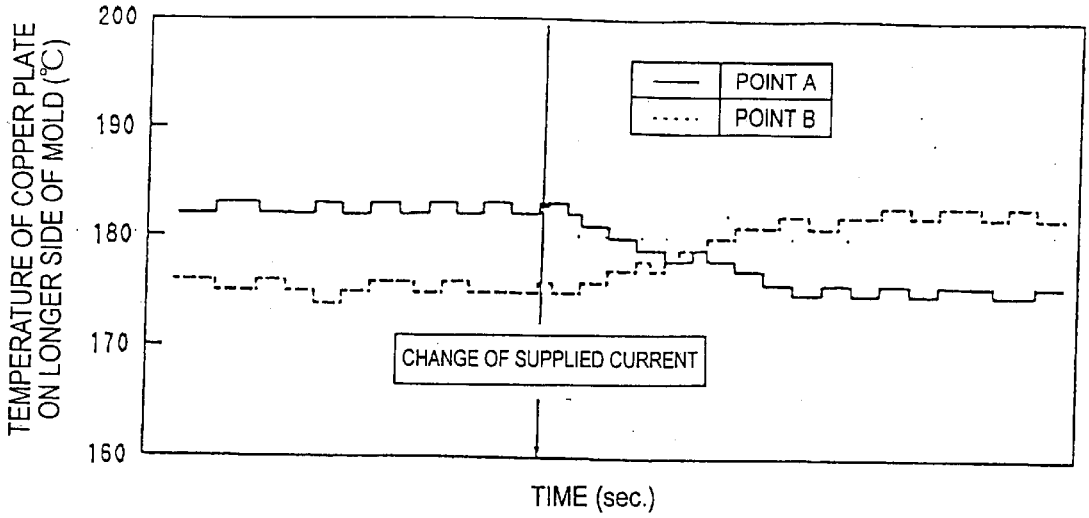
FIG. 9 is a graph showing temperature variations with time at two different measurement points after increased the intensity of magnetic field in Example 1 of the Embodiment 1.

In this regard, the current supplied to the magnetic field generator was increased to increase the intensity of the moving magnetic fields at right and left to the immersion nozzle to decelerate the injection flow. FIG. 9 shows the result of measured changes in temperatures at two measurement points, A and B, while continuing the casting. Immediately after changed the supplied current, the temperature at the Point A decreased, and the temperature at the Point B increased, then the temperatures were stabilized in the same state as that at the time ($T_1-\Delta T$). It was confirmed that the distribution of surface flow on the meniscus became the same as that at the time ($T_1-\Delta T$) using the refractory rods.

An slab that was obtained by the Example was rolled to a thin steel plate. The steel plate showed low generation rate of defects caused from mold powder inclusion, and gave high production yield. The symbols used in FIGS. 6 and 7 correspond to respective symbols in FIGS. 3 and 4.

EXAMPLE 2

Example 2 is described relating to the continuous casting machine shown in FIG. 3 and FIG. 4. The slab had 250 mm in thickness and 1,600 mm in width. A carbon steel containing 0.12 wt. % carbon was cast at 1.8 m/min of drawing speed. The applied magnetic field was a moving magnetic field. The center of the magnetic field generator in the casting direction was set to 150 mm from the lower end of the injection hole. The Ar gas injection rate into the tapping hole of the molten steel was 9 Nl/min. Holes were drilled on the copper plate on longer side of the mold at 130 mm from top of the copper plate (50 mm from the meniscus) at 50 mm of intervals. Thermocouple was inserted in each of the holes to measure the temperature of copper plate on longer side of the mold. The Example measured the surface shape of the solidified shell using five displacement meters located directly beneath the mold to correct the temperatures of copper plate on longer side of the mold.

Figure 10:
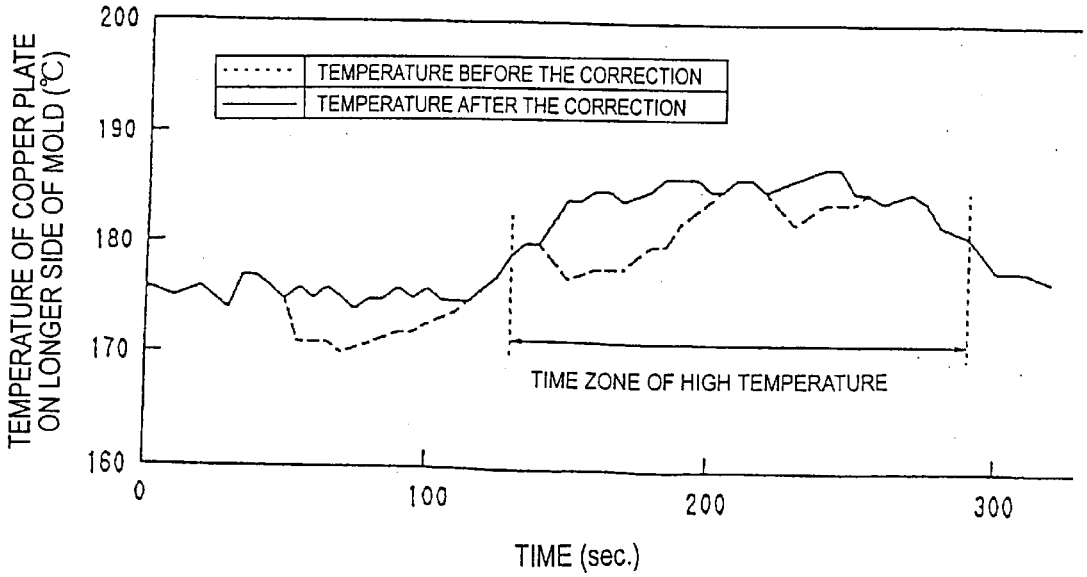
FIG. 10 shows the temperatures of copper plate on longer side of the mold before and after the correction in Example 2 of the Embodiment 1.

FIG. 10 shows measured data of temperatures of copper plate on longer side of the mold at specific times. The broken line indicates the temperatures of copper plate on longer side of the mold before the correction, and the solid line indicates the temperatures of copper plate on longer side of the mold after the correction. The heat transfer resistance was estimated after bringing the gap between the copper plate on longer side of the mold and the solidified shell to a standard value, then the temperatures of copper plate on longer side of the mold were corrected. The temperatures before the correction showed vigorous ups and downs so that the accurate grasping of the time sequential change of temperatures of copper plate on longer side of the mold was difficult. However, the correction allowed accurate grasping of the time zone which gives high temperatures of copper plate on longer side of the mold.

Figure 11:
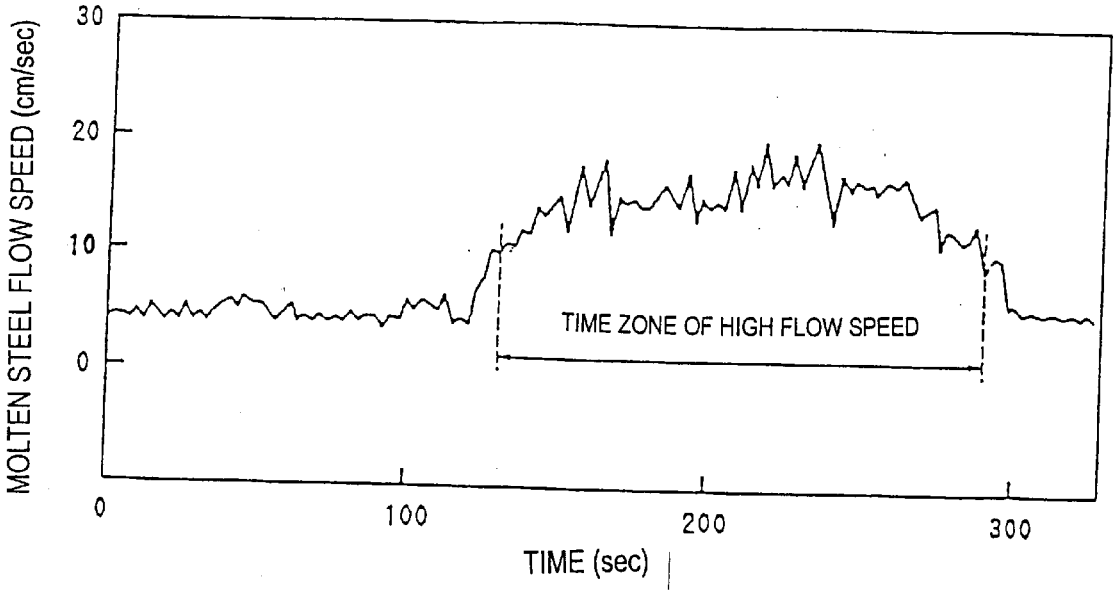
FIG. 11 shows the flow speed of molten steel measured by refractory rods in Example 2 of the Embodiment 1.

FIG. 11 shows the flow speed of molten steel measured by refractory rods immersed in the meniscus, at near the measurement points shown in FIG. 10 at the same time. The time zone giving high flow speed of molten steel occurred at the same time with the time generating a time zone giving high temperatures of copper plate on longer side of the mold in FIG. 10. In this manner, correction of the temperatures of copper plate on longer side of the mold allowed more precise detection of the flow pattern.

Embodiment 2

Method for Estimating Flow Pattern of Molten Steel and Apparatus Therefor

The inventors of the present invention investigated the positions for mounting the temperature measurement elements buried in the mold copper plate to accurately detect the flow of molten steel even when complex flow of molten steel exits in the vicinity of the meniscus.

Figure 12:
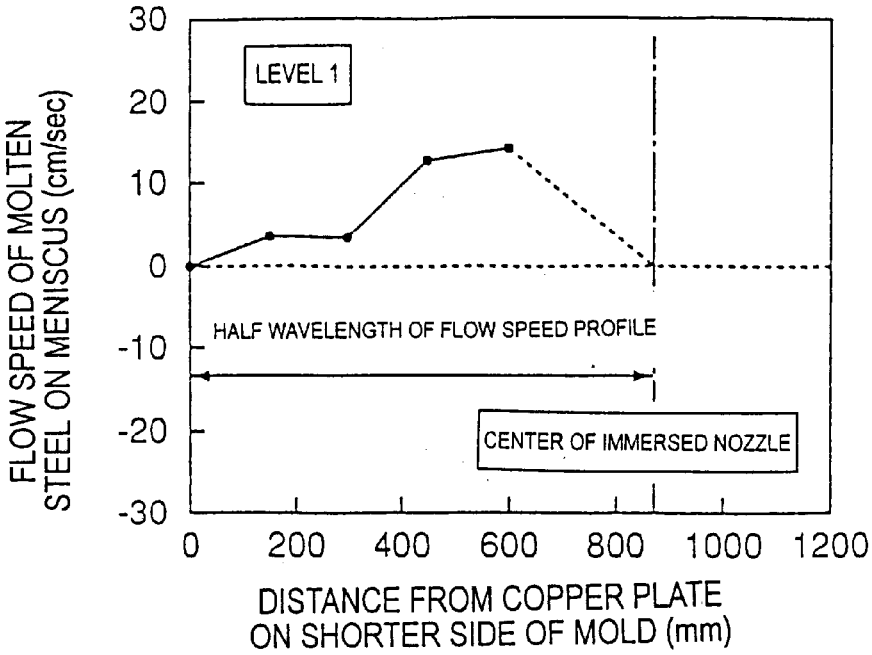
FIG. 12 shows the measured flow speed profile of molten steel in the vicinity of the meniscus under the casting condition of Level 1 of the Embodiment 2.
Figure 13:
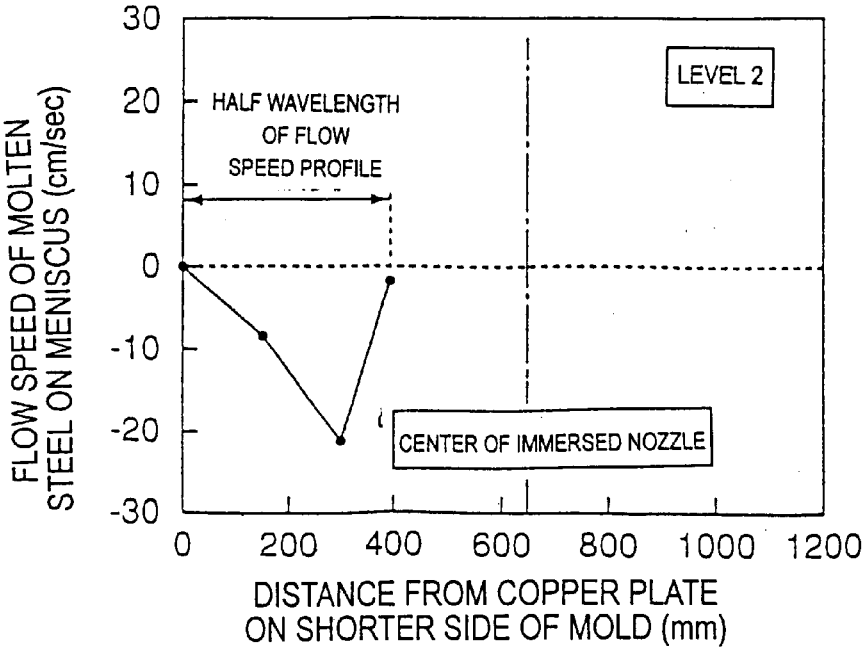
FIG. 13 shows the measured flow speed profile of molten steel in the vicinity of the meniscus under the casting condition of Level 2 of the Embodiment 2.
Figure 14:
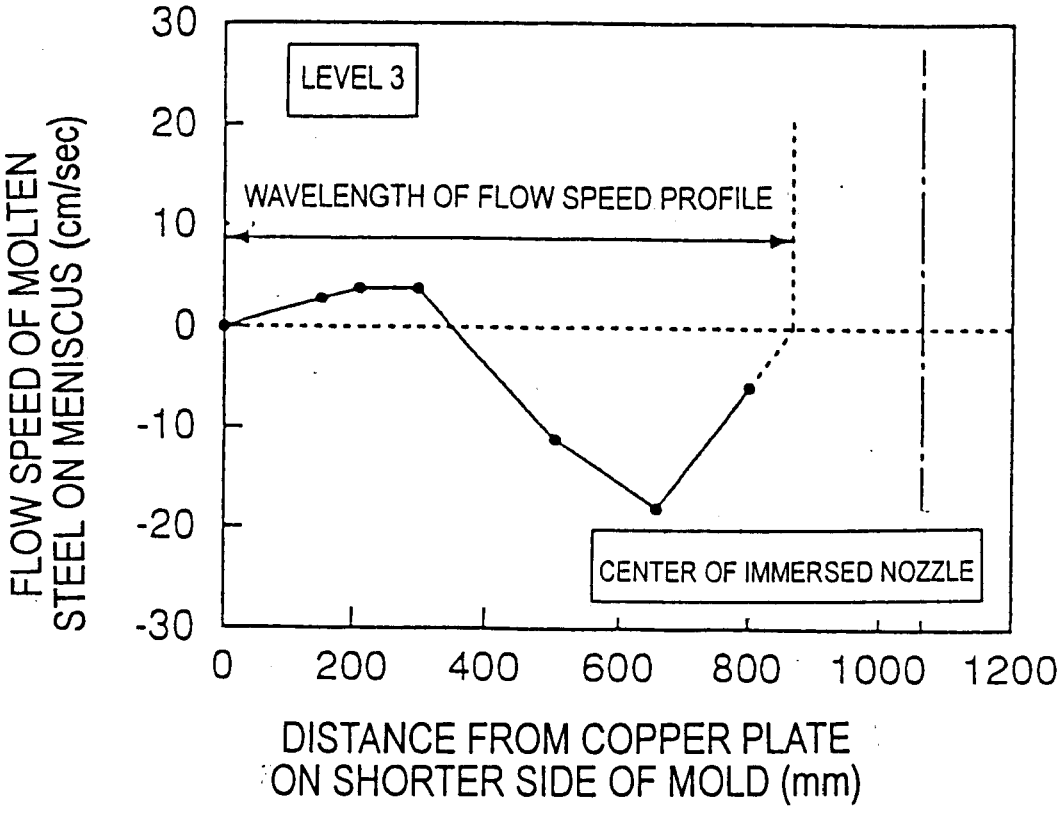
FIG. 14 shows the measured flow speed profile of molten steel in the vicinity of the meniscus under the casting condition of Level 3 of the Embodiment 2.

First, the intervals of temperature measurement elements in width direction of the mold were investigated. As of the complex flows of molten steel at near the meniscus, the profile of molten steel flow speed in the vicinity of meniscus along the width direction of the mold is a particularly important variable in view of quality control. To this point, the continuous casting machine which is applied in the embodiments described later was applied. An end of a refractory rod was immersed in the meniscus. A flow meter for the molten steel was used to determine the flow speed of the molten steel by measuring the force of the molten steel flow applied onto a load cell. Thus, the profile of molten steel flow along the width direction of the mold in the vicinity of the meniscus was determined. The measurement of the profile of molten steel flow was carried out at three levels of the combination of the slab-drawing speed and the slab width. Table 1 lists the casting condition for each of the three levels. FIGS. 12 through 14 show the results of determined profile of molten steel flow speed in the vicinity of the meniscus at each of the three levels. In these figures, the "positive" flow speed of the molten steel on the meniscus on the vertical axis designates the flow from the shorter side of the mold to the immersion nozzle, and the "negative" flow designates the inverse flow. Hereinafter the flow speed of molten steel on the meniscus is given in that positive/negative expression.

TABLE 1

| | Slab thickness (mm) | Slab width (mm) | Slab-drawing speed (m/min) | Ar gas injection rate (N1/min) |
|---|---|---|---|---|
| Level 1 | 220 | 1750 | 2.1 | 10 |
| Level 2 | 220 | 1300 | 1.6 | 10 |
| Level 3 | 220 | 2100 | 1.6 | 10 |

As seen in FIGS. 12 through 14, the wavelength of the profile of flow speed of molten steel in the vicinity of meniscus along the width direction of mold, or the wavelength of high and low level of flow speed of molten steel, is 1,750 mm for the Level 1, 800 mm for the Level 2, and around 800 to 1,800 mm for the Level 3.

Figure 15:
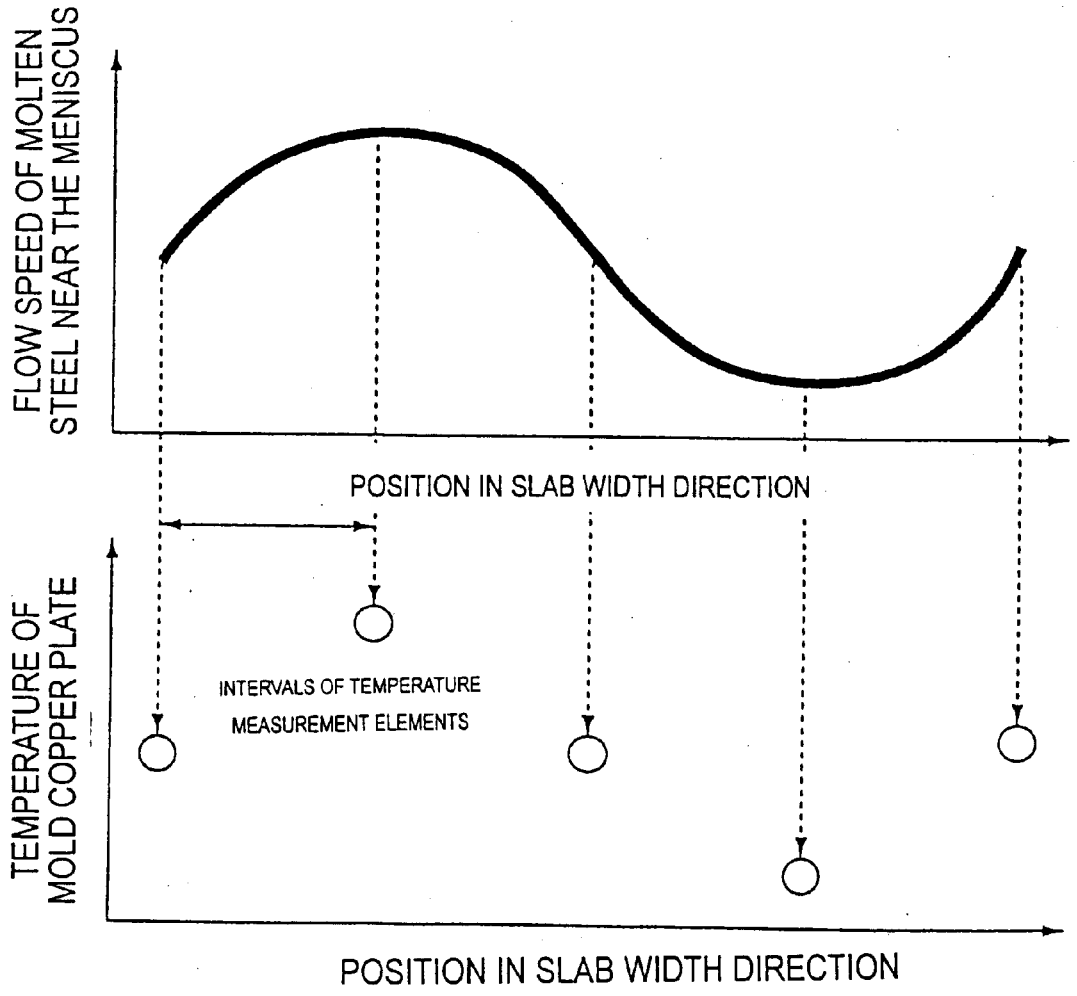
FIG. 15 shows the positions of temperature measurement elements to accurately grasp the flow speed profile of molten steel of the Embodiment 2.

To accurately grasp the profile of flow speed of the molten steel by the temperature measurement elements buried in the copper plate of mold, at least 5 temperature measurement points are required covering a single wavelength, as shown in FIG. 15. FIG. 15 shows the comparison between the wavelength of high level and low level of flow speed of molten steel in the vicinity of the meniscus and the temperature of the copper plate of the mold. Experience of the inventors of the present invention identified that the temperature of copper plate of the mold increases with increase in the flow speed of molten steel.

Accordingly, when the wavelength of high level and low level of flow speed of molten steel is in a range of from 800 to 1,800 mm, the temperature measurement elements may be arranged at intervals of from 200 to 450 mm. As shown in FIGS. 12 through 14, however, since the profile of flow speed of molten steel in the vicinity of meniscus varies with the casting conditions even with the same continuous casting machine, the intervals of temperature measurement elements are necessary to select not more than 200 mm to catch the above-described shortest wavelength of high level and low level of flow speed of molten steel.

Secondary, the positions of temperature measurement elements in the slab-drawing direction were investigated. Since the present invention aims to estimate the flow of molten steel in the vicinity of the meniscus, the temperature measurement elements are necessary to be located near to the meniscus as far as possible. Owing to fine balance fluctuation between the flow rate of molten steel poured into the mold and the slab-drawing speed, however, the position of meniscus varies in the slab-drawing direction. The magnitude of the variations is generally at around ±10 mm at the maximum. The position of temperature measurement element is required to be below the range of variation of the meniscus position. The reason is that, when the meniscus descends to below the position of temperature measurement element down to the slab-drawing direction, the temperature of copper plate of mold significantly reduces, thus inducing significant error on the estimation of the flow of molten steel in the vicinity of the meniscus. Consequently, the upper limit of the position of temperature measurement elements was determined to 10 mm distant from the meniscus in the slab-drawing direction.

Figure 16:
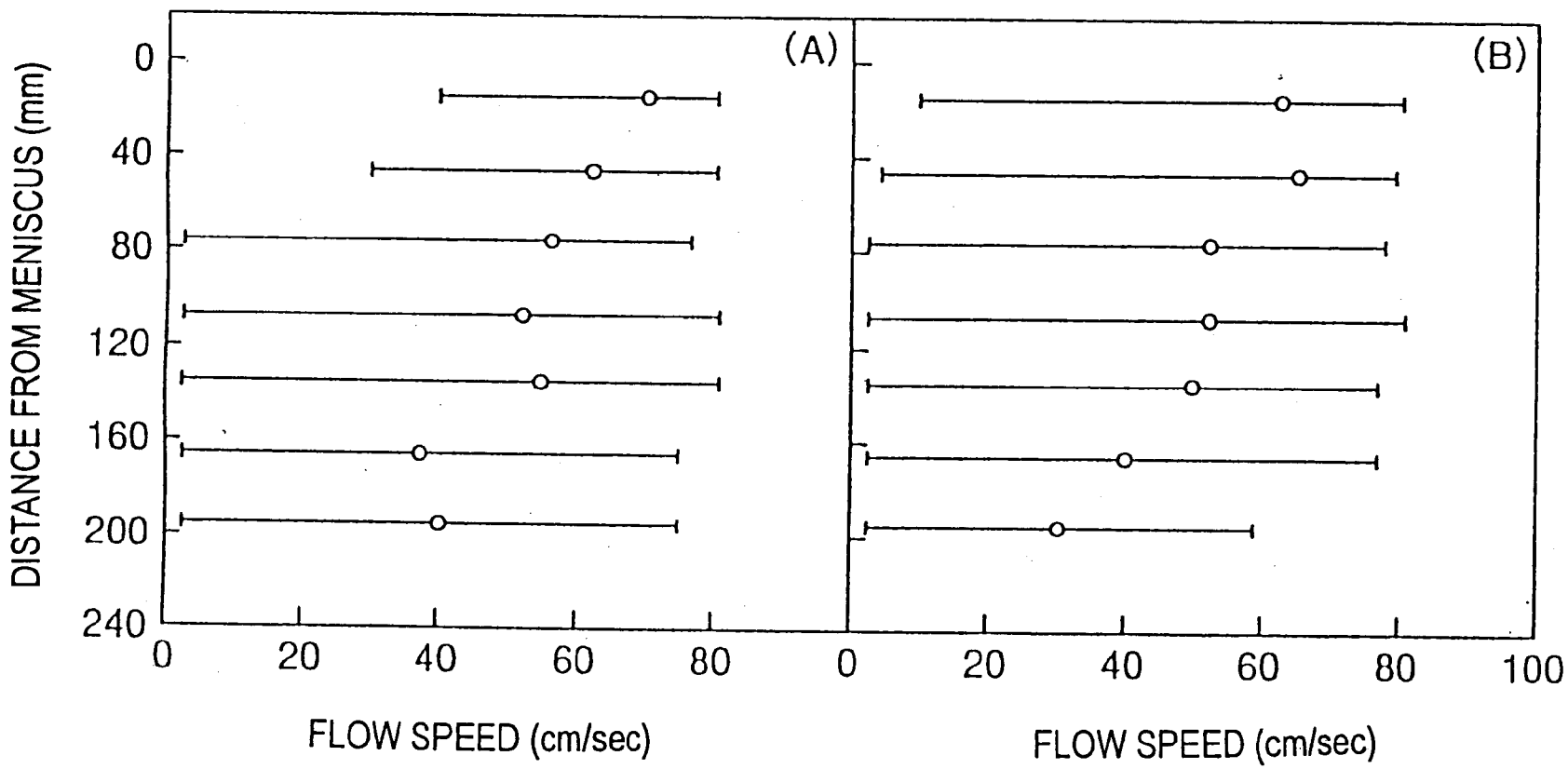
FIG. 16 shows the flow speed distribution directly beneath the meniscus measured by a water model of the Embodiment 2.

Next, the lower limit of the temperature measurement elements in the slab-drawing direction was investigated. The lower limit is determined by the depth of uniform flow of the molten steel in the vicinity of the meniscus below the meniscus. To investigate the phenomenon, a water model apparatus having 1,500 mm of mold width was used. The flow speed distribution was determined at positions 225 mm and 375 mm apart from the shorter side of the mold and down to 195 mm from the meniscus. FIG. 16 shows the result. FIG. 16(A) shows the measurement result at 225 mm distant from the shorter side of the mold, FIG. 16(B) shows the measurement result at 375 mm distant from the shorter side of the mold. The symbol (○) designates average flow speed, and the length of the line indicates the range of flow speed. As shown in FIG. 16, at the measured two positions, the flow speed slowly decreases down to 135 mm below the meniscus, and it rapidly decreases to below the 135 mm depth. Consequently, the lower limit of the positions of temperature measurement elements in the slab-drawing direction was set to 135 mm distant from the meniscus.

Figure 17:
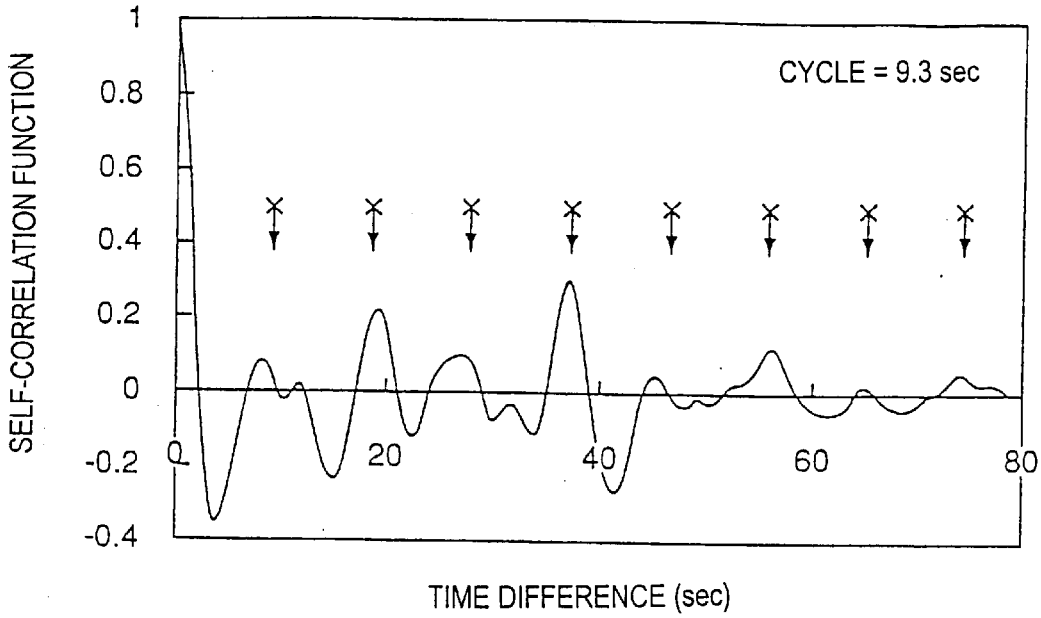
FIG. 17 shows the calculated result of the self-correlation coefficient of the molten steel flow speed measured by a refractory rod type molten steel flow speed meter of the Embodiment 2.

Thirdly, the distance between the surface of molten steel on the copper plate of the mold and the tip of the temperature measurement element was investigated. Excessively long distance increases the delay of response time of the temperature measurement element, which fails to accurately pursue the time sequential variations of the flow of molten steel in the vicinity of the meniscus. To this point, the time frequency of variations of flow speed of molten steel in the vicinity of the meniscus was investigated using the above-described immersion rod type molten steel flow speed meter. To determine the periodicity of the time-sequential change of flow speed of molten steel, the self-correlation coefficient of the measured flow speed of molten steel was calculated. FIG. 17 shows the result of the calculation. In this Example, as shown in FIG. 17, the flow speed of molten steel in the vicinity of the meniscus has a periodicity of 9.3 seconds. The symbol (×) indicates the boundary of each cycle. The inventors of the present invention investigated similar study on the periodicity under other casting conditions, and found that some cases give 9 to 30 seconds of frequency. Based on the results of investigations, the following-described investigation was carried out on the depth of buried temperature measurement element to estimate the flow speed of molten steel, having that type of periodicity, in the vicinity of the meniscus.

Figure 18:
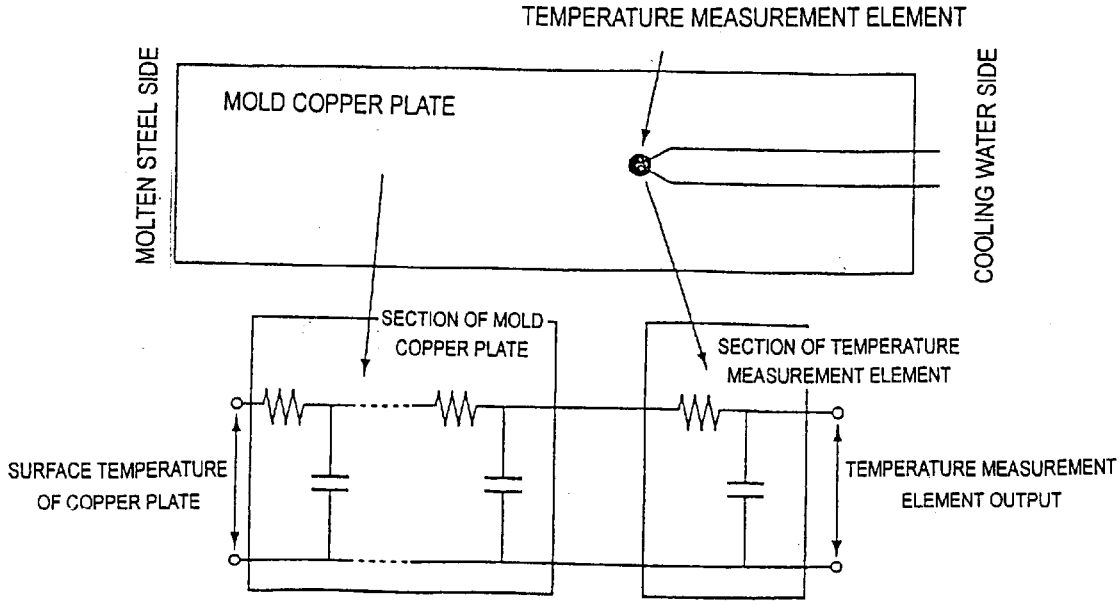
FIG. 18 shows an electrically equivalent circuit of a model providing the variations of temperatures of copper plate at the molten steel side as the output of the temperature measurement element buried of the Embodiment 2.
Figure 19:
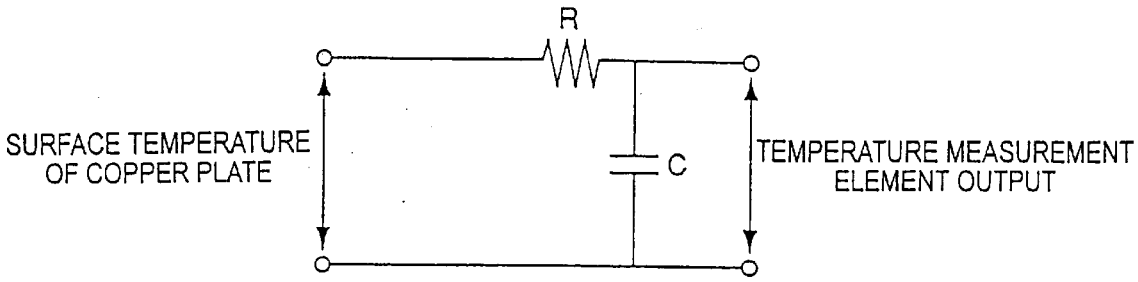
FIG. 19 shows another electrically equivalent circuit of a model providing the variations of temperatures of copper plate at the molten steel side as the output of the temperature measurement element buried in the copper plate of the Embodiment 2.

The model in which the variations of temperature of the copper plate of the mold at the surface of molten steel side become the output of the temperature measurement element buried in the copper plate of the mold is expressed by an electrically equivalent circuit, shown in FIG. 18, having a distribution coefficient. For simplification, that type of distribution coefficient circuit is replaced by a concentrated coefficient circuit as shown in FIG. 19. The replaced circuit is a low pass filter using an RC integration circuit. The cutoff frequency of the circuit is expressed by eq. (1).

$$f_0=1/(2\pi\times R\times C) \tag{1}$$

where, $f_0$ is the cutoff frequency, R is the DC resistance component, and C is the capacity component.

As described before, the present invention needs to identify the variations of flow speed of molten steel in the vicinity of meniscus at 9 seconds of cycle, or the variations of surface temperature of the copper plate of the mold at the molten steel side. If the cycle is defined as the cutoff point and if the variations of the temperature of copper plate of the mold longer than the cutoff point cycle are measured by the temperature measurement elements, then the product of R×C at that moment is expressed by eq. (2).

$$2\pi\times R\times C=9 \tag{2}$$

Figure 20:
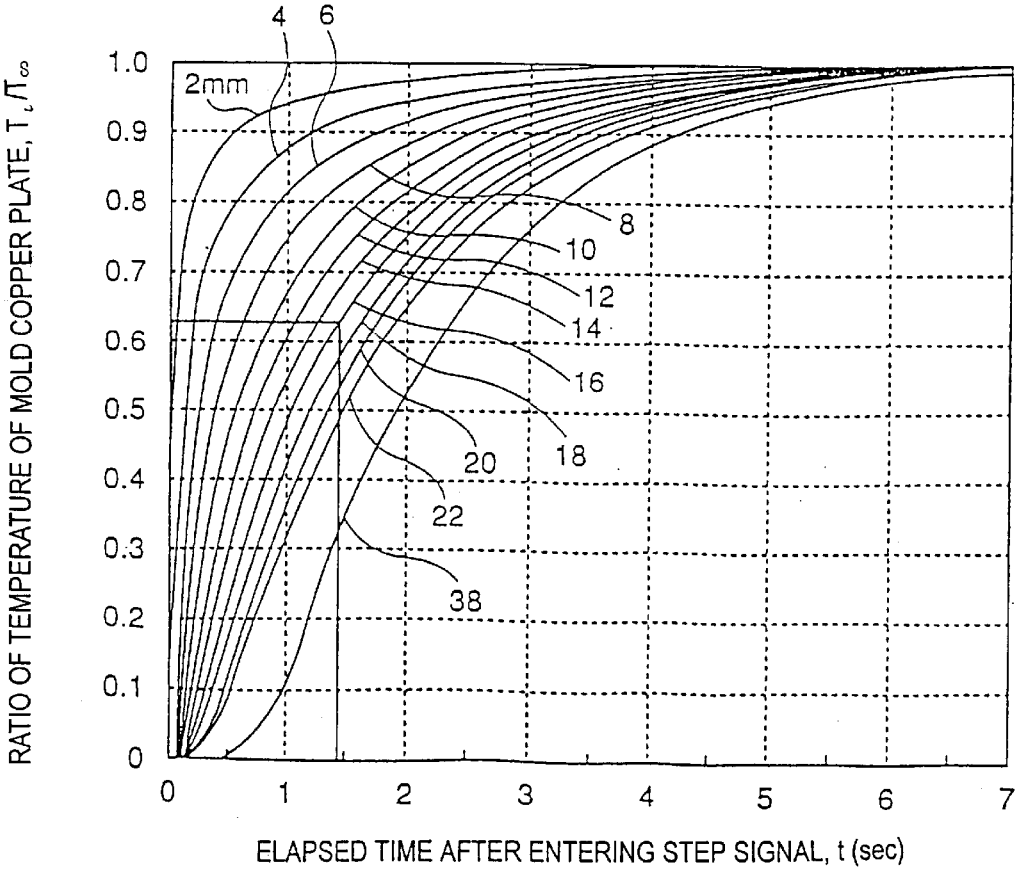
FIG. 20 is a graph showing the variations of temperature of mold copper plate at each position in the mold copper plate when a step signal is applied to the surface of the mold copper plate at the molten steel side of the Embodiment 2.

Eq. (2) gives R×C=1.4 seconds. Next, the distance between the surface of copper plate of the mold at the molten steel side and the tip of the temperature measurement element to give R×C=1.4 was determined. FIG. 20 expresses the variations of temperature of copper plate of the mold using unsteady one-dimensional heat transfer equation at each position in the copper plate of the mold. The figure was drawn under the conditions that step signals to increase the temperature from 25 to 300° C. were given to the surface of the copper plate of the mold at the molten steel side while keeping the surface temperature of the copper plate of the mold at the cooling water side to 25° C. The horizontal axis of FIG. 20 designates the elapsed time (t) after entered the step signal, and the vertical axis designates the temperature ratio, ($Ti/T_\infty$), where $T_\infty$ is the temperature of copper plate of the mold at the time reached to steady state, and Ti designates the temperature of copper plate of the mold at that time. FIG. 20 shows the ratio($Ti/T_\infty$) at plurality of positions, each of which differs in the distance (×) from the surface of molten steel side toward the cooling water side. Each numeral in the figure is the distance (×) in millimeter unit. The curves of FIG. 20 can be approximated by eq. (3).

$$Ti=\{1-\exp[-t/(R\times C)]\}\times T_\infty \tag{3}$$

At t=R×C, the ratio Ti/T∞ becomes 0.63. Consequently, if the temperature measurement element is positioned at a distance (×) to give the ratio $Ti/T_\infty \geqq 0.63$ at t=R×C=1.4 sec, the product (R×C) of the temperature measurement element is not more than 1.4 seconds, thus the above-described variations of temperature of copper plate of the mold having 9 sec or longer variation cycle, or the variations of flow speed of molten steel in the vicinity of meniscus, can be determined. The distance (×) that satisfies the condition is 16 mm or less as determined from FIG. 20. Therefore, the present invention specified the distance between the surface of copper plate of the mold at the molten steel side to the tip of the temperature measurement element to 16 mm or less.

The method for estimating flow of molten steel in the mold using the above-described temperature measurement device is described below. First, regarding the method for estimating the flow of molten steel in the mold based on the temperature of copper plate of the mold, the principle is described in the following.

Figure 21:
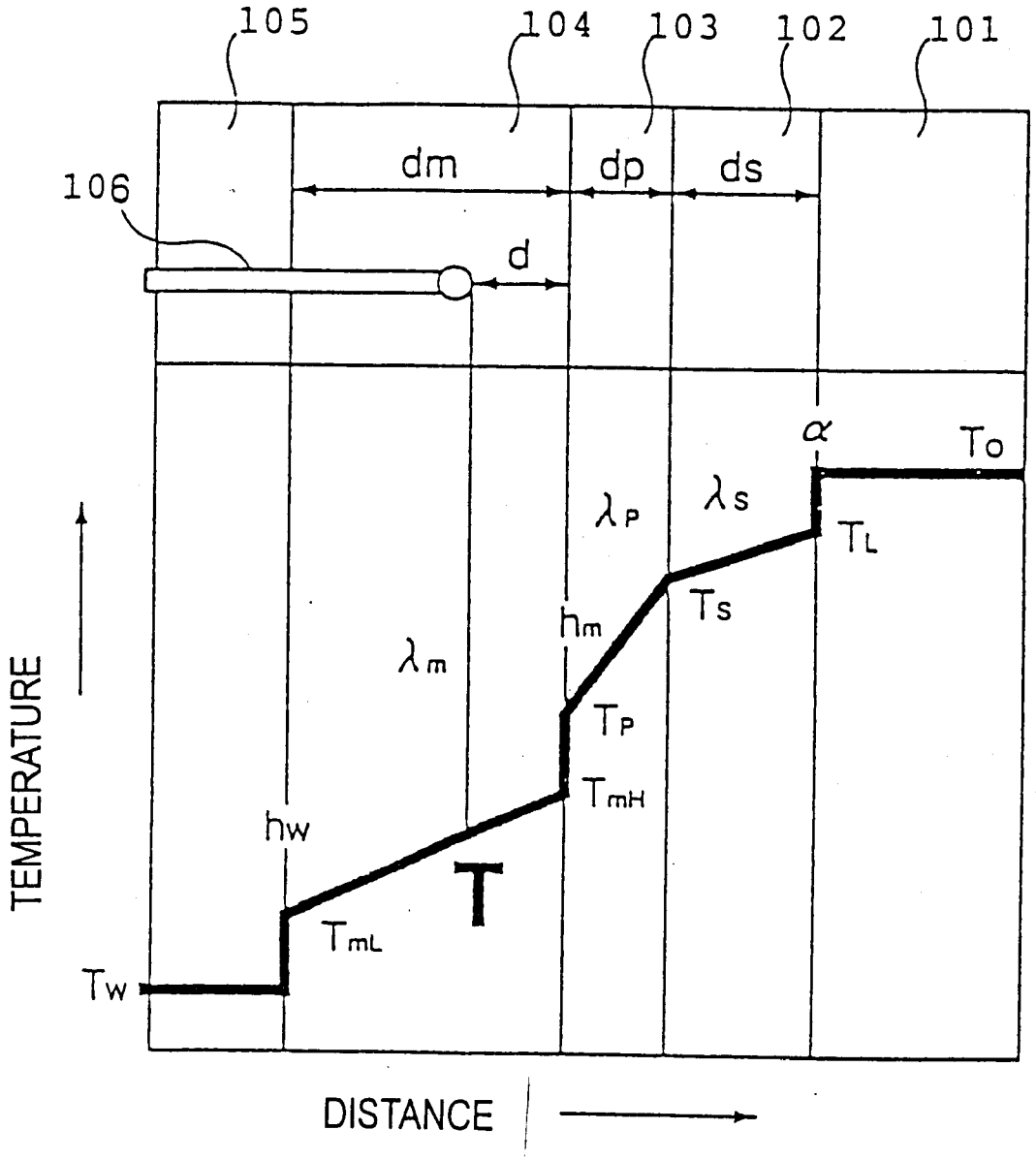
FIG. 21 is a schematic diagram of temperature distribution from the molten steel to the cooling water for the mold copper plate of the Embodiment 2.

FIG. 21 is a schematic diagram of temperature distribution covering from the molten steel to the cooling water for copper plate of the mold during the heat conduction process from the molten steel in the mold, the copper plate of the mold, to the cooling water for copper plate of the mold. As seen in FIG. 21, between the molten steel 101 and the cooling water 105 for copper plate of the mold, there exist the solidified shell 102, the mold powder layer 103, and the copper plate 104 of the mold. The temperatures inside of the copper plate 104 of the mold are measured by the temperature measurement elements 106 buried in the copper plate 104 of the mold. The symbol $T_0$ designates the temperature of molten steel 101, $T_L$ designates the boundary temperature between the solidified shell 102 and the molten steel 101, $T_S$ designates the boundary temperature between the solidified shell 102 and the mold powder layer 103, $T_P$ designates the surface temperature of the mold powder layer 103 at the side of copper plate 104 of the mold, $T_{mH}$ designates the surface temperature of the copper plate 104 of the mold at the side of mold powder layer 103, $T_{mL}$ designates the surface temperature of copper plate 104 of the mold at the side of cooling water 105, and $T_W$ designates the temperature of cooling water 105.

In that case, the overall heat resistance derived from combining the heat resistances of heat conductors ranging from the molten steel 101 to the cooling water 105 is expressed by eq. (4).

$$R=(1/\alpha)+(d_S/\lambda_S)+(d_P/\lambda_P)+(1/h_m)+(d_m/\lambda_m)+(1/h_W) \quad (4)$$

where, R is the overall heat resistance, $\alpha$ is the convection heat transfer coefficient between the molten steel and the solidified shell, $\lambda_S$ is the thermal conductivity of the solidified shell, $\lambda_P$ is the thermal conductivity of the mold powder layer, $\lambda_m$ is the thermal conductivity of the copper plate of the mold, $h_m$ is the heat transfer coefficient between the mold powder layer and the copper plate of the mold, $h_W$ is the heat transfer coefficient between the copper plate of the mold and the cooling water, $d_S$ is the thickness of the solidified shell, $d_P$ is the thickness of the mold powder layer, and $d_m$ is the thickness of the copper plate of the mold.

The thickness of copper plate of the mold, ($d_m$) and the thermal conductivity of copper plate of the mold, ($\lambda_m$) are fixed by the applied apparatus. The thermal conductivity ($\lambda_S$) is fixed by the applied steel type. The thickness of mold powder layer ($d_P$) is fixed by the kind of the mold powder, the amplitude, frequency, and wave shape of the vibration of the mold, and the slab-drawing speed. The thermal conductivity ($\lambda_P$) of the mold powder layer is known as almost constant independent of the kind of mold powder. The heat transfer coefficient ($h_W$) between the copper plate of the mold and the cooling water becomes constant if the flow rate of the cooling water 105 and the surface roughness of the copper plate 104 of the mold are determined. Also the heat transfer coefficient ($h_m$) between the mold powder layer and the copper plate of the mold becomes almost constant if the kind of the mold powder is selected.

The convection heat transfer coefficient ($\alpha$) between the molten steel and the solidified shell, however, varies with the flow speed of molten steel along the surface of the solidified shell 102. The convection heat transfer coefficient ($\alpha$) can be expressed by eq. (5) which is an approximation to flat plate.

$$\alpha=N_U\times\lambda_1/X^1 \quad (5)$$

where, Nu is the Nusselt number, $\lambda_1$ is the thermal conductivity, and $X_1$ is the representative length for heat transfer.

The Nusselt number (Nu) is expressed by eq. (6) and eq. (7) for individual ranges of flow speed of molten steel.

$$N_U=0.664\times Pr^{1/3}\times Re^{4/5}(U<U_0) \quad (6)$$

$$N_U=0.036\times Pr^{1/3}\times Re^{1/2}(U\leqq U_0) \quad (7)$$

where, Pr is the Prandtl number, Re is the Reynolds number, U is the flow speed of molten steel, and $U_0$ is the transition speed between laminar flow and turbulent flow of molten steel.

The Prandtl number (Pr) and the Reynolds number (Re) are expressed by eq. (8) and eq. (9), respectively.

$$Pr=0.1715 \quad (8)$$

$$Re=U\times X_2/\nu \quad (9)$$

where, $X_2$ is the representative length of molten steel flow, and $\nu$ is the dynamic viscosity of molten steel.

The heat flux transferred from the molten steel 101 to the cooling water 105 is expressed by eq. (10).

$$Q=(T_0-T_W)/R \quad (10)$$

where, Q is the heat flux transferred from the molten steel to the cooling water, $T_0$ is the temperature of molten steel, and $T_W$ is the temperature of cooling water.

The surface temperature of cooling water 105 of the copper plate 104 of the mold is expressed by eq. (11).

$$T_{mL}=T_W+Q/h_W \quad (11)$$

where, $T_{mL}$ is the surface temperature of the copper plate of the mold at the side of cooling water.

The temperature of copper plate of the mold measured by the temperature measurement element 106 is expressed by eq. (12).

$$T=T_{mL}+Q\times(d_m-d)/\lambda_m \quad (12)$$

where, T is the temperature of copper plate of the mold measured by the temperature measurement element, and d is the distance between the surface of copper plate of the mold at molten steel side to the tip of the temperature measurement element.

By combining eq. (11) with eq. (12), the temperature of copper plate of the mold, (T), is expressed by eq. (13).

$$T=T_W+Q/h_W+Q\times(d_m-d)/\lambda_m \quad (13)$$

The present invention is to determine the flow speed of molten steel, (U), using the above-derived equations. The procedure of determination is described below. First, the value of the temperature of copper plate of the mold, (T), measured by the temperature measurement element is entered to eq. (13) to derive the heat flux (Q). In eq. (13), since all the variables in the right hand member except for the heat flux (Q) are known, the heat flux (Q) can be derived. Then, thus derived heat flux (Q) value is entered to eq. (10) to derive the overall heat resistance (R). Since all the variables in the right hand member except for the overall heat resistance (R) are known, the overall heat resistance (R) can be calculated. Next, the overall heat resistance (R) is entered to eq. (4) to derive the convection heat transfer coefficient ($\alpha$). Since all the variables in the right hand member except for the convection heat transfer coefficient ($\alpha$) are known, the convection heat transfer coefficient ($\alpha$) can be calculated. By entering the derived convection heat transfer coefficient ($\alpha$) to eq. (5) to determine the Nusselt number (Nu), then by entering thus derived Nusselt number (Nu) to eq. (6) to derive the Reynolds number (Re). Finally, the derived Reynolds number (Re) is entered to eq. (9) to determine the flow speed of molten steel (U).

In this manner, the flow speed of molten steel along the boundary of solidification can be estimated by grasping the variations of temperature of copper plate of the mold, which variations are induced from the variations of convection heat transfer coefficient between the molten steel and the solidified shell, caused from the flow speed of molten steel.

The following is the description about the method for estimating flow pattern of molten steel in the mold based on the temperature of copper plate of the mold. The flow pattern of molten steel in the mold gives different patterns depending on the slab-drawing speed, the shape of immersion nozzle, the Ar gas flow rate injected to the immersion nozzle, and other variables. FIG. 22 shows typical examples of the flow patterns. FIG. 22 also shows the measured results of temperature of the copper plate on longer side of the mold in the direction of mold width. The reference number 109 designates the copper plate on shorter side of the mold, 116 designates the meniscus, 120 designates the immersion nozzle, 121 designates the injection hole, and 122 designates the injected flow. The injected flow 122 is expressed by arrow giving the direction of flow. As seen in the figure, the result of temperature measurement of the copper plate on longer side of the mold in the mold width direction gives good agreement with the flow pattern of molten steel. That is, the injected flow 122 coming from the immersion nozzle 120 flows mainly to the section of high temperature of copper plate on longer side of the mold, which main flow determines the flow pattern of molten steel. At that moment, the flow pattern is readily estimated by identifying the number of peaks and the positions of peaks at respective temperatures of copper plate of the mold in the direction of mold width.

For example, for the Pattern 0 in FIG. 22, no specifically governing flow exists, and the flow is mild over the whole width of the mold, showing no significant difference in the measured values of the temperature measurement elements. However, in the Pattern 1, the ascending flow in the vicinity of immersion nozzle is the governing flow, which is accompanied by the ascending Ar gas bubbles, which Ar gas was injected into the immersion nozzle 120, thus increasing the measured temperatures in the vicinity of immersion nozzle. The phenomenon comes from that one temperature peak is observed at near the immersion nozzle. In the Pattern 2, the injected flow 122 ejected from the immersion nozzle 120 collides against the copper plate 109 on shorter side of the mold, which results in the increased measured temperatures in the vicinity of copper plate on shorter side of the mold. At that moment, a temperature peak appears near the copper plate 109 on shorter side of the mold, and two temperature peaks exist over the whole mold area. In the Pattern 3, both the ascending flow in the vicinity of the immersion nozzle owing to the Ar bubbles injected into the immersion nozzle and the flow caused from inertial force of the injected flow 122 are the governing flows. As a result, the measured temperatures increase at both areas of near the immersion nozzle and of near the copper plate on shorter side of the mold. At that time, there are three temperature peaks over the whole width of the mold. The integer section of the pattern No. given in FIG. 22 indicates the number of the temperature peaks over the whole width direction, and the decimal section indicates that the position of temperature peak at the side of shorter side of mold is distant from the copper plate 109 on shorter side of the mold toward the immersion nozzle 120.

The description on the method for estimating the existence/absence of deflected flow of molten steel in the mold based on the mold copper plate temperature is given below. Normally, the molten steel poured from the immersion nozzle into the mold establishes symmetrical flow centering the immersion nozzle in the mold width, so that the temperatures of copper plate on longer side of the mold also become symmetrical to the immersion nozzle. As a result, if the positions of maximum temperature of copper plate on longer side of the mold in width direction is not symmetrical to the immersion nozzle, generation a deflected flow is readily suggested. Even when the maximum temperature positions of the copper plate are symmetrical to the immersion nozzle, if the maximum values are different from each other, the injected flow rate differs on each side, thus the generation of deflected flow is readily detected.

Figure 23:
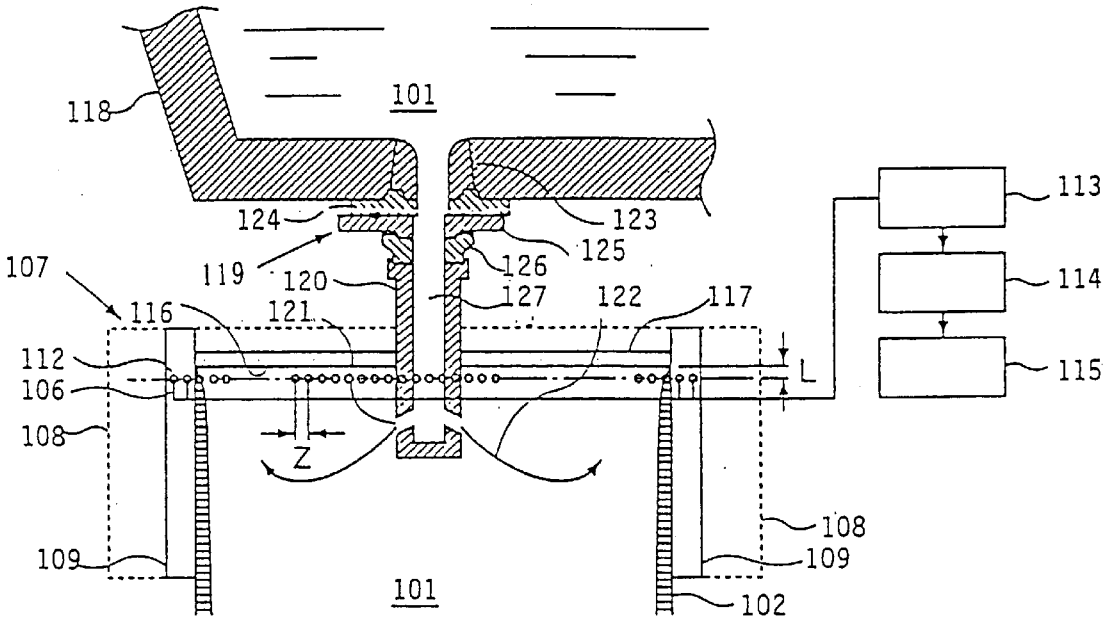
FIG. 23 is a schematic drawing of cross sectional front view of the casting section of the continuous casting machine of the Embodiment 2.
Figure 24:
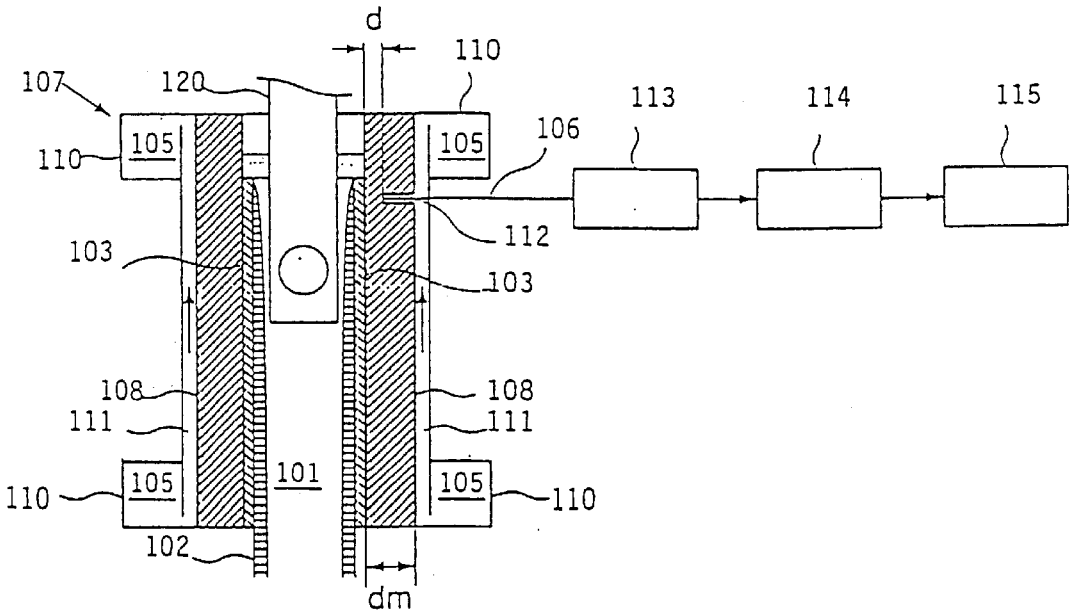
FIG. 24 is a schematic drawing of cross sectional side view of the casting section of the Embodiment 2.

The present invention is described referring to the drawings. FIG. 23 is a schematic drawing of cross sectional front view of the casting section of a continuous casting machine, showing a mode to carry out the present invention. FIG. 24 is a schematic drawing of cross sectional side view of the casting section of FIG. 23.

As seen in FIGS. 23 and 24, a tundish 118 is located above a mold 107 which comprises a pair of copper plates 108 on longer side of the mold and a pair of copper plates 109 on shorter side of the mold, which pair of copper plates 109 on shorter side of the mold are inserted between the pair of copper plates 108 on longer side of the mold, and each of the longer sides and each of the shorter sides faces to each other, respectively. At each of the upper section and the lower section of the rear face of the copper plate 108 on longer side of the mold, a water box 110 is installed. A cooling water 105 supplied from the water box 110 on longer side of the mold at lower section of the rear face passes through a water path 111 to cool the copper plate 108 on longer side of the mold, then flows out to the water box 110 on longer side of the mold at upper section of the rear face. The thickness between the copper plate 108 on longer side of the mold and the water path 111, or the thickness of the copper plate on longer side of the mold is $d_m$. The copper plate 109 on shorter side of the mold is cooled in a similar manner, though the drawings do not give the illustration.

At the bottom of the tundish 118, an upper nozzle 123 is located. A sliding nozzle 119 comprising a fixing plate 124, a sliding plate 125, and a streaming nozzle 126 is located to connect with the upper nozzle 123. Furthermore, an immersion nozzle 120 is located on the bottom face of the sliding nozzle 119, thus forming a tapping hole 127 for the molten steel from the tundish 118 to the mold 107.

The molten steel 101 which was poured from a ladle (not shown) to the tundish 118 is injected in the mold 107 as an injected flow 122 toward the copper plate 109 on shorter side of the mold through an injection hole 121 that is located at lower portion of the immersion nozzle 120 and that is immersed in the molten steel 101 in the mold 107, via the tapping hole 127 of the molten steel. The molten steel 101 is cooled in the mold 107 to form a solidified shell 102, which is then drawn downward from the mold 107 to become an slab. At that moment, a mold powder 117 is added to the surface of the meniscus 116 in the mold 107. The mold powder 117 is fused to flow in between the solidified shell 102 and the mold 107 to form a mold powder layer 103.

On the copper plate 108 on longer side of the mold, plurality of holes are drilled along width direction on the copper plate 108 on longer side of the mold at a distance L from the meniscus 116 to the direction of slab-drawing, while keeping intervals of Z of adjacent holes, thus providing the measurement points 112 to measure the temperatures of the copper plate 108 on longer side of the mold. The distance (L) from the meniscus 116 to the direction of slab-drawing is in a range of from 10 to 135 mm, and the intervals (Z) are not more than 200 mm. The distance between the surface of copper plate 108 on longer side of the mold at the side of molten steel and the tip of the temperature measurement element 106 is expressed by (d). The tip of the temperature measurement element touches the copper plate 108 on longer side of the mold. The distance (d) is not more than 16 mm.

The other end of the temperature measurement element 106 is connected to a zero-point compensator 113. The electromotive force signals generated from the temperature measurement element 106 are entered a converter 114 via the zero-point compensator 113, where the electromotive force signals are converted to current signals, which current signals are then entered a data analyzer 115.

Figure 25:
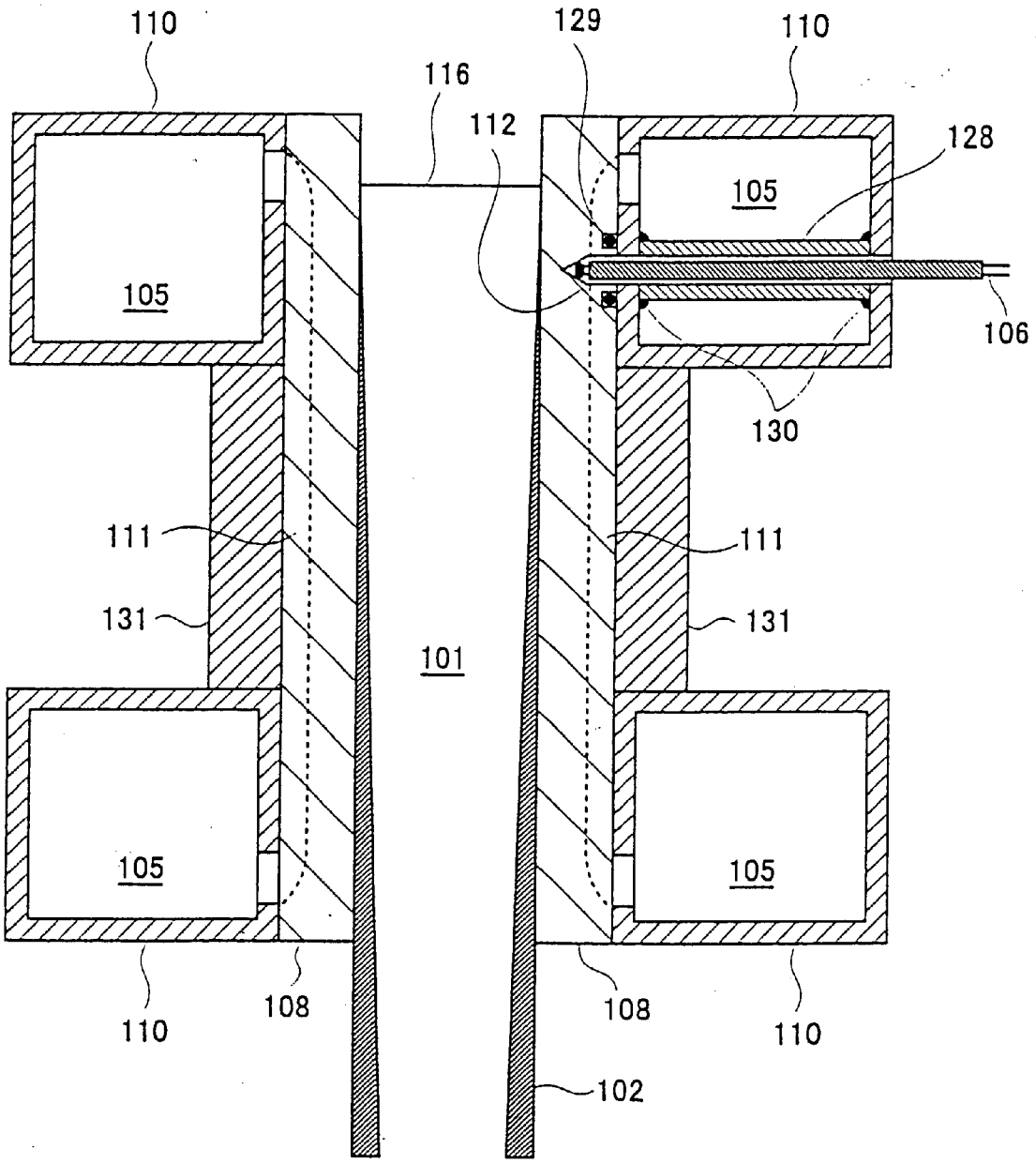
FIG. 25 is a schematic drawing of cross sectional side view of the casting section of the Embodiment 2, showing the mounting structure of the temperature measurement element.

If the cooling water 105 enters the temperature measurement point 112, the temperature of copper plate at the contact point of the temperature measurement element decreases to hinder the measurement of precise temperature of the copper plate. To prevent the invasion of cooling water 105 into the temperature measurement point 112, according to the present invention, a stainless pipe 128 is located in the water box 110 on longer side of the mold, as shown in FIG. 25, to form a welded sections 130 over the whole peripheral length of contact face between the pipe 128 and the water box 110 on longer side of the mold, and the temperature measurement element 106 passes through the pipe 128. In addition, a groove is formed on the copper plate 108 on longer side of the mold at periphery of the temperature measurement point 112, in which groove a seal packing 129 is placed to contact with the copper plate 108 on longer side of the mold and with the water box 110 on longer side of the mold. A coil spring (not shown) presses the tip of the temperature measurement element 106 against the copper plate 108 on longer side of the mold. FIG. 25 is a schematic drawing of cross sectional side view of the casting section of a continuous casting machine illustrating the structure for mounting the temperature measurement element. The reference number 131 designates the back frame.

With the configuration, the temperature measurement element 106 is completely separated from the cooling water in the water box 110 on longer side of the mold. Thus, the cooling water 105 in the water box 110 on longer side of the mold does not enter the temperature measurement point 112, and, even when the cooling water 105 reaches to the periphery of the temperature measurement point 112 through a gap of contact point between the copper plate 108 on longer side of the mold and the water box 110 on longer side of the mold, the seal packing 129 prevents the invasion of the cooling water 105 into the temperature measurement point 112. Instead of the welding, seal with a resin or a hard solder may be applied. The seal packing 129 may be placed in a groove formed at the side of the water box 110 on longer side of the mold. Any type of temperature measurement element 106 may be applied, such as thermocouple and resistance thermometer, if only it has ±1° C. or higher accuracy.

The data analyzer 115 estimates and displays the flow pattern of molten steel in the mold based on the temperature distribution of copper plate on longer side of the mold in the mold width direction and on the number and positions of peaks of temperatures thereof, and estimates and displays the deflected flow of molten steel in the mold based on the position and value of maximum temperature of copper plate of the mold at right side and left side to the immersion nozzle 120 in the width of copper plate 108 on longer side of the mold. Furthermore, the data analyzer 115 computes and displays the flow speed (U) of molten steel at each measurement point 112 on the basis of the above-described principle for determining the flow speed of molten steel, and using the data such as the temperature (T) of copper plate on longer side of the mold, the thickness ($d_m$) of copper plate on longer side of the mold, the above-described distance (d), the temperature of molten steel, and the temperature of cooling water. Among fifteen variables that structure eqs. (4) through (13), there are three variables that vary depending on the casting conditions and that cannot be directly measured, which three are (1) the thickness of solidified shell ($d_S$), (2) the thickness of mold powder ($d_P$), and (3) heat transfer coefficient between mold copper plate and cooling water ($h_W$). For these three variables, a preliminary study may be given on the variations of values under the variations of casting conditions by an experiment on commercial facility or by a simulation test, and the flow speed of molten steel (U) may be computed on the basis of the values corresponding to the casting conditions at the measurement of temperature of copper plate of the mold. For other twelve variables, they can be determined by the facility conditions and the physical properties.

Figure 26:
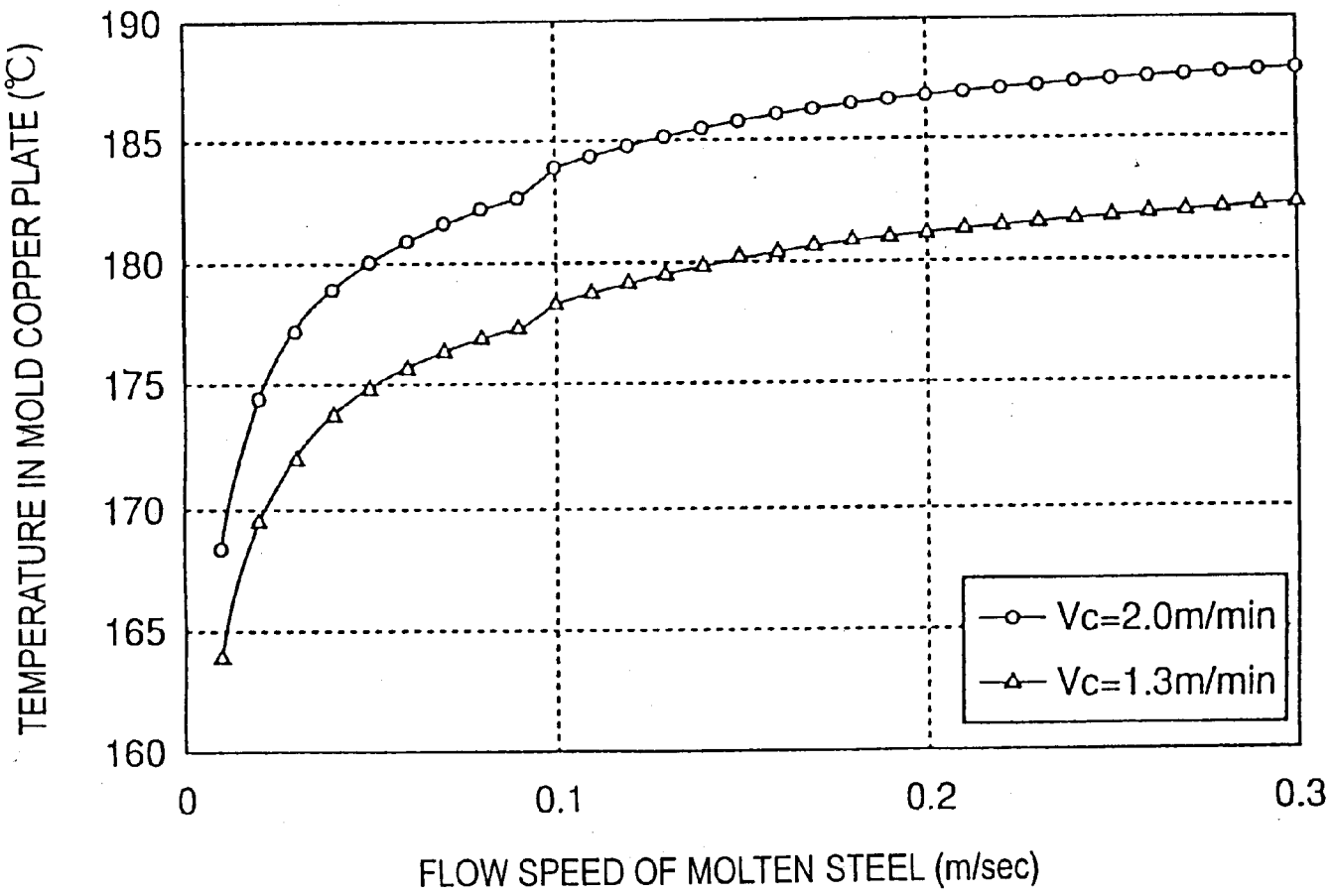
FIG. 26 shows an example of the relation between the temperatures of mold copper plate and the molten steel flow speed.

Table 2 shows an example of each variable under casting conditions of 2.0 and 1.3 m/min of slab-drawing speed. FIG. 26 gives the relation between the temperature (T) of copper plate of the mold and the flow speed (U) of the molten steel derived from the variables in Table 2. As shown in FIG. 26, the flow speed of molten steel significantly differs with the slab-drawing speed even on the same temperature of copper plate of the mold, thus the flow speed of molten steel can be estimated from the temperature of copper plate of the mold. The transition speed ($U_0$) between the laminar flow and the turbulent flow of the molten steel is computed as 0.1 m/sec, and the reference symbol Vc in Table 2 and FIG. 26 designates the slab-drawing speed.

TABLE 2

| | Variable | Value |
|---|---|---|
| 1 | Thermal conductivity of solidified shell ($\lambda$) | 20 W/m · K |
| 2 | Thermal conductivity of mold powder layer ($\lambda_p$) | 1.5 W/m · K |
| 3 | Thermal conductivity of mold copper plate ($\lambda_m$) | 300 W/m · K |
| 4 | Heat transfer coefficient between mold powder layer and mold copper plate ($h_m$) | 2500 W/m$^2$ · K |
| 5 | Heat transfer coefficient between mold copper plate and cooling water ($h_w$) | 28750 W/m$^2$ · K |
| 6 | Thickness of mold copper plate ($d_m$) | 0.04 m |
| 7 | Distance between the surface of copper plate of mold at the side of molten steel to the temperature measurement element (d) | 0.013 m |
| 8 | Temperature of cooling water ($T_w$) | 25° C. |
| 9 | Thickness of solidified shell ($d_s$) | 0.00348 m (Vc = 2.0 m/min)<br>0.00432 m (Vc = 1.3 m/min) |
| 10 | Thickness of mold powder layer ($d_p$) | 0.0006 m |
| 11 | Temperature of molten steel ($T_o$) | 1545° C. |
| 12 | Thermal conductivity of molten steel ($\lambda_1$) | 33.44 W/m$^2$ · K |
| 13 | Representative heat transfer length ($X_1$) | 0.23 m |
| 14 | Representative flow length of molten steel ($X_2$) | 0.23 m |
| 15 | Dynamic viscosity of molten steel ($\nu$) | $1 \times 10^{-6}$ m$^2$/sec |

With the arrangement of temperature measurement elements 106 on the mold copper plate, the variations of temperatures of mold copper plate caused from the flow of molten steel in the mold can be accurately measured even when complex flow of molten steel in the vicinity of the meniscus 116 exists. Based on thus measured temperatures of mold copper plate, the flow speed of molten steel in the mold, the flow pattern of molten steel in the mold, and the deflected flow of molten steel in the mold are estimated, the accuracy of the estimation increases, and also the on-line estimation is available without hindering the operation of the production line.

The above-given description applied the temperature measurement elements 106 arranged along a horizontal line in the width direction of the mold 107. They can be arranged in plural rows in the casting direction. The above-given description applied the temperature measurement elements 106 only on one side of the copper plate 108 on longer side of the mold. They can be mounted on both the copper plates 108 on longer side of the mold. Furthermore, the above-given description gave the explanation about the mold 107 having rectangular cross section. The present invention, however, does not limit the mold 107 to rectangular cross section, and, for example, a circular cross section may be applied.

EXAMPLE 1

Example 1 is an example for estimating the flow speed of molten steel using the slab continuous casting machine and the temperature measurement device for mold copper plate given in FIG. 23. The continuous casting machine applied was a vertical and bending type having 3 meters of vertical section, which machine produced slab of max. 2,100 mm in width. Table 3 shows the specification of the applied continuous casting machine.

TABLE 3

| Item | Specification |
|---|---|
| Type of continuous casting machine | Vertical and bend type |
| Length of vertical section | 3 m |
| Capacity of molten steel in ladle | 250 ton |
| Capacity of molten steel in tundish | 80 ton |
| Thickness of slab | 220 to 300 mm |
| Width of slab | 675 to 2100 mm |
| Slab-drawing speed | max. 3 m/min |
| Immersion nozzle | Downward 25 deg., tapping hole 80 mm in diameter |

The thickness ($d_m$) of copper plate on longer side of the mold was 40 mm. The temperature measurement element applied alumel-chromel (JIS thermocouple K). The thermocouples were buried under the conditions of: 13 mm of the distance (d) between the surface of mold copper plate on the side of molten steel and the tip of thermocouple (contact of measurement), 66.5 mm of the interval (Z) of adjacent thermocouples, and 50 mm of the distance (L) from the meniscus. The temperatures of copper plate on longer side of the mold were measured f or the case of casting slab of 220 mm in thickness and 1,650 mm in width at 1.85 m/min of drawing speed, (hereinafter referred to as "the Casting condition 1"), and for the case of casting slab of 220 mm in thickness and 1,750 mm in width at 1.75 m/min of drawing speed, (hereinafter referred to as "the Casting condition 2"). Table 4 summarizes the casting conditions.

TABLE 4

| | Slab thickness (mm) | Slab width (mm) | Slab-drawing speed (mm/min) | Ar gas injection rate (N1/min) |
|---|---|---|---|---|
| Casting condition 1 | 220 | 1650 | 1.85 | 10 |
| Casting condition 2 | 220 | 1750 | 1.75 | 10 |

Figure 27:
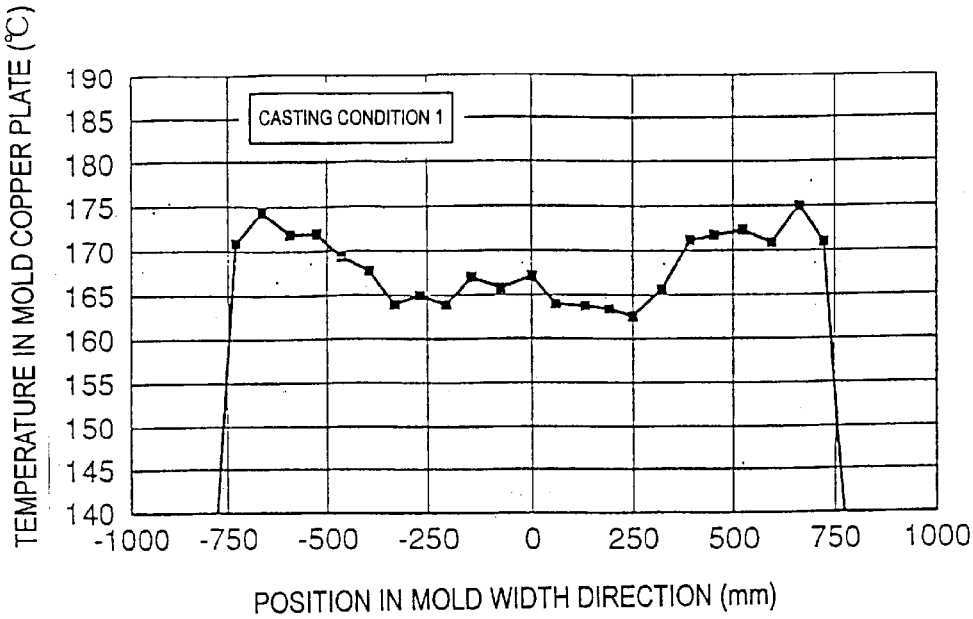
FIG. 27 shows an example of temperature measurement data for the mold copper plate in Example 1 of the Embodiment 2.
Figure 28:
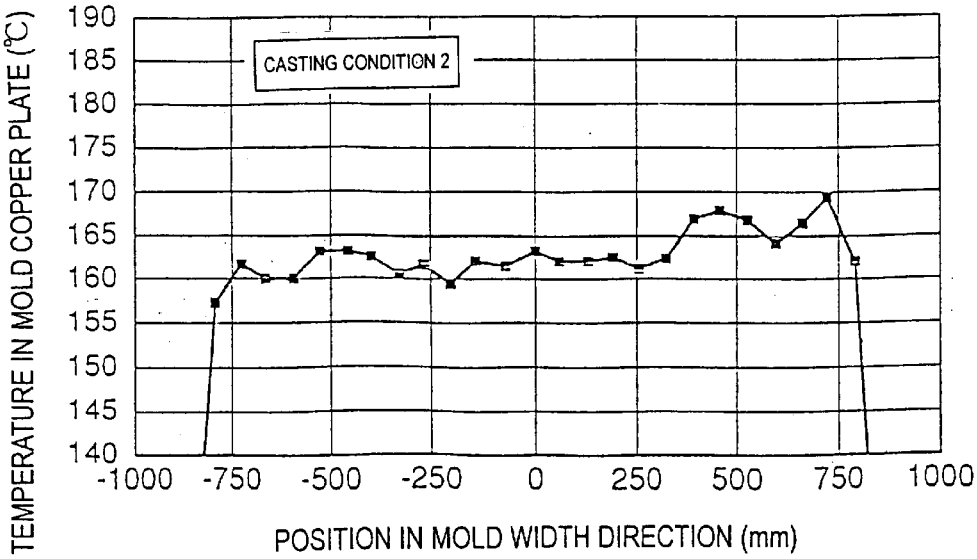
FIG. 28 shows another example of temperature measurement data for the mold copper plate in Example 1 of the Embodiment 2.

FIG. 27 and FIG. 28 show examples of temperature measurement data for the mold copper plate in the mold width direction at a certain time under the Casting condition 1 and the Casting condition 2, respectively. The horizontal axis of these figures indicates the position on an slab in the width direction thereof. The position "0 mm" is the center of the slab width, or the position of the immersion nozzle, (hereinafter the position in slab-width direction is given by the same expression). As seen in FIG. 27 and FIG. 28, the temperature at both edges of the slab-width direction significantly reduces because the copper plate on shorter side of the mold is located at near the portion where the temperature significantly reduces.

Figure 29:
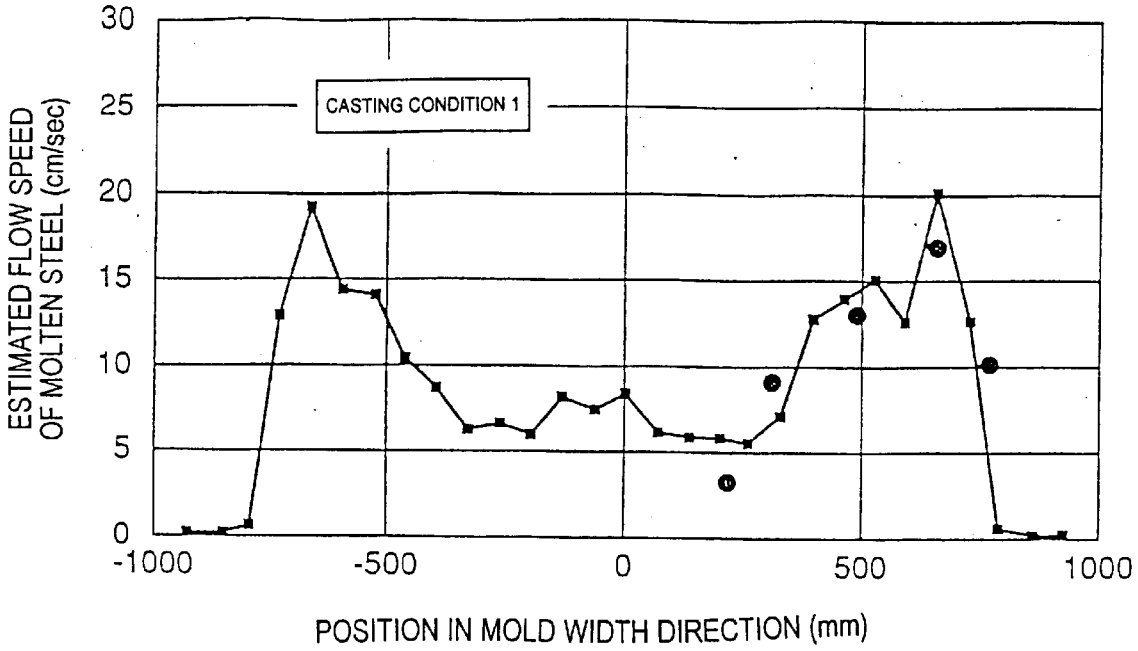
FIG. 29 shows an example of flow speed distribution estimated from the temperatures of mold copper plate in Example 1 of the Embodiment 2.
Figure 30:
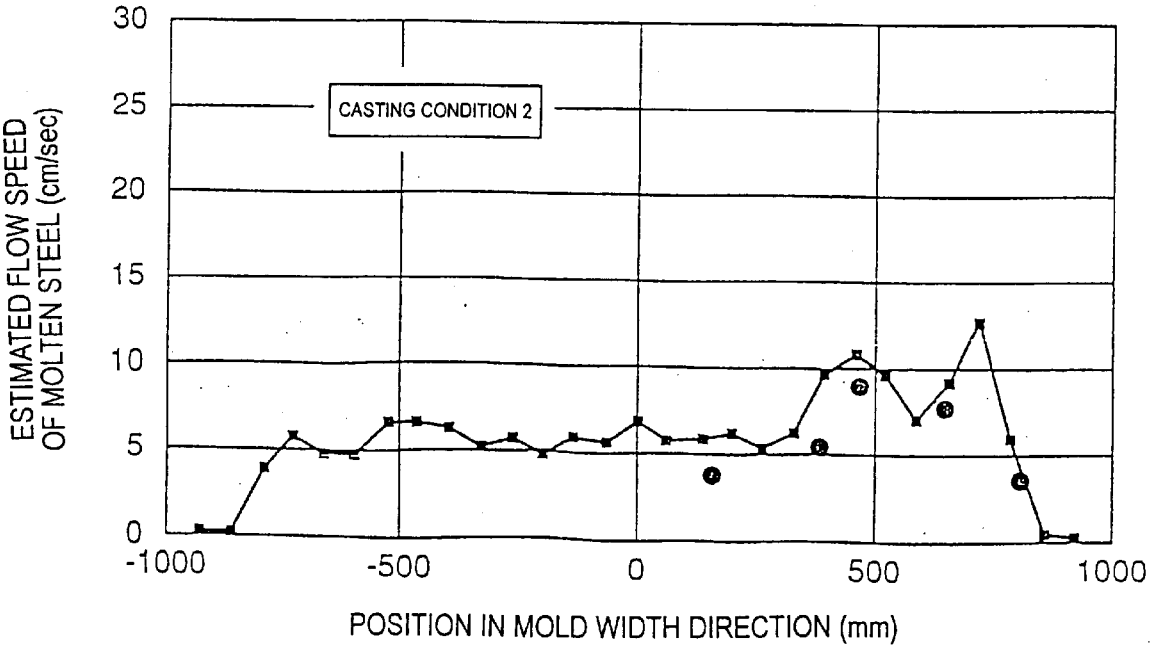
FIG. 30 shows another example of flow speed distribution estimated from the temperatures of mold copper plate in Example 1 of the Embodiment 2.

FIG. 29 and FIG. 30 show the calculated flow speed of molten steel based on the temperatures of mold copper plate shown in FIG. 27 and FIG. 28, respectively. As of the variables given in Table 2, the thickness ($d_S$) of solidified shell was set to 0.00362 m under the Casting condition 1, and 0.00372 m under the Casting condition 2. In FIG. 29 and FIG. 30, the flow speed of molten steel measured by the above-described immersion rod type molten steel flow speed meter at the time of measurement of the temperature of mold copper plate is given by the symbol ●. From these results, good agreement was confirmed between the flow speed of molten steel at 50 mm below the meniscus, that was estimated from the temperature of mold copper plate, and the flow speed of molten steel in the vicinity of the meniscus, that was determined by immersion rods.

EXAMPLE 2

The continuous casting machine and the temperature measurement device for mold copper plate applied in Example 1 were used. Ar gas was injected into the immersion nozzle at a rate of 10 Nl/min, and an slab having the size of 250 mm in thickness and 1,600 mm in width was cast at a drawing speed of 2.2 m/min. The flow pattern of the molten steel in the mold was estimated.

Figure 31:
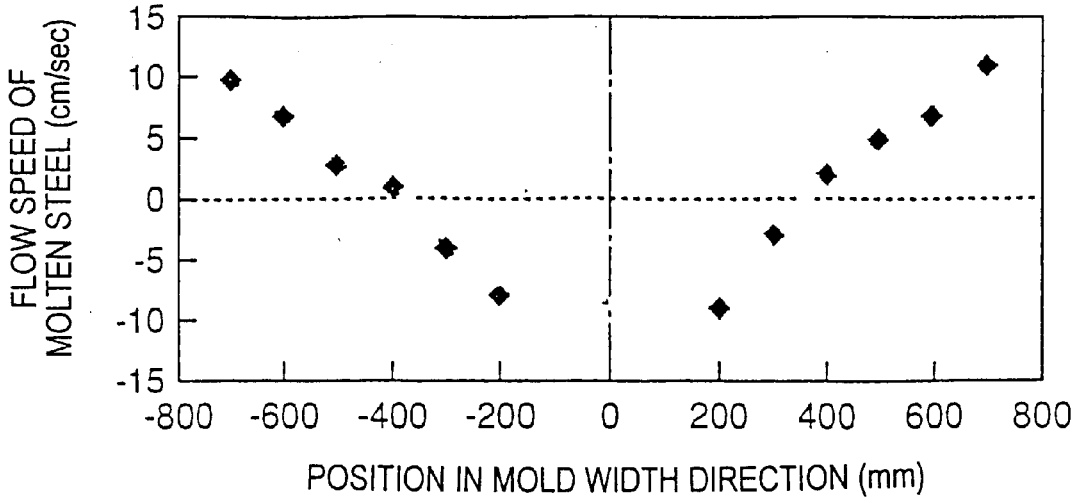
FIG. 31 shows a flow speed distribution of molten steel in the mold measured on the first heat of sequence casting in Example 2 of the Embodiment 2.

On the temperature distribution of the copper plate on longer side of the mold after 10 minutes have passed from the beginning of casting showed three positions of temperature peaks at the position of immersion nozzle and at both copper plates on shorter side of the mold. Furthermore, the temperature distribution became almost symmetrical in right half and left half in the mold width. The result derived estimation of the Pattern 3 which was given in FIG. 22. To confirm the pattern, the above-described immersion rod type molten steel flow speed meter was applied to determine the flow speed and the flow direction of the molten steel in the mold width direction. FIG. 31 shows the result. As seen in the figure, the result obtained by the immersion rod type molten steel flow speed meter confirmed that, at the side of the immersion nozzle in the mold, the flow directs from the immersion nozzle to the copper plate on shorter side of the mold, and that, at the side of the copper plate on shorter side of the mold, the inverse flow exists, or the Pattern 3 flow state is established. The result agreed with the estimated result based on the temperature of copper plate on longer side of the mold.

Figure 32:
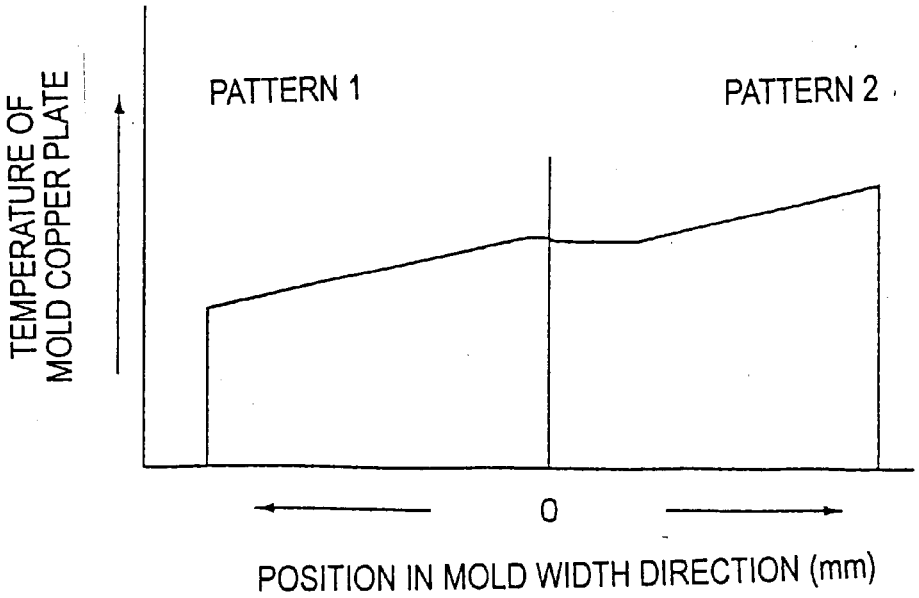
FIG. 32 shows a temperature distribution of mold copper plate measured on the fifth heat of sequence casting in Example 2 of the Embodiment 2.
Figure 33:
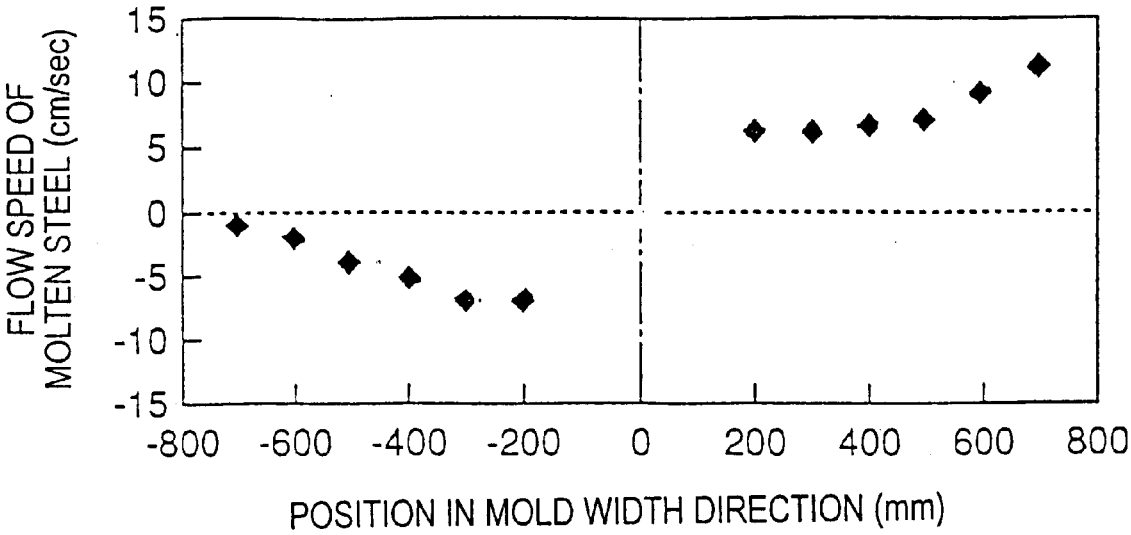
FIG. 33 shows a flow speed distribution of molten steel in the mold measured on the fifth heat of sequence casting in Example 2 of the Embodiment 2.

The temperature distribution on the copper plate on longer side of the mold after 10 minutes had passed from the beginning of the fifth heat casting in sequence casting differed in the right half and the left half in the mold width to each other, giving the temperature distribution of FIG. 32. The flow pattern was estimated based on the temperature distribution to derive an estimation that, in the left half width, the Pattern 1 which has the temperature peak at the side of immersion nozzle was established, and, in the right half width, the Pattern 2 which has the temperature peak at the side of copper plate on shorter side of the mold was established. To confirm the phenomenon, the above-described immersion rod type molten steel flow speed meter was applied to determine the flow speed and the flow direction of the molten steel in the mold width direction. FIG. 33 shows the result of the determination. As shown in FIG. 33, the result of the determination by the immersion rod type molten steel flow speed meter showed that, in the left half in the mold width, the Pattern 1 which gives the flow direction from the immersion nozzle to the copper plate on shorter side of the mold was established, and, in the right half, the Pattern 2 which has the inverse flow from the mold shorter side to the immersion nozzle was established. The result agreed with the estimated result based on the temperature of copper plate on longer side of the mold.

EXAMPLE 3

The continuous casting machine and the temperature measurement device for mold copper plate applied in Example 1 were used. Ar gas was injected into the immersion nozzle at a rate of 10 Nl/min, and an slab having the size of 250 mm in thickness and 1,600 mm in width was cast at a drawing speed of 2.6 m/min. The existence of deflected flow in the molten steel in the mold was estimated.

Figure 34:
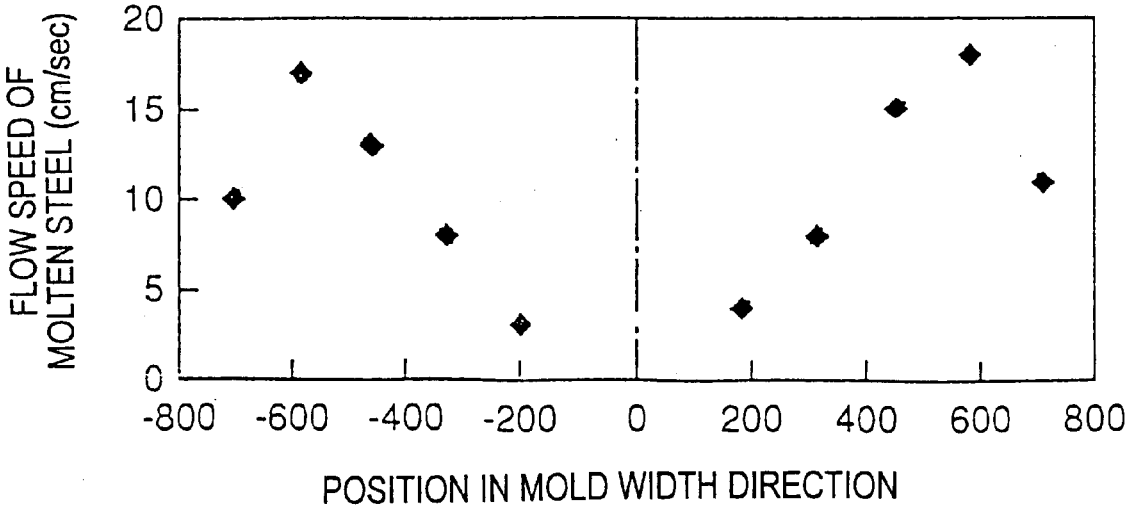
FIG. 34 shows a flow speed distribution of molten steel in the mold measured on the first heat of sequence casting in Example 3 of the Embodiment 2.

The temperature distribution on the copper plate on longer side of the mold after 10 minutes had passed from the beginning of casting showed almost symmetrical distribution in right half and left half in the mold width, giving the maximum temperature of 180.5° C. at left half width and 181° C. at right half width of the mold. There was no difference in the positions of the maximum temperature between half and left half, and the difference in maximum temperatures between right half and left half in the mold width was small. Therefore, the estimation concluded that no deflected flow existed. To confirm the conclusion, the above-described immersion rod type molten steel flow speed meter was applied to measure the flow speed and the flow direction of the molten steel in the mold width direction. The result is given in FIG. 34. As shown in FIG. 34, the flow speed of molten steel at meniscus, determined by the immersion rod type molten steel flow speed meter, is symmetrical to the immersion nozzle position in right and left sides, and no deflected flow occurred, thus agreed with the estimation based on the temperature of mold copper plate.

Figure 35:
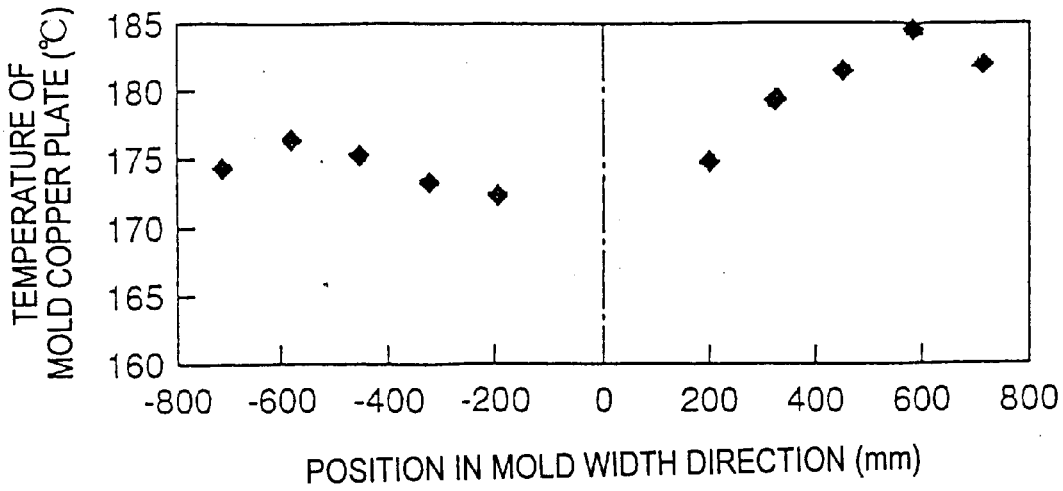
FIG. 35 shows a temperature distribution of mold copper plate measured on the third heat of sequence casting in Example 3 of the Embodiment 2.
Figure 36:
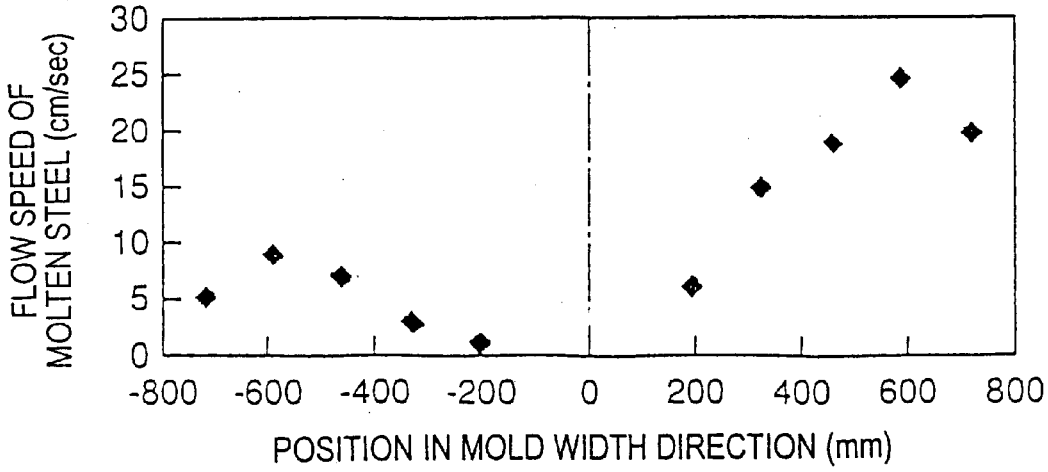
FIG. 36 shows a flow speed distribution of molten steel in the mold measured on the third heat of sequence casting in Example 3 of the Embodiment 2.

The temperature distribution on the copper plate on longer side of the mold after 10 minutes had passed from the beginning of the third heat casting in sequence casting differed in the right half and the left half in the mold width to each other, giving the temperature distribution of FIG. 35. As shown in the figure, the position of the maximum temperature was identified by the thermocouple distant from the center of the immersion nozzle by 598.5 mm both to the right and to the left, giving 176.5° C. at the left half width and 184.5° C. at the right half width, with the difference of 8° C. Since the magnitude of the difference in the maximum temperature was large, a deflection flow should occurred. To confirm the occurrence of the deflected flow, the above-described immersion rod type molten steel flow speed meter was applied to measure the flow speed and the flow direction of the molten steel in the mold width direction. The result is shown in FIG. 36. As shown in FIG. 36, the flow speed of molten steel at meniscus, determined by the immersion rod type molten steel flow speed meter, differed in right and left sides to the immersion nozzle position, and the occurrence of deflected flow was confirmed.

According to the present invention, the temperature measurement elements to measure the temperatures of mold copper plate are arranged as above-described configuration, the variations of temperature of mold copper plate caused from the flow of molten steel in the mold are accurately determined even when complex flow of molten steel exits in the vicinity of the meniscus. Since, based on thus measured temperatures of mold copper plate, the flow speed of molten steel in the mold, the flow pattern of molten steel in the mold, and the deflected flow of molten steel in the mold are estimated, thus the accuracy of the estimation improves, and the on-line estimation is available without hindering the operation of the production line. As a result, the quality control of the slab improves, and the production of high quality slab at high yield is attained. Thus, the industrial effect is significant.

Embodiment 3

Method for Judging Surface Defect on Continuously Cast Slab

Figure 37:
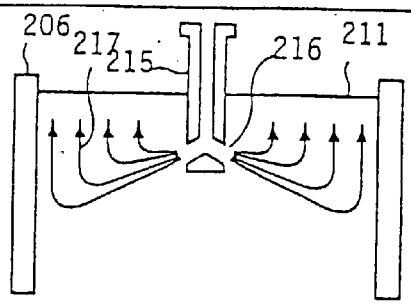
FIG. 37 shows schematic illustration of comparison between the flow state of molten steel in the mold and the temperature of mold copper plate of the Embodiment 3.
Figure 37:
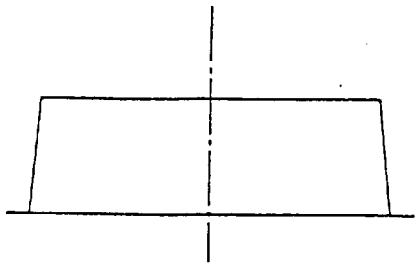
Figure 37:
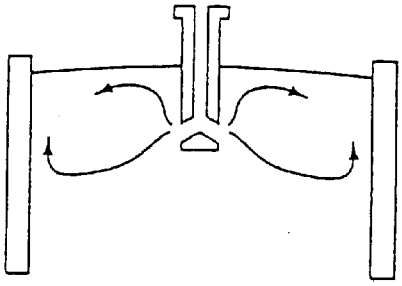
Figure 37:
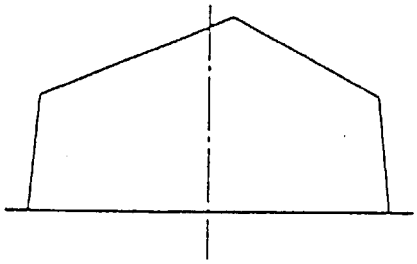
Figure 37:
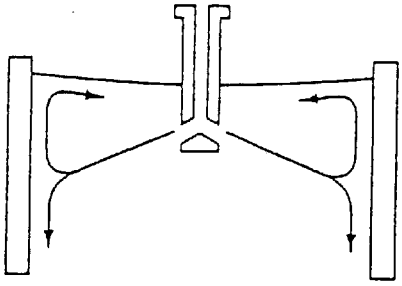
Figure 37:
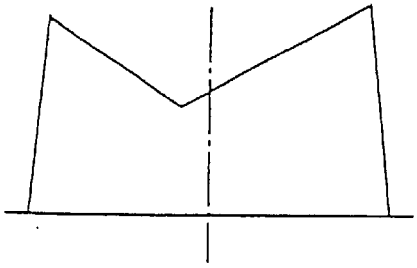
Figure 37:
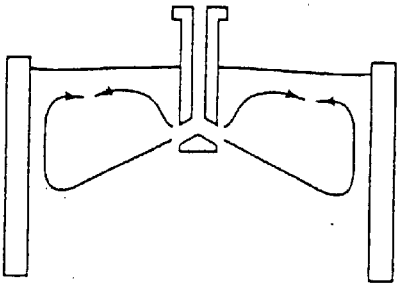
Figure 37:
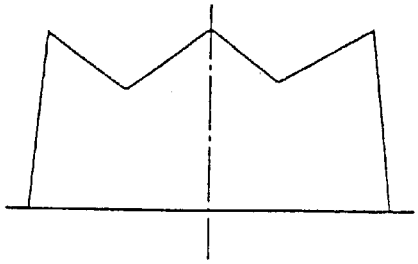

The inventors of the present invention conducted measurements on a commercial facility, model experiments, and numerical analyses to investigate the flow state of molten steel in the mold under various casting conditions, and the temperature profile on the mold copper plate in the mold width direction. FIG. 37 shows schematic illustration of comparison between the flow state of molten steel in the mold and the temperature of mold copper plate. In the figure, the reference number 206 designates the copper plate on shorter side of the mold, 211 designates the meniscus, 215 designates the immersion nozzle, 216 designates the injection hole, 217 designates the injected flow, and the injected flow 217 indicates the flow direction by arrow mark.

In the Pattern 0, no governing flow exists, and a mild flow appears over the whole width of the mold, thus the measured values on the temperature measurement elements in the mold width direction give no significant difference to each other. That is, the Pattern 0 is the case that no significant temperature peak appears, and the temperature profile is flat over the whole width of the mold. In the Pattern 1, the ascending flow at near the immersion nozzle accompanied with the ascending Ar gas bubbles injected into the immersion nozzle 215 is the governing flow. At the meniscus 211, the molten steel flows from the immersion nozzle 215 toward the copper plate 206 on shorter side of the mold. As a result, the temperature distribution in the width direction on mold copper plate increases at near the immersion nozzle 215, generating a single and large temperature peak in the vicinity of the immersion nozzle 215. In the Pattern 2, the inertial force of the injected flow 217 coming from the immersion nozzle 215 is strong, and the injected flow 217 collides against the copper plate 206 on shorter side of the mold, and branches to upward flow and downward flow. On the meniscus 211, the molten steel flow directing from the copper plate 206 on shorter side of the mold toward the immersion nozzle 215 is established. In that case, the flow speed of molten steel at the meniscus 211 is relatively high. The temperature of copper plate at near the copper plate 206 on shorter side of the mold increases, thus forming a temperature profile which gives a large temperature peak in the vicinity of the copper plate 206 on shorter side of the mold on both right and left sides in the mold.

In this manner, the temperature profile is roughly classified to three types: Pattern 0, Pattern 1, and Pattern 3. Actually, however, patterns other than these three patterns exist. For example, the Pattern 3 shown in FIG. 37 appears when both the ascending flow near the immersion nozzle 215 accompanied with the ascending Ar gas bubbles and the inertial force of the injected flow 217 are the governing flows, and gives a temperature profile having three temperature peaks. This pattern, however, can be considered as a combination of the Pattern 1 and the Pattern 2. For other cases, the inventors of the present invention confirmed that the pattern can be expressed by a combination of the Pattern 0, the Pattern 1, and the Pattern 2.

The above-given investigations revealed that the state of molten steel flow varies with the manufacturing conditions, and that various temperature profiles exist responding to the flow state of molten steel. And, it was found that, the judgment of quality of the surface of slab is important to take into account of the flow state and to be based on the corresponding temperature profile.

First, the description is given on the case that the state of molten steel flow during operation is the Pattern 1. In that case, the ascending Ar bubbles concentrate at near the immersion nozzle, and the ascending Ar bubbles are coarse ones. When these bubbles separate from the meniscus, they disturb the meniscus to result in inclusion of mold powder, or these bubbles themselves are entrapped into the molten steel to cause blow defects. In that case, in the temperature distribution on the mold copper plate in the width direction thereof, the maximum value ($T_{max}$) can be treated as one index that expresses the magnitude of disturbance of the meniscus. Accordingly, excessively large maximum value ($T_{max}$) suggests the inclusion of mold powder by the Ar bubbles.

Figure 38:
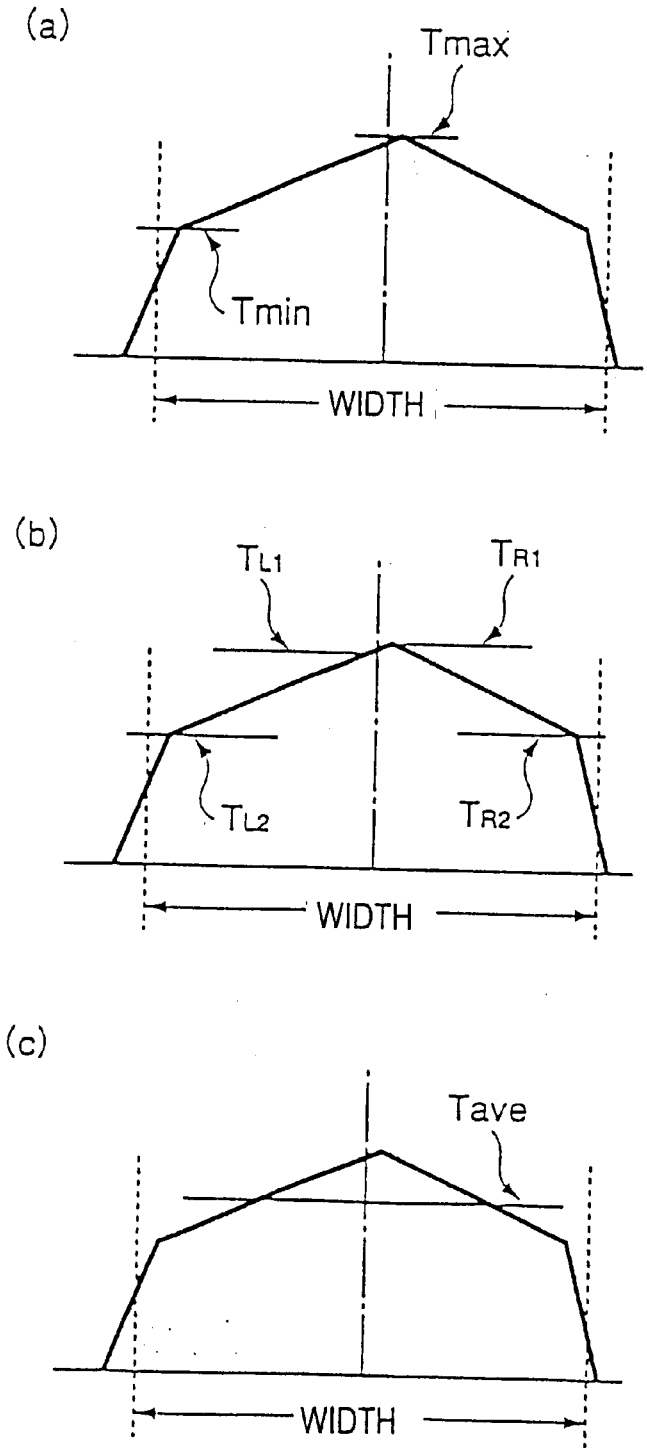
FIG. 38 shows schematic illustration of the temperature distribution of mold copper plate in the width direction thereof, and the maximum, minimum, and average values of the temperatures of mold copper plate for the Pattern 1 of the state of molten steel flow in the Embodiment 3.

If the meniscus has both a rapid flow and a slow flow, the gradient of the flow speed of the molten steel relates to the shear stress applied to the mold powder, and steep gradient likely peels the mold powder off into the molten steel. The gradient of flow speed is detected as the gradient of temperature of mold copper plate. To this point, as shown in FIG. 38(*b*), there is another variable to express the magnitude of disturbance of the meniscus caused from the Ar bubbles. That is, centering the immersion nozzle to divide in the right half and the left half in the mold width, the larger one of the two is selected: one variable is the difference between the maximum value ($T_{L1}$) and the minimum value ($T_{L2}$) of the temperature distribution in the left half width, or ($T_{L1}-T_{L2}$), and the other variable is the difference between the maximum value ($T_{R1}$) and the minimum value ($T_{R2}$) of the temperature distribution in the right half width, or ($T_{R1}-T_{R2}$), which larger one is hereinafter referred to as the "maximum high and low temperature difference". Consequently, the inclusion of the mold powder caused from the Ar bubbles can also be predicted by the magnitude of the maximum high and low temperature difference.

For the case of the Pattern 1 of the state of molten steel flow, the molten steel on shorter side of the mold flows from the side of the immersion nozzle toward the side of copper plate on shorter side of the mold. Thus, the temperature of molten steel at the side of copper plate on shorter side of the mold becomes low. Accordingly, if the circulation flow rate of the molten steel is less, the solidification of molten steel such as skimming or slag inclusion occurs in the meniscus at near the copper plate on shorter side of the mold. Therefore, in the temperature distribution on the mold copper plate in the width direction thereof, the minimum value ($T_{min}$) can be treated as a variable to express the circulation flow rate of molten steel at the meniscus. Consequently, if the minimum value ($T_{min}$) is excessively small, skimming may occur, and blow defects and slag inclusion may frequently occur. Also, the average temperature of copper plate ($T_{ave}$) over the whole width of the mold, which is shown in FIG. 38(*c*), can be treated as still another variable to express the circulation flow rate of the molten steel on the meniscus. Therefore, the skimming and slag inclusion can be predicted by the magnitude of the average temperature ($T_{ave}$) of the copper plate.

The mechanism of generation of slag inclusion is speculated as that the dispersion of physical properties of mold powder leads abnormally high consumption of the mold powder to reduce the thickness of the melt layer of the mold powder, thus the nonmelted mold powder adheres to the surface of the solidified shell to induce the generation of the slag inclusion. In this case, the consumption of the mold powder abnormally increases, so that the temperature of mold copper plate decreases compared with the case of normal consumption of the mold powder. Therefore, the presence and absence of the slag inclusion can be predicted by grasping the average temperature ($T_{ave}$) of copper plate in the mold width direction, and by comparing the value with the average temperature ($T_{ave}$) of copper plate of typical temperatures in the mold width direction at the slab-drawing speed. The average temperature ($T_{ave}$) of copper plate of typical temperatures in the mold width direction at the slab-drawing speed is defined herein as the average of temperature of copper plate in the mold width direction measured at many casting opportunities at the slab-drawing speed.

Figure 39:
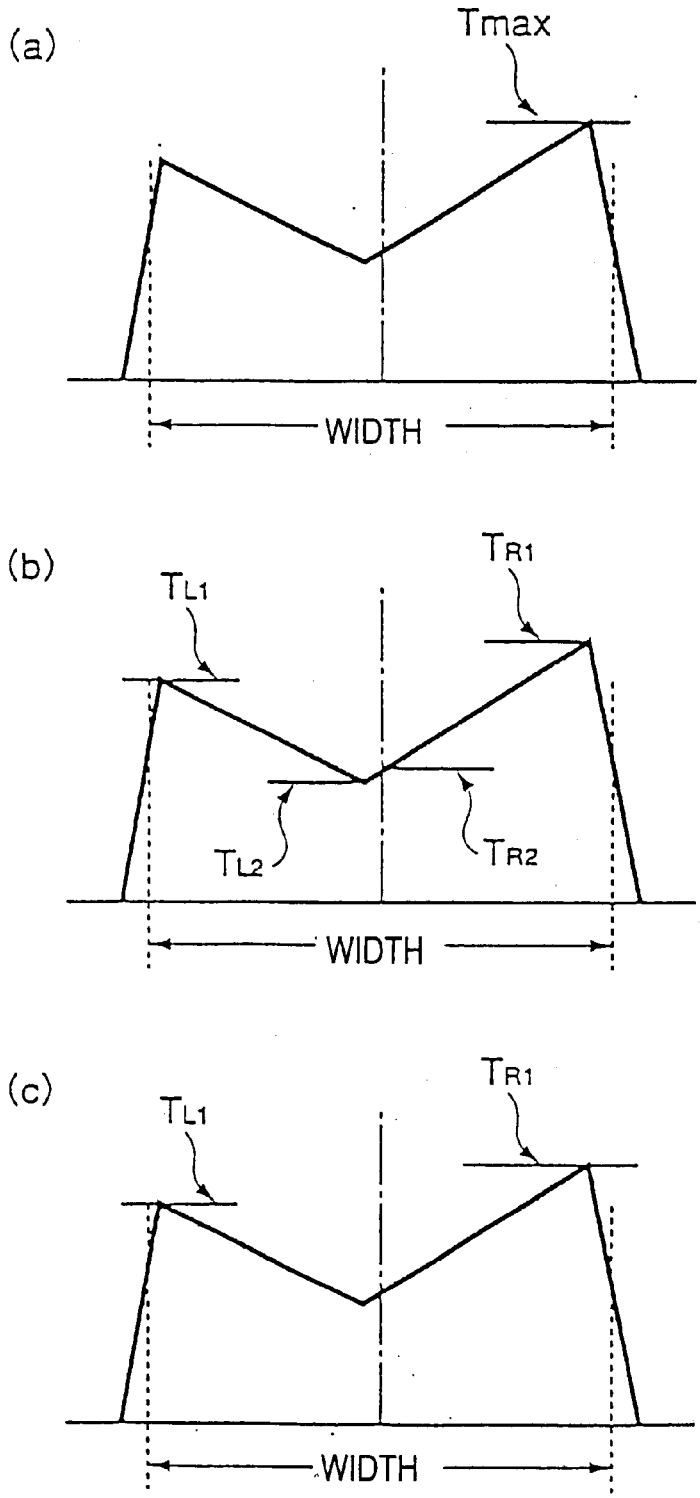
FIG. 39 shows schematic illustration of the temperature distribution of mold copper plate in the width direction thereof, and the maximum and minimum values of the temperatures of mold copper plate for the Pattern 2 of the state of molten steel flow in the Embodiment 3.

Next, the description is given on the Pattern 2 of the state of molten steel during operation. When the state of molten steel flow shows, as in the Pattern 2, the presence of relatively high molten flow on the meniscus, the flow may peel the mold powder covering the meniscus off to bring it into the molten steel. In this respect, as shown in FIG. 39(*a*), the maximum value ($T_{max}$) in the temperature distribution of the mold copper in the width direction thereof can be treated as a variable expressing the maximum speed of the molten steel on the meniscus. Accordingly, excessively large maximum value ($T_{max}$) suggests the occurrence of peeling and inclusion of mold powder.

As in the case of the Pattern 2 of the state of molten steel flow, if the meniscus has both a relatively high speed flow and a low speed flow, as described before, the gradient of the molten steel flow speed relates with the shear stress applied to the mold powder. Thus, larger gradient of the flow speed of the molten steel more likely peels the mold powder to induce inclusion of the mold powder into the molten steel. The gradient of the flow speed is detected as the gradient of the temperature of mold copper plate. Thus, as shown in FIG. 39(*b*), there is another variable to express the magnitude of gradient of flow speed. That is, centering the immersion nozzle to divide in the right half and the left half in the mold width, the larger one of the two is selected: one variable is the difference between the maximum value ($T_{L1}$) and the minimum value ($T_{L2}$) of the temperature distribution in the left half width, or ($T_{L1}-T_{L2}$), and the other variable is the difference between the maximum value ($T_{R1}$) and the minimum value ($T_{R2}$) of the temperature distribution in the right half width, or ($T_{R1}-T_{R2}$), or the "maximum high and low temperature difference". Consequently, the inclusion of the mold powder caused from the Ar bubbles can also be predicted by the magnitude of the maximum high and low temperature difference.

In the case of the Pattern 2 of the state of molten steel flow, when the dispersion of the flow speed of molten steel on the meniscus at right half and left half in the mold width is significant, vortexes likely appear at the point of colliding the flows to each other, and mold powder may be included into the molten steel. In this respect, as shown in FIG. 39(*c*), the absolute value of the difference between the maximum value ($T_{L1}$) of the temperature distribution at left half in the mold width and the maximum value ($T_{R1}$) of the temperature distribution at right half therein, (hereinafter referred to as the "maximum right and left temperature difference"), can be treated as a variable expressing the deflected flow that gives influence on the inclusion of mold powder caused from vortexes. Therefore, the inclusion of the mold powder can be predicted by the magnitude of the maximum right and left temperature difference.

In the case that the state of flow of molten steel in the mold varies, for example, from Pattern 1 to Pattern 2, or in the case that, even in the Pattern 2, the injection flow speed becomes higher on one side than that on the other side, the molten steel flow in the mold is disturbed, and the variations in meniscus also increase, thus the probability of occurrence of the inclusion of mold powder increases. Normally, the variations in flow observed in the mold show a mild progress with several tens of seconds of the cycle. If, however, the variations proceeds shorter than the cycle time, the frequency of occurrence of inclusion of the mold powder increases. The variations of the molten steel flow are detected as the variations in temperature of the mold copper plate per unit time. Accordingly, the presence and absence of the inclusion of mold powder are predicted by grasping the maximum value of the temperature variations of the temperatures of mold copper plate per unit time in the mold width direction, and by determining the magnitude of the maximum value.

The position of temperature measurement on the mold copper plate is necessary to place in a range of from 10 to 135 mm distant from the meniscus in the mold in the slab-drawing direction. In a range of less than 10 mm from the meniscus, the temperature of mold copper plate increase or decrease depending on the variations of the meniscus position during casting, so that accurate grasping the variations of temperature of the mold copper plate caused from the molten steel flow cannot be attained. At positions below the 135 mm from the meniscus, the variations of temperature of the mold copper plate caused from the variations of molten steel flow become less, which fails to accurately grasp the variations of temperature of the mold copper plate.

In this manner, by analyzing the distribution of the temperature on mold copper plate in the width direction thereof, the immediate judgment can be done at on-line basis in terms of the degree of slab-surface defects such as inclusion of mold powder, skimming, blow defects, and slag inclusion.

FIG. 38 relates to the Pattern 1, showing schematic drawings of the temperature distribution on the mold copper plate in the width direction thereof, the maximum value, the minimum value, and the average value of the temperatures of mold copper plate. FIG. 39 relates to the Pattern 2, showing schematic drawings of the temperature distribution on the mold copper plate in the width direction thereof, the maximum value and the average value of the temperatures of mold copper plate. Since the measured values of the temperatures in the vicinity of the copper plate on shorter side of the mold decrease under the influence of the copper plate on shorter side of the mold, the present invention gives the analysis on the temperature distribution on the mold copper plate in the width direction thereof excluding the measured values in a range that the influence of the copper plate on shorter side of the mold appears.

Figure 40:
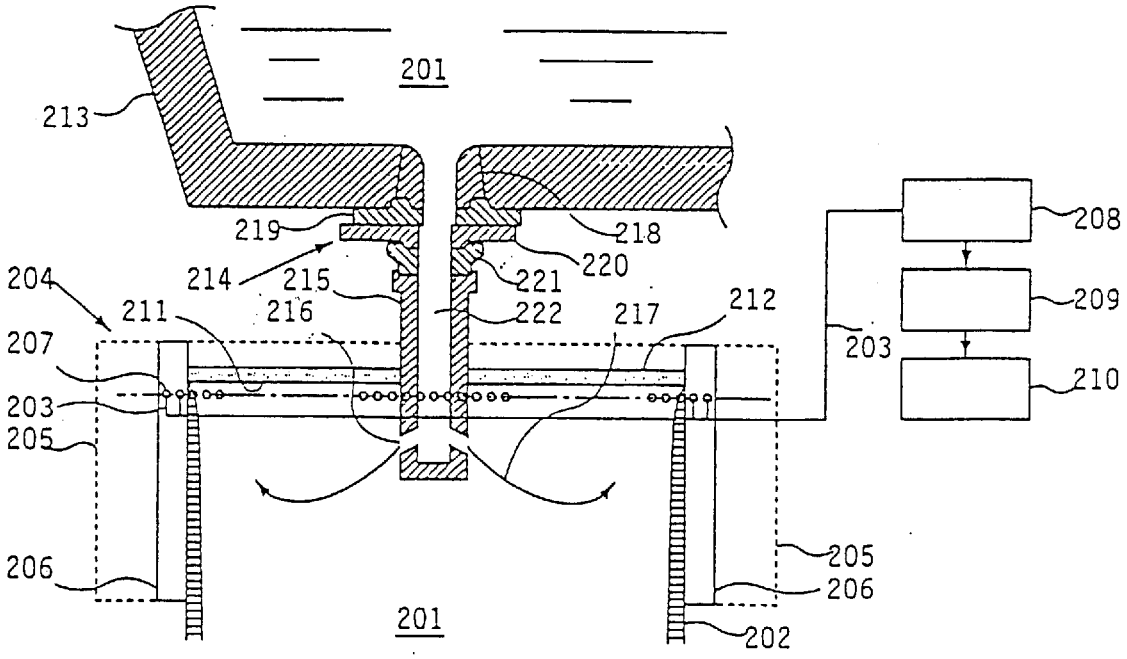
FIG. 40 is a schematic drawing of cross sectional front view of the casting section of the continuous casting machine of the Embodiment 3.

The present invention is described referring to the drawings. FIG. 40 is a schematic drawing of cross sectional front view of the casting section of a continuous casting machine, showing a mode to carry out the present invention.

In FIG. 40, a tundish 213 is located above a mold 204 which comprises a pair of copper plates 205 on longer side of the mold and a pair of copper plates 206 on shorter side of the mold, which pair of copper plates 206 on shorter side of the mold are inserted between the pair of copper plates 205 on longer side of the mold, and each of the longer sides and each of the shorter sides faces to each other, respectively. At the bottom of the tundish 213, an upper nozzle 218 is located. A sliding nozzle 214 comprising a fixing plate 219, a sliding plate 220, and a streaming nozzle 221 is located to connect with the upper nozzle 218. Furthermore, an immersion nozzle 215 is located on the bottom face of the sliding nozzle 214, thus forming a tapping hole 222 for the molten steel from the tundish 213 to the mold 204.

The molten steel 201 which was poured from a ladle (not shown) to the tundish 213 is injected into the mold 204 as an injected flow 217 toward the copper plate 206 on shorter side of the mold through an injection hole 216 that is located at lower portion of the immersion nozzle 215 and that is immersed in the molten steel 201 in the mold 204, via the tapping hole 217 of the molten steel. The molten steel 201 is cooled in the mold 204 to form a solidified shell 202, which is then drawn downward from the mold 204 to become an slab. At that moment, a mold powder 212 is added to the surface of the meniscus 211 in the mold 204.

The upper nozzle 218 is made of a porous brick. To prevent adhesion of alumina onto the wall surface of the tapping hole 222 of the molten steel, Ar gas is introduced to the tapping hole 222 of the molten steel through the upper nozzle 218 via an Ar gas conduit (not shown). The introduced Ar gas enters the mold 204 along with the molten steel 201 via the immersion nozzle 215 and the injection hole 216, passes through the molten steel 201 in the mold 204 to ascend to a meniscus 211, then penetrates a mold powder 212 added onto the meniscus 211 to diffuse in atmosphere.

On the rear face of the copper plate 205 on longer side of the mold, plurality of holes are drilled along a line in the width direction of the copper plate 205 on longer side of the mold orthogonally to the direction of slab-drawing in a range of from 10 to 135 mm distant from the meniscus in the slab-drawing direction. These holes act as the measurement points 207 to measure the temperatures of copper plate 205 on longer side of the mold. A temperature measurement element 203 is inserted into each of the measurement points 207 contacting the bottom of the hole on the copper plate 205. With the configuration, the temperatures of copper plate corresponding to the whole width of the slab can be measured. Preferably the temperature measurement points 207 are arranged at 200 mm or less of intervals. If the distance between the measurement points 207 exceeds 200 mm, the number of the measurement points 207 becomes less to fail in precise detection of the temperature distribution on the mold copper plate in the width direction thereof.

The other end of the temperature measurement element 203 is connected to a zero-point compensator 208. The electromotive force signals generated from the temperature measurement element 203 enter a converter 209 via the zero-point compensator 208, where the electromotive force signals are converted to current signals, which current signals then enter into a data analyzer 210. To avoid direct cooling of the tip of the temperature measurement element 203, which tip is the contact for temperature measurement, by the cooling water (not shown) flowing in the mold 204, the temperature measurement point 207 is isolated from the cooling water by a sealing material. Any type of temperature measurement element 203 may be applied, such as thermocouple and resistance thermometer, if only it has ±1° C. or higher accuracy.

From the measured temperature distribution on the copper plate on longer side of the mold in width direction thereof, the data analyzer 210 determines the maximum value ($T_{max}$), the minimum value ($T_{min}$), the average temperature ($T_{ave}$) of copper plate, the maximum high and low temperature difference, the maximum right and left temperature difference, and the maximum value of temperature variations per unit time. Responding to the quality grades, the data analyzer 210 compares these determined values with respective threshold values to judge the degree of defect occurrence, thus determines the method for the slab correction. Regarding the typical values of each of the maximum value ($T_{mx}$) the minimum value ($T_{min}$), the average temperature ($T_{ave}$) of copper plate, the maximum high and low temperature difference, and the maximum right and left temperature difference, the typical values of the slab in each of these maximum value ($T_{max}$), minimum value ($T_{min}$), average temperature ($T_{ave}$) of copper plate, maximum high and low temperature difference, and maximum right half width and left half width temperature difference may be the largest value (for the case of the maximum value ($T_{max}$), the maximum high and low temperature difference, and the maximum right half width and left half width temperature difference), or may be the smallest value (for the case of the minimum value ($T_{min}$) and the average temperature ($T_{ave}$) of the copper plate), or the average value of the measured values in the slab. In view of surely detection of the surface defects of the slab, however, it is preferable to give judgment based on the largest value or the smallest value. As for the temperature variations per unit time, either one of the following may be applicable: the one is to calculate the temperature variations during a unit time ranging from 5 to 20 seconds, and to determine the maximum value of the temperature variations in the mold width direction, thus to average the maximum values of individual time intervals on the slab as the representative value of the slab; and the other is to select the largest value among the maximum values of individual time intervals on the slab as the representative value.

In actual operation, since the molten steel flow pattern in the mold 204 often varies with time, or often becomes a combination of three fundamental patterns 0, 1, and 2, the judgment of surface defects on the slab is preferably conducted under a combination of two or more of these patterns.

In this manner, since the present invention gives quality judgment on the surface of slab based on the measured temperatures of the mold copper plate over the whole width of the mold, accurate judgment of the surface defects can be given at on-line basis even with any type of flow pattern of the molten steel in the mold 204.

The above-described mode of the present invention used linear arrangement of the temperature measurement elements 203 on the copper plate 205 on longer side of the mold in width direction thereof. The temperature measurement elements 203 can be arranged in plural rows in the casting direction. The above-described mode of the present invention located the temperature measurement elements 203 only on one side of the copper plate 205 on longer side of the mold. They can be arranged on both copper plates 205 on longer side of the mold. The method for injecting the Ar gas is not limited to that described above, and the Ar gas may be injected from the sliding nozzle 214 and the immersion nozzle 215.

EXAMPLE 1

The continuous slab casting machine shown in FIG. 40 was used to cast slabs of carbon steel having 250 mm in thickness and 1,600 to 1,800 mm in width. The slab drawing speed was 1.2 to 1.8 m/min, the injection rate of Ar gas into the tapping hole of the molten steel was 10 Nl/min, and the immersion nozzle was a two-hole Λ-shape nozzle, with the injection angle of downward 25 degrees. Thermocouples were used as the temperature measurement elements, which were arranged at 65 mm of intervals symmetrically in right and left sides to the immersion nozzle at a depth of 50 mm from the meniscus.

Figure 41:
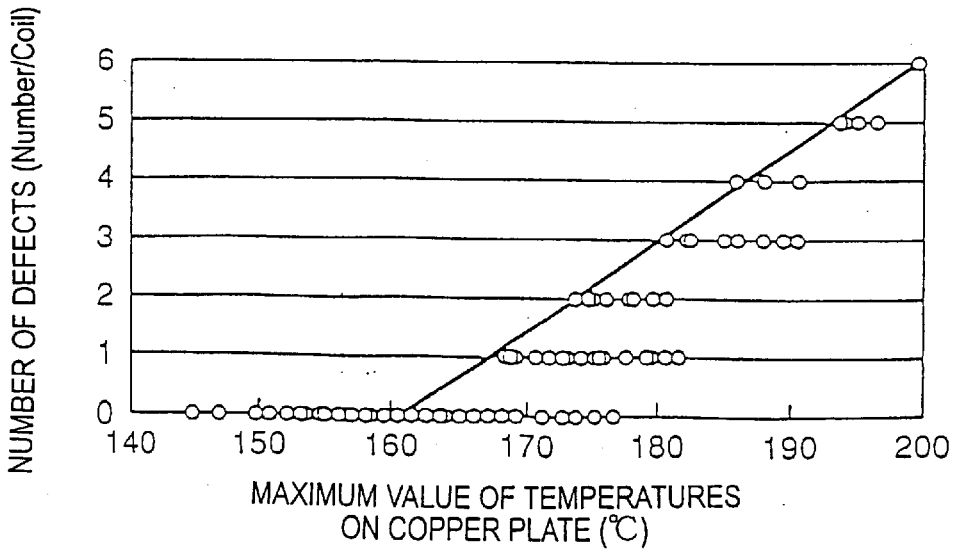
FIG. 41 shows a result of investigation in Example 1 of the Embodiment 3, giving the relation between the maximum value ($T_{max}$) of temperatures of mold copper plate and the generation of surface defects on a cold-rolled coil.

The cast slab was cold-rolled to form a coil, and the cold-rolled coil was visually inspected for checking the presence/absence of surface defects. FIG. 41 shows the result. The horizontal axis indicates the maximum value ($T_{max}$) of the temperatures of mold copper plate. And the vertical axis indicates the number of surface defects per single cold-rolled coil. In that case, the maximum value ($T_{max}$) of the temperatures of the mold copper plate is expressed by the representative value, which was determined by, based on the temperature distribution in width direction measured at 10 seconds of intervals on the slab corresponding to each coil, deriving the maximum value ($T_{max}$) at each measurement time, then by averaging these maximum values ($T_{max}$). As seen in FIG. 41, the plot gives a straight line increasing to right side.

In this manner, the magnitude of the surface defects on the cold-rolled coil can be predicted from the maximum value ($T_{max}$) in the temperature distribution in the mold width direction. And, by setting a threshold value depending on each use and grade of the cold-rolled coil, the judgment of need or not need of correction can be obtained. For the case of FIG. 41, the threshold value was set to 160° C. If the maximum value ($T_{max}$) is less than 160° C., the correction is not necessary, and if the maximum value ($T_{max}$) is not less than 160° C., the correction is necessary. The surface defects may not occur even at high maximum value ($T_{max}$) in some cases. That case should be no inclusion of mold powder on the probability basis.

EXAMPLE 2

The continuous slab casting machine shown in FIG. 40 was used to cast slabs of carbon steel having 250 mm in thickness and 2,000 mm in width. The slab drawing speed was 1.2 m/min, the injection rate of Ar gas into the tapping hole of the molten steel was 10 Nl/min, and the immersion nozzle was a two-hole Λ-shape nozzle, with the injection angle of downward 25 degrees. Thermocouples were used as the temperature measurement elements, which were arranged at 65 mm of intervals symmetrically in right and left sides to the immersion nozzle at a depth of 50 mm from the meniscus. Under the manufacturing condition, the pattern of the temperatures of mold copper plate became very close to the Pattern 1, though the pattern fluctuated with time.

Figure 42:
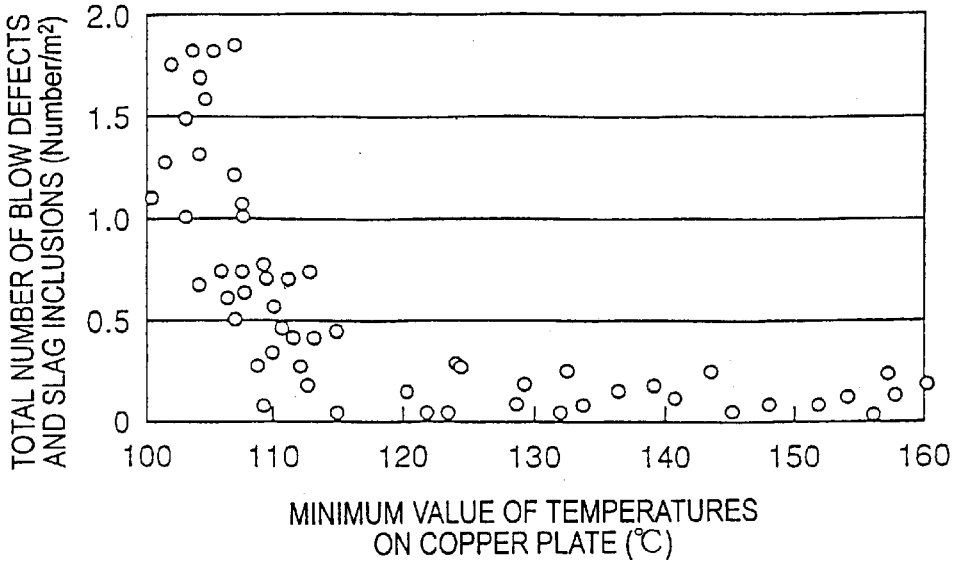
FIG. 42 shows a result of investigation in Example 2 of the Embodiment 3, giving the relation between the minimum value ($T_{min}$) of temperatures of mold copper plate and the generation of blow defects and slag inclusion defects on the surface of slab.

The surface of the cast slab was visually inspected using the color check method to check the presence and absence of blow defects and slag inclusion. FIG. 42 shows the result. The horizontal axis designates the minimum value ($T_{min}$) of the temperatures of mold copper plate, and the vertical axis designates the total number of blow defects and slag inclusions per unit area of the slab surface. In that case, the minimum value ($T_{min}$) of the temperatures of the mold copper plate on the horizontal axis is expressed by the representative value, which was determined by, based on the temperature distribution in width direction measured at 10 seconds of intervals on the slab corresponding to each coil, deriving the minimum value ($T_{min}$) at each measurement time, then by averaging these minimum values ($T_{min}$). As seen in FIG. 41, the plot gives a straight line increasing to right side.

As shown in FIG. 42, decreased minimum value ($T_{min}$) of the temperature increased the number of blow defects and slag inclusions.

In this manner, the degree of surface defects on the slab surface can be predicted from the minimum value ($T_{min}$) of the temperature distribution in the mold width direction. And, the judgment of need or not need of correction can be given by setting a threshold value depending on each use and grade of the cold-rolled coil. For the case of FIG. 42, the threshold value was set to 120° C. If the minimum value ($T_{min}$) is not more than 120° C., the correction is necessary. And if the minimum value ($T_{min}$) is more than 120° C., the correction is not necessary.

EXAMPLE 3

The continuous slab casting machine shown in FIG. 40 was used to cast slabs of carbon steel having 250 mm in thickness and 1,600 to 1,800 mm in width. The slab drawing speed was 1.6 to 1.8 m/min, the injection rate of Ar gas into the tapping hole of the molten steel was 10 Nl/min, and the immersion nozzle was a two-hole Λ-shape nozzle, with the injection angle of downward 25 degrees. Thermocouples were used as the temperature measurement elements, which were arranged at 65 mm of intervals symmetrically in right and left sides to the immersion nozzle at a depth of 50 mm from the meniscus. Under the manufacturing condition, the pattern of the temperatures of mold copper plate became very close to the Pattern 2, though the pattern fluctuated with time.

Figure 43:
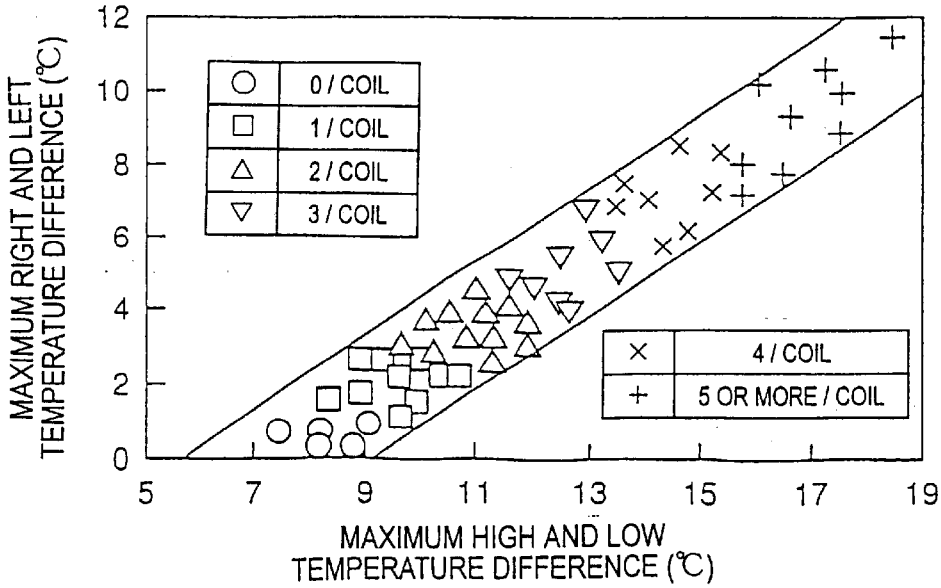
FIG. 43 shows a result of investigation in Example 3 of the Embodiment 3, giving the relation between the temperature difference between the maximum and the minimum values, the maximum right half width and left half width temperature difference, and the generation of surface defects on a cold-rolled coil.

The cast slab was cold-rolled to form a cold-rolled coil. The surface of the cast slab was visually inspected using the color check method to check the presence and absence of blow defects and slag inclusion. FIG. 43 shows the result. The horizontal axis designates the maximum high and low temperature difference, and the vertical axis designates the maximum right half width and left half width temperature difference. The graph gives the relation of these temperature differences for each number of defects appeared on the surface. In that case, each of the maximum high and low temperature difference on the horizontal axis and the maximum right half width and left half width temperature difference on the vertical axis is expressed by respective representative values, which representative value was determined by, based on the temperature distribution in width direction measured at 10 seconds of intervals on the slab corresponding to each coil, deriving the maximum high and low temperature difference on the horizontal axis and the maximum right half width and left half width temperature difference at each measurement time, then by averaging these derived values. As seen in FIG. 43, the plot gives a straight line increasing to right side, which suggests that the number of defects in the cold-rolled coil increases toward the upper right portion of the graph.

In this manner, the degree of surface defects on the slab surface can be predicted from the maximum high and low temperature difference on the horizontal axis and the maximum right half width and left half width temperature difference in the mold width direction. And, the judgment of need or not need of correction can be given by setting a threshold value depending on each use and grade of the cold-rolled coil. For the case of FIG. 43, the threshold value for the maximum high and low temperature difference was set to 10° C., and the maximum right half width and left half width temperature difference was set to 2° C. as the boundary of need and not need of correction.

EXAMPLE 4

The continuous slab casting machine shown in FIG. 40 was used to cast slabs of carbon steel having 250 mm in thickness and 1,800 to 2,100 mm in width. The slab drawing speed was 1.0 to 1.6 m/min, the injection rate of Ar gas into the tapping hole of the molten steel was 10 Nl/min, and the immersion nozzle was a two-hole Λ-shape nozzle, with the injection angle of downward 25 degrees. Thermocouples were used as the temperature measurement elements, which were arranged at 65 mm of intervals symmetrically in right and left sides to the immersion nozzle at a depth of 50 mm from the meniscus. Under the manufacturing condition, the pattern of the temperatures of mold copper plate became very close to the Pattern 1, though the pattern fluctuated with time.

Figure 44:
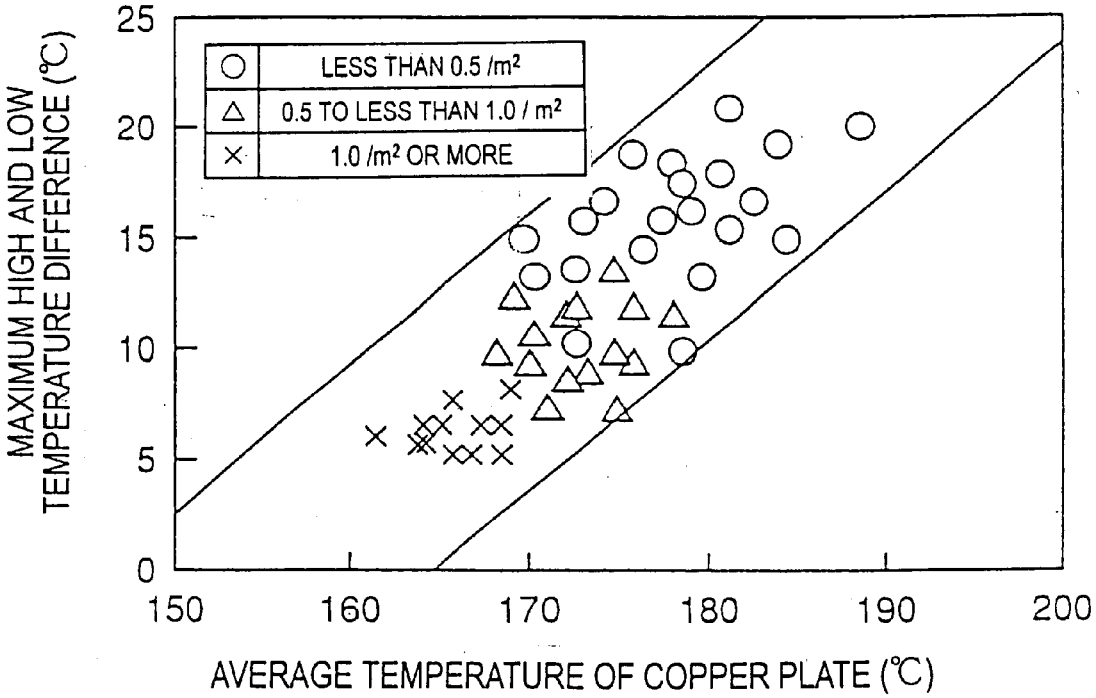
FIG. 44 shows a result of investigation in Example 4 of the Embodiment 3, giving the relation between the average temperature ($T_{ave}$) of copper plate, the temperature difference between the maximum and the minimum values, and the generation of blow defects and slag inclusion defects on the surface of slab.

The surface of the cast slab was visually inspected using the color check method to check the presence and absence of blow defects and slag inclusion. FIG. 44 shows the result. The horizontal axis designates the average temperature ($T_{ave}$)of mold copper plate, and the vertical axis designates the maximum high and low temperature difference to express the relation of these variables for each level of total number of the blow defects and slag inclusions on the slab per unit area. In that case, the average temperature ($T_{ave}$) of copper plate on the horizontal axis and the maximum high and low temperature difference on the vertical axis are expressed by the representative value, which was determined by, based on the temperature distribution in width direction measured at 10 seconds of intervals on the slab corresponding to each slab, deriving the average temperature ($T_{ave}$) of copper plate and the maximum high and low temperature difference at each measurement time, then by averaging these values. As seen in FIG. 44, the plot gives a straight line increasing in the number of blow defects and slag inclusions to lower left side.

In this manner, the degree of surface defects on the slab can be predicted from the average temperature ($T_{ave}$) of copper plate and the maximum high and low temperature difference. And, the judgment of need or not need of correction can be given by setting a threshold value depending on each use and grade of the cold-rolled coil. For the case of FIG. 44, the threshold value for the average temperature ($T_{ave}$) of copper plate was set to 180° C., and the maximum high and low temperature difference was set to 15° C. as the boundary of need and not need of correction.

EXAMPLE 5

The continuous slab casting machine shown in FIG. 40 was used to produce 5 heat of sequence cast slabs of carbon steel having 250 mm in thickness and 1,6800 mm in width.

The slab drawing speed was 1.8 m/min, the injection rate of Ar gas into the tapping hole of the molten steel was 10 Nl/min, and the immersion nozzle was a two-hole Λ-shape nozzle, with the injection angle of downward 25 degrees. Thermocouples were used as the temperature measurement elements, which were arranged at 65 mm of intervals symmetrically in right and left sides to the immersion nozzle at a depth of 50 mm from the meniscus. The number of applied thermocouples was 25.

Figure 45:
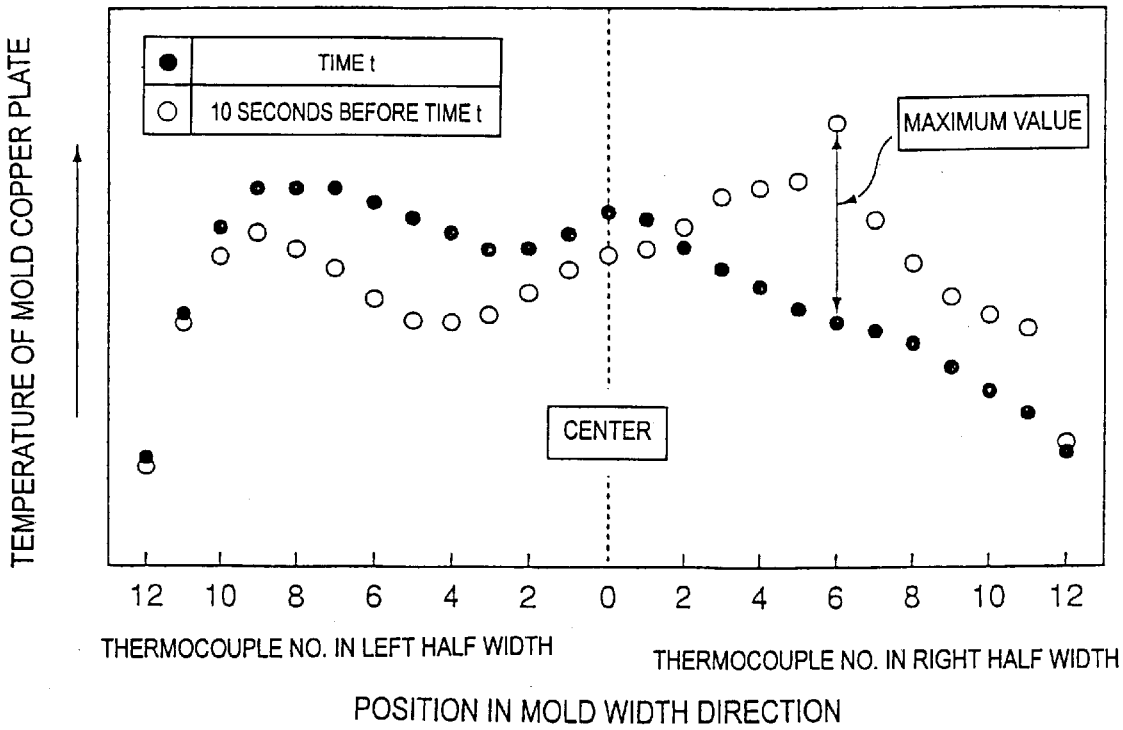
FIG. 45 shows an example of measured temperatures of mold copper plate in Example 5 of the Embodiment 4.

First, the flow speed of molten steel at meniscus was measured using the method to measure the flow speed of molten steel by immersing the immersion rods in the meniscus and by determining the force applied to the immersion rods, thus investigated the long cycle variations of flow of the molten steel in the mold. The long cycle variations were found to occur at about 30 seconds of cycle. Consequently, the unit time was set to 10 seconds, and the variations of temperature of the mold copper plate were measured. FIG. 45 shows an example of measured values of temperature of the mold copper plate at time t, and at 10 seconds before the time t. In FIG. 45, the symbol ● designates the temperature at time t, and the symbol ○ designates the temperature at 10 seconds before the time t.

As seen in FIG. 45, during the period, the temperature of the mold copper plate increased during the 10 seconds at left side to the immersion nozzle in the mold width direction, and the temperature of the mold copper plate decreases at right side thereto. In that case, the maximum value of the temperature variations per unit time becomes the measured value at No. 6 thermocouple at right half width of the mold. The temperature difference was divided by the unit time, 10 seconds, to define as the maximum value of the temperature variations per the unit time.

Figure 46:
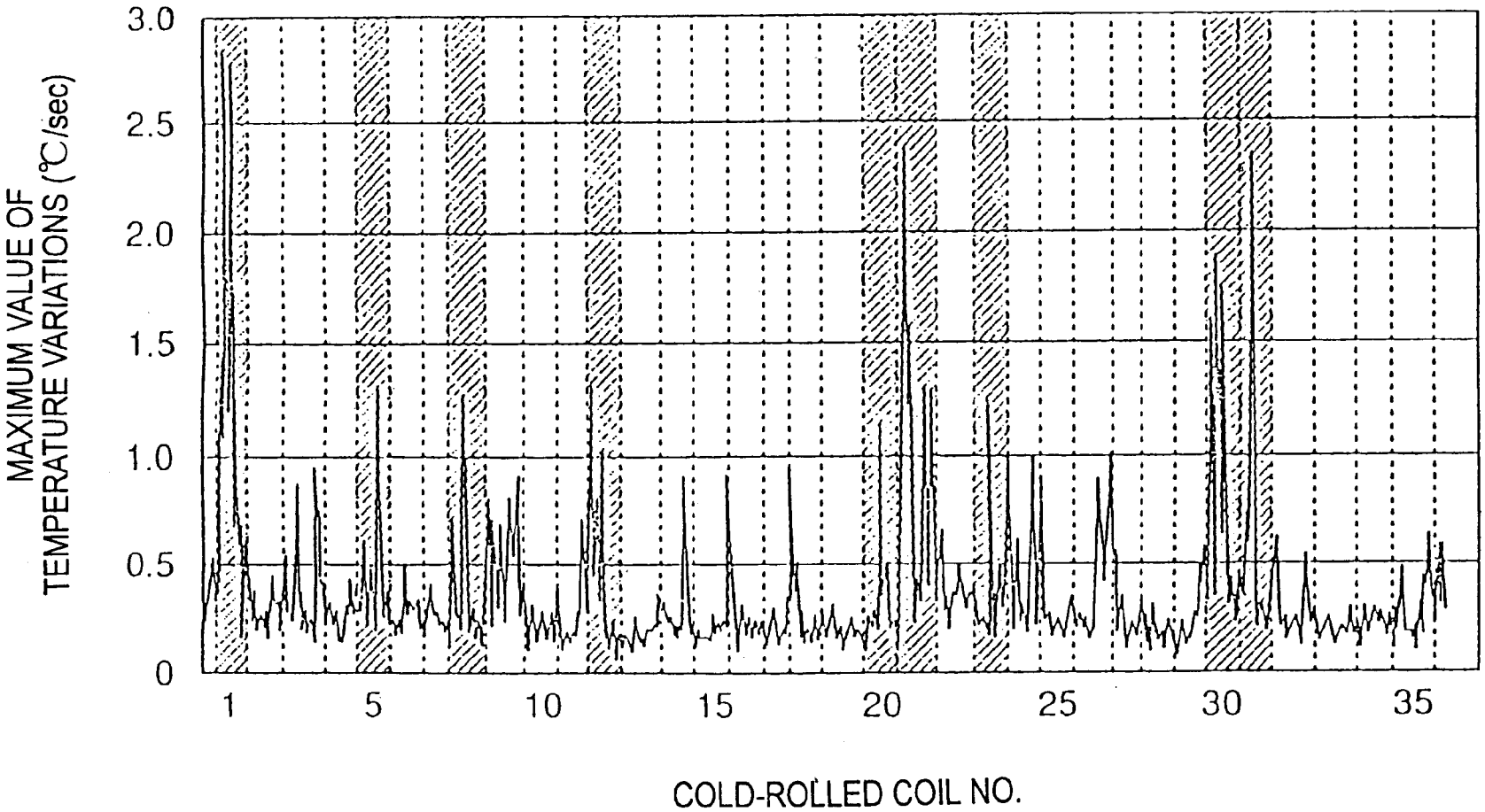
FIG. 46 shows a result of investigation in Example 5 of the Embodiment 3, showing the variations of the maximum value in the variations in temperatures with time for a cold-rolled coil.

Thus cast slab was cold-rolled to a cold-rolled coil. The surface defects of the cold-rolled coil were visually inspected. In FIG. 46, the vertical axis is the maximum value of temperature variations measured at 10 seconds of intervals on an slab corresponding to each coil, and the horizontal axis is the sequential number of cold-rolled coils corresponding to respective slabs in casting sequential order. FIG. 46 does not show the coils corresponding to the bottom slab and to the top slab, and the casting direction is from smaller coil number to larger, coil number.

In FIG. 46, surface defects were found on the shaded coils, Nos. 1, 5, 8, 12, 20, 21, 23, 30, and 31. In these coils, the maximum value of temperature variations exceeded 1.0° C./sec at some position in the slab. Three surface defects were found per coil in each of Nos. 1, 21, 30, and 31 coils, which coils gave the maximum value of temperature variations larger than 1.5° C./sec, to cause the degradation of yield.

In this manner, the judgment of need or not need of correction can be given by setting a threshold value depending on each use and grade of the cold-rolled coil. For the case of FIG. 46, the threshold value was set to 1.0° C./sec. If the maximum value of the temperature variations is not more than 1.0° C./sec, the correction is not necessary, and if the maximum exceeds 1.0° C./sec, the correction is necessary.

EXAMPLE 6

The continuous slab casting machine shown in FIG. 40 was used to produce slabs of carbon steel having 250 mm in thickness and 1,250 to 1,900 mm in width applying a mold powder which had composition of 33.6 wt. % CaO, 39.1 wt. % $SiO_2$, 5.0 wt. % $Al_2O_3$, 3.4 wt. % $Na_2O$, 7.6 wt. % F, and 6.9 wt. % MgO, having 0.35 Pa.s of viscosity at 1,300° C. The slab-drawing speed was 0.78 to 1.82 m/min, the injection rate of Ar gas into the tapping hole of the molten steel was 10 Nl/min, and the immersion nozzle was a two-hole Λ-shape nozzle, with the injection angle of downward 25 degrees. Thermocouples were used as the temperature measurement elements, which were arranged at 65 mm of intervals symmetrically in right and left sides to the immersion nozzle at a depth of 50 mm from the meniscus.

Figure 47:
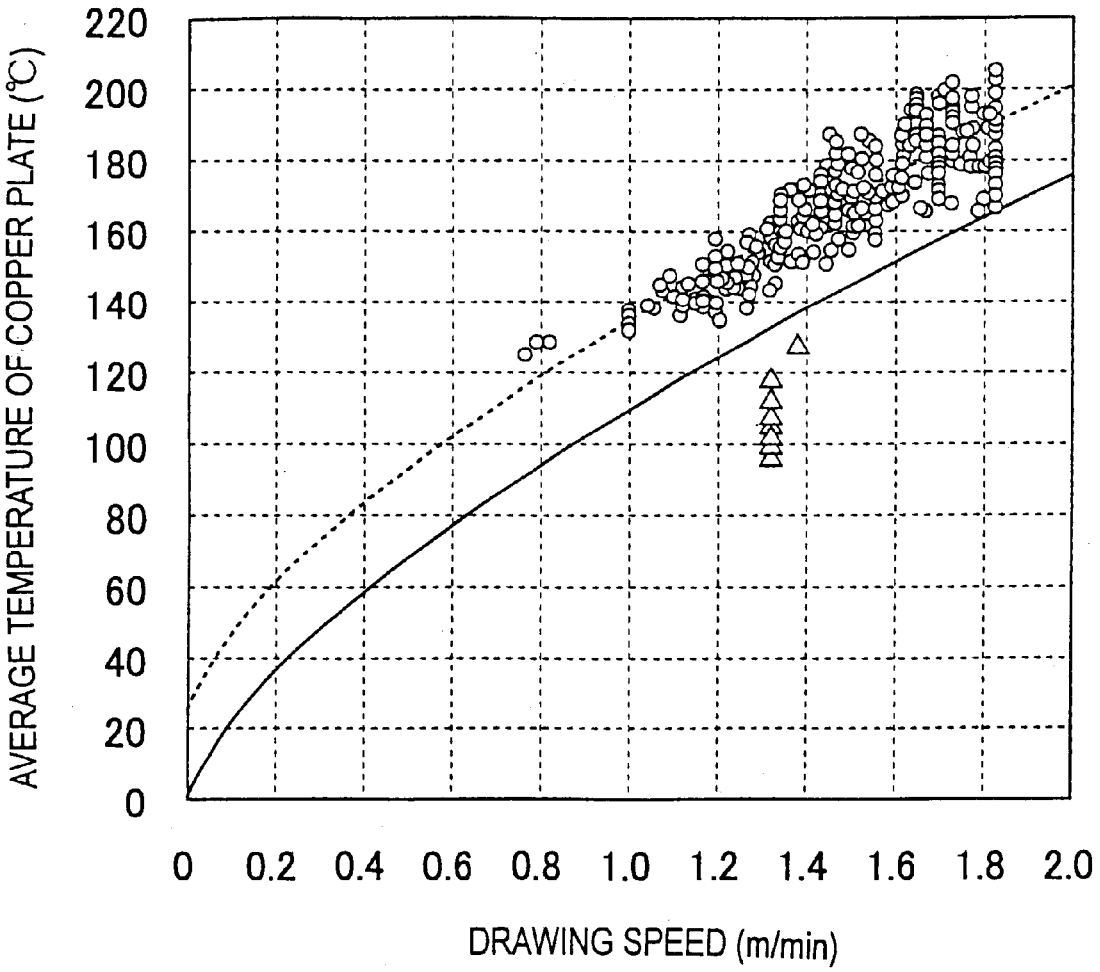
FIG. 47 shows a result of investigation in Example 6 of the Embodiment 3, giving the relation between the slab-drawing speed and the average temperature ($T_{ave}$) of copper plate in relation to the rate of generation of surface defects on a cold-rolled coil.

The cast slab was cold-rolled to form a cold-rolled coil. Visual inspection was given to the cold-rolled coil to check the presence/absence of scab defect on surface, which should come from slag inclusion. The relation with average temperature ($T_{ave}$) of the mold copper plate was investigated. FIG. 47 shows the result, giving the relation between the slab-drawing speed and the average temperature ($T_{ave}$) of copper plate with respect to the rate of surface defect generation. The average temperature ($T_{ave}$) of copper plate on the vertical axis was derived from the temperature distribution in width direction of each slab measured at 10 seconds of intervals, by determining the average temperatures ($T_{ave}$) of copper plate at each measured time, and by averaging these average temperatures.

In FIG. 47, the symbol ○ designates the average temperature ($T_{ave}$) of copper plate of the mold corresponding to the coil on which no scab defect caused from slag inclusion was not observed. The broken line passes through each symbol ○ is a curve of the average temperature ($T_{ave}$) of the group ○ determined by the least square method, and the curve indicates the representative average temperature ($T_{ave}$) of copper plate in the mold width direction at the slab-drawing speed. All the symbol ○ points distributed in a range of ±25° C. to the curve. FIG. 47 gives a solid line that indicates the temperature curve that is shifted by 25° C. to the lower temperature side.

FIG. 47 also shows the average temperature ($T_{ave}$) of slab corresponding to the coil on which scab defects caused from slag inclusion by the symbol Δ. The symbol Δ points were found to lie below the representative average temperature ($T_{ave}$) of copper plate in the temperature distribution in the mold width direction by more than 25° C.

In this manner, the degree of surface defects on the slab can be predicted by monitoring the average temperature ($T_{ave}$) in the temperature distribution in mold width direction and by comparing thus monitored values with the representative average temperature ($T_{ave}$) of copper plate at the slab-drawing speed. And, by setting a threshold value depending on each use and grade of the cold-rolled coil, the judgment of need or not need of correction cab be obtained. For the case of FIG. 47, the threshold of the difference in the average temperature ($T_{ave}$) of copper plate was set to 25° C. as the boundary of need and not need of correction.

Embodiment 4

First, the description is given on the result of investigations for removing noise caused from the variations in air gap distance between the mold powder layer and the mold copper plate and from the variations in the thickness of mold powder, based on the measured temperatures of mold copper plate.

There are seven variables that give influence on the variations of temperatures of mold copper plate: slab-drawing speed, temperature of cooling water for the mold, thickness of mold copper plate, temperature of molten steel in the mold, flow speed of molten steel along the surface of solidified shell, air gap distance between the mold powder layer and the mold copper plate, and thickness of the mold powder. Among those seven variables, the influence of the slab-drawing speed stays at a certain level as far as concerning the mold width direction at an instantaneous time, so that the variable can be neglected. The temperature of cooling water and the thickness of mold copper plate do not significantly vary during the period of the casting, so that the influence of these variables is also negligible. The variations of temperature of molten steel in the mold during the casting are small so that the influence of the variable is also negligible. The influence of the thickness of mold powder and that of the air gap distance is significant, thus these variations should be removed on evaluating the flow speed of molten steel.

Actual temperatures of mold copper plate include the variations of flow speed profile, the variations of thickness of solidified shell, and the variations of thickness of mold powder. To avoid the influence of the variations of thickness of solidified shell and of the variations of thickness of mold powder, if the intervals of arranged temperature measurement elements in the mold width direction are increased to decrease the spatial resolution of the temperature distribution, the temperatures of mold copper plate significantly vary to induce large error in the estimated values of state of the molten steel flow at a place where the intervals of the temperature measurement elements coincide with the multiple of integer of the spatial variation wavelength of the variation of thickness of solidified shell and of thickness of mold powder layer.

To this point, the inventors of the present invention investigated the intervals of variations of thickness of mold powder layer and of air gap distance based on the variations of thickness of solidified shell of an slab using a testing apparatus for continuous casting and a commercial apparatus. It is known that the variations of thickness of solidified shell significantly give influence to the thickness of mold powder layer and the air gap distance. As a result, it has been found that the intervals of variations of the thickness of mold powder layer and of the air gap distance are several tens of millimeters.

Figure 48:
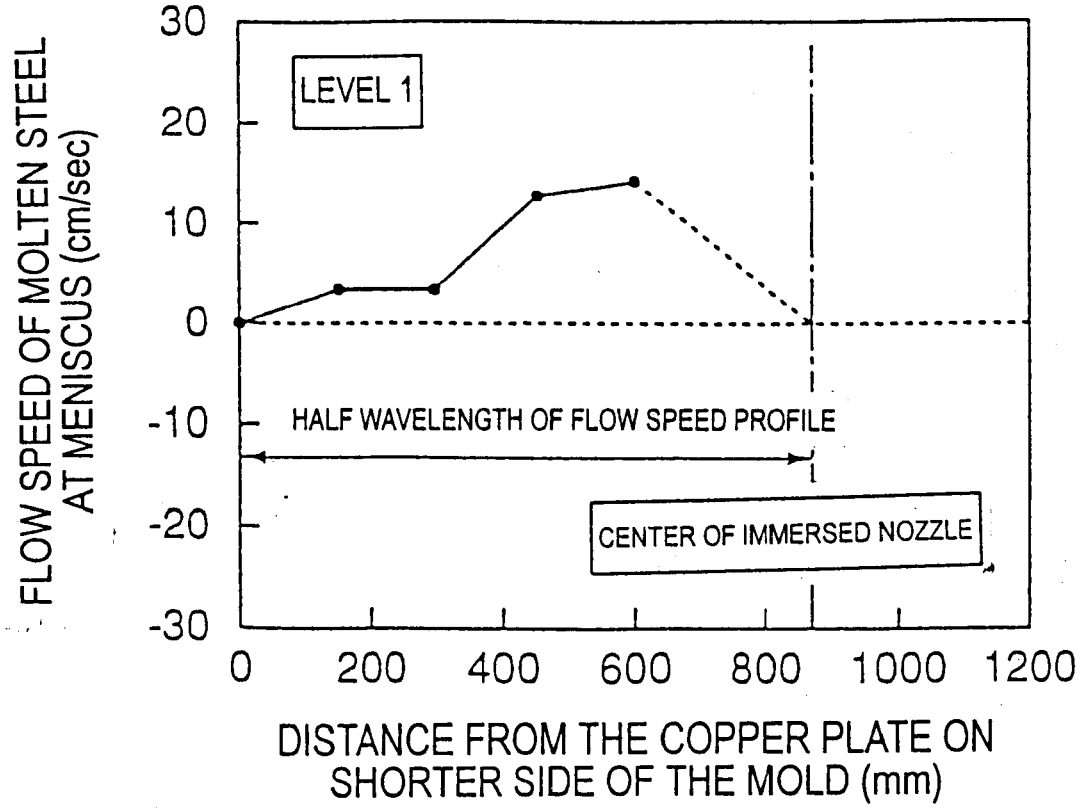
FIG. 48 shows a measured result of flow speed profile of molten steel under a casting condition of Level 1 of the Embodiment 4.
Figure 49:
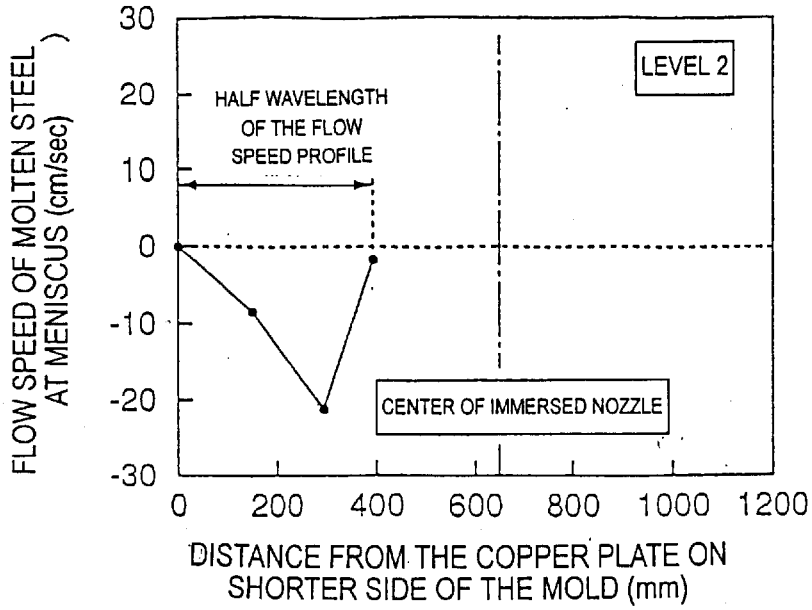
FIG. 49 shows a measured result of flow speed profile of molten steel under a casting condition of Level 2 of the Embodiment 4.
Figure 50:
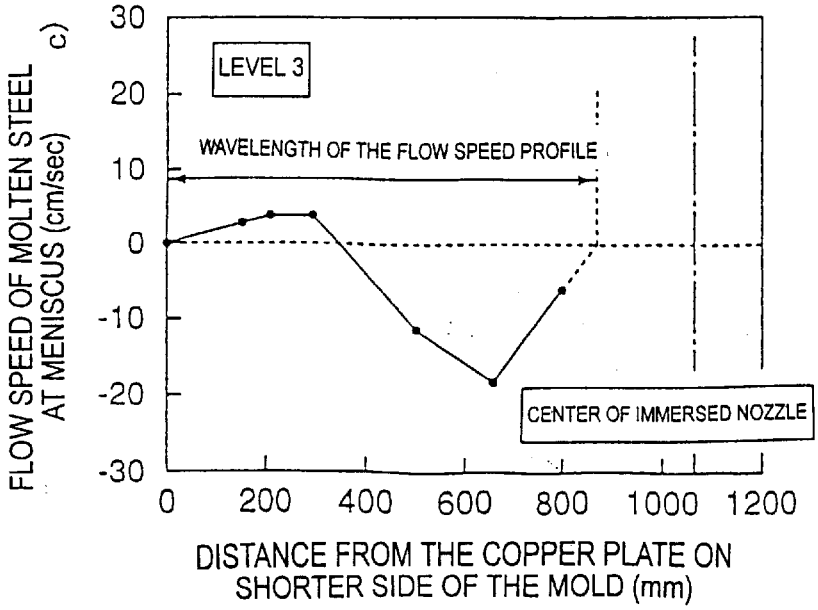
FIG. 50 shows a measured result of flow speed profile of molten steel under a casting condition of Level 3 of the Embodiment 4.

An end of the refractory rod was immersed in the meniscus. A flow meter for the molten steel was used to determine the flow speed of the molten steel by measuring the force of the molten steel flow applied onto a load cell. Thus, the profile of molten steel flow along the width direction of the mold in the vicinity of the meniscus was measured to determine the spatial variation wavelength of the flow speed profile of the molten steel in the mold. The measurement of the profile of molten steel flow was carried out at three levels of the combination of the slab-drawing speed and the slab width. Table 5 lists the casting condition for each of the three levels. FIGS. 48 through 50 show the results of determined profile of molten steel flow speed in the vicinity of the meniscus at each of the three levels. In these figures, the "positive" flow speed of the molten steel on the meniscus on the vertical axis designates the flow from the shorter side of the mold to the immersion nozzle, and the "negative" flow designates the inverse flow.

TABLE 5

| | Slab thickness (mm) | Slab width (mm) | Slab-drawing speed (m/min) | Ar gas injection rate (N1/min) |
|---|---|---|---|---|
| Level 1 | 220 | 1750 | 2.1 | 10 |
| Level 2 | 220 | 1300 | 1.6 | 10 |
| Level 3 | 220 | 2100 | 1.6 | 10 |

As seen in FIGS. 48 through 50, the wavelength of the profile of flow speed of molten steel in the vicinity of meniscus along the width direction of mold, or the wavelength of high and low level of flow speed of molten steel, is 1750 mm for the Level 1, 800 mm for the Level 2, and around 800 to 1,800 mm for the Level 3.

Thus, it was found that the intervals of spatial variations of the flow of molten steel are from 100 mm to several thousands of millimeters, and that the intervals of variations of thickness of mold powder layer and of air gap distance are several tens of millimeters. Accordingly, the variations of thickness of mold powder layer and the variations of air gap distance were removed utilizing the phenomenon that the intervals of spatial variations of molten steel flow are significantly larger than the intervals of variations of thickness of mold powder layer and of air gap distance.

That is, the measured temperature distribution of the mold copper plate includes a variation pitch of heat-removal at several tens of millimeters and a variation pitch ranging from several hundreds of millimeters to several thousands of millimeters caused from the molten steel flow. The temperature distribution after removing the variations of several tens of millimeters has only the variations of temperatures of mold copper plate caused from the molten steel flow. Consequently, at least the case that the fine variations of 100 mm or less caused from the thickness of mold powder layer and from the air gap distance are removed to evaluate the large variations over the whole mold, a low pass filter treatment is applied to remove the variation wavelengths of 100 mm or less, and, also for the maximum wavelength, to remove the variation wavelength of half or less of the mold width.

If the spatial frequency f of the molten steel flow is defined by $f=1/L$ ($mm^{-1}$), where L is the variation wavelength (mm), the necessary cutoff spatial frequency f to remove the variation wavelengths of 100 mm or less is less than 0.01. If the mold width is defined as W (mm), the cutoff spatial frequency fc to remove the variation wavelengths of ½ or less of the mold width W is more than 2/W.

In this manner, according to the present invention, the temperatures of the mold copper plate are measured by plurality of temperature measurement elements arranged in the orthogonal direction to the slab-drawing direction, and by applying low pass filter treatment in a range of the cutoff spatial frequency fc from larger than 2/W to smaller than 0.01. Thus, the noise caused from the thickness of mold powder and from the air gap distance can be eliminated. Since the state of molten steel flow in the mold is estimated on the basis of the temperature distribution in the mold after treated by the low pass filter, the variations on the temperatures of the mold copper plate caused from the variations of thickness of solidified shell and from the variations of thickness of mold powder layer can be eliminated to allow precise detection of the state of the flow of molten steel in the mold.

Since the width of the mold is finite, the influence of the drop of measured temperature at each end of the mold width during the low pass filter treatment cannot be neglected. Consequently, application of low pass filter treatment, using a data series which is extended by doubling back the data at each of both edges of the mold width is a highly effective method for using finite number of data, and the evaluation accuracy of the temperature distribution on the copper plate is improved. Particularly when the injected flow speed from the immersion nozzle is high, the ejected flow collides against the copper plate on shorter side of the mold to branch in upward flow and in downward flow. The upward flow turns the flow direction at the meniscus to the direction from the side of shorter side of the mold to the side of the immersion nozzle. As a result, high temperature is observed at the side of shorter side of the mold, as a feature of the temperature distribution of the copper plate. To accurately grasp the feature, it is necessary to effectively remove the temperature reduction at the edges of the mold width.

The spatial movement average is an example of the low pass filter treatment. This method is a simple one, and the method is preferably used as a means to eliminate the noise from the measured temperatures of the mold copper plate, which noise is caused from the variations of air gap distance between the mold powder layer and the mold copper plate and the variations of thickness of mold powder layer.

Regarding the spatial movement average, when the temperature measurement points of the mold copper plate are numbered in sequence from an end to the other end, i=1, 2, 3, . . . K (K is the temperature measurement point at the other end), the temperature Tn(ave) after averaging the spatial movement is defined by eq. (14) at the temperature Tn on i=N temperature measurement point.

$$T_n(ave) = (1/M) \times \sum_{m=-L}^{m=L} T_{n+m} \tag{14}$$

Where, L=(M−1)/3, and the averaged number M is an odd number.

An arbitrary continuous function can be expressed by, under the definition of Fourieris transformation, a sine wave set, or eq. (15).

$$\begin{aligned} u(L, h) &= (1/L) \times \int_{L}^{h+L} \sin 2\pi fh \cdot dh \\ &= (1/2\pi fL) \times [(2 - 2\cos 2\pi fL]^{1/2} \times \sin(2\pi fh + \Phi)] \end{aligned} \tag{15}$$

where, $\phi = \tan^{-1}[(1-\cos 2\pi fL)/\sin^2 \pi fL]$

Since the cutoff spatial frequency fc is a frequency giving the gain of $1/\sqrt{2}$, the cutoff spatial frequency fc can be expressed by eq. (16) using eq. (15).

$$(\tfrac{1}{2} fcL) \times [(2-2\cos 2\pi fcL)^{1/2} = 1/\sqrt{2} \tag{16}$$

From eq. (16), fc×L≈0.443.

If the number of averaging points is M, and the interval of adjacent temperature measurement elements is Δh, eq. (17) is derived.

$$fc \times L \approx 0.443 = fc \times M \times \Delta h \tag{17}$$

In the case that M is the minimum value of 3, to shut out the wave motions less than 100 mm of variation pitch, the interval Δh of adjacent temperature measurement elements needs to satisfy eq. (18) given below. In the case that M is the minimum value of 3, to shut out the wave motions less than half the mold width W, the interval Δh of adjacent temperature measurement elements needs to satisfy eq. (19) given below.

$$\Delta h = 0.443/[(1/100 \times 3] = 44.3/3 \tag{18}$$

$$\Delta h = 0.443/[(2/W) \times 3] = 0.443W/6 \tag{19}$$

Therefore, in normal operation, the target wave motion can be eliminated if the interval Δh (mm) of adjacent temperature measurement elements is in a range of eq. (20) given below.

$$44.3/3 < \Delta h < 0.443W/6 \tag{20}$$

The number of averages M is not necessarily 3, and the number can be selected in the following procedure. The attenuation R of the waves resembling sine waves caused from the average of spatial movement is expressed by eq. (21).

$$R = (\tfrac{1}{2}\pi f\tau) \times [2-2\cos(2\pi f\tau)]^{1/2}] \tag{21}$$

where, π is the ratio of the circumference of a circle to its diameter; f is the spatial frequency of wave resembling sine wave, τ=M/f s; and fs is the spatial frequency between the buried temperature measurement elements in the mold width direction, which is expressed by dividing the reference mold with by the interval of temperature measurement elements.

The number of averages M is changed, and the attenuation M of each frequency f of the wave resembling sine wave is calculated by eq. (21), thus selecting the number of averages M with which the attenuation R of the frequency band of the profile of molten steel flow to be measured is minimized, and the frequency band of variations of the temperatures of mold copper plate caused from the variations of thickness of solidified shell and the variations of thickness of mold powder layer, which frequency band is to be eliminated, are fully attenuated. In this manner, the variations of the thickness of solidified shell and the variations of the thickness of mold powder layer, which are shorter wavelength than the wavelength of the profile of molten steel flow, can be eliminated by averaging the spatial movement using the averaged number M as the adequate value. The term "fully attenuate" means the state that the value after the attenuation becomes to about one tenth of the value before the attenuation, or the state that the attenuation M around −10 dB, where the attenuation M is expressed by dB unit.

As described above, the variations of temperatures of the mold copper plate during casting occurred from the variations of molten steel flow speed, from the variations of thickness of mold powder, and from the variations of thickness of air gap distance. The above-described low pass filter treatment is carried out to eliminate the noise caused from the thickness of mold powder layer and the air gap distance that affect the temperatures of the mold copper plate. Therefore, if the value after the low pass filter treatment is subtracted from the measured value of the temperature of the mold copper plate, the influence of the thickness of mold powder layer and of the air gap distance on the temperatures of the mold copper plate in the mold width direction can be determined.

During the continuous casting, when the variations of thickness of mold powder layer and the variations of air gap distance lead to the irregular heat removal in the mold in the mold width direction, the thickness of solidified shell becomes irregular in the mold width direction, and vertical cracks occur on the surface of slab to degrade the slab quality. Furthermore, if the thickness of solidified shell becomes extremely thin, the molten steel flows out at directly beneath the mold by the overridden static pressure of the molten steel, which is what is called the breakout.

As described above, the on-line grasping of the irregularity of the heat removal in the mold width direction is available if the value after the low pass filter treatment is subtracted from the measured temperature of the mold copper plate. By the feed back of thus grasped result to the casting conditions, the quality improvement of slab and the stability of casting operation are assured.

The following is the description about the investigation on optimization of data sampling intervals.

Generally, computer is applied to determine the temperature distribution on the mold copper plate and to estimate the state of flow of molten steel from thus determined temperature distribution on the mold copper plate based on the measured temperatures collected by plurality of temperature measurement elements arranged on rear face of the mold copper plate. The computer data processing, however, needs to use distributed data with time, not continued ones with time, in view of the system configuration of the computer.

To this point, the inventors of the present invention used a moving magnetic field type magnetic field generator located on rear face of the copper plate on longer side of the mold, applied to the continuous casting machine and the temperature measurement device for the mold copper plate, which are described below. With the magnetic field generator, the flow of molten steel in the mold was positively varied to investigate the approximate time for completing the variations of molten steel flow. And, an investigation was given to clarify the allowable dispersion time intervals for data collection using the temperature measurement elements arranged on the mold copper plate to detect the variations of the flow state of molten steel in the mold without fail.

Figure 51:
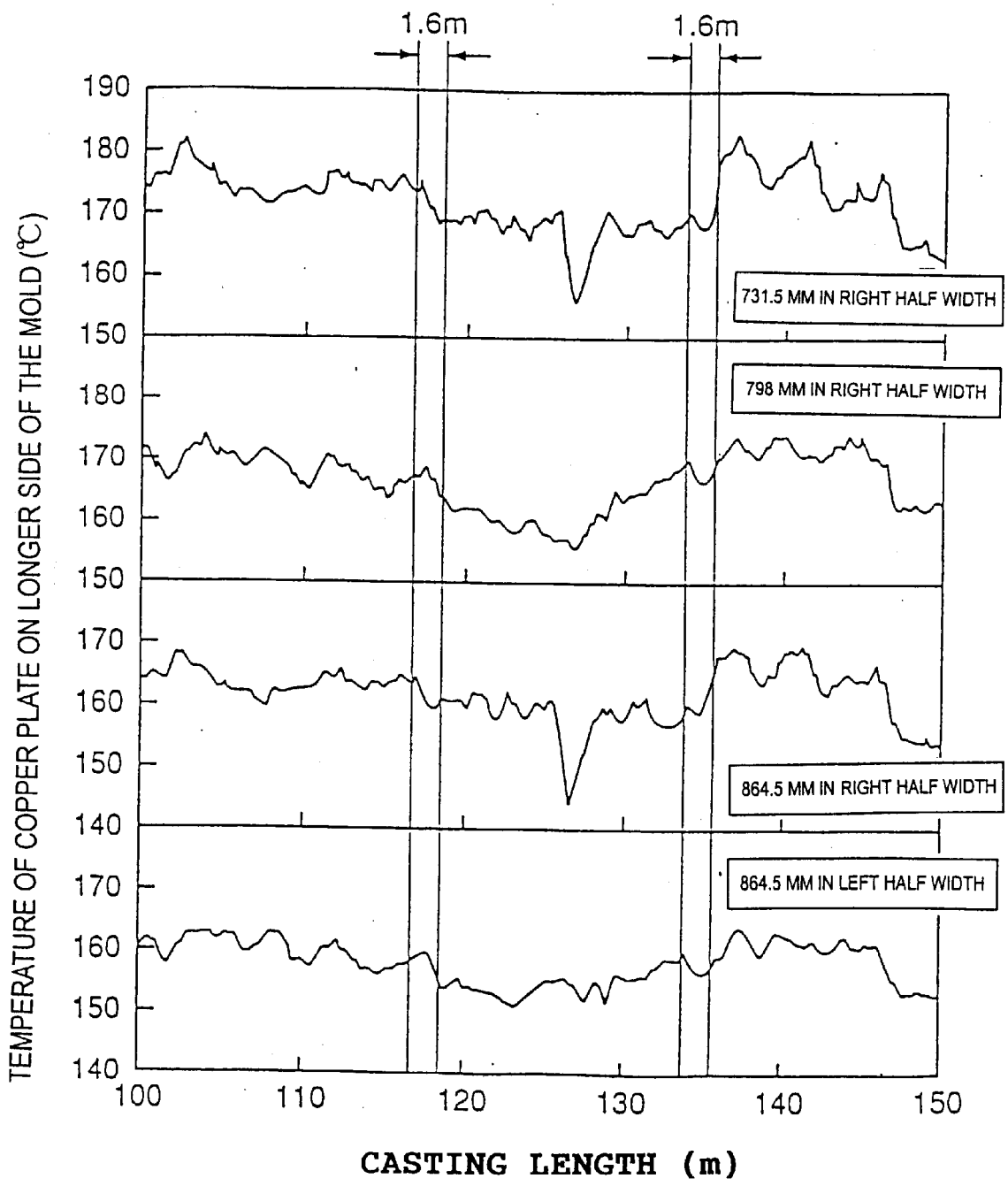
FIG. 51 shows the time sequential change of the temperatures of copper plate on longer side of the mold under variations of magnetic flux density of the magnetic field generator of the Embodiment 4.

The investigation was carried out under the casting condition given below. The slab thickness was 220 mm. The slab width was 1,875 mm. The slab-drawing speed was 1.6 m/min. The Ar gas injection rate into the immersion nozzle was 13 Nl/min. The magnetic flux density of the moving magnetic field type magnetic field generator was increased stepwise from 0.03 to 0.05 stela, then was decreased stepwise to 0.03 stela after a certain period. Through the period of changing magnetic flux density, the variations of temperatures of copper plate on longer side of the mold with time were observed. FIG. 51 shows the result. FIG. 51 shows the time sequential change of the temperatures of copper plate on longer side of the mold at each position distant from the immersion nozzle by: 731.5 mm, 798 mm, 864.5 mm in right half width, and 864.5 mm in left half width. For all these cases, it was found that the transition time of temperature change on the copper plate on longer side of the mold under the varied magnetic flux was about 60 seconds.

Figure 52:
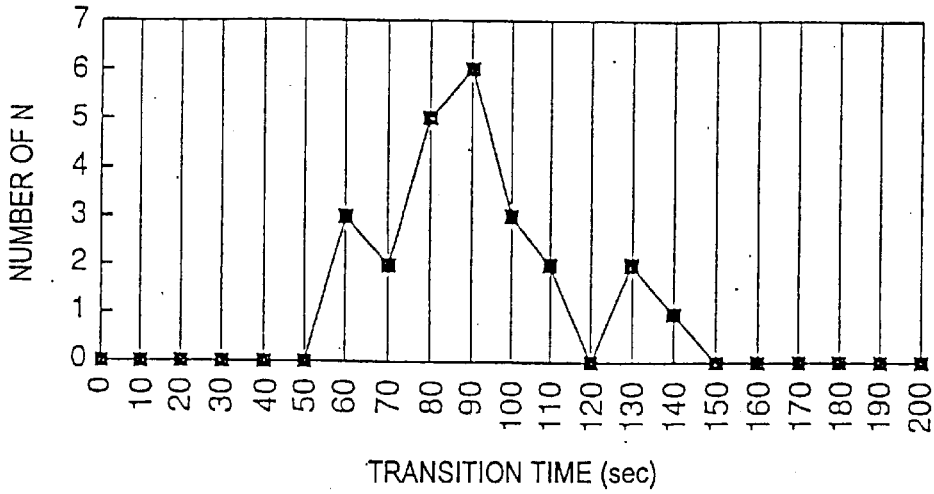
FIG. 52 is a histogram of transition period of the temperature variations of copper plate on longer side of the mold of the Embodiment 4.

Similar types of investigations were conducted under various casting conditions to determine the transition time of temperature changes on the copper plate on longer side of the mold. The results are summarized in FIG. 52 as a histogram. FIG. 52 suggests that the transition time distributes in a range of from 60 to 120 seconds. Accordingly, if the dispersion time interval for collecting the temperatures by the temperature measurement elements is set to 60 seconds or less, the variations of flow state of molten steel in the mold affecting the quality are fully detected.

As described above, according to the present invention, the collection of the temperatures by the temperature measurement elements arranged on the mold copper plate is conducted at intervals of 60 seconds or less, and the flow state of molten steel in the mold is estimated based on the collected temperatures of the mold copper plate at the intervals. As a result, the variations of flow state of molten steel in the mold affecting the quality are fully and accurately detected.

Figure 53:
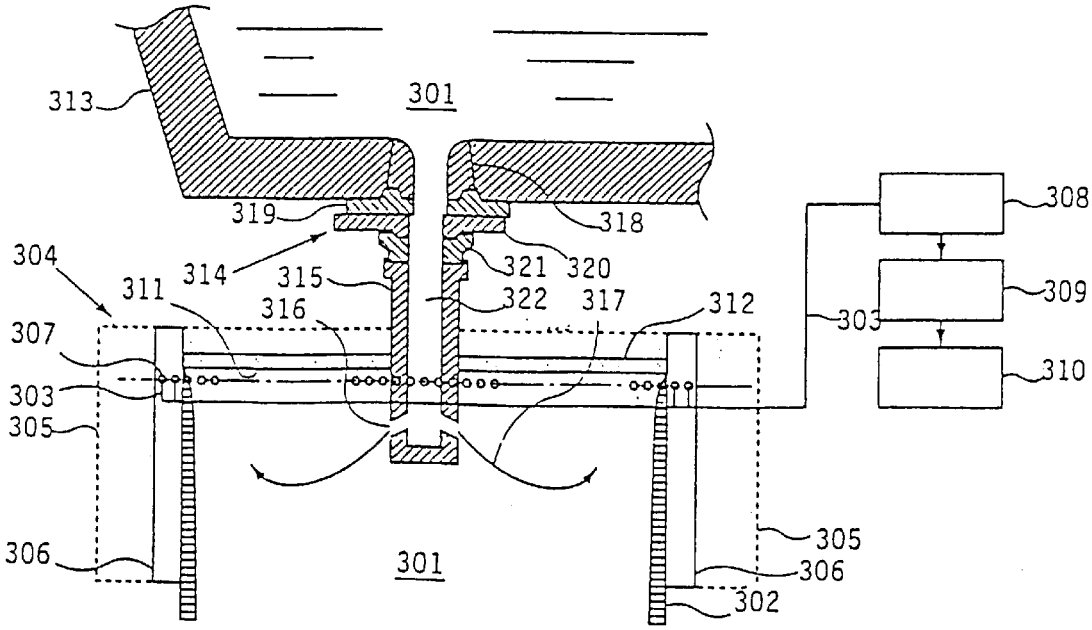
FIG. 53 is a schematic drawing of cross sectional front view of the casting section of the continuous casting machine of the Embodiment 4.

The present invention is described referring to the drawings. FIG. 53 is a schematic drawing of cross sectional front view of the casting section of a continuous casting machine, showing a mode to carry out the present invention.

As shown in FIG. 53, a tundish 313 is located above a mold 304 which comprises a pair of copper plates 305 on longer side of the mold and a pair of copper plates 306 on shorter side of the mold, which pair of copper plates 306 on shorter side of the mold are inserted between the pair of copper plates 305 on longer side of the mold, and each of the longer sides and each of the shorter sides faces to each other, respectively. At the bottom of the tundish 313, an upper nozzle 318 is located. A sliding nozzle 314 comprising a fixing plate 319, a sliding plate 320, and a streaming nozzle 321 is located to connect with the upper nozzle 318. Furthermore, an immersion nozzle 315 is located on the bottom face of the sliding nozzle 314, thus forming a tapping hole 322 for the molten steel from the tundish 313 to the mold 304.

The molten steel 301 which was poured from a ladle (not shown) to the tundish 313 is injected in the mold 304 as an injected flow 317 toward the copper plate 306 on shorter side of the mold through an injection hole 316 that is located at lower portion of the immersion nozzle 315 and that is immersed in the molten steel 301 in the mold 304, via the tapping hole 317 of the molten steel. The molten steel 301 is cooled in the mold 304 to form a solidified shell 302, which is then drawn downward from the mold 304 to become an slab. At that moment, a mold powder 312 is added to the surface of the meniscus 311 in the mold 304.

The upper nozzle 318 is made of a porous brick. To prevent adhesion of alumina onto the wall surface of the tapping hole 322 of the molten steel, Ar gas is introduced to the tapping hole 322 of the molten steel through the upper nozzle 318 via an Ar conduit (not shown). The introduced Ar gas enters the mold 304 along with the molten steel 301 via the immersion nozzle 315 and the injection hole 316, passes through the molten steel 301 in the mold 304 to ascend to a meniscus 311, then penetrates a mold powder 312 added onto the meniscus 311 to diffuse in atmosphere.

On the rear face of the copper plate 305 on longer side of the mold, plurality of holes are drilled along a line in the width direction of the copper plate 305 on longer side of the mold orthogonally to the direction of the slab-drawing below the meniscus in the slab-drawing direction. These holes act as the measurement points 307 to measure the temperatures of copper plate 305 on longer side of the mold. A temperature measurement element 303 is inserted into each of the measurement points 307 contacting the bottom of the hole on the copper plate 305. With the configuration, the temperatures of copper plate corresponding to the whole width of the slab can be measured. When the temperatures of the mold copper plate are required to be processed by a low pass filter, the intervals between adjacent measurement points is necessary to be in a range of from 44.3/3=14.8 mm to 0.443× [Mold width (mm)]/6. Preferably, the distance between the meniscus 311 and the measurement point 307 is in a range of from 10 to 13 mm in the slab-drawing direction. In a range of less than 10 mm of distance from the meniscus 311, the temperature of mold copper plate increase and decrease owing to the changes of meniscus during casting, so that the variations of temperatures of the mold copper plate caused from the flow of molten steel cannot be accurately grasped. At positions below 135 mm distant from the meniscus 311, the developed solidified shell 302 reduces the variations of temperatures of copper plate, which cannot give accurate measurement. Furthermore, it is preferable that the distance between the surface of the copper plate 305 on longer side of the mold at the side of molten steel and the tip of the temperature measurement element 303 is not more than 16 mm to accurately grasp the variations of flow speed of molten steel at every time.

The other end of the temperature measurement element 303 is connected to a zero-point compensator 308. The electromotive force signals generated from the temperature measurement element 303 enter a converter 309 via the zero-point compensator 308, where the electromotive force signals are converted to current signals, which current signals then enter a data analyzer 310. The data analyzer 310 has a function to compute the spatial movement average using, for example, above-described eq. (20). To avoid direct cooling of the tip of the temperature measurement element 303, which tip is the contact for temperature measurement, by the cooling water (not shown) flowing in the mold 304, the temperature measurement point 307 is isolated from the cooling water by a sealing material. Any type of temperature measurement element 303 may be applied, such as thermocouple and resistance thermometer, if only it has ±1° C. or higher accuracy.

The data analyzer 310 reads, intermittently at intervals of 60 seconds or less, the temperature data of copper plate on longer side of the mold transmitted from the converter 309, derives spatial movement average of the read data at each of the measurement points 307 using eq. (20), and displays the distribution of the temperatures Tn(ave) after applying spatial movement average in the mold width direction onto the monitor (not shown), or displays the flow pattern of the molten steel defined on the basis of the preliminarily defined temperature distribution of copper plate on longer side of the mold. The averaged number M in eq. (20) is an optimum value entered in advance taking into account of the frequency of the profile of molten steel flow speed.

According to the present invention, the detection of flow state of the molten steel 301 in the mold can eliminate the noise of variations of the thickness of solidified shell and of variations of the thickness of mold powder layer, and can detect the variations of flow accurately and fully owing to the optimization of the data sampling intervals. Furthermore, when the molten steel flow is controlled by feeding back the detected molten steel flow pattern to the casting conditions such as the slab-drawing speed and the Ar gas injection flow rate to the tapping hole 322, the feedback control is prompt and optimum because of the high accuracy of the detected information.

The above-described mode of the present invention used linear arrangement of the temperature measurement elements 303 on the copper plate 305 on longer side of the mold in width direction thereof. The temperature measurement elements 303 can be arranged in plural rows in the casting direction, or they can be arranged on both the copper plates 305 on longer side of the mold. There is no temperature measurement element 303 on the copper plate on shorter side of the mold. However, the temperature measurement elements 303 can be arranged on the copper plate 306 on shorter side of the mold. The method for injecting the Ar gas is not limited to that described above, and the Ar gas may be injected from the sliding nozzle 314 and the immersion nozzle 315.

EXAMPLE 1

Example 1 is an example of estimating flow speed of molten steel using the slab continuous casting machine and the temperature measurement device for mold copper plate given in FIG. 53. The continuous casting machine applied is a vertical and bending type having 3 meters of vertical section, which machine produces slabs of max. 2,100 mm in width. Table 6 shows the specification of the applied continuous casting machine.

Alumel-chromel (JIS thermocouple K) was used to the temperature measurement element. The distance between the surface of the copper plate on longer side of the mold at the side of molten steel and the tip of the thermocouple (temperature measurement contact) was set to 13 mm. The interval between adjacent thermocouples was set to 66.5 mm. The distance from the meniscus was set to 50 mm. The thermocouples were buried along the mold width direction over a range of 2,100 mm. Thus, the slab having 220 mm in thickness and 1,700 mm in width was cast under the casting condition of 2.1 m/min of slab-drawing speed and 10 Nl/min of Ar gas injection rate.

TABLE 6

| Item | Specification |
|---|---|
| Type of continuous casting machine | Vertical and bend type |
| Length of vertical section | 3 m |
| Capacity of molten steel in ladle | 250 ton |
| Capacity of molten steel in tundish | 80 ton |
| Thickness of slab | 220 to 300 mm |
| Width of slab | 675 to 2100 mm |
| Slab-drawing speed | max. 3 m/min |
| Immersion nozzle | Downward 25 deg., tapping hole 80 mm in diameter |

Figure 54:
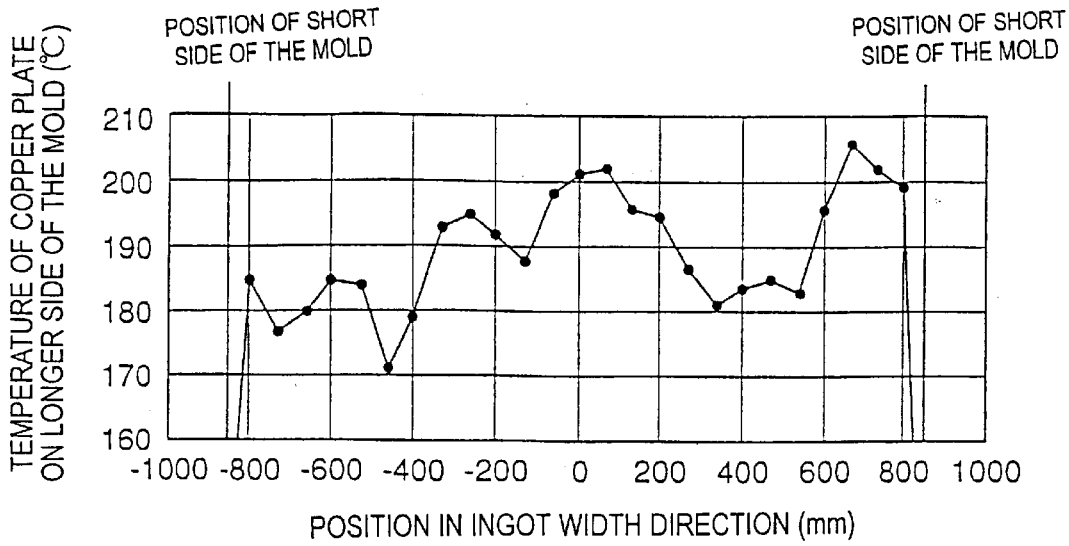
FIG. 54 shows a temperature distribution in the mold width direction derived from non-processed data of temperatures of copper plate on longer side of the mold in Example 1 of the Embodiment 4.

FIG. 54 shows the temperature distribution in the mold width direction based on the un-processed data of the temperatures of copper plate on longer side of the mold collected under the casting condition. The temperature distribution includes the short wavelength variations presumably resulted from the variations of thickness of solidified shell and the variations of thickness of molten powder layer. The horizontal axis indicates the positions in the mold width direction, giving the center of the mold width at the center of the axis "0 mm". The negative sign indicates the left half width of the mold, and the positive sign indicates the right half width of the mold, (hereinafter the same expression is applied to point the position of the mold width direction).

Figure 55:
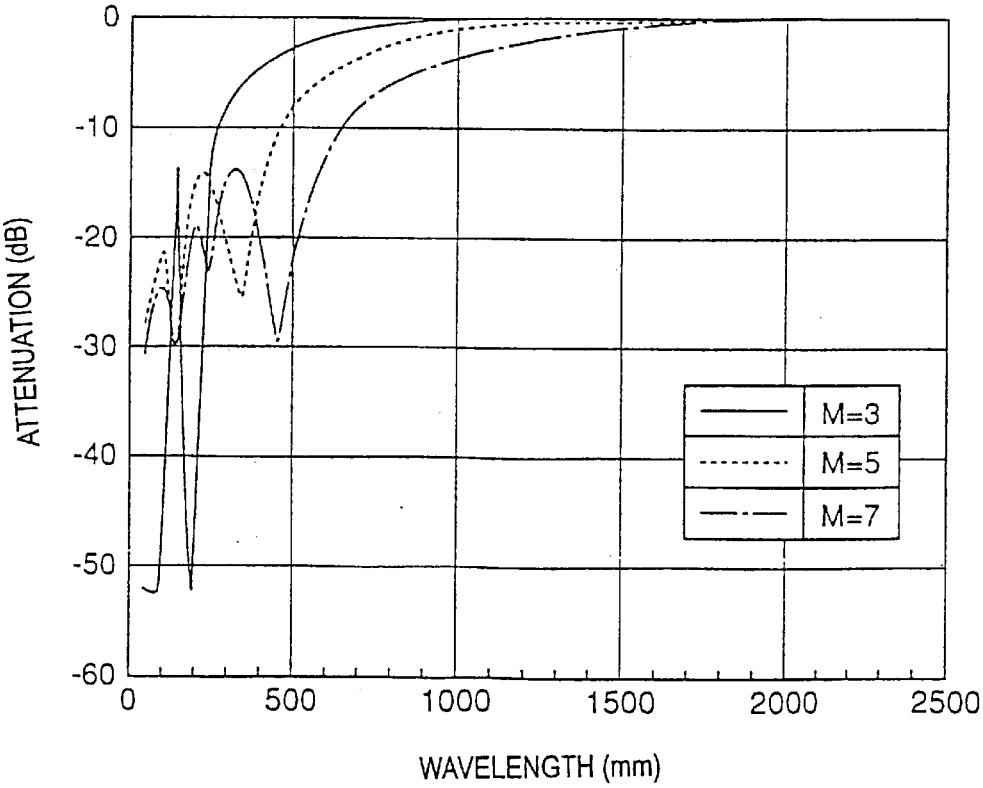
FIG. 55 is a graph showing the variations of attenuation R resulted from the variations of the averaged number M of the Embodiment 4.

The spatial movement average was applied to the temperature distribution shown in FIG. 54. First, the averaged number M was determined in the following given procedure. The mold width that is the basis to determine the spatial frequency f of the waves resembling sine waves and the spatial frequency fs of buried intervals of temperature measurement elements was set to the maximum width 2,100 mm. The averaged number M was changed to three levels, 3, 5, and 7. Thus the attenuation R of the waves resembling the sine waves was calculated. FIG. 55 shows the result. As shown in FIG. 55, the change of averaged number M induces difference in the attenuation R of the waves resembling sine waves having 1,000 mm or less of wavelength.

In this example, the waves resembling sine waves having approximate wavelength of 200 mm presumably caused from the variations of thickness of solidified shell and the variations of mold powder layer are wanted to eliminate, and the waves resembling sine waves having approximate wavelengths of from 800 to 1,800 mm presumably corresponding to the flow speed profile of molten steel are wanted to maintain. When FIG. 55 is investigated from this point of view, the averaged number M at the time that the attenuation R of the wavelength of about 200 mm is 3. Thus, the adequate averaged number M was judged as 3. For the case that the averaged number M is 5 and 7, the flow speed profile of molten steel may be significantly attenuated, which is inadequate. Therefore, the averaged number M was decided to 3.

Figure 56:
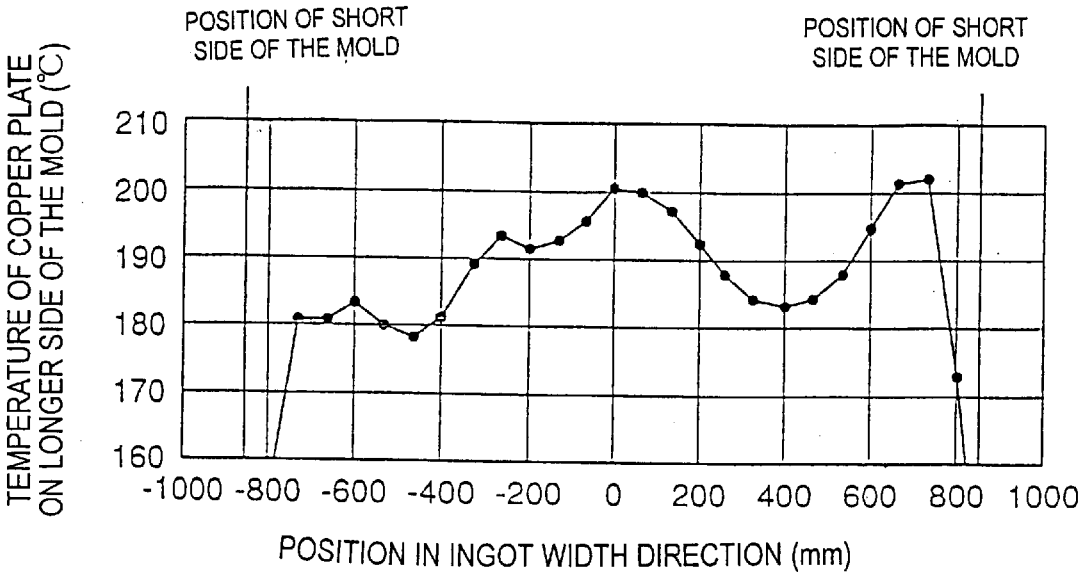
FIG. 56 shows the temperature distribution derived from the spatial movement average of the temperature distribution of FIG. 54.

FIG. 56 shows the temperature distribution of the copper plate on longer side of the mold in the width direction after applying the spatial movement average to the temperature distribution of FIG. 54, taking the averaged number M as 3. As shown in FIG. 56, there is no variation of short wavelength which was observed in FIG. 54, thus the variations of temperature caused only from the flow speed profile of molten steel can be expressed.

EXAMPLE 2

The same continuous casting machine with that in Example 1 was used for casting slabs having 250 mm in thickness and 1,500 mm in width under the casting condition of 2.0 m/min of slab-drawing speed and 10 Nl/min of Ar gas injection rate. The alumel-chromel (JIS thermocouple K) was used as the temperature measurement element. The distance between the surface of the copper plate on longer side of the mold at the side of molten steel and the tip of the thermocouple (temperature measurement contact) was set to 13 mm. The interval between adjacent thermocouples was set to 50 mm. The distance from the meniscus was set to 50 mm. The thermocouples were buried along the mold width direction over the whole width thereof.

Figure 57:
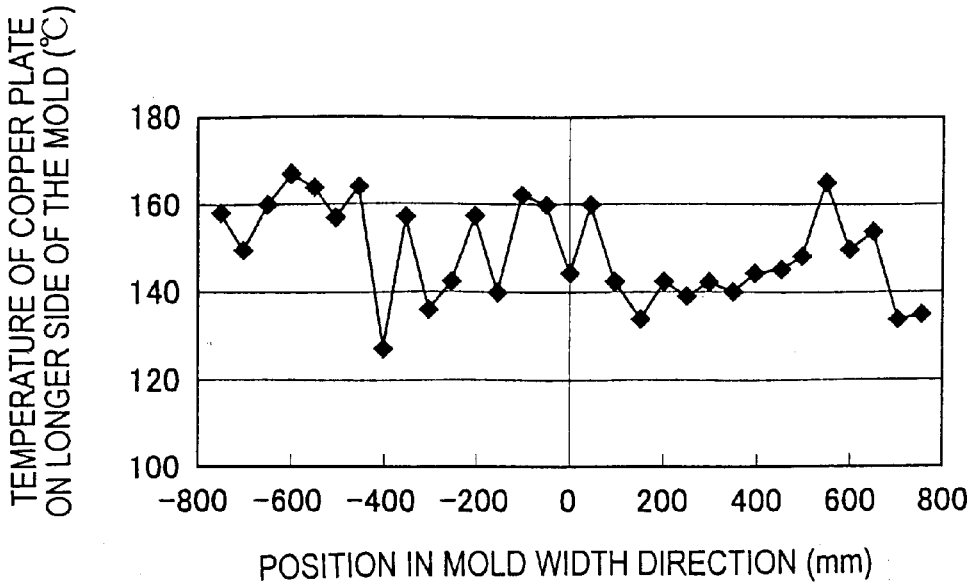
FIG. 57 shows the temperature distribution in the mold width direction derived from the collected non-processed data of the temperature distribution of the copper plate on longer side of the mold in Example 2 of the Embodiment 4.
Figure 58:
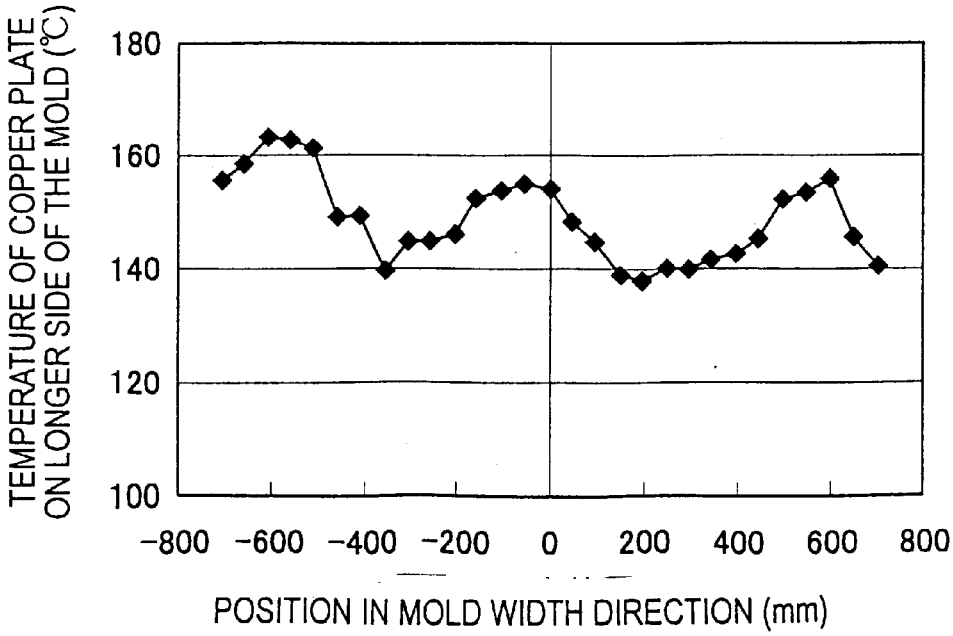
FIG. 58 shows the temperature distribution of FIG. 57, processed by the averaged number M of 3.
Figure 59:
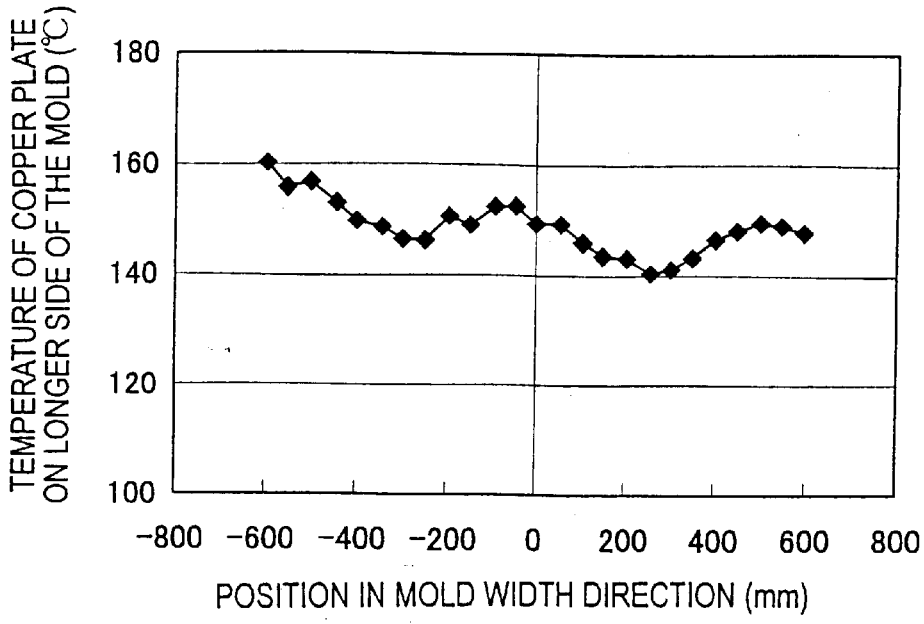
FIG. 59 shows the temperature distribution of FIG. 57, processed by the averaged number M of 7.
Figure 60:
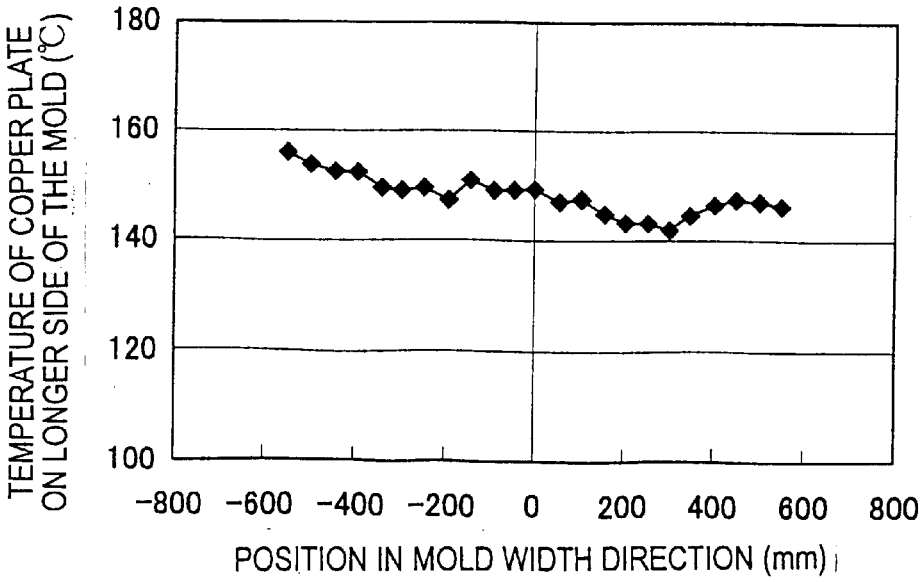
FIG. 60 shows the temperature distribution of FIG. 57, processed by the averaged number M of 9.

FIG. 57 shows thus collected non-processed data of the temperature distribution of the copper plate during casting. The non-processed data indicate the variations of wavelengths of 100 mm (twice the buried intervals) or more. The spatial movement average was used as the low pass filter. FIGS. 58 through 60 show the temperature distributions processed by the averaged number M of 3, 7, and 9, respectively. For the averaged number M of 7, the shielded spatial frequency fc is 0.00123, and the wavelength is 790 mm. For the averaged number M of 9, the shielded spatial frequency fc is 0.001, and the wavelength is 1,015 mm.

In the case of no low pass filter treatment, though no feature is grasped on one glance, a strong flow in the vicinity of shorter side of the mold appears as the high temperature caused from the strong injection flow at M=3, as shown in FIG. 58. At the same time, an ascending flow at near the immersion nozzle caused from Ar gas bubbles is observed as high temperature at near the center portion. When M is 7, the feature becomes somewhat vague, as shown in FIG. 59, though the temperature becomes high at near the shorter side and near the center portion. When M is 9, as seen in FIG. 60, the temperature distribution becomes flat over the whole width, and shows no feature. Consequently, it was found that the cutoff wavelength of the filter is preferably done in a range of from 100 mm to mold width (W)/2 (=750 mm).

EXAMPLE 3

Figure 61:
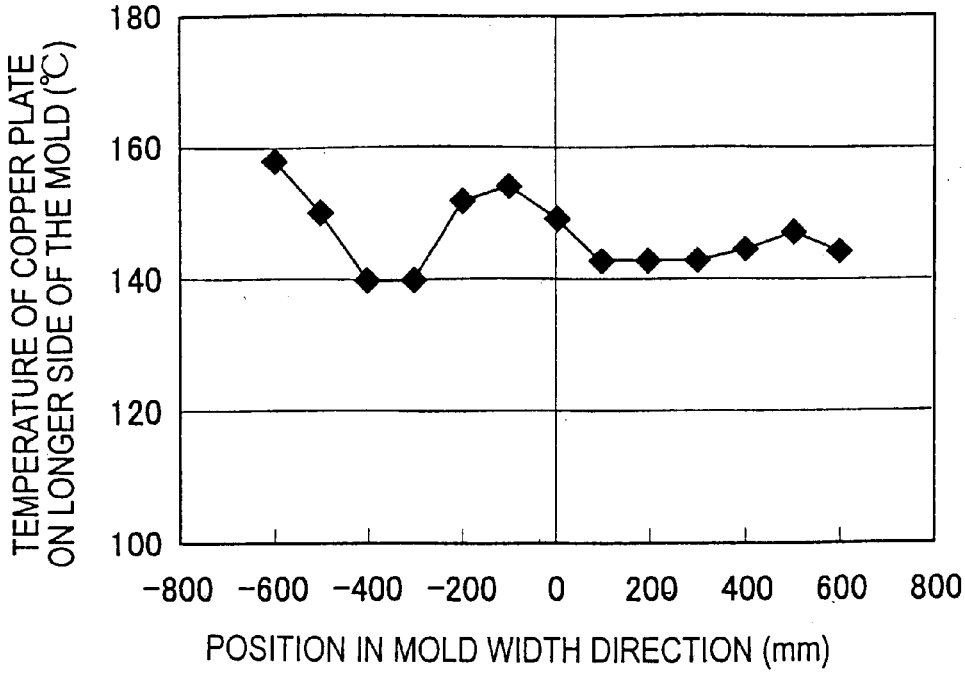
FIG. 61 shows the temperature distribution of the case that the thermocouples were buried at an interval of 100 mm, and that the spatial movement average was applied with the averaged number M of 3, in Example 3 of the Embodiment 4.

The same continuous casting machine and the same casting condition with those in Example 2 were used. The intervals of buried thermocouples were selected to 50, 100, and 150 mm. The spatial movement average was used to the low pass filter treatment. The treatment was done at the minimum averaged number M=3. FIG. 58 shows the temperature distribution in the case that the thermocouples were buried at 50 mm of interval. FIG. 61 shows the temperature distribution of the case that the thermocouples were buried at an interval of 150 mm.

Figure 62:
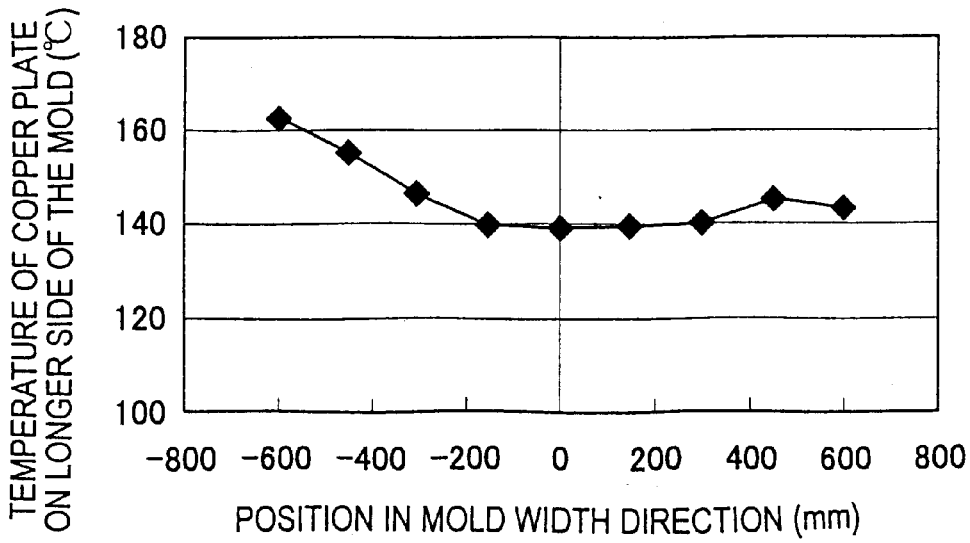
FIG. 62 shows the temperature distribution of the case that the thermocouples were buried at an interval of 150 mm, and that the spatial movement average was applied with the averaged number M of 3, in Example 3 of the Embodiment 4.

The cutoff wavelength corresponding to each buried interval for the case of M=3 is 340, 680, and 1,015 mm for the intervals of 50 , 100, and 150 mm, respectively. As shown in FIG. 62, for the case of 150 mm in interval, the low pass filter treatment gives flat temperature distribution, which fails to grasp the feature of the temperature distribution. From these findings, it was found that the intervals of buried thermocouples are defined by 0.443/(3×f) mm, and that they are not higher than 0.443×[Mold width (W)]/6 mm (110 mm for the case of 1,500 mm) at the maximum.

EXAMPLE 4

Figure 63:
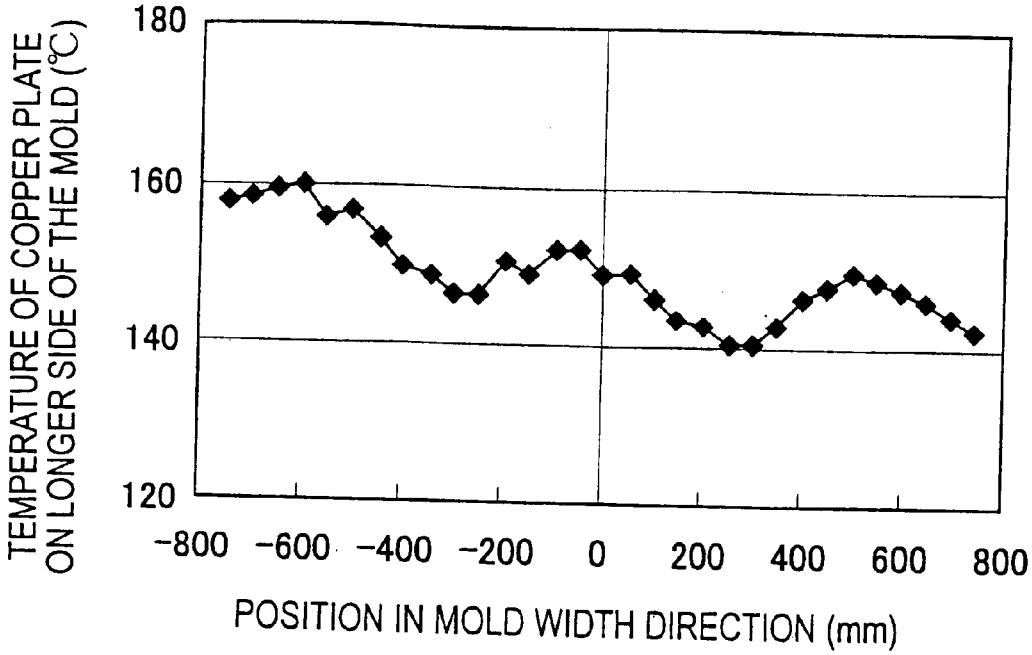
FIG. 63 shows the case that the data extended by doubling back thereof at each of both edges of the mold width were used and that the spatial movement average was applied in Example 4 of the Embodiment 4.
Figure 64:
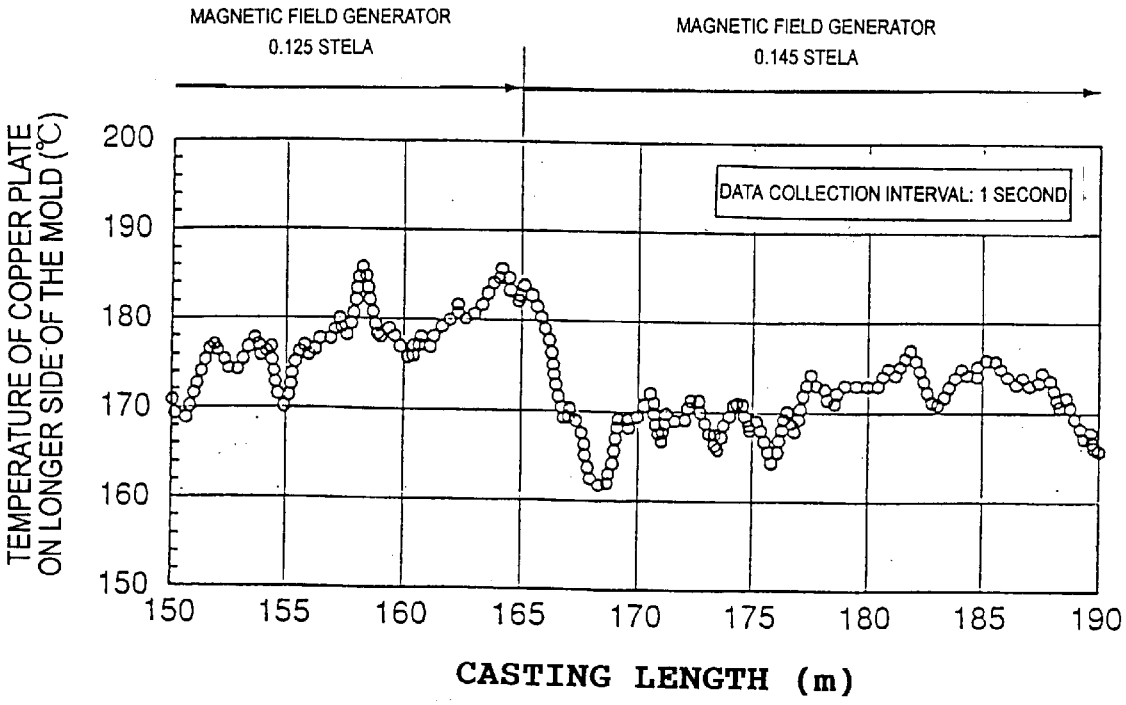
FIG. 64 shows the time sequential variations of temperatures of copper plate on longer side of the mold at 1 second of intervals of data collection, in Example 5 of the Embodiment 4.
Figure 65:
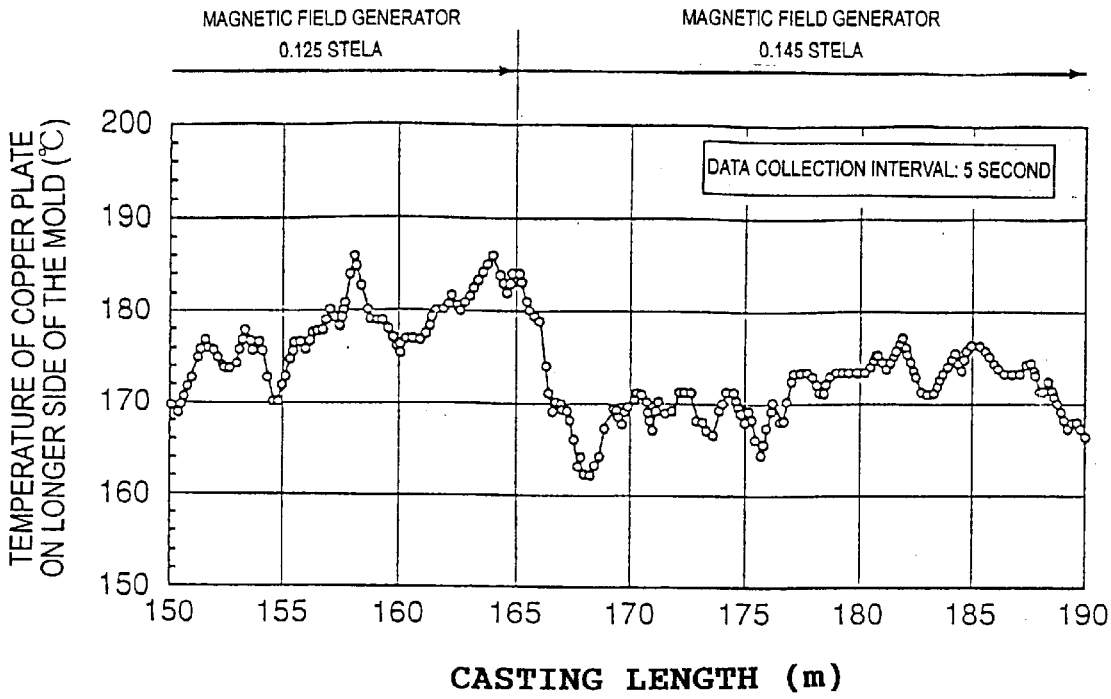
FIG. 65 shows the time sequential variations of temperatures of copper plate on longer side of the mold at 5 seconds of intervals of data collection, in Example 5 of the Embodiment 4.
Figure 66:
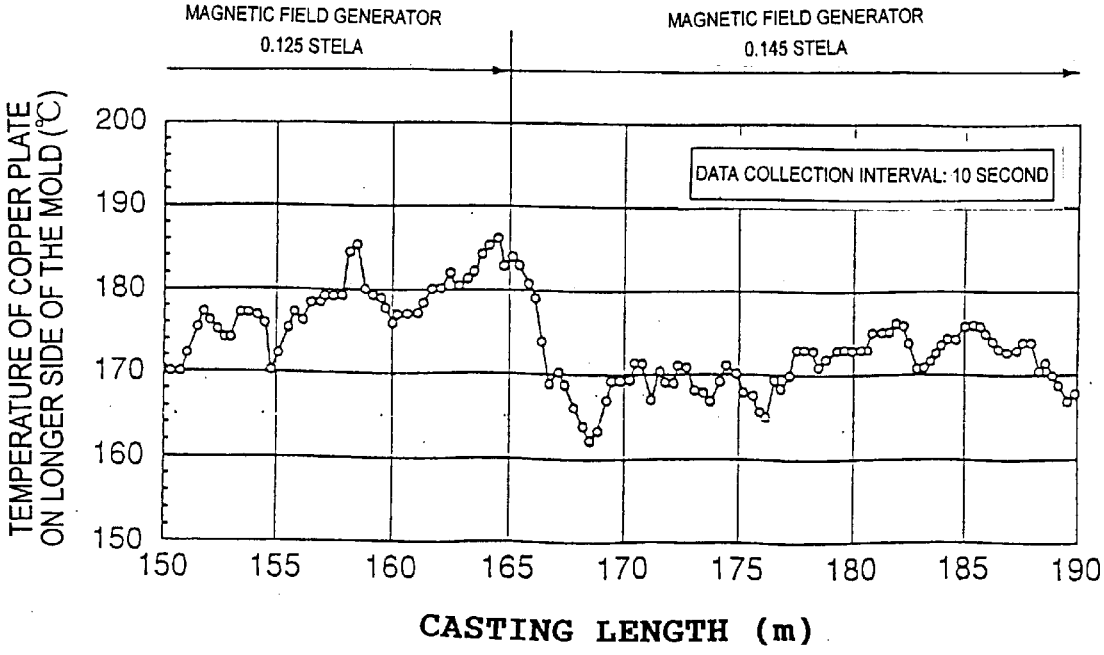
FIG. 66 shows the time sequential variations of temperatures of copper plate on longer side of the mold at 10 seconds of intervals of data collection, in Example 5 of the Embodiment 4.
Figure 67:
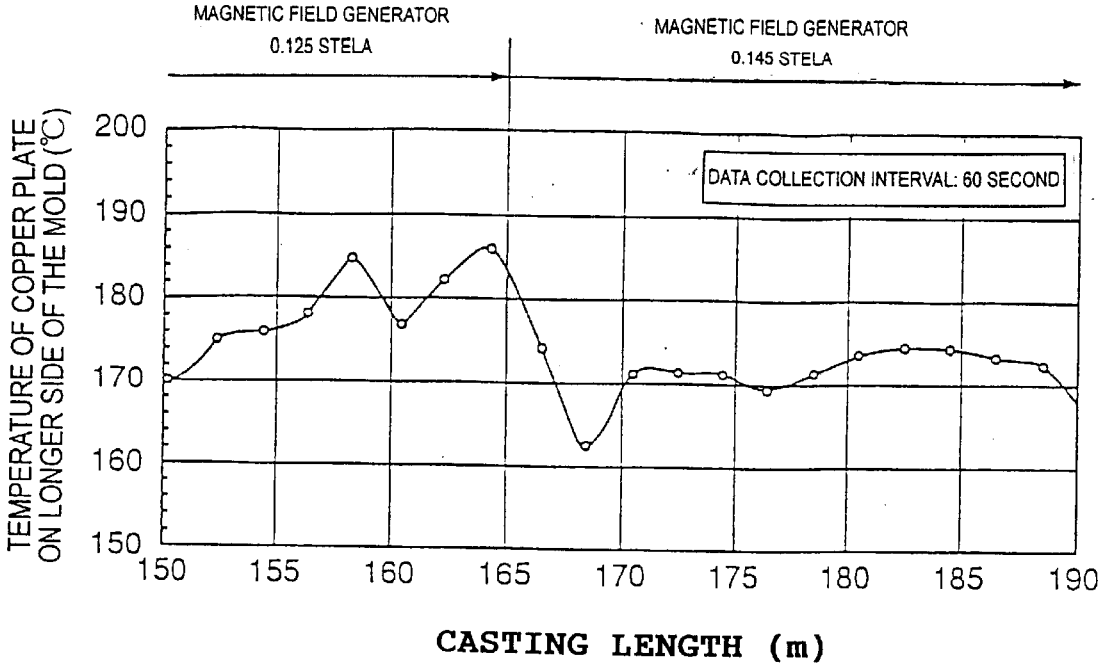
FIG. 67 shows the time sequential variations of temperatures of copper plate on longer side of the mold at 60 seconds of intervals of data collection, in Example 5 of the Embodiment 4.
Figure 68:
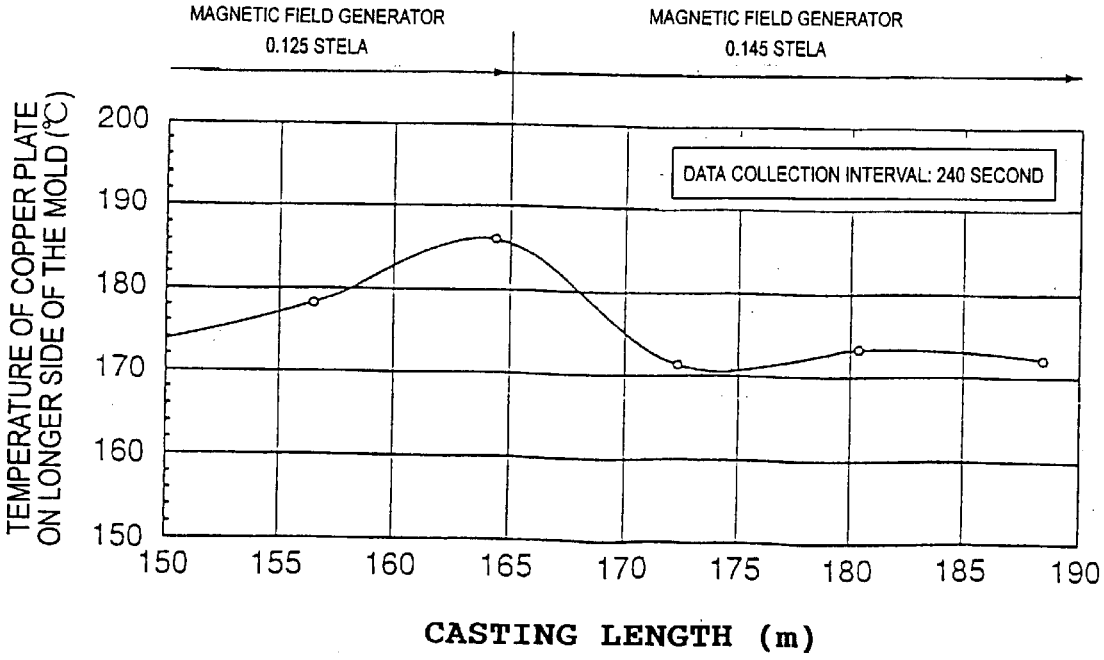
FIG. 68 shows the time sequential variations of temperatures of copper plate on longer side of the mold at 240 seconds of intervals of data collection, in Example 5 of the Embodiment 4.

The same continuous casting machine and the same temperature measurement device with those in Example 2 were used. And the same casting condition with that in Example 2 was applied for casting. FIG. 63 shows the case that the data extended by doubling back thereof at each of both edges of the mold width were used and that the spatial movement average was applied at M=7. FIG. 63 was compared with FIG. 59 which did not doubling back the data. In the case of doubling back the data, the feature of non-processed data is expressed to the edges of the mold width, thus giving more accurate evaluation of the temperature distribution.

EXAMPLE 5

The same continuous casting machine and the same temperature measurement device with those in Example 2 were used. The slab having 220 mm in thickness and 1,550 mm in width was cast under the condition of 2.0 m/min of slab-drawing speed and 10 Nl/min of Ar gas injection rate. In this example, a moving magnetic field type magnetic field generator was installed on rear face of the copper plate on longer side of the mold, thus applying the moving magnetic field in the direction to brake the injection flow injected from the immersion nozzle.

During the casting, the measured temperatures of copper plate on longer side of the mold were collected to the data analyzer at 1 second of interval. In this example, to change the intervals of acquisition of data of temperature of the copper plate on longer side of the mold, the data collected by the data analyzer were further transmitted to the data collection and analysis personal computer at intervals of five levels: 1, 5, 10, 60, and 240 seconds. The data transmission from the data analyzer was given by TCP/IP procedure. The data collection and analysis personal computer was a common type having 200 MHz of CPU clock and 128 MB of RAM memory.

When the pouring has reached to 165 m during casting, the magnetic flux of the moving magnetic field type magnetic field generator was increased from 0.125 stela to 0.145 stela stepwise. The variations of temperatures on the copper plate on longer side of the mold during the stepwise changes of magnetic flux were monitored at above-described five levels of intervals. The difference between these obtained data was checked. FIGS. 64 through 68 show the time-sequential change of the temperature of copper plate on longer side of the mold at each of the data acquisition intervals of 1, 5, 10, 60, and 240 seconds at the data collection and analysis personal computer.

As shown in FIGS. 64 through 68, both the temperature variations for the shortest data collection time of 1 second and those for the longest data collection time of 60 seconds can grasp the variations of temperature of copper plate on longer side of the mold accompanied with the variations of magnetic flux of the moving magnetic field type magnetic field generator, almost accurately. However, for the case of 240 seconds of data collection interval, the temperature variations on the copper plate on longer side of the mold became slow, and accurate temperature variations could not be grasped. The data shown in FIGS. 64 through 68 are the temperatures measured at the measurement point at a distance of 665 mm right from the center of width of the copper plate on longer side of the mold.

EXAMPLE 6

The same continuous casting machine and the same temperature measurement device with those in Example 2 were used. The slab having 250 mm in thickness and 1,400 to 1,800 mm in width was cast under the condition of 10

Nl/min of Ar gas injection rate and 2.0 m/min of slab-drawing speed.

Iron sulfide was added to the slab during casting. The thickness of solidified shell was determined at 30 points on each cross section based on the sulfur distribution, and the standard deviation (σ) was derived.

The measured data of temperatures on the mold copper plate were processed to determine the spatial movement average at 3 of the averaged number M. At each measurement point, the value subtracted the value Tn(ave) after the spatial movement averaged from the measured value (Ti), (Di=Ti−Tn(ave)), was derived at on-line basis. As shown in eq. (22), the average of the absolute value (Di) in the mold width direction, ($D_0$), was calculated as the representative value of the irregularity of the heat release in the mold.

$$D_0 = (1/n) \times \sum_{i=1}^{n} |Di| \tag{22}$$

Figure 69:
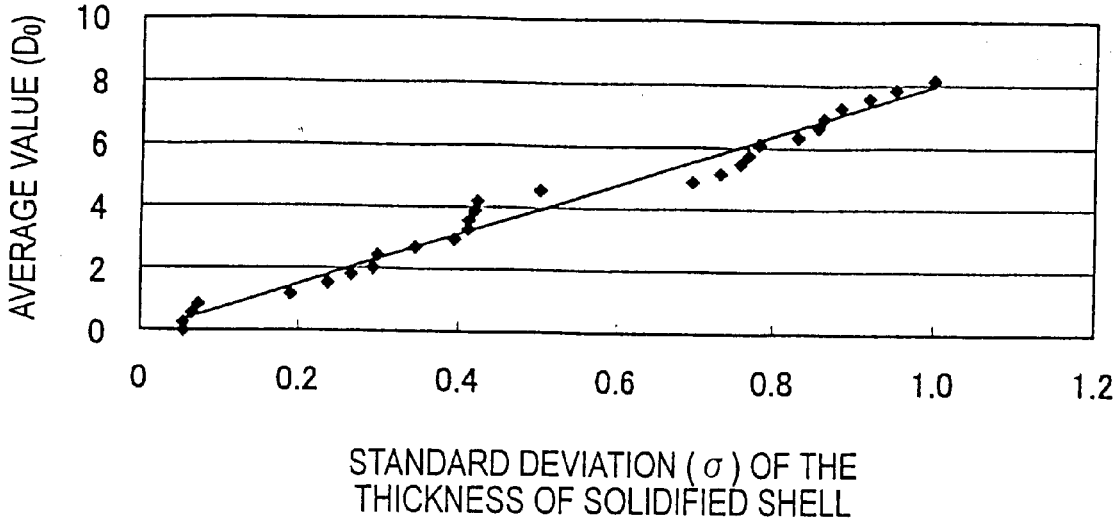
FIG. 69 shows the relation between the average value ($D_0$) in the mold width direction and the standard deviation ($\sigma$) of thickness of solidified shell in Example 6 of the Embodiment 4.

FIG. 69 shows the relation between thus derived average value ($D_0$) in the mold width direction and the standard deviation (σ) of the thickness of solidified shell determined from the sulfur distribution. As the figure shows, both variables have a linear correlation to each other, and show the irregularity of heat release in the mold at high accuracy. On-line evaluation of the irregularity of the heat release provides an indirect prediction of the resulting irregularity of thickness of solidified shell.

Embodiment 5

An object of the present invention is to grasp the state of molten steel flow in a mold on real time basis independent of the database for estimation, and to adequately control the state of molten steel flow on the grasped information. A sensor is necessary to grasp the flow of molten steel in the mold for continuous casting on real time basis. To this point, the inventors of the present invention placed several units of temperature measurement elements on the rear face of the copper plate on longer side of the mold in the width direction thereof. The convection heat transfer coefficient between the molten steel in the mold and the solidified shell changes responding to the flow of molten steel in the mold, thus the magnitude of the heat flux propagating from the molten steel to the cooling water for the copper plate on longer side of the mold through the copper plate on longer side of the mold. Accordingly, if the temperatures on the copper plate on longer side of the mold are monitored, the state of flow of molten steel in the mold can be monitored. Since the temperature measurement elements do not directly touch the molten steel, they can detect the flow speed of molten steel in the mold always during the period as far as the elements are durable and as long as the mold is in the continuous casting machine.

According to the disclosure of Japanese Patent Laid-Open No. 109145(1998), the flow pattern of molten steel in the mold can be classified to three patterns, A, B, and C by varying the four variables: namely, the mold size, the slab-drawing speed, the Ar gas injection rate into the immersion nozzle, and the intensity of magnetic field for controlling the flow of molten steel. Thus, Japanese Patent Laid-Open No. 109145(1998) deals with these four variables as the target casting conditions, and measures the flow pattern of molten steel in the mold in advance under plurality of casting conditions comprising these variables to estimate the flow pattern of molten steel in the mold under individual casting conditions based on the measured result, thus adjusting the intensity of magnetic field to apply to the injection flow or adjusting the Ar gas injection rate to the immersion nozzle to establish the Pattern B of the flow pattern. The Pattern A is the pattern to branch upward and downward flows after the injection flow reached the solidified shell at the side of shorter side of the mold, and, at the meniscus, to form a flow directing the solidified shell at the side of shorter side of the mold. The Pattern B is the pattern in which the injected flow coming from the immersion nozzle does not reach the solidified shell at the side of shorter side of the mold, and disperses between the injection hole and the solidified shell at the side of shorter side of the mold. The Pattern C is the pattern that has upward flow at near the immersion nozzle, and, at the meniscus, a flow directing from the immersion nozzle to the shorter side of the mold is established. From the viewpoint of generation of defects caused from mold powder in the products, the Pattern B is the most preferable pattern among these three patterns.

Consequently, to assure the product quality, particularly to minimize the inclusions by entrapping mold powder into the product, it is most preferable that the flow pattern of the molten steel in the mold is brought to the Pattern B. To this point, the inventors of the present invention measured the flow speed of molten steel at the meniscus in a state of the Pattern B of the flow of molten steel in the mold, using the continuous casting machine described in examples given later, under the casting condition of 220 mm in thickness and 1,600 mm in width of the slab, 1.3 m/min of slab-drawing speed, 10 Nl/min of Ar gas injection rate to the immersion nozzle, and 260 mm of immersion depth of the immersion nozzle. The flow speed of molten steel was measured by the method of immersing refractory rods in the meniscus to determine the deflection angle of the refractory rod resulted by the molten steel flow, (hereinafter referred to as the "immersion rod type meniscus molten steel flow speed meter").

Figure 70:
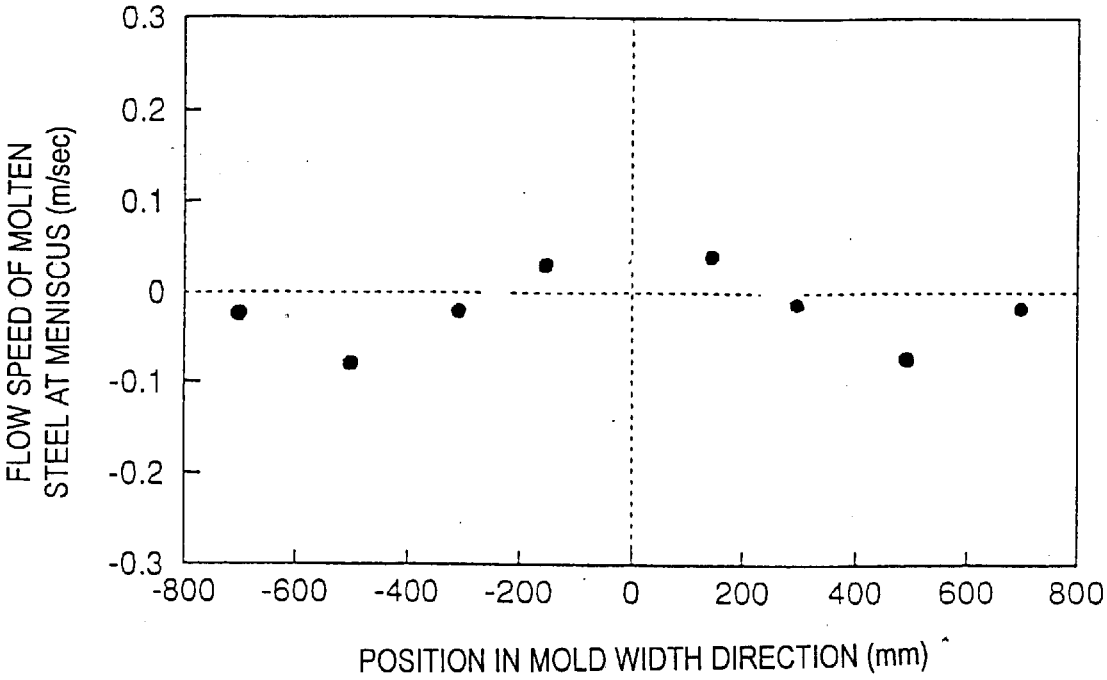
FIG. 70 shows an example of flow speed distribution of molten steel at the meniscus in the case of Pattern B of the flow pattern of molten steel in the mold of the Embodiment 5.

The result is shown in FIG. 70. As shown in FIG. 70, the distribution of flow speed of molten steel at the meniscus is almost symmetrical to the center of width of the mold, the difference of absolute values of flow speed in width of the mold is small. The positive sign flow speed on the vertical axis of the figure is the flow from the shorter side of the mold to the immersion nozzle, and the negative sign flow speed flows in the inverse direction. The horizontal axis of the figure indicates the position in width direction of the mold. The point of "0 mm" at the center of horizontal axis is the center of width of the mold, or the place of the immersion nozzle. The negative sign designates the left half width of the mold, and the positive sign designates the right half width thereof. (Hereinafter the same indication is given to express the position in mold width direction.)

Figure 71:
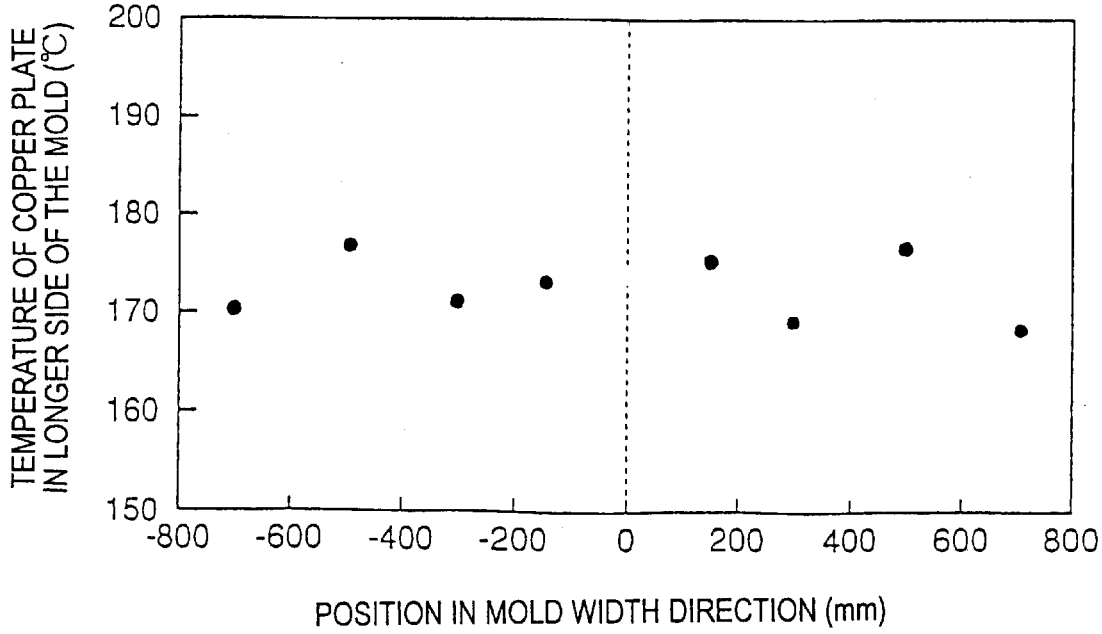
FIG. 71 shows an example of temperature distribution of molten steel of the copper plate on longer side of the mold in the case of Pattern B of the flow pattern of molten steel in the mold of the Embodiment 5.

Based on the above-described response characteristics of the temperature of copper plate to the flow of molten steel, the temperature distribution of the copper plate on longer side of the mold at that moment should be flat and symmetrical in right half width and left half width to each other. Actually, the temperature distribution of the copper plate on longer side of the mold in width direction thereof at the Pattern B is drawn as FIG. 71. As seen in FIG. 71, the temperature distribution at the Pattern B is almost symmetrical in right half width and left half width of the mold, and gives flat distribution with small difference between the maximum and the minimum values. The measurement of temperature distribution at the Pattern B was carried out under various casting conditions. The measurement revealed that the temperature distribution of copper plate on longer side of the mold at the Pattern B gives a relatively flat one with not more than 12° C. of difference between the maximum and the minimum values, and that, in view of symmetry on right half width and left half width of the mold, the difference in temperature of copper plate at symmetrical positions to the center of mold width is not more than 10° C.

Since the present invention specifies the difference between the maximum and the minimum values in the temperature distribution of copper plate on longer side of the mold in width direction thereof to 12° C. or less, and furthermore, preferably, the difference of temperature of copper plate on longer side of the mold in the width direction thereof between the symmetrical positions to the immersion nozzle in right half width and left half width of the mold is controlled to 10° C. or less. Thus the flow of molten steel in the mold is controlled to the Pattern B, and the product quality is improved.

As a means to control the flow of molten steel in that type of control, the present invention adjusts one or more of the variables of: the intensity of magnetic field of the magnetic field generator, the slab-drawing speed, the immersion depth of the immersion nozzle, and the Ar gas injection rate to the immersion nozzle.

In the case that the magnetic field generated by the magnetic field generator is static one, the flow of molten steel in the mold is subjected to braking force by the Lorentz force. If the magnetic field generated by the magnetic field generator is dynamic one, the molten steel in the mold is driven to the moving direction of the magnetic field, and the excited molten steel flow controls the flow of molten steel in the mold. That type of magnetic field generator can vary the intensity of the magnetic field instantaneously by changing instantaneously the supplied power. Accordingly, the control of molten steel flow becomes possible responding to the variations of flow of molten steel in the mold measured by the temperature measurement elements on time sequence. Since the magnetic field generator does not directly touch the molten steel and since the durability thereof on operation is favorable, the magnetic field can be applied to the molten steel at any time during the period of mounting the mold on the continuous casting machine.

Adjustment of slab-drawing speed can adjust the speed of injection flow injected from the immersion nozzle, so that the flow of molten steel in the mold can be controlled. Adjustment of immersion depth of the immersion nozzle ascends and descends the position that the injected flow collides against the solidified shell on shorter side of the mold. The change in the colliding position results in the adjustment of distance between the colliding position and the meniscus. That is, the molten steel flow collides against the solidified shell on shorter side of the mold, then a molten steel flow branches to upward direction, thus the attenuation of the branched upward flow until reaching to the meniscus is adjusted. As a result, the flow of molten steel in the mold can be controlled. The Ar gas injected into the immersion nozzle comes out from the nozzle to ascend at near the nozzle, while inducing upward flow of the molten steel. Consequently, the adjustment of Ar gas injection rate controls the flow of molten steel in the mold. The immersed depth of the immersion nozzle referred in the present invention signifies the distance between the upper end of the injection hole of the immersion nozzle and the meniscus.

As described above, the molten steel flow in the mold can be controlled based on the temperature distribution of the copper plate on longer side of the mold. The temperature of the copper plate on longer side of the mold measured by the temperature measurement elements varies also with the thickness of copper plate, the temperature and flow rate of cooling water for the mold, and other variables. Therefore, the control of molten steel flow in the mold can be conducted by determining the molten steel flow speed in the mold based on the temperatures of copper plate in the mold using a heat transfer model, and by eliminating the causes of varying temperatures of mold copper plate, other than the molten steel flow speed. The method to derive the flow speed of molten steel in the mold from the temperatures of copper plate on longer side of the mold measured by the temperature measurement elements has the procedure described below.

Figure 72:
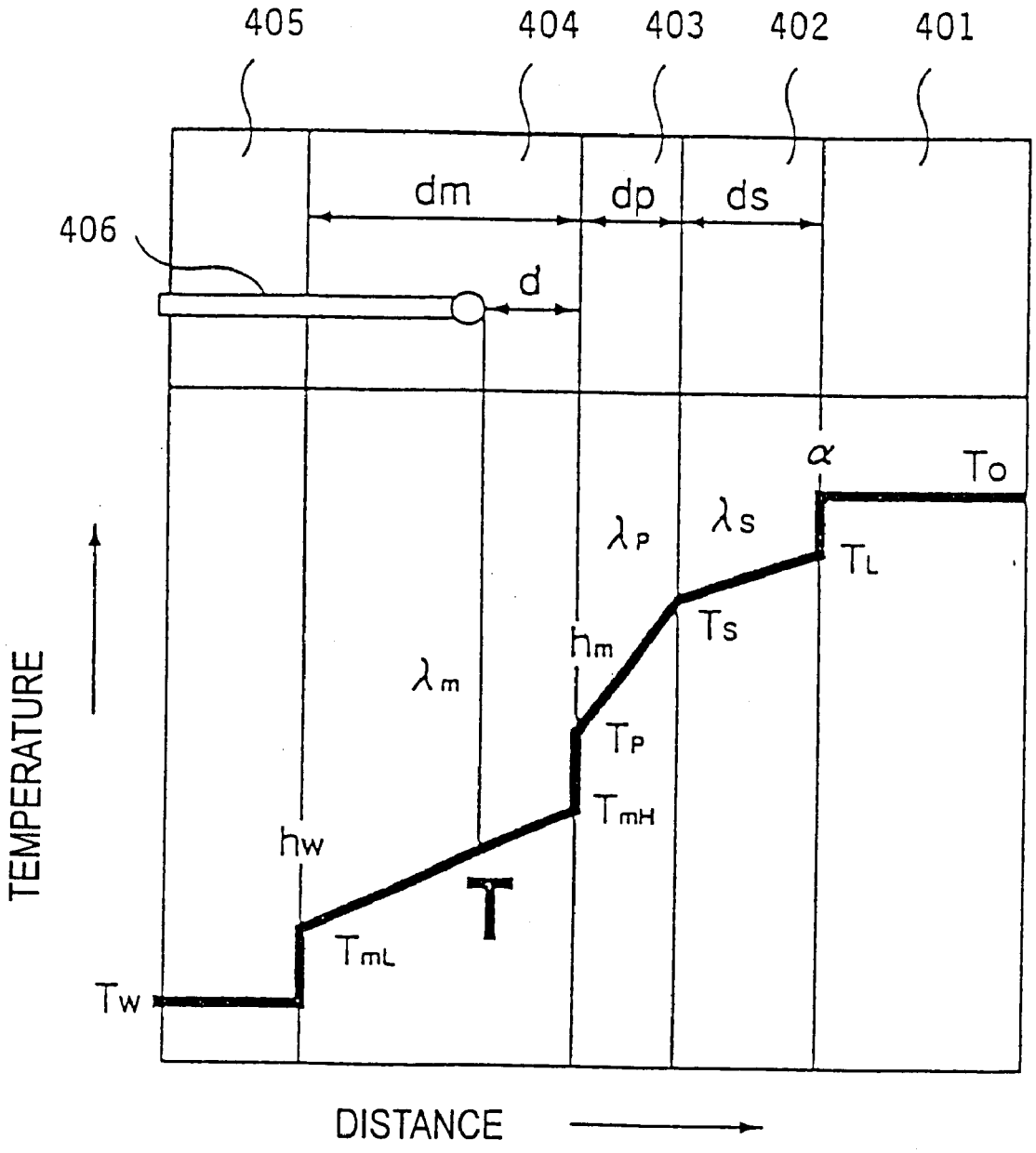
FIG. 72 shows a schematic illustration of the temperature distribution over a range of from the molten steel to the cooling water for mold copper plate of the Embodiment 5.

FIG. 72 is a schematic drawing of the temperature distribution over a range of from the molten steel to the cooling water, during the process of heat conduction from the molten steel in the mold, the copper plate on longer side of the mold, to the cooling water for copper plate on longer side of the mold. As seen in FIG. 72, between the molten steel 401 and the cooling water 405 for the copper plate on longer side of the mold, there exist heat conductive bodies: the solidified shell 402, the mold powder layer 403, and the copper plate 404 on longer side of the mold. The temperature measurement elements 406 are buried in the copper plate 404 on longer side of the mold to measure the temperatures in the copper plate 404 on longer side of the mold. In the figure, the reference symbol $T_0$ is the temperature of molten steel 401, $T_L$ is the boundary temperature between the solidified shell 402 and the molten steel 401, $T_S$ is the boundary temperature between the solidified shell 402 and the mold powder layer 403, $T_P$ is the surface temperature of the mold powder layer 403 at the side of copper plate 403 on longer side of the mold, $T_{mH}$ is the surface temperature of the mold powder layer 403 at the side of copper plate 404 on longer side of the mold, $T_{mL}$ is the surface temperature of the copper plate 404 on longer side of the mold at the side of cooling water 405, and $T_W$ is the temperature of cooling water 405.

In that case, the overall heat resistance derived by combining the heat resistances of heat conductors ranging from the molten steel 401 to the cooling water 405 is expressed by eq. (23).

$$R=(1/\alpha)+(d_S/\lambda_S)+(d_P/\lambda_P)+(1/h_m)+(d_m/\lambda_m)+(1/h_W) \quad (23)$$

where, R is the overall heat resistance, $\alpha$ is the convection heat transfer coefficient between the molten steel and the solidified shell, $\lambda_S$ is the thermal conductivity of the solidified shell, $\lambda_P$ is the thermal conductivity of the mold powder layer, $\lambda_m$ is the thermal conductivity of the copper plate on longer side of the mold, $h_m$ is the heat transfer coefficient between the mold powder layer and the copper plate on longer side of the mold, $h_W$ is the heat transfer coefficient between the copper plate on longer side of the mold and the cooling water, $d_S$ is the thickness of the solidified shell, $d_P$ is the thickness of the mold powder layer, and dm is the thickness of the copper plate on longer side of the mold.

The thickness of copper plate on longer side of the mold, ($d_m$), and the thermal conductivity of copper plate on longer side of the mold, ($\lambda_m$) are fixed by the applied apparatus. The thermal conductivity ($\lambda_S$) of the solidified shell is fixed by the applied steel type. The thickness of mold powder layer ($d_P$) is fixed by the kind of the mold powder, the amplitude, frequency, and wave shape of the vibration of the mold, and the slab-drawing speed. The thermal conductivity ($\lambda_P$) of the mold powder layer is known as almost constant independent of the kind of mold powder. The heat transfer coefficient ($h_W$) between the copper plate on longer side of the mold and the cooling water becomes constant if the flow rate of the cooling water 405 and the surface roughness of the copper plate 404 on longer side of the mold are determined. Also the heat transfer coefficient ($h_m$) between the mold powder layer and the copper plate on longer side of the mold becomes almost constant if the kind of the mold powder is selected.

The convection heat transfer coefficient ($\alpha$) between the molten steel and the solidified shell, however, varies with the flow speed of molten steel along the surface of the solidified shell 402. The convection heat transfer coefficient ($\alpha$) can be expressed by eq. (24) which is an approximation to a flat plate.

$$\alpha = N_U \times \lambda_1 / X_1 \tag{24}$$

where, Nu is the Nusselt number, $\lambda_1$ is the thermal conductivity, and $X_1$ is the representative length for heat transfer.

The Nusselt number (Nu) is expressed by eq. (25) and eq. (26) for individual ranges of flow speed of molten steel.

$$N_U = 0.664 \times Pr^{1/3} \times Re^{4/5} (U < U_0) \tag{25}$$

$$N_U = 0.036 \times Pr^{1/3} \times Re^{1/2} (U \geqq U_0) \tag{26}$$

where, Pr is the Prandtl number, Re is the Reynolds number, U is the flow speed of molten steel, and $U_0$ is the transition speed between laminar flow and turbulent flow of molten steel.

The Prandtl number (Pr) and the Reynolds number (Re) are expressed by eq. (27) and eq. (28), respectively.

$$Pr = 0.1715 \tag{27}$$

$$Re = U \times X_2 / \nu \tag{28}$$

where, $X_2$ is the representative length of molten steel flow, and $\nu$ is the dynamic viscosity of molten steel.

The heat flux transferred from the molten steel 401 to the cooling water 405 is expressed by eq. (29).

$$Q = (T_0 - T_W)/R \tag{29}$$

where, Q is the heat flux transferred from the molten steel to the cooling water, $T_0$ is the temperature of molten steel, and $T_W$ is the temperature of cooling water.

The surface temperature of cooling water 405 of the copper plate 404 on longer side of the mold is expressed by eq. (30).

$$T_{mL} = T_W + Q/h_W \tag{30}$$

where, $T_{mL}$ is the surface temperature of the copper plate on longer side of the mold at the side of cooling water.

The temperature of copper plate on longer side of the mold measured by the temperature measurement element 406 is expressed by eq. (31).

$$T = T_{mL} + Q \times (d_m - d)/\lambda_m \tag{31}$$

where, T is the temperature of copper plate on longer side of the mold measured by the temperature measurement element, and d is the distance between the surface of copper plate on longer side of the mold at molten steel side to the tip of the temperature measurement element.

By combining eq. (30) with eq. (31), the temperature of copper plate on longer side of the mold, (T), is expressed by eq. (32).

$$T = T_W + Q/h_W + Q \times (d_m - d)\lambda_m \tag{32}$$

Consequently, the steps for deriving the flow speed of molten steel, (U), from the temperatures of copper plate on longer side of the mold, (T), are the following. First, the value of the temperature of copper plate on longer side of the mold, (T), measured by the temperature measurement element is entered to eq. (32) to derive the heat flux (Q). In eq. (13), since all the variables in the right hand member except for the heat flux (Q) are known, the heat flux (Q) can be derived. Then, thus derived heat flux (Q) value is entered to eq. (29) to derive the overall heat resistance (R). Since all the variables in the right hand member except for the overall heat resistance (R) are known, the overall heat resistance (R) can be calculated. Next, the overall heat resistance (R) is entered to eq. (23) to derive the convection heat transfer coefficient ($\alpha$). Since all the variables in the right hand member except for the convection heat transfer coefficient ($\alpha$) are known, the convection heat transfer coefficient ($\alpha$) can be calculated. By entering the derived convection heat transfer coefficient ($\alpha$) to eq. (24) to determine the Nusselt number (Nu), then by entering thus derived Nusselt number (Nu) to eq. (25) or eq. (26) to derive the Reynolds number (Re). Finally, the derived Reynolds number (Re) is entered to eq. (28) to determine the flow speed of molten steel (U). In this manner, according to the present invention, the flow speed of molten steel (U) along the boundary of solidification can be estimated by grasping the variations of temperature (T) of copper plate on longer side of the mold, which variations are induced from the variations of convection heat transfer coefficient ($\alpha$) between the molten steel and the solidified shell, caused from the flow speed (U) of molten steel.

Figure 73:
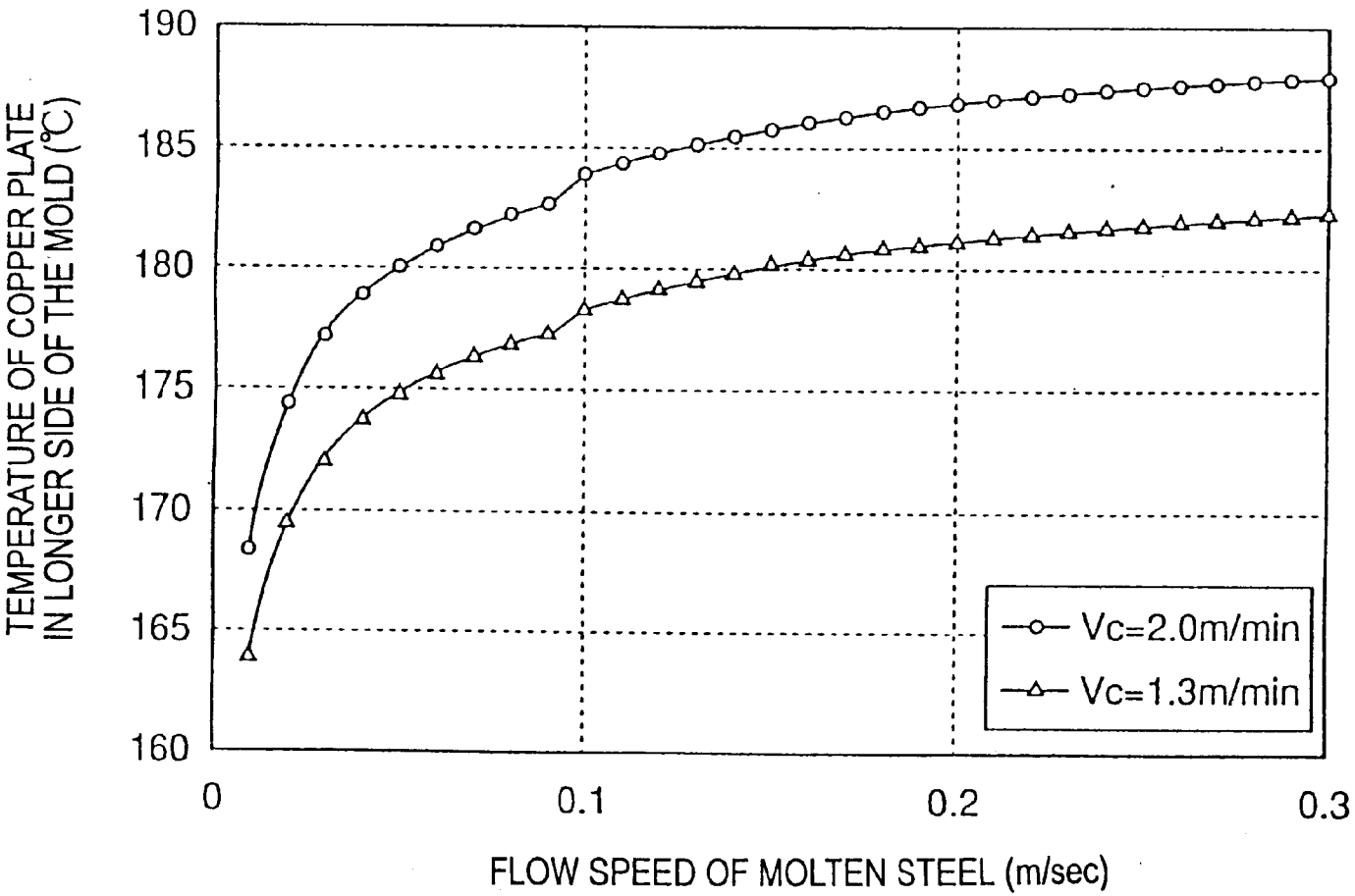
FIG. 73 shows an example of the relation between the temperature of mold copper plate and the molten steel flow speed of the Embodiment 5.

FIG. 73 shows an example of the relation between the molten steel flow speed and the temperature of copper plate on longer side of the mold derived from the above-described principle. As shown in FIG. 73, the flow speed of molten steel significantly differs with the slab-drawing speed even on the same temperature of copper plate on longer side of the mold, thus enabling the estimation of the molten steel flow speed based on the temperature of copper plate on longer side of the mold. FIG. 73 is the calculated result of the molten steel flow speed from the temperatures of copper plate on longer side of the mold based on the variables listed in Table 7. Table 7 shows an example of individual variables under a casting condition of 2.0 and 1.3 m/min of slab-drawing speeds. The calculation was given by assuming the transition speed ($U_0$) between laminar flow and turbulent flow as 0.1 m/sec. The reference symbol Vc of Table 7 and FIG. 73 designates the slab-drawing speed.

TABLE 7

| | Variable | Value |
|---|---|---|
| 1 | Thermal conductivity of solidified shell ($\lambda$) | 20 W/m · K |
| 2 | Thermal conductivity of mold powder layer ($\lambda_p$) | 1.5 W/m · K |
| 3 | Thermal conductivity of mold copper plate ($\lambda_m$) | 300 W/m · K |
| 4 | Heat transfer coefficient between mold powder layer and mold copper plate ($h_m$) | 2500 W/m · K |
| 5 | Heat transfer coefficient between mold copper plate and cooling water ($h_w$) | 28750 W/m$^2$ · K |
| 6 | Thickness of mold copper plate ($d_m$) | 0.04 m |
| 7 | Distance between the surface of copper plate of mold at the side of molten steel to the temperature measurement element (d) | 0.013 m |
| 8 | Temperature of cooling water ($T_w$) | 25° C. |

TABLE 7-continued

| Variable | Value |
|---|---|
| 9 Thickness of solidified shell ($d_s$) | 0.00348 m (Vc = 2.0 m/min)<br>0.00432 m (Vc = 1.3 m/min) |
| 10 Thickness of mold powder layer ($d_p$) | 0.0006 m |
| 11 Temperature of molten steel ($T_0$) | 1545° C. |
| 12 Thermal conductivity of molten steel ($\lambda_1$) | 33.44 W/m$^2$ · K |
| 13 Representative heat transfer length ($X_1$) | 0.23 m |
| 14 Representative flow length of molten steel ($X_2$) | 0.23 m |
| 15 Dynamic viscosity of molten steel (ν) | $1 \times 10^{-6}$ m$^2$/sec |

As described above, the molten steel flow speed in the mold can be determined from the temperatures of copper plate on longer side of the mold. To this point, the inventors of the present invention carried out a series of tests using the above-described continuous casting machine while arranging plurality of temperature measurement elements on the copper plate on longer side of the mold along the width thereof, thus estimating the flow speed of molten steel in the mold and the flow speed distribution of molten steel in the mold width direction. Alumel-chromel thermocouple (JIS thermocouple K) was used as the temperature measurement element. The temperature measurement contact of the thermocouple was set to 50 mm below the meniscus, to 13 mm of distance (d) between the surface of copper plate on longer side of the mold at the side of molten steel and the tip of the thermocouple, and to 66.5 mm of intervals between adjacent thermocouples. The row of the thermocouples covers the length of 2,100 mm on the copper plate on longer side of the mold in width direction thereof. The electromotive force signals of each of the thermocouples are transmitted to the zero-point compensator via a compensation lead, where the electromotive force signals are converted to current analog output (4 to 20 mA) to enter a data collection and analysis personal computer.

Figure 74:
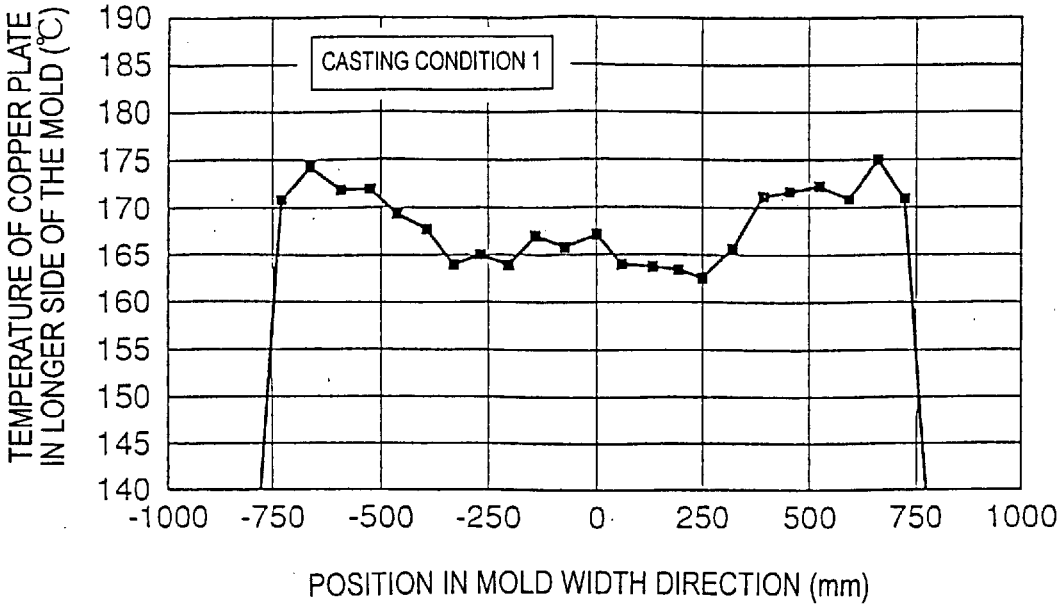
FIG. 74 shows an example of the measurement of temperatures of copper plate on longer side of the mold of the Embodiment 5.
Figure 75:
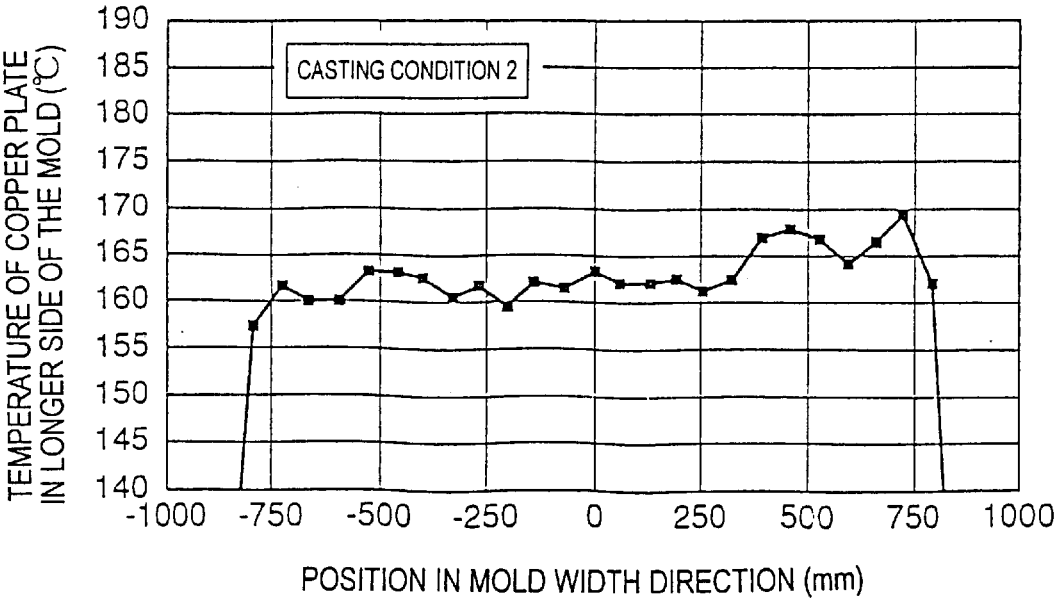
FIG. 75 shows another example of the measurement of temperatures of copper plate on longer side of the mold of the Embodiment 5.

The measured results of the temperatures of copper plate on longer side of the mold are given in FIG. 74 and FIG. 75. FIG. 74 is the result of measurement under the condition (Casting condition 1) of 220 mm in thickness of slab, 1,650 mm in width of slab, 1.85 m/min of slab-drawing speed, 10 Nl/min of Ar gas injection rate to the immersion nozzle, and 260 mm of immersion depth of the immersion nozzle. FIG. 75 is the result of measurement under the condition (Casting condition 2) of 220 mm in thickness of slab, 1,750 mm in width of slab, 1.75 m/min of slab-drawing speed, 10 Nl/min of Ar gas injection rate to the immersion nozzle, and 260 mm of immersion depth of the immersion nozzle. Both FIG. 74 and FIG. 75 significantly reduce the temperature at both ends of the mold in width thereof, which is caused from the presence of shorter side of the mold at near the position of significant reduction in temperature.

Figure 76:
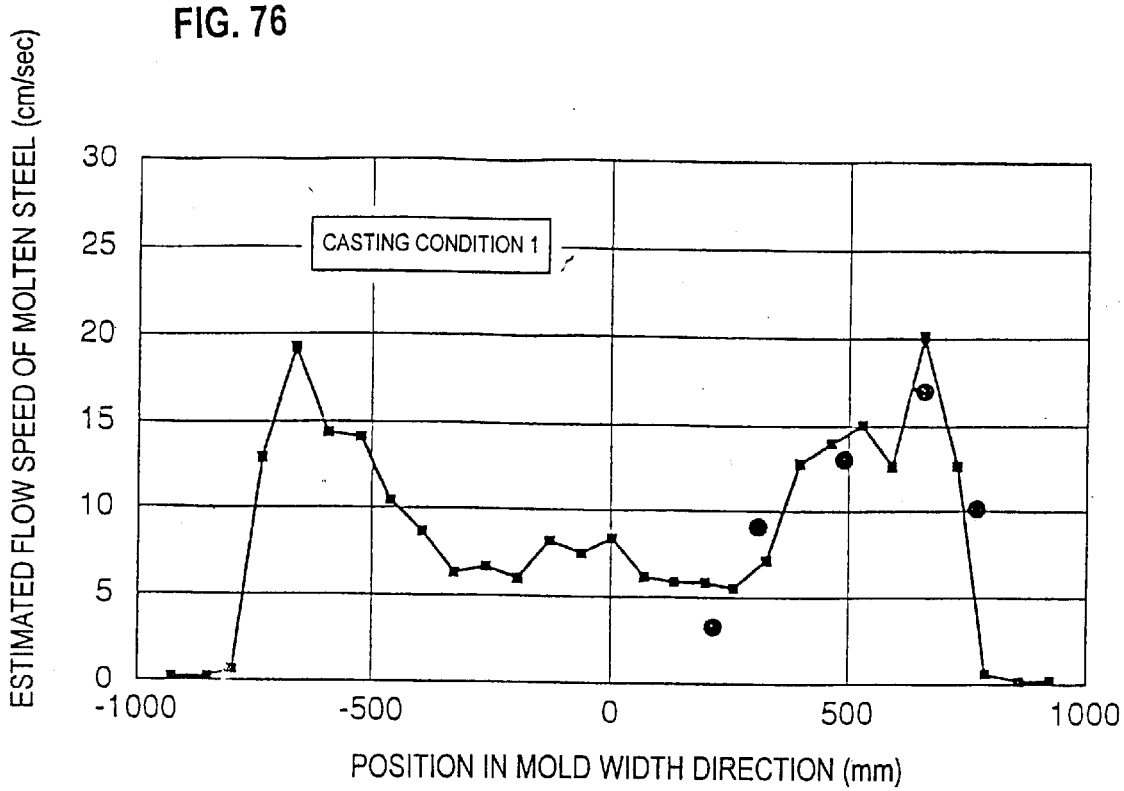
FIG. 76 show the molten steel flow speed converted from the temperatures of copper plate on longer side of the mold given in FIG. 74.
Figure 77:
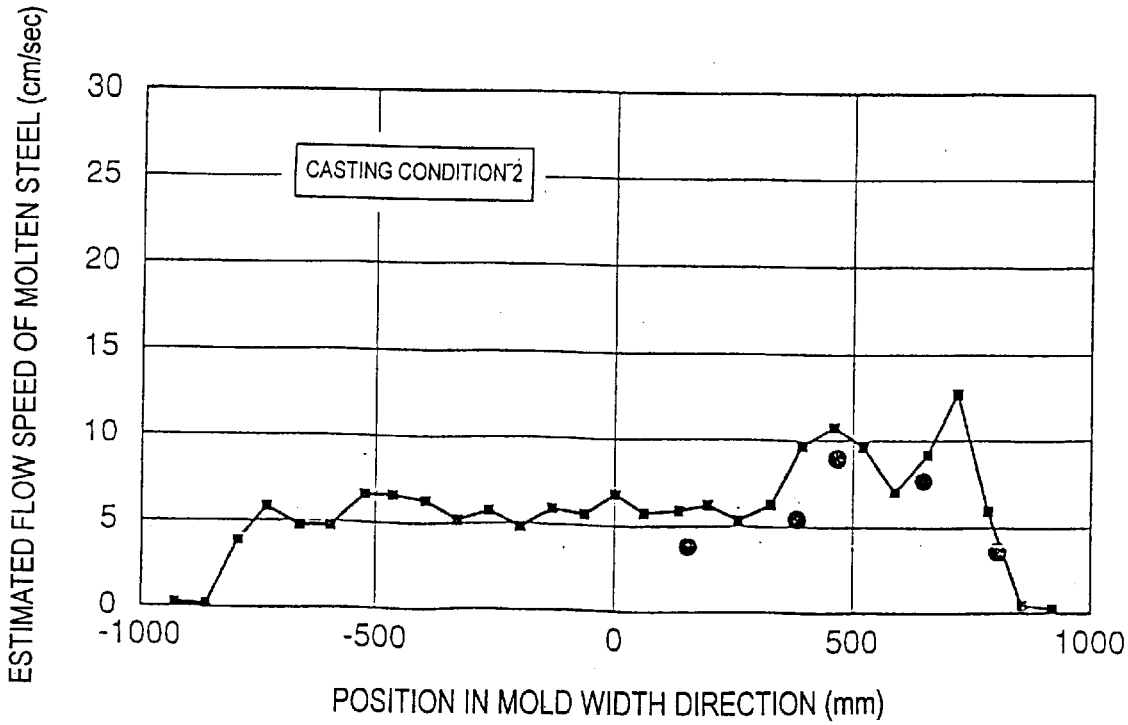
FIG. 77 show the molten steel flow speed converted from the temperatures of copper plate on longer side of the mold given in FIG. 75.

FIG. 76 and FIG. 77 show the molten steel flow speed derived from the temperatures of copper plate on longer side of the mold given in FIG. 74 and FIG. 75, respectively, using the above-described conversion method. The symbol ● in these figures designates the estimated value of molten steel flow speed in the vicinity of the meniscus determined by immersion rod type flow speed meter for the meniscus molten steel. As seen in FIG. 76 and FIG. 77, it was found that the flow speed of molten steel estimated from the temperatures of copper plate on longer side of the mold and the flow speed of molten steel measured by the immersion rod type flow speed meter for the meniscus molten steel agreed to each other. As of the variables in Table 7, the thickness (ds) of solidified shell was set to 0.00362 m under the Casting condition 1, and 0.00372 m under the Casting condition 2.

With the method, adequate selection of the distance (d) between the surface of copper plate on longer side of the mold and the tip of the temperature measurement element assures sufficient time constant of variations of output of temperature measurement element to grasp the change of flow speed of molten steel at any time.

According to the method, the time constant of the variations of output of temperature measurement elements is satisfactory to determine the variations of flow speed of molten steel at any time, by adequately gasping the distance (d) between the surface of copper plate on longer side of the mold and the tip of the temperature measurement element.

According to the conversion method, when the flow pattern of the molten steel in the mold is the Pattern B, it was found that the flow give relatively flat speed distribution providing 0.25 m/sec or smaller difference between the maximum value and the minimum value of the flow speed, and that, in view of the symmetry in right half and left half of the width of the mold, the difference of flow speed at symmetrical positions in right and left to the center of the mold width is 0.20 m/sec or less. The difference in speed referred in this invention designates the difference in absolute values of flow speed independent of the flow direction of the molten steel.

Since the present invention sets the difference between the maximum value and the minimum value of the flow speed distribution of molten steel on the copper plate on longer side of the mold in the width direction thereof to 0.25 m/sec or less, and, preferably further controls the difference of flow speed of molten steel at symmetrical positions in right and left to the immersing nozzle on the copper plate on longer side of the mold in the width direction thereof to 0.20 m/sec or less, the flow of molten steel in the mold is controlled to the Pattern B, thus improving the product quality.

The measured temperatures at portions near the copper plate on shorter side of the mold become low owing to the cooling effect of the copper plate on shorter side of the mold. Therefore, the present invention eliminates the temperatures of copper plate on longer side of the mold in a range of from the surface of copper plate on shorter side of the mold at the side of molten steel to the point of 150 mm toward the center of the mold width from the monitoring target range.

Figure 78:
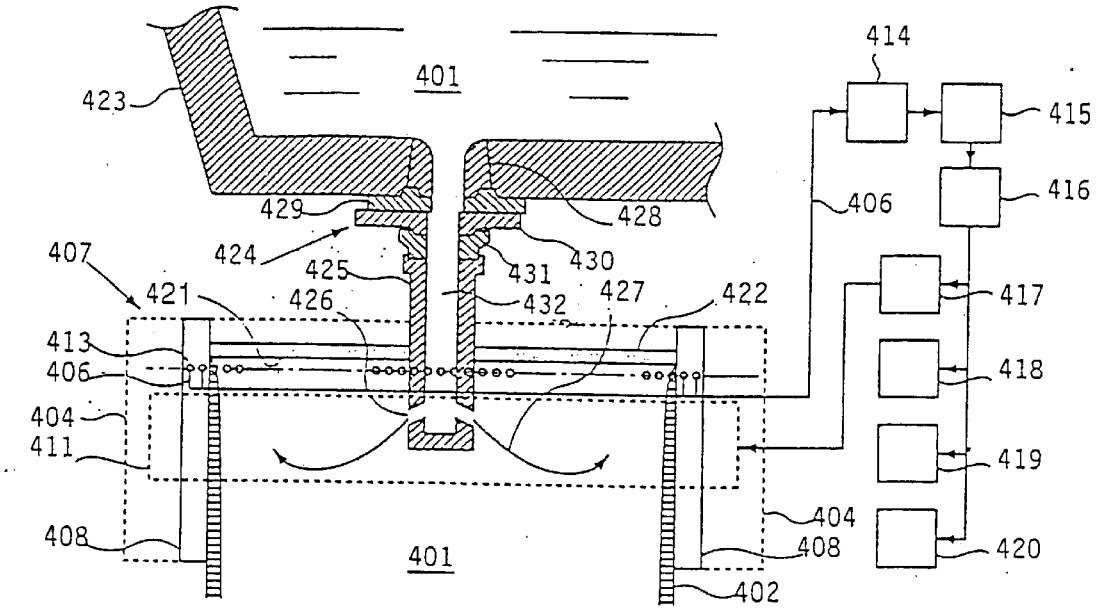
FIG. 78 is a schematic drawing of cross sectional front view of the casting section of a continuous casting machine of the Embodiment 5.
Figure 79:
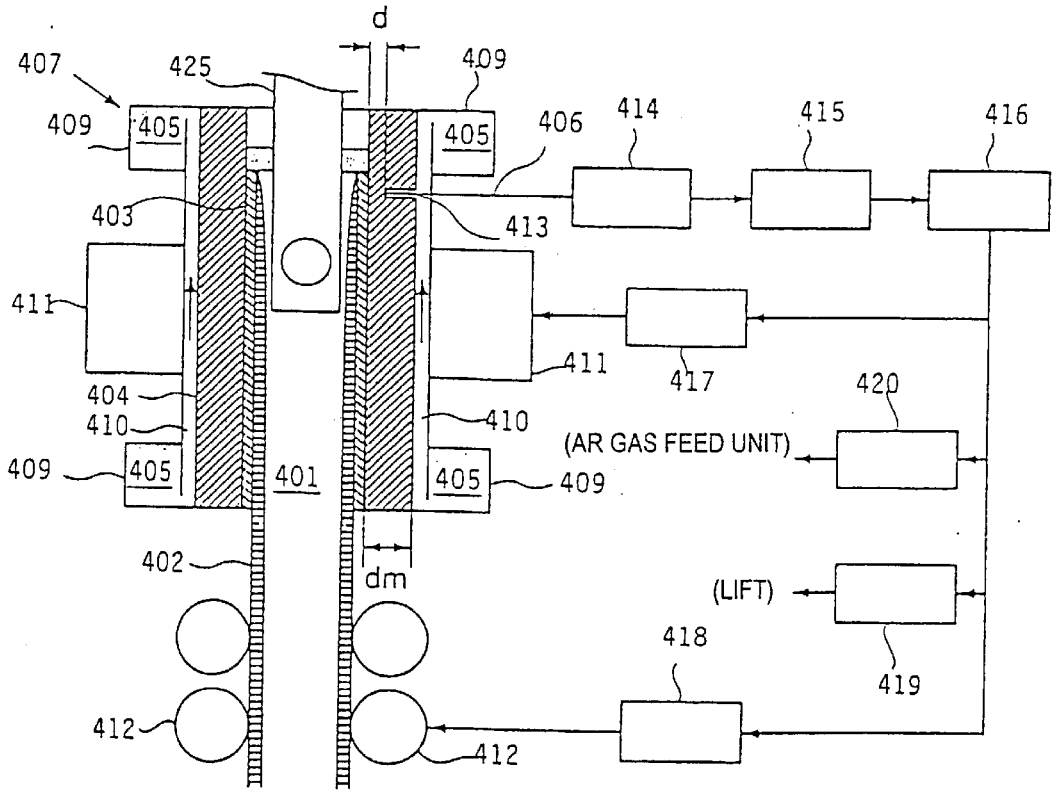
FIG. 79 is a schematic drawing of cross sectional side view of the casting section of the Embodiment 5.

The present invention is described referring to the drawings. FIG. 78 is a schematic drawing of cross sectional front view of the casting section of a continuous casting machine, showing a mode to carry out the present invention. FIG. 79 is a schematic drawing of cross sectional side view of the casting section of FIG. 78.

As seen in FIGS. 78 and 79, a tundish 423 which is mounted on a tundish car (not shown) is located at a specified position above a mold 407 which comprises a pair of copper plates 404 on longer side of the mold and a pair of copper plates 404 on shorter side of the mold, which pair of copper plates 408 on shorter side of the mold are inserted between the pair of copper plates 404 on longer side of the mold, and each of the longer sides and each of the shorter sides faces to each other, respectively. The tundish 423 is ascended and descended by a lift (not shown) mounted to the tundish car, and is held at a specified position. The lift is controlled by a lift controller 419.

At each of the upper section and the lower section of the rear face of the copper plate 404 on longer side of the mold, a water box 409 is installed. A cooling water 405 supplied from the water box 409 on longer side of the mold at lower section of the rear face passes through a water path 410 to cool the copper plate 404 on longer side of the mold, then flows out to the water box 409 on longer side of the mold at upper section of the rear face. The thickness between the copper plate 404 on longer side of the mold and the water path 410, or the thickness of the copper plate on longer side of the mold is $d_m$. The copper plate 408 on shorter side of the mold is cooled in a similar manner, though the drawings do not give the illustration.

A magnetic field generator 411 is installed on rear face of the copper plate 404 on longer side of the mold. The magnetic field generated by the magnetic field generator 411 may be static one or dynamic one. The intensity of the magnetic field generated by the magnetic field generator 411 is controlled by the magnetic field intensity controller 417. To easily control the flow of molten steel in the mold 407, it is preferable to make the intensity of magnetic field generated by the magnetic field generator 411 adjustable separately in right side and left side on the mold width to the immersion nozzle 425.

At the bottom of the tundish 423, an upper nozzle 428 is located. A sliding nozzle 424 comprising a fixing plate 429, a sliding plate 430, and a streaming nozzle 431 is located to connect with the upper nozzle 428. Furthermore, an immersion nozzle 425 is located on the bottom face of the sliding nozzle 424, thus forming a tapping hole 432 for the molten steel from the tundish 423 to the mold 407.

The molten steel 401 which was poured from a ladle (not shown) to the tundish 423 is injected in the mold 407 as an injected flow 427 toward the copper plate 408 on shorter side of the mold through an injection hole 426 that is located at lower portion of the immersion nozzle 425 and that is immersed in the molten steel 401 in the mold 407, via the injection hole 426 of the molten steel. The molten steel 401 is cooled in the mold 407 to form a solidified shell 402, which is then drawn downward from the mold 407 to become an slab. At that moment, a mold powder 422 is added to the surface of the meniscus 421 in the mold 407. The mold powder 422 is fused to flow in between the solidified shell 402 and the mold 407 to form a mold powder layer 403. The drawing roll 412 is controlled by an slab-drawing speed controller 418.

The upper nozzle 418 is made of a porous brick. To prevent adhesion of alumina onto the wall surface of the tapping hole 432 of the molten steel, Ar gas is introduced to the tapping hole 432 of the molten steel through the upper nozzle 428 via an Ar conduit (not shown) and the Ar supply unit comprising the Ar gas flow rate regulating valve (not shown) inserted in the Ar gas conduit. The introduced Ar gas enters the mold 407 along with the molten steel 401 via the immersion nozzle 425 and the injection hole 426, passes through the molten steel 401 in the mold 407 to ascend to a meniscus 421, then penetrates a mold powder 422 added onto the meniscus 421 to diffuse in atmosphere.

On the rear face of the copper plate 404 on longer side of the mold, plurality of holes are drilled along a line in the width direction of the copper plate 404 on longer side of the mold. These holes act as the measurement points 413 to measure the temperatures of copper plate 404 on longer side of the mold. A temperature measurement element 413 is inserted into each of the measurement points 406 contacting the bottom of the hole on the copper plate 404, keeping the distance, d, between the surface of the copper plate 404 on longer side of the mold and the tip of the temperature measurement element 406. To accurately grasp the variations of flow speed of molten steel at any time, the distance (d) is preferably kept to 16 mm or less. To eliminate the influence of temperature variations caused from the vertical movements of the meniscus 421 during casting, it is preferable to keep the distance between the meniscus 421 and the measurement point 413 to 10 mm or more. Furthermore, to accurately grasp the temperature distribution in the mold width direction, the distance between adjacent measurement points is preferably kept to 200 mm or less.

The other end of the temperature measurement element 406 is connected to a zero-point compensator 414. The electromotive force signals generated from the temperature measurement element 406 enter a converter 415 via the zero-point compensator 414, where the electromotive force signals are converted to current signals, which current signals then enter a data analyzer 416. The data analyzer 416 has a function to compute the flow speed of molten steel based on the temperatures of copper plate on longer side of the mold. The output of the data analyzer 416 is transmitted to the magnetic field intensity controller 417, the slab-drawing speed controller 418, the lift controller 419, and the Ar gas injection rate controller 420. To a void direct cooling of the tip of the temperature measurement element 406, which tip is the contact for temperature measurement, by the cooling water 405, the temperature measurement point 413 is isolated from the cooling water by a sealing material (not shown). Any type of temperature measurement element 406 may be applied, such as thermocouple and resistance thermometer, if only it has ±1° C. or higher accuracy.

With the continuous casting machine having above-described configuration, the flow of the molten steel in the mold is controlled following the procedure described below. The data analyzer 416 grasps the maximum and the minimum values of the temperatures at any time based on the temperature distribution on the copper plate on longer side of the mold in the mold width direction thereof, and grasps the temperature difference between symmetrical positions to the copper plate 404 on longer side of the mold in right and left to the immersion nozzle 425. Then, the data analyzer 416 transmits the control signals to one or more of the magnetic field intensity controller 417, the slab-drawing speed controller 418, the lift controller 419, and the Ar gas injection rate controller 420 so as the temperature difference at symmetrical positions in right and left in the width direction of the copper plate 404 on longer side of the mold to become 10° C. or less. Responding to thus transmitted control signals, each controller changes the magnetic field intensity, the slab-drawing speed, the immersion depth of the immersion nozzle 425, and the Ar gas injection rate to control the flow of molten steel.

Based on eqs. (23) through (32), the data analyzer estimates the flow speed of molten steel at each measurement point 413 using the data of the temperature of copper plate on longer side of the mold, the thickness ($d_m$) of copper plate on longer side of the mold, the above-described distance (d), the temperature of molten steel, the temperature of cooling water, and other variables. Thus, the data analyzer determines the flow speed distribution of molten steel on the copper plate 404 on longer side of the mold in the width direction thereof, then transmits the control signals to one or more of the magnetic field intensity controller 417, the slab-drawing speed controller 418, the lift controller 419, and the Ar gas injection rate controller 420 so as the difference in flow speed of molten steel at symmetrical positions in right and left in width of the copper plate 404 on longer side of the mold to the immersion nozzle 25 to become 0.20 m/sec or less. Responding to thus transmitted control signals, each controller changes the magnetic field intensity, the slab-drawing speed, the immersion depth of the immersion nozzle 425, and the Ar gas injection rate to control the flow of molten steel.

On controlling the flow of molten steel using the magnetic field generator 411, experience of the inventors of the present invention tells that 30 seconds are necessary for the flow of molten steel in the mold 407 to reach a steady state. Accordingly, the changes of magnetic field intensity are preferably done at intervals of 30 seconds or more.

As of the fifteen variables, shown in Table 7, structuring eqs. (23) through (32), three variables, (1) thickness ($d_S$) of the solidified shell, (2) thickness ($d_P$) of the mold powder layer, and (3) heat transfer coefficient ($h_W$) between the mold copper plate and the cooling water, vary with the structure conditions and cannot be directly measured during casting. These three variables, however, can be preliminarily investigated on their variations of values accompanied with the changes of casting conditions through an actual facility test or a simulation test. Then, the flow speed of molten steel may be computed on the values corresponding to the casting condition on measuring the temperature of mold copper plate. Other twelve variables can be determined from the facility conditions and the physical properties thereof.

With thus established control of flow of molten steel in the mold, the molten steel flow in the mold can be controlled to an adequate flow pattern on on-line basis and real-time basis, thus the production of slab with extremely clean at a stable state.

The above-given description applied the temperature measurement elements 406 arranged along the width direction of copper plate 404 on longer side of the mold. They can be arranged in plural rows in the casting direction. The above-given description applied the temperature measurement elements 406 only on one side of the copper plate 404 on longer side of the mold. They can be mounted on both the copper plates 404 on longer side of the mold. The position of Ar gas injection into the tapping hole 432 of molten steel is not limited to the upper nozzle 428, and it may be at the fixing plate 429 or the immersion nozzle 425.

EXAMPLE 1

Example 1 is an example for estimating flow speed of molten steel using the slab continuous casting machine and the temperature measurement device for mold copper plate given in FIG. 78. The continuous casting machine applied was a vertical and bending type having 3 meters of vertical section, which machine produced slab of max. 2,100 mm in width. Table 8 shows the specification of the applied continuous casting machine.

TABLE 8

| Item | Specification |
|---|---|
| Type of continuous casting machine | Vertical and bend type |
| Length of vertical section | 3 m |
| Capacity of molten steel in ladle | 250 ton |
| Capacity of molten steel in tundish | 80 ton |
| Thickness of slab | 220 to 300 mm |
| Width of slab | 675 to 2100 mm |
| Slab-drawing speed | max. 3 m/min |
| Immersion nozzle | Downward 25 deg., tapping hole 80 mm in diameter |

The thickness ($d_m$) of copper plate on longer side of the mold was 40 mm. The temperature measurement element applied alumel-chromel (JIS thermocouple K). The thermocouples were buried under the conditions of: 13 mm of the distance (d) between the surface of mold copper plate on the side of molten steel and the tip of thermocouple (contact of measurement), 66.5 mm of the interval of adjacent thermocouples, 50 mm of the distance from the meniscus, covering the range of 2,100 mm in width direction of the mold. The temperatures of copper plate on longer side of the mold were measured for the case of casting slab of 220 mm in thickness and 1,875 mm in width at 1.60 m/min of drawing speed. The casting condition was 1.60 m/min of slab-drawing speed, 10 Nl/min of Ar gas injection rate, and 260 mm of immersion depth of immersion nozzle. The moving magnetic field was applied from the magnetic field generator in the direction of controlling the injection flow. Table 9 summarizes the magnetic field generator.

TABLE 9

| Item | Specification |
|---|---|
| Type of magnetic field | Moving magnetic field |
| Capacity | 2000 kVA |
| Voltage | 430 V (max) |
| Current | 2700 A (max) |
| Frequency | 2.6 Hz (max) |
| Magnetic flux density | 0.21 tesla (max) |

Figure 80:
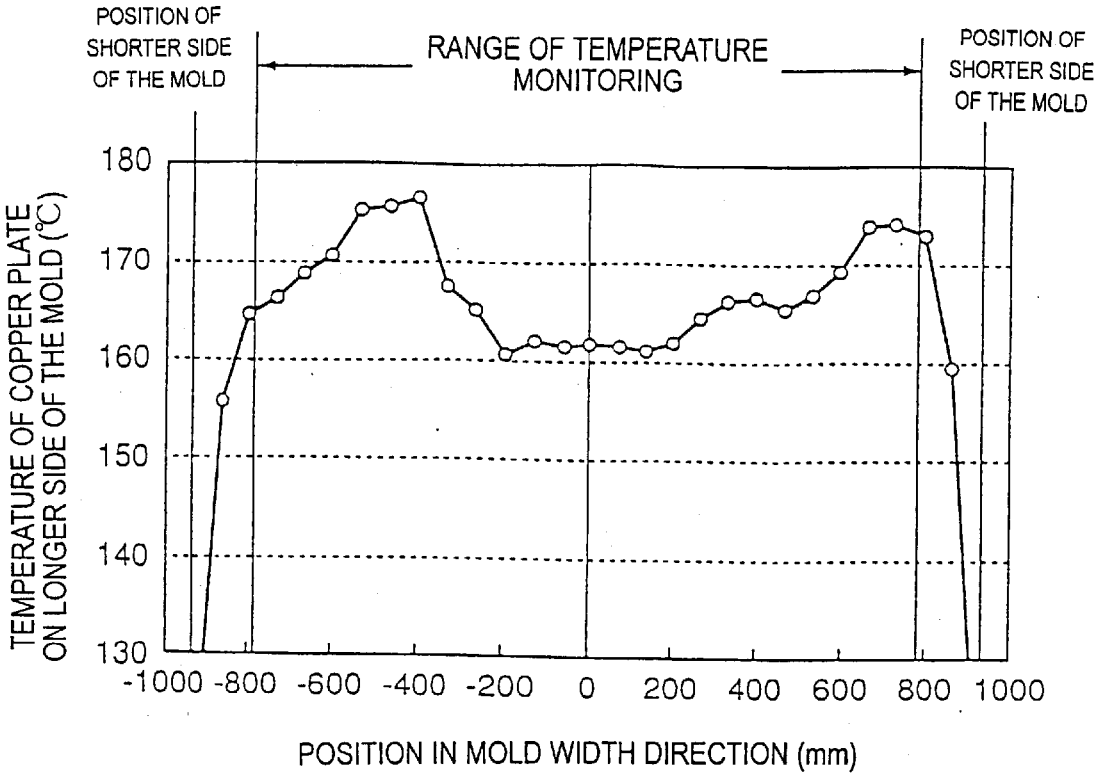
FIG. 80 shows a result of measured temperatures of mold copper plate in Example 1 of the Embodiment 5.

First, casting was carried out under 0.03 tesla of magnetic flux density generated from the magnetic field generator. FIG. 80 shows the result drawing the temperature distribution on copper plate on longer side of the mold. The temperature distribution showed that the temperatures near the copper plate on shorter side of the mold became high, thus it was suggested that, at the meniscus, the flow speed of molten steel became high at near the copper plate on shorter side of the mold. In that case, the corresponding state of flow of molten steel in the mold was estimated as that given in FIG. 81. The flow pattern corresponds to the Pattern A of Japanese Patent Laid-Open No. 109145(1998).

Figure 82:
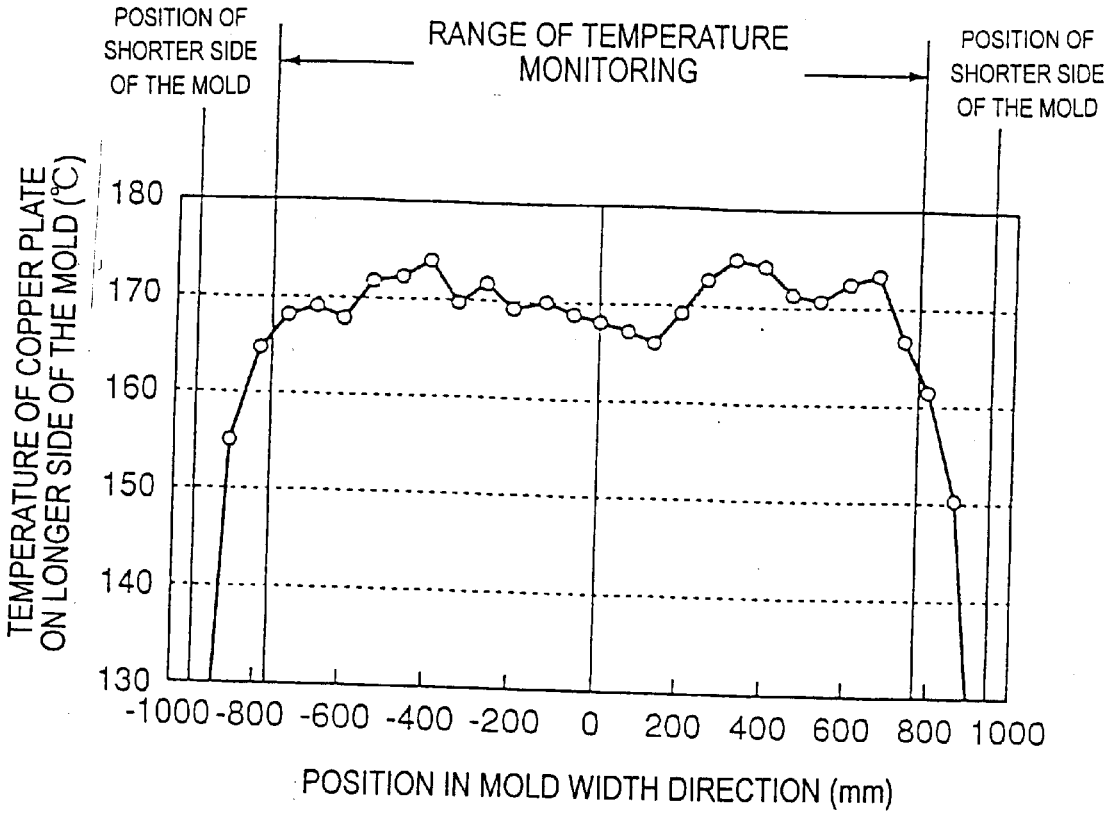
FIG. 82 shows another result of measured temperatures of mold copper plate in Example 1 of the Embodiment 5.

When the power supply to the magnetic field generator was increased to set the magnetic flux density to 0.05 tesla, the temperature distribution of copper plate on longer side of the mold became that shown in FIG. 82. The temperature distribution gave 8° C. of the difference between maximum and minimum values, and gave not more than 10° C. of the temperature difference at symmetrical positions in right half width and left half width of the mold. Consequently, the flow speed of molten steel at meniscus was estimated almost uniform over the mold width. In that case, the state of molten steel in the mold was speculated as the one given in FIG. 83. The flow pattern corresponds to the Pattern B of Japanese Patent Laid-Open No. 109145(1998).

Figure 84:
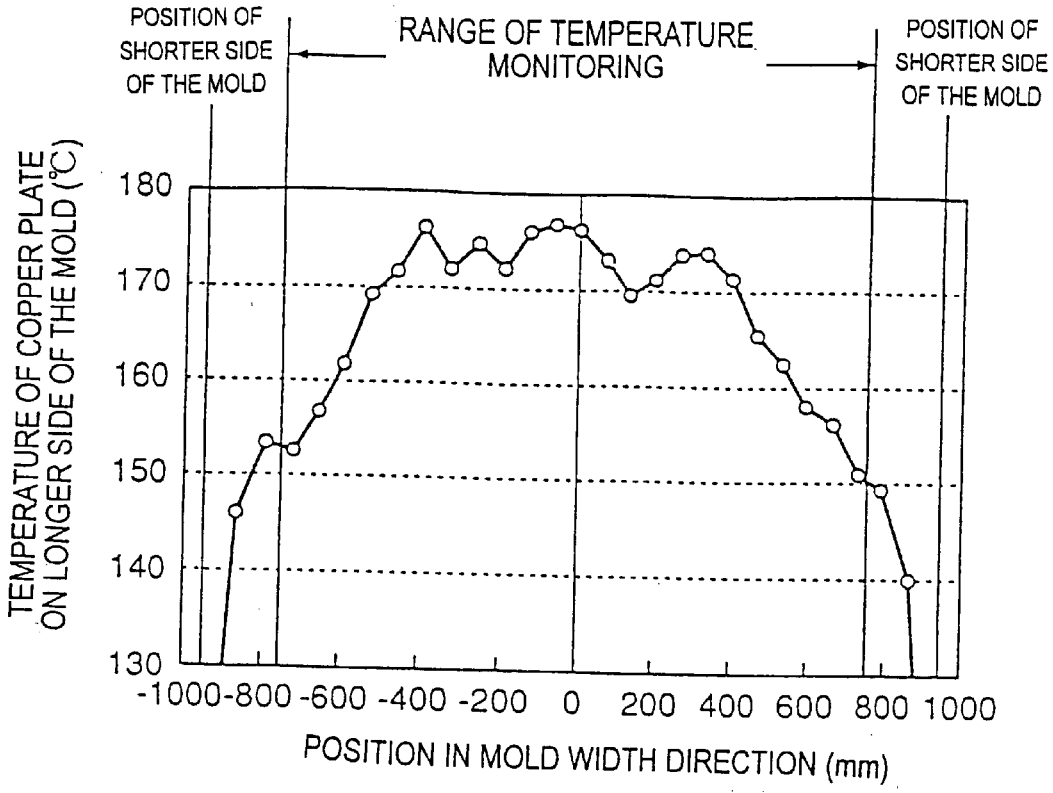
FIG. 84 shows further result of measured temperatures of mold copper plate in Example 1 of the Embodiment 5.

Next, the power supply to the magnetic field generator was further increased to set the magnetic flux density to 0.07 tesla. The result was the temperature distribution of copper plate on longer side of the mold as shown in FIG. 84. In the temperature distribution, the temperature near the immersion nozzle became high, thus the flow speed of molten steel at meniscus was estimated to become highest at near the immersion nozzle. The corresponding state of flow of molten steel in the mold was speculated as that given in FIG. 85. The flow pattern corresponds to the Pattern C of Japanese Patent Laid-Open No. 109145(1998).

Figure 81:
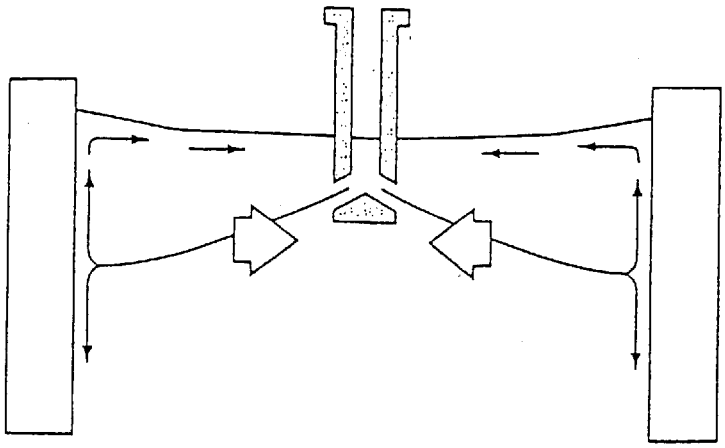
FIG. 81 illustrates the state of molten steel flow estimated from the temperature distribution of FIG. 80.
Figure 83:
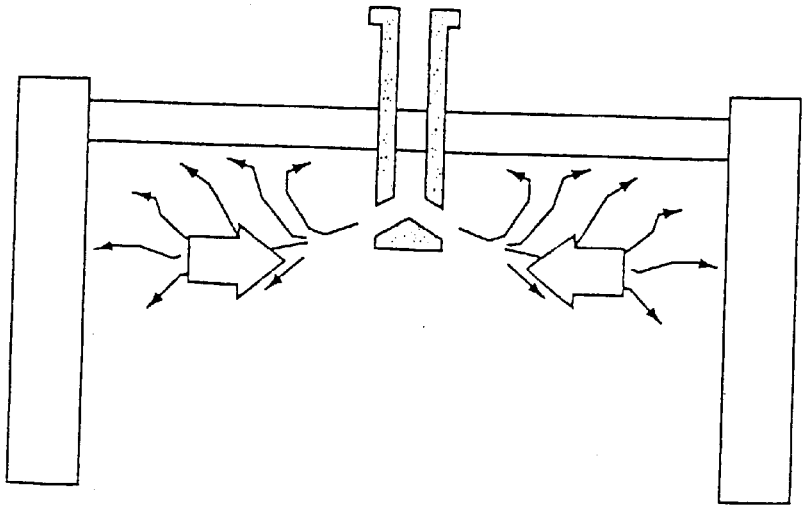
FIG. 83 illustrates the state of molten steel flow estimated from the temperature distribution of FIG. 82.
Figure 85:
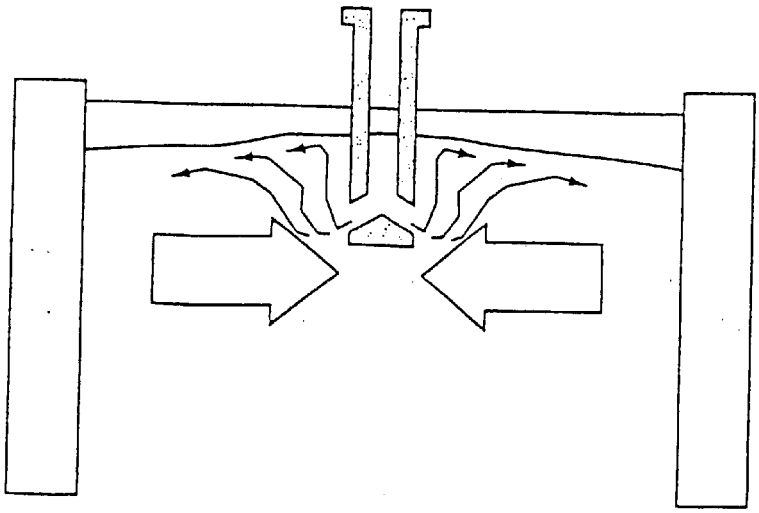
FIG. 85 illustrates the state of molten steel flow estimated from the temperature distribution of FIG. 84.

In this manner, it was found that the control of magnetic field intensity generated from the magnetic field generator can control the state of flow of molten steel in the mold to an adequate flow pattern. In FIGS. 81, 83, and 85, the symbol blank arrow expresses the moving direction of the moving magnetic field.

EXAMPLE 2

The continuous casting machine and the temperature measurement device for mold copper plate applied in Example 1 were used. The casting of slab having 220 mm in thickness and 1,600 mm in width was carried out by applying moving magnetic field in the direction to brake the injection flow using the magnetic field generator. The casting conditions were 1.30 m/min of slab-drawing speed, 10 Nl/min of Ar gas injection rate, and 260 mm of immersion depth of immersion nozzle.

Figure 86:
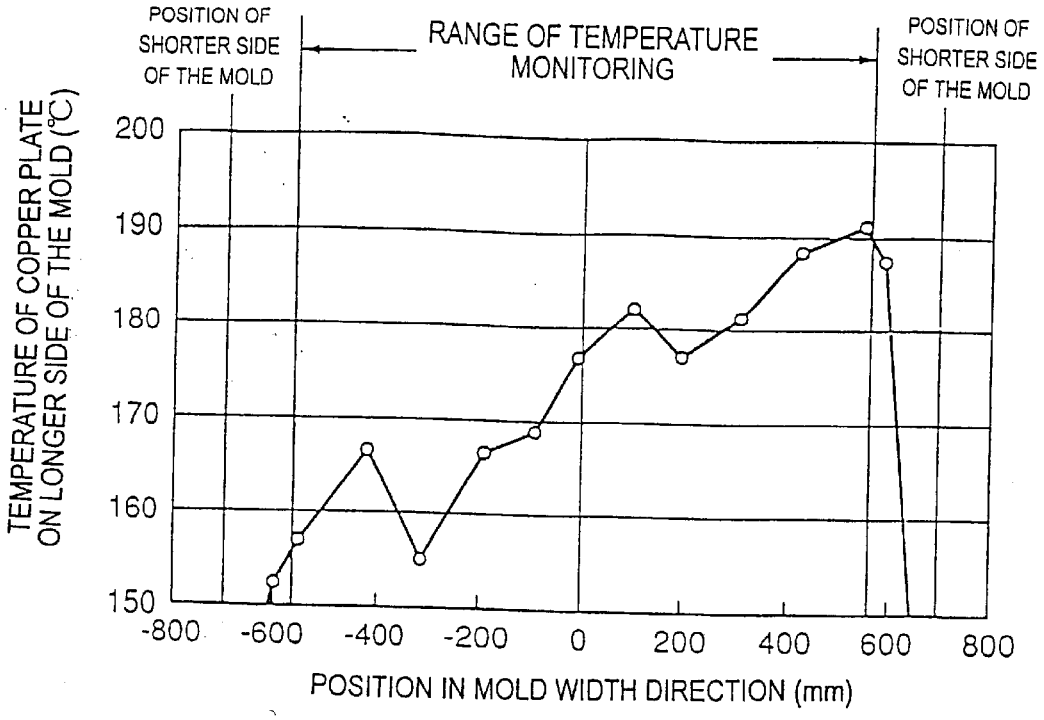
FIG. 86 shows a result of measured temperatures of mold copper plate in Example 2 of the Embodiment 5.

First, casting was carried out under 0.13 tesla of magnetic flux density generated from the magnetic field generator. FIG. 86 shows the result drawing the temperature distribution on copper plate on longer side of the mold. The temperature distribution showed that the temperatures at right side to the center of the slab in the width direction became higher than the left side thereof, thus it was suggested that, at the meniscus, the flow speed of molten steel became high at right half width than that in the left half width. That is, there are deflected flows in right half width and left half width of the mold.

Figure 87:
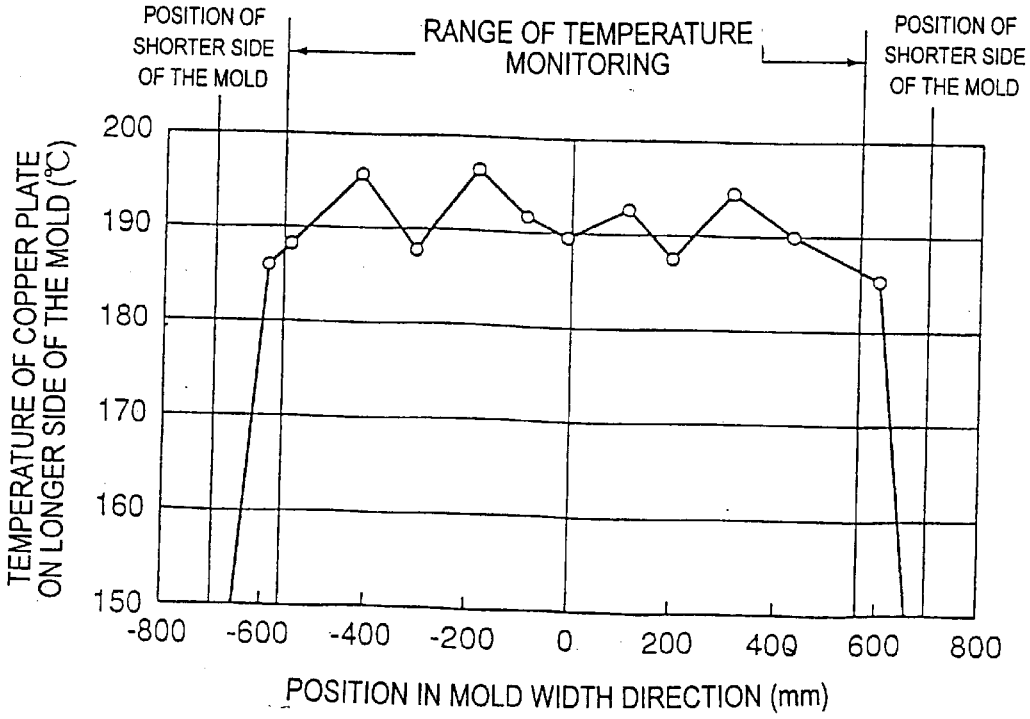
FIG. 87 shows another result of measured temperatures of mold copper plate in Example 2 of the Embodiment 5.

When the magnetic flux density of the magnetic field generator was increased to 0.17 tesla, the temperature distribution became that shown in FIG. 87. The temperature distribution gave 9° C. of the difference between maximum and minimum values, and gave not more than 10° C. of the temperature difference at symmetrical positions in right half width and left half width of the mold. Consequently, the flow speed of molten steel at meniscus was estimated almost uniform over the mold width. Under the condition, the flow speed of molten steel at the meniscus was measured using an immersion rod type molten steel flow speed meter to confirm that the flow pattern corresponds to the Pattern B.

EXAMPLE 3

The continuous casting machine and the temperature measurement device for mold copper plate applied in Example 1 were used. The casting of slab having 220 mm in thickness and 1,600 mm in width was carried out under the casting conditions of 10 Nl/min of Ar gas injection rate and 260 mm of immersion depth of immersion nozzle. In Example 3, no magnetic field generator was used.

Figure 88:
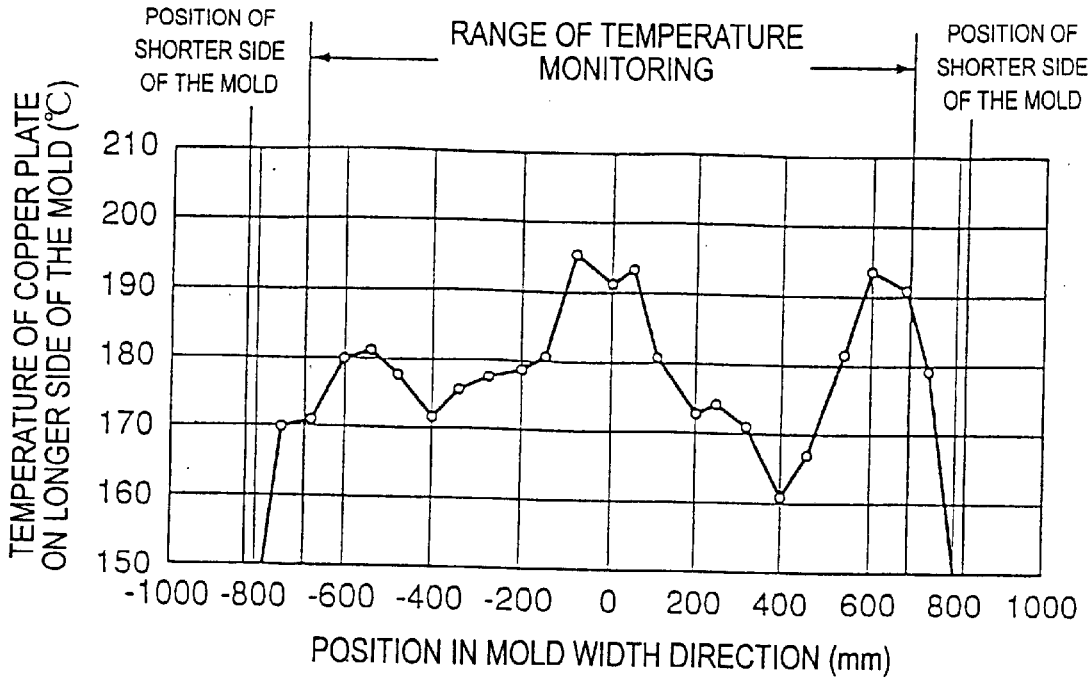
FIG. 88 shows a result of measured temperatures of mold copper plate in Example 3 of the Embodiment 5.

First, the casting was carried out at 1.60 m/min of slab-drawing speed. The resulted temperature distribution on copper plate on longer side of the mold is shown in FIG. 88. The temperature distribution showed the maximum value at near the copper plate on shorter side of the mold and at near the immersion nozzle. The temperature distribution suggested that, at the meniscus, the flow speed of molten steel was high at near the copper plate on shorter side of the mold and at near the immersion nozzle. That is, the molten steel flow near the copper plate on shorter side of the mold came from ascending flow generated from branching upward and downward after colliding the injection flow from the immersion nozzle against the solidified shell on shorter side of the mold. And, the molten steel flow at near the immersion nozzle came from ascending flow of molten steel induced during upward movement of the Ar gas injected into the immersion nozzle at near the injection opening. At a position where both of these molten steel flows met together, or intermediate position between the copper plate on shorter side of the mold and the immersion nozzle, both flows presumably canceled to each other to reduce the flow speed of molten steel. Actually, the temperature distribution observed gave a minimum value.

Figure 89:
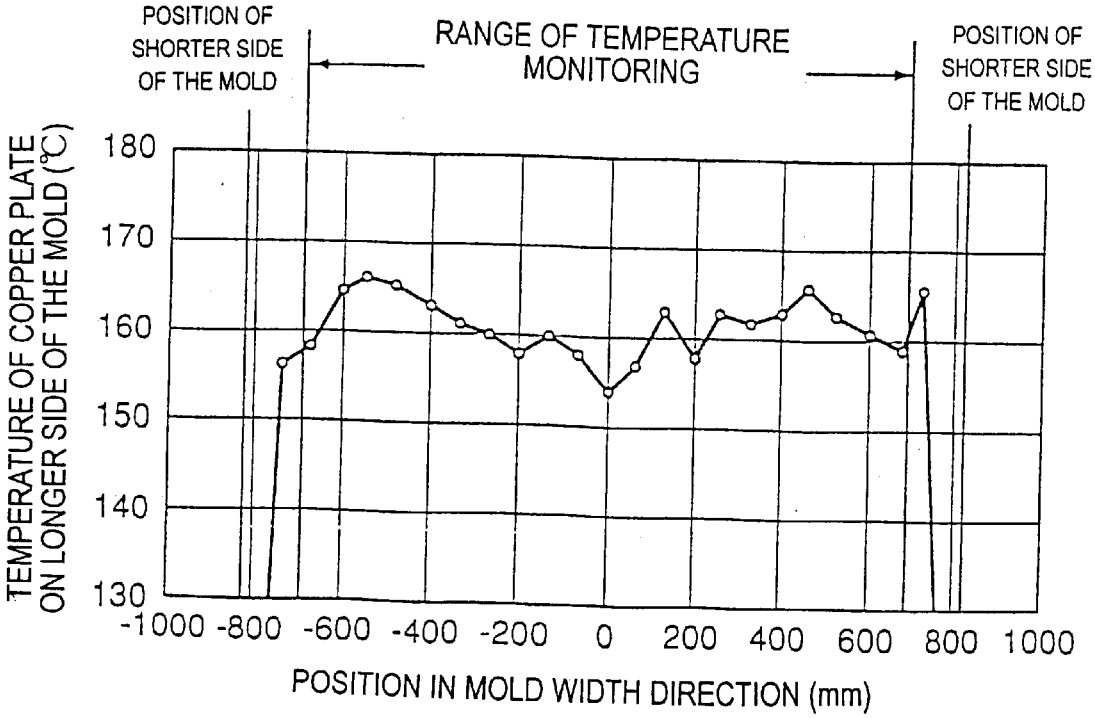
FIG. 89 shows another result of measured temperatures of mold copper plate in Example 3 of the Embodiment 5.

When the slab-drawing speed was reduced to 1.30 m/min, the temperature distribution became as shown in FIG. 89. The temperature distribution gave 12° C. of the difference between maximum and minimum values, and gave not more than 10° C. of the temperature difference at symmetrical positions in right half width and left half width of the mold. Consequently, the flow speed of molten steel at meniscus was estimated almost uniform over the mold width. Under the condition, the flow speed of molten steel at the meniscus was measured using an immersion rod type molten steel flow speed meter to confirm that the flow pattern corresponds to the Pattern B. The phenomenon presumably appeared from the reduction of slab-drawing speed to reduce the injection flow speed, thus failing the injection flow to reach to the solidified shell on shorter side of the mold, and dispersing the injection flow during the course from the injection opening to the solidified shell in shorter side of the mold.

EXAMPLE 4

The continuous casting machine and the temperature measurement device for mold copper plate applied in Example 1 were used. The casting of slab having 220 mm in thickness and 1,000 mm in width was carried out under the casting conditions of 1.50 m/min of slab-drawing speed and 10 Nl/min of Ar gas injection rate. In Example 4, moving magnetic field was applied in the braking direction of injection flow using the magnetic field generator.

Figure 90:
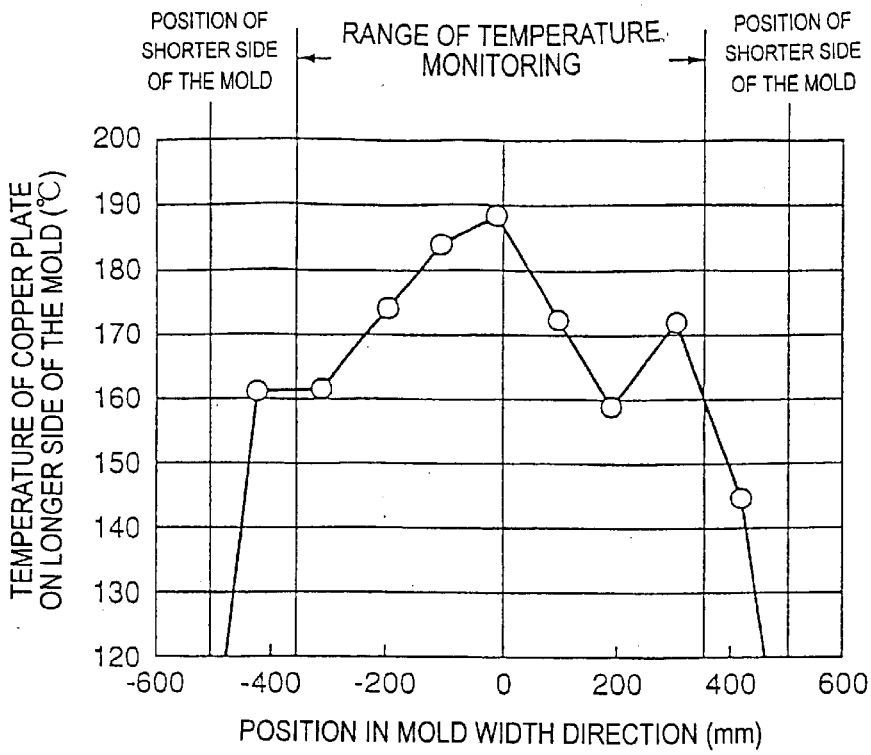
FIG. 90 shows a result of measured temperatures of mold copper plate in Example 4 of the Embodiment 5.

First, the casting was carried out under 0.03 tesla of magnetic flux density generated by the magnetic field generator. The resulted temperature distribution on copper plate on longer side of the mold is shown in FIG. 90. The temperature distribution showed the maximum value at near the copper plate on longer side of the mold and at near the immersion nozzle. The temperature distribution suggested that, at the meniscus, the flow speed of molten steel was high at near the immersion nozzle. That is, the molten steel flow caused from ascending flow of molten steel induced during upward movement of the Ar gas injected into the immersion nozzle at near the injection opening was the main flow.

Figure 91:
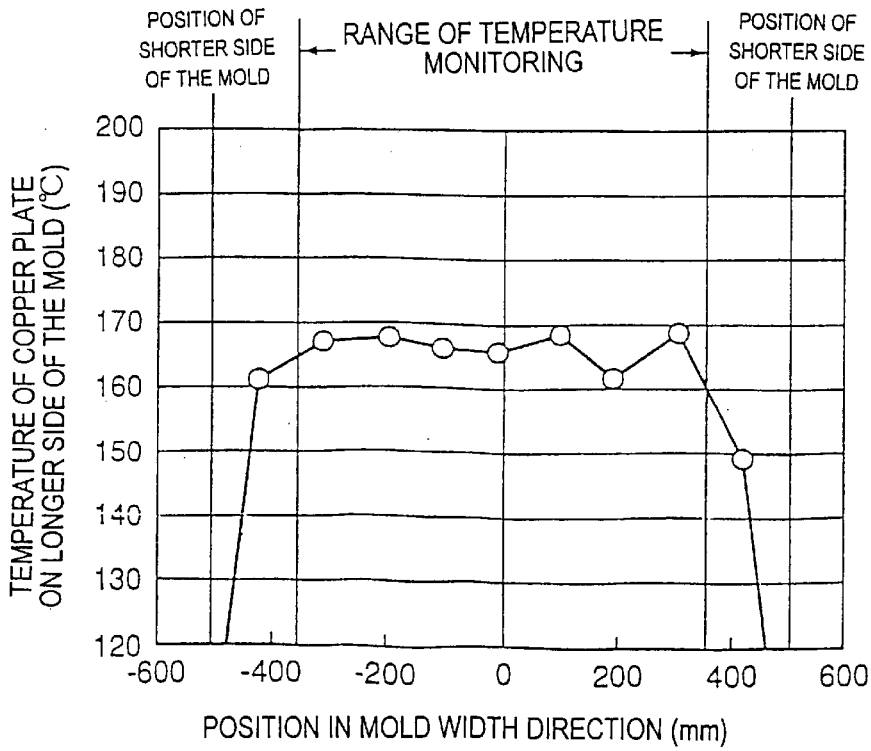
FIG. 91 shows another result of measured temperatures of mold copper plate in Example 4 of the Embodiment 5.

Next, the immersion depth was increased to 230 mm while maintaining the magnetic flux density to 0.03 tesla. The resulted temperature distribution is that shown in FIG. 91. The temperature distribution gave 9° C. of the difference between maximum and minimum values, and gave not more than 10° C. of the temperature difference at symmetrical positions in right half width and left half width of the mold. The flow speed of molten steel at meniscus was estimated almost uniform on both sides to the center of the mold width. Under the condition, the flow speed of molten steel at the meniscus was measured using an immersion rod type molten steel flow speed meter to confirm that the flow pattern corresponds to the Pattern B. The phenomenon presumably appeared from that the increased immersion depth of the immersion nozzle induced the movement of upward flow from near the immersion nozzle to a position far apart from the immersion nozzle, thus decreasing the upward flow speed at near the immersion nozzle.

EXAMPLE 5

The continuous casting machine and the temperature measurement device for mold copper plate applied in Example 1 were used. The casting of slab having 220 mm in thickness and 1,600 mm in width was carried out under the casting conditions of 2.0 m/min of slab-drawing speed, 10 Nl/min of Ar gas injection rate, and 220 mm of immersion depth of the immersion nozzle. In Example 5, moving magnetic field was applied in the braking direction of injection flow using the magnetic field generator. The magnetic field generator can adjust the intensity of applied magnetic field separately for right and left to the immersion nozzle in the mold width direction.

Figure 92:
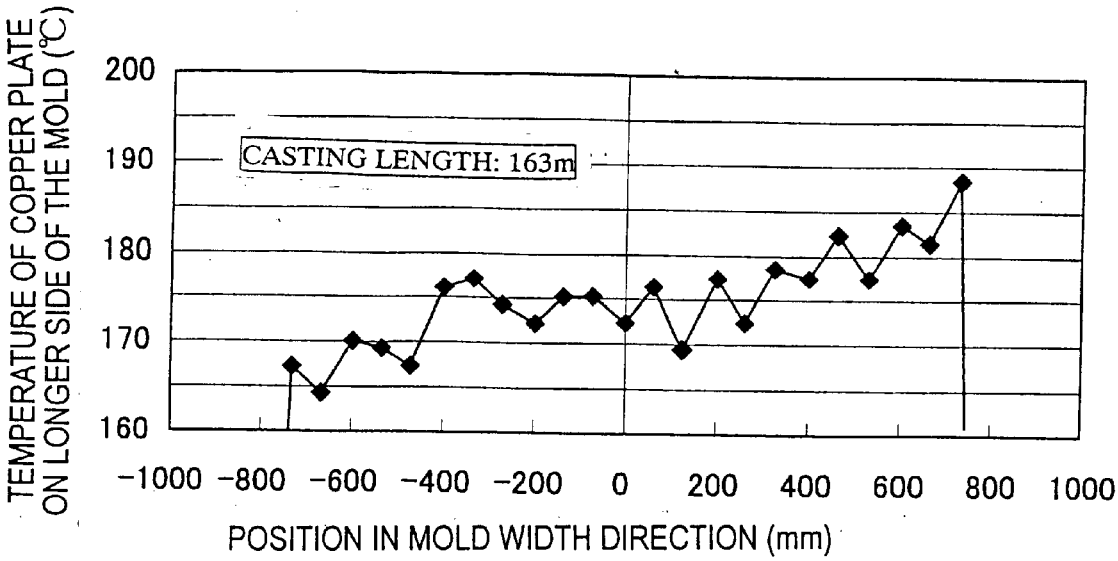
FIG. 92 shows a result of measured temperatures of mold copper plate in Example 5 of the Embodiment 5.

First, the magnetic flux density generated from the magnetic field generator was set to 0.06 tesla for both right and left sides on mold width. The resulted temperature distribution on copper plate on longer side of the mold became that shown in FIG. 92. The temperature distribution in the right side became(higher than that in the left side to the center of the mold width.

Accordingly, it was estimated that, at meniscus, the molten steel flow speed was higher in the right half width than in the left half width. That is, there were deflected flows in right half width and left half width of the mold.

Figure 93:
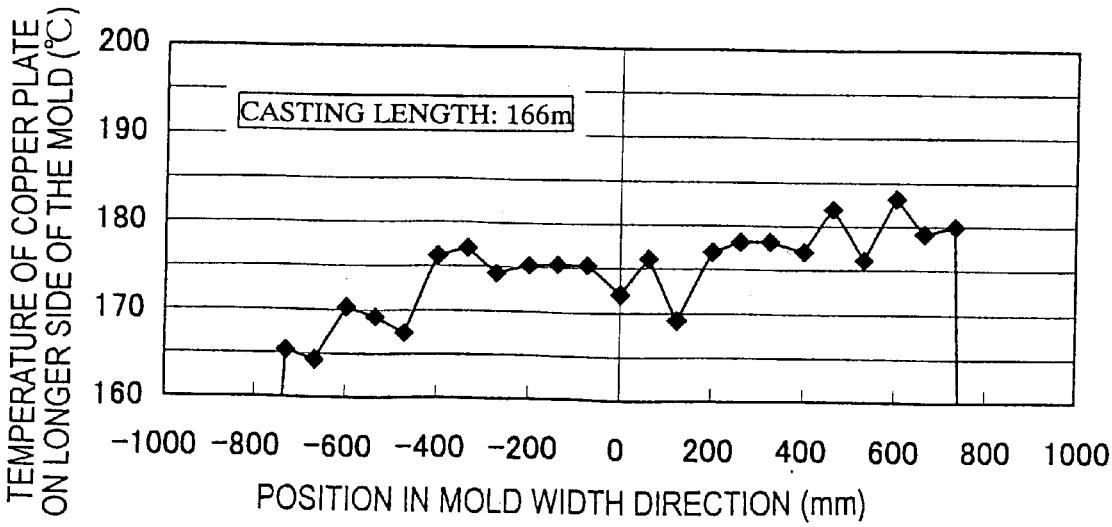
FIG. 93 shows another result of measured temperatures of mold copper plate in Example 5 of the Embodiment 5.
Figure 94:
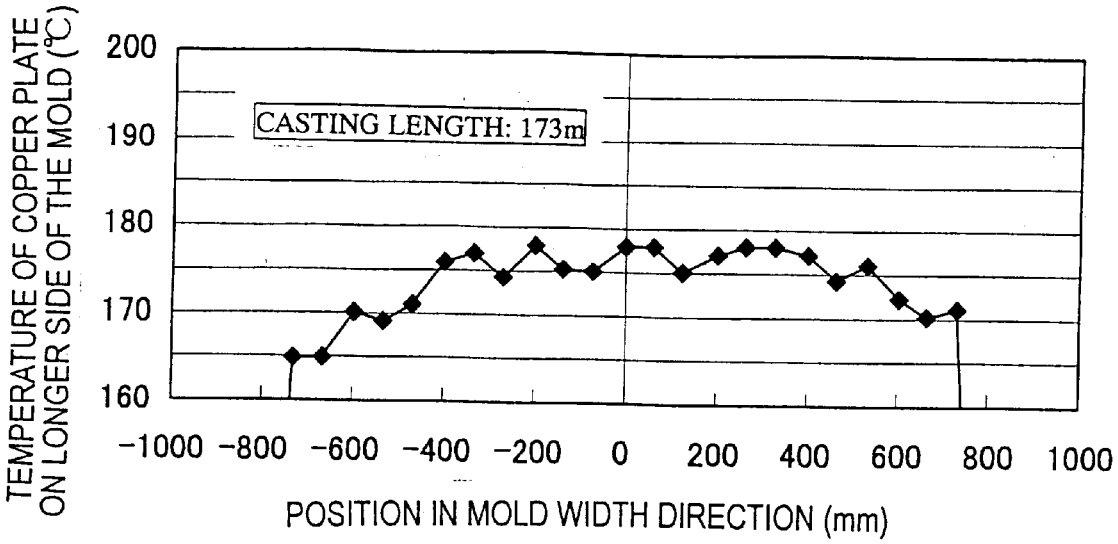
FIG. 94 shows further result of measured temperatures of mold copper plate in Example 5 of the Embodiment 5.

When the magnetic flux density generated from the magnetic field generator was increased to 0.065 tesla only on the right half width of the mold, the resulted temperature distribution became that shown in FIG. 93, which shows decreased deflected flow on right half width and left half width of the mold. Furthermore, when the magnetic flux density generated from the magnetic field generator was increased to 0.07 tesla only on the right half width of the mold, the resulted temperature distribution became that shown in FIG. 94. The temperature distribution gave 12° C. of the difference between maximum and minimum values, and gave not more than 10° C. of the temperature difference at symmetrical positions in right half width and left half width of the mold. The flow speed of molten steel at meniscus was estimated almost uniform on both half widths to the center of the mold width.

Figure 95:
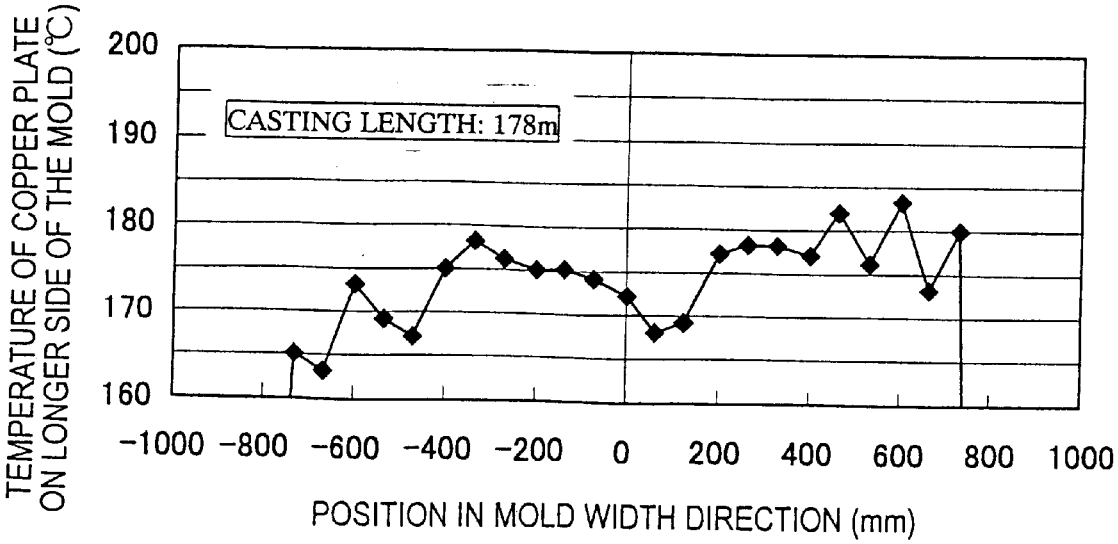
FIG. 95 shows still another result of measured temperatures of mold copper plate in Example 5 of the Embodiment 5.

Under the condition, the flow speed of molten steel at the meniscus was measured using an immersion rod type molten steel flow speed meter to confirm that the flow pattern corresponds to the Pattern B. For confirmation, the magnetic flux density generated from the magnetic field generator on the right half width was returned to 0.06 tesla which is the original value same as in the left half width, the resulted temperature distribution became that shown in FIG. 95. The temperature distribution in the right half width of the mold became higher than that in the left half width thereof, which proved that the original deflected flow state on right half width and left half width of mold appeared again.

Figure 96:
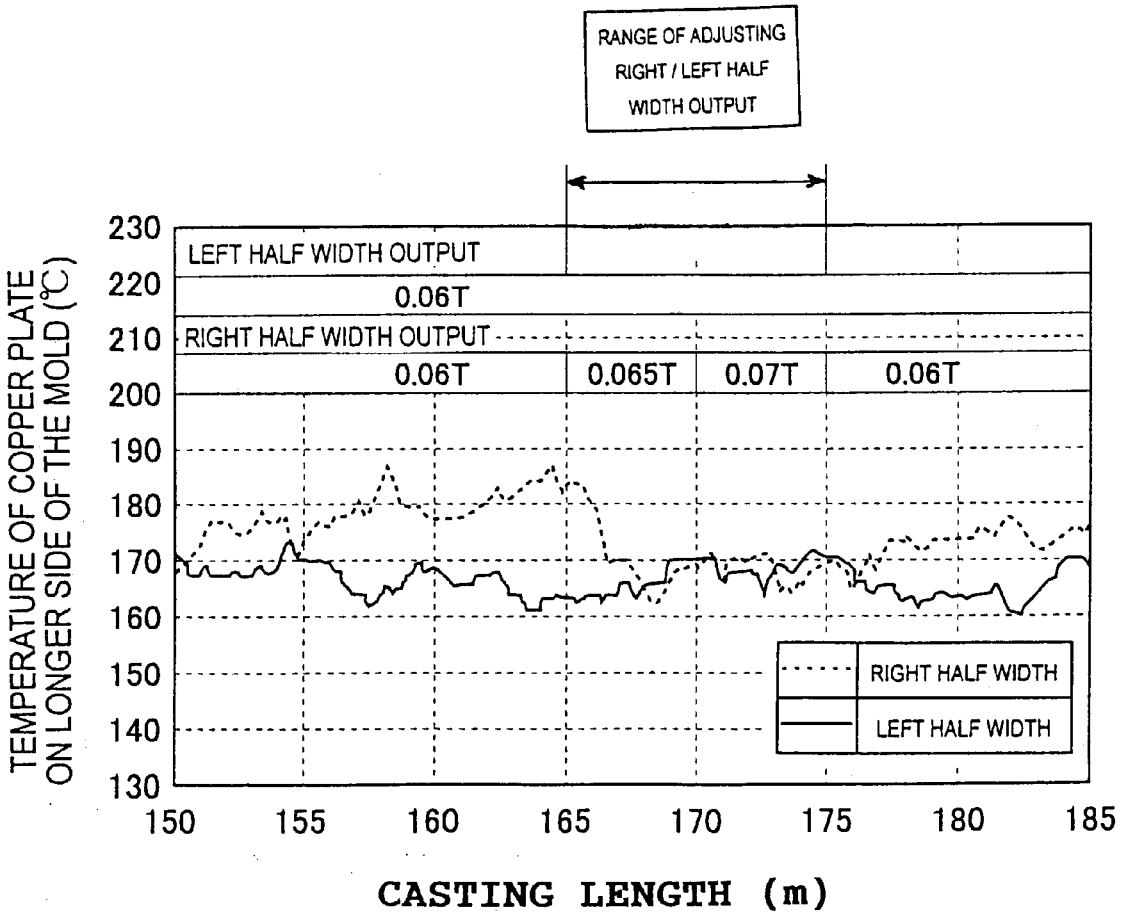
FIG. 96 shows an example of the time sequential variations of temperature of copper plate on longer side of the mold under variations of magnetic flux density of the magnetic field generator in Example 5 of the Embodiment 5.

FIG. 96 shows the variations of mold copper temperature measured by a thermocouple located at 665 mm distant from the center of mold width to each of right half width and left half width. The graph shows that the deflected flow is suppressed by applying magnetic field at right half width and left half width separately.

Example 5 used a method to increase the intensity of magnetic field at the side of stronger flow. Alternatively, a method of weakening the intensity of magnetic field at the side of weaker flow may be used. In the case that the moving magnetic field is applied in the direction to accelerate the flow, either a method to weakening the intensity of magnetic field at the side of stronger flow or a method to strengthen the intensity of magnetic field at the side of weaker flow can be used.

What is claimed is:

1. A method for estimating flow pattern of molten steel in continuous casting, comprising the steps of:

continuously casting a molten steel injected into a mold through an immersion nozzle;

measuring temperatures of a copper plate in width direction of the copper plate on a longer side of the mold at a plurality of points using a temperature measurement device; and estimating a flow pattern of the molten steel in the mold based on a distribution of the copper plate temperatures at individual measurement points, the step of estimating the flow pattern comprising estimating a flow pattern of the molten steel in the mold based on a quantity and positions of peaks of temperatures of the mold copper plate in the mold width direction.

2. The method of claim 1, further comprising the step of applying a magnetic field to the molten steel that was injected into the mold so as to establish a specified flow pattern.

3. A method for estimating flow pattern of molten steel in continuous casting, comprising the steps of:

continuously casting a molten steel injected into a mold through an immersion nozzle;

measuring temperatures of a copper plate in width direction of the copper plate on longer side of the mold at a plurality of points using a temperature measurement device;

estimating a flow pattern of the molten steel in the mold based on a distribution of the copper plate temperatures at individual measurement points; and determining a heat flux being transferred from the molten steel in the mold to a cooling water for the mold copper plate using the mold copper plate temperatures measured by the temperature measurement device, thickness of the mold copper plate, distance between a surface of the mold copper plate on the molten steel side and a tip of a temperature measurement element, temperature of the cooling water for the mold copper plate, thickness of a solidified shell, thickness of a mold powder layer, and temperature of the molten steel in the mold;

deriving a convection heat transfer coefficient, corresponding to the heat flux, between the molten steel and a solidified shell; and determining flow speed of the molten steel along the solidified shell based on the thus derived convection heat transfer coefficient.

4. A method for estimating flow pattern of molten steel in continuous casting, comprising the steps of:

continuously casting a molten steel injected into a mold through an immersion nozzle;

measuring temperatures of a copper plate in width direction of the copper plate on longer side of the mold at a plurality of points using a temperature measurement device; and estimating a flow pattern of the molten steel in the mold based on a distribution of the copper plate temperatures at individual measurement points;

the temperature measurement device for the mold copper plate comprising a plurality of temperature measurement elements which are buried in rear face of the mold copper plate for continuous casting, the temperature measurement elements being located in a distance range of from 10 to 135 mm from the level of molten steel in the mold to the direction of slab-drawing, a distance between a surface of the mold copper plate on the molten steel side and a tip of the temperature measurement element being 16 mm or less, while keeping not more than 200 mm of intervals of the temperature measurement elements in the mold width direction and allotting thereof over a range corresponding to a whole width of the slab.

5. A method for estimating flow pattern of molten steel in continuous casting comprising the steps of:

continuously casting a molten steel injected into a mold through an immersion nozzle;

measuring temperatures of a copper plate in width direction of the copper plate on longer side of the mold at a plurality of points using a temperature measurement device; and estimating a flow pattern of the molten steel in the mold based on a distribution of the copper plate temperatures at individual measurement points;

the step of estimating the flow pattern comprising estimating a deflected flow of the molten steel in the mold based on the measured temperatures by comparing a maximum value and a position of the maximum value of the temperatures of mold copper plate at right half width with a maximum value and a position of the maximum value of the temperatures of mold copper plate at left half width of the mold to a center of the mold width.

6. A temperature measurement device for mold copper plate comprising:

a plurality of temperature measurement elements buried in a rear face of a mold copper plate for continuous casting process;

the temperature measurement elements being located in a distance range of from 10 to 135 mm from a level of molten steel in the mold to a direction of slab-drawing, a distance between a surface of the mold copper plate on a molten steel side and a tip of the temperature measurement element being 16 mm or less, while keeping not more than 200 mm of intervals of the temperature measurement elements in a mold width direction, and allotting thereof over a range corresponding to a whole width of the slab.

7. The temperature measurement device of claim 6, wherein the temperature measurement element is placed passing through a pipe which is isolated from a cooling water in a water box, and a seal packing is applied around the place where the temperature measurement element is placed.

8. A method for judging surface defect on a slab obtained by continuous casting, comprising the steps of:

locating a plurality of temperature measurement elements in a distance range of from 10 to 135 mm from a position of meniscus in a mold to a direction of slab-drawing along a width direction of a rear face of a mold copper plate;

measuring a distribution of temperatures of a mold copper plate in a width direction thereof; and judging the surface defect on the slab on a basis of the distribution of temperatures in the mold width direction, the judgment of surface defect being carried out by judging the surface defect of the slab based on a maximum value in the temperature distribution in the mold width direction.

9. A method for judging surface defect on a slab obtained by continuous casting, comprising the steps of:

locating a plurality of temperature measurement elements in a distance range of from 10 to 135 mm from a position of meniscus in a mold to a direction of slab-drawing along a width direction of a rear face of a mold copper plate;

measuring a distribution of temperatures of a mold copper plate in a width direction thereof; and judging the surface defect on the slab on a basis of the distribution of temperatures in the mold width direction, the judgment of surface defect being carried out by judging the surface defect of the slab based on a minimum value in the temperature distribution in the mold width direction.

10. A method for judging surface defect on a slab obtained by continuous casting, comprising the steps of:

locating a plurality of temperature measurement elements in a distance range of from 10 to 135 mm from a position of meniscus in a mold to a direction of slab-drawing along a width direction of a rear face of a mold copper plate;

measuring a distribution of temperatures of a mold copper plate in a width direction thereof; and judging the surface defect on the slab on a basis of the distribution of temperatures in the mold width direction, the judgment of surface defect being carried out by judging the surface defect of the slab based on an average value in the temperature distribution in the mold width direction.

11. A method for judging surface defect on a slab obtained by continuous casting, comprising the steps of:

locating a plurality of temperature measurement elements in a distance range of from 10 to 135 mm from a position of meniscus in a mold to the direction of slab-drawing along a width direction of a rear face of a mold copper plate;

measuring a distribution of temperatures of a mold copper plate in a width direction thereof; and judging the surface defect on the slab on a basis of the distribution of temperatures in the mold width direction, the judgment of surface defect being carried out by judging the surface defect of the slab based on a difference between the average value of the temperature distribution in the mold width direction and the average value of a typical temperature distribution in the mold width direction at the slab-drawing speed.

12. A method for judging surface defect on a slab obtained by continuous casting, comprising the steps of:

locating a plurality of temperature measurement elements in a distance range of from 10 to 135 mm from a position of meniscus in a mold to a direction of slab-drawing along a width direction of a rear face of a mold copper plate;

measuring a distribution of temperatures of a mold copper plate in a width direction thereof; and judging the surface defect on the slab on a basis of the distribution of temperatures in the mold width direction, the judgment of surface defect being carried out by judging the surface defect of the slab based on a larger value of, centering an immersion nozzle located at center of a mold, the difference between a maximum value and a minimum value in the temperature distribution at left half width of the mold and the difference between a maximum value and a minimum value in the temperature distribution at right half width of the mold.

13. A method for judging surface defect on a slab obtained by continuous casting, comprising the steps of:

locating a plurality of temperature measurement elements in a distance range of from 10 to 135 mm from a position of meniscus in a mold to a direction of slab-drawing along a width direction of a rear face of a mold copper plate;

measuring a distribution of temperatures of a mold copper plate in a width direction thereof; and judging the surface defect on the slab on a basis of the distribution of temperatures in the mold width direction, the judgment of surface defect being carried out by judging the surface defect of the slab based on an absolute value of a difference between a maximum value in a temperature distribution at left half width of the mold and a maximum value in the temperature distribution at right half width of the mold, centering an immersion nozzle located at center of the mold.

14. A method for detecting flow of molten steel in a continuous casting process comprising the steps of locating a plurality of temperature measurement elements orthogonally to a direction of slab-drawing at a rear face of a mold copper plate for continuous casting;

measuring mold copper plate temperatures using the plurality of temperature measuring elements;

applying low pass filter treatment to each of the thus measured mold copper temperatures assuming a range of cut-off space frequency of larger than [2/(mold width W)] and less than 0.01, the space frequency f of the molten steel flow being defined by f=1/L, where L designates varying wave length (mm); and estimating a state of flow of molten steel in the mold on a basis of the temperature distribution of the mold copper plate, which temperature distribution was treated by the low pass filter.

15. The method of claim 14, wherein the low pass filter treatment is a spatial movement average, and, at 3 of averaged number, a distance between adjacent temperature measurement elements is adjusted to a range of from more than 14.8 mm and less than [0.443×(mold width W)/6) mm.

16. The method of claim 14, wherein the low pass filter treatment is carried out using a data series which is extended by doubling back acquired data at each of both edges of the mold width.

17. A method for detecting flow of molten steel in continuous casting, comprising the steps of:

locating a plurality of temperature measurement elements orthogonally to a direction of slab-drawing while keeping a distance between adjacent temperature measurement elements to a range of from 14.8 mm to [0.443×(mold width W)/6] mm;

measuring temperatures of a mold copper plate using the thus located temperature measurement elements;

deriving a spatial movement average of the thus measured mold copper plate temperatures; and estimating a state of molten steel flow in the mold based on a temperature distribution of the spatial movement average mold copper plate temperatures.

18. The method of claim 17, wherein the measured mold copper plate temperatures are sampled at intervals of not more than 60 seconds.

19. A method for evaluating irregularity in heat-release in a mold in continuous casting, comprising the steps of:

locating a plurality of temperature measurement elements orthogonally to the direction of slab-drawing at a rear face of a mold copper plate for continuous casting;

measuring temperatures of the mold copper plate using the thus located temperature measurement elements;

applying low pass filter treatment to each of the thus measured mold copper temperatures; and evaluating the irregularity in heat-release in the mold on a basis of a difference between the measured mold copper plate temperature and the mold copper plate temperature that was treated by the low pass filter.

20. A method for controlling molten steel flow in continuous casting, comprising the steps of:

measuring temperature distribution in the width direction of a copper plate on a longer side of a mold by locating a plurality of temperature measurement elements in a width direction of and on a rear face of the copper plate on a longer side of the mold for continuous casting; and adjusting one or more of the variables of an intensity of a magnetic field generated by a magnetic field generator attached to the mold, a slab-drawing speed, an immersion depth of an immersion nozzle, and an Ar gas injection rate into the immersion nozzle, so as a difference between a maximum value and a minimum value in the thus determined temperature distribution becomes 12° C. or less.

21. The method of claim 20, wherein the intensity of magnetic field of the magnetic field generator attached to the mold is adjusted separately in a right half width and a left half width of the mold in relation to the immersion nozzle and to each other.

22. The method of claim 20, wherein one or more of the variables of the magnetic field intensity of the magnetic field generator attached to the mold, the slab-drawing speed, the immersion depth of the immersion nozzle, and the Ar gas injection rate into the immersion nozzle are adjusted so as a difference between a maximum value and a minimum value in the measured temperature distribution becomes 12° C. or less, and so as a temperature difference between symmetrical positions in a right half width and a left half width of the mold in relation to the immersion nozzle along a width of the copper plate on the longer side of the mold becomes 10° C. or less.

23. The method of claim 22, wherein the intensity of the magnetic field of the magnetic field generator attached to the mold is adjusted separately in a right half width and a left half width of the mold in relation to the immersion nozzle and to each other.

24. A method for controlling molten steel flow in a continuous casting process comprising the steps of:

measuring temperature distribution in a width direction of a copper plate on a longer side of a mold by locating a plurality of temperature measurement elements in the width direction on a rear face of the copper plate on the longer side of the mold for continuous casting;

deriving molten steel flow distribution in the width direction of the copper plate on the longer side of the mold by determining a flow speed of the molten steel at each measurement point on a basis of the thus measured temperatures;

adjusting one or more of the variables of an intensity of a magnetic field generated by a magnetic field generator attached to the mold, a slab-drawing speed, an immersion depth of an immersion nozzle, and an Ar gas injection rate into the immersion nozzle, so as a difference between a maximum value and a minimum value in the determined molten steel flow distribution becomes 0.25 m/sec or less.

25. The method of claim 24, wherein the intensity of the magnetic field generator attached to the mold is adjusted separately in a right half width and a left half width of the mold in relation to the immersion nozzle and to each other.

26. The method of claim 24, wherein one or more of the variables of the magnetic field intensity of the magnetic field generator attached to the mold, the slab-drawing speed, the immersion depth of the immersion nozzle, and the Ar gas injection rate into the immersion nozzle are adjusted so as the difference between the maximum value and the minimum value in the derived molten steel flow distribution becomes 0.25 m/sec or less, and so as a difference in flow speed of molten steel between symmetrical positions in a right half width and a left half width in relation to the immersion nozzle along a width of the copper plate on longer side of the mold becomes 0.20 m/sec or less.

27. The method of claim 26, wherein the intensity of the magnetic field generator attached to the mold is adjusted separately in the right half width and the left half width of the mold in relation to the immersion nozzle and to each other.

28. A temperature measurement device for mold copper plate comprising:

a plurality of temperature measurement elements buried in rear face of a mold copper plate for continuous casting process;

the temperature measurement elements being located in a distance range of from 10 to 135 mm from a level of molten steel in the mold to a direction of slab-drawing;

a distance between a surface of the mold copper plate on a molten steel side and a tip of the temperature measurement element being 16 mm or less;

the temperature measurement elements comprising at least five temperature measurement elements in one wavelength of a flow speed profile of the molten steel near a meniscus.

29. A method for controlling a quality of steel in continuous casting, comprising the steps of:

continuously casting a molten steel injected into a mold through an immersion nozzle;

measuring temperatures of a copper plate in a width direction of the copper plate on a longer side of the mold at a plurality of points using a temperature measurement device; and estimating a flow pattern of the molten steel in the mold based on a distribution of copper plate temperatures at individual measurement points; and the step of estimating the flow pattern comprising estimating a flow pattern of the molten steel in the mold based on quantity and positions of peaks of temperatures of the mold copper plate in the mold width direction to detect a flow state of the molten steel in the mold.

30. A continuous casting method, comprising the steps of:

injecting a molten steel into a mold through an immersion nozzle;

measuring temperatures of a copper plate in a width direction of the copper plate on a longer side of the mold at a plurality of points using a temperature measurement device;

estimating a flow pattern of the molten steel in the mold based on a distribution of the copper plate temperatures at individual measurement points;

the step of estimating the flow pattern comprising estimating a flow pattern of the molten steel in the mold based on quantity and positions of peaks of temperatures of the mold copper plate in the mold width direction;

adjusting at least one variable selected from the group consisting of a magnetic field intensity of a magnetic field generator attached to the mold, a slab-drawing speed, an immersion depth of an immersion nozzle, and an Ar gas injection rate into the immersion nozzle, so as to establish a specified flow pattern.

31. A continuous casting method, comprising the steps of:

injecting a molten steel into a mold through an immersion nozzle;

measuring temperatures of a copper plate in a width direction of the copper plate on a longer side of the mold at a plurality of points using a temperature measurement device comprising temperature measurement elements;

estimating a flow pattern of the molten steel in the mold based on a distribution of the copper plate temperatures at individual measurement points;

the temperature measurement elements being located in a distance range of from 10 to 135 mm from a level of molten steel in the mold to a direction of slab-drawing, a distance between a surface of the mold copper plate on a molten steel side and a tip of the temperature measurement element being 16 mm or less, while keeping not more than 200 mm of intervals of the temperature measurement elements in a mold width direction, and allotting thereof over a range corresponding to a whole width of the slab;

adjusting at least one variable selected from the group consisting of a magnetic field intensity of a magnetic field generator attached to the mold, a slab-drawing speed, an immersion depth of an immersion nozzle, and an Ar gas injection rate into the immersion nozzle, so as to establish a specified flow pattern.

32. A method for estimating flow speed of molten steel in a mold, comprising the steps of:

measuring a temperature of a copper plate of the mold using a temperature measurement element buried in the copper plate;

calculating a convection heat transfer coefficient between the molten steel and a solidified shell by using the measured temperature of the copper plate;

estimating a flow speed of the molten steel along the solidified shell.

33. A method for estimating flow speed of molten steel in a mold, comprising the steps of:

measuring a temperature of a copper plate of the mold using a temperature measurement element buried in the copper plate;

calculating a convection heat transfer coefficient between the molten steel and a solidified shell by using the measured temperature of the copper plate, a temperature of a cooling water for the copper plate of the mold and a temperature of the molten metal in the mold;

estimating a flow speed of the molten steel along the solidified shell from the convection heat transfer coefficient.

34. A method for estimating flow speed of molten steel in a mold, comprising the steps of:

measuring a temperature of a copper plate of the mold using a temperature measurement element buried in the copper plate;

calculating a convection heat transfer coefficient between the molten steel and a solidified shell by using the measured temperature of the copper plate, a temperature of a cooling water for the copper plate of the mold and a temperature of the molten metal in the mold;

estimating a flow speed of the molten steel along the solidified shell by using an equation between the convection heat transfer coefficient and the flow speed of the molten steel.

35. A method for estimating flow speed of molten steel in a mold, comprising the steps of:

measuring a temperature of a copper plate of the mold using a temperature measurement element buried in the copper plate;

determining a heat flux being transferred from the molten steel in the mold to a cooling water for the mold copper plate using the mold copper plate temperature measured by the temperature measurement device, a thickness of the mold copper plate, a distance between a surface of the mold copper plate on the molten steel side and a tip of a temperature measurement element, a temperature of the cooling water for the mold copper plate, a thickness of a solidified shell, a thickness of a mold powder layer, and a temperature of the molten steel in the mold;

deriving a convection heat transfer coefficient, corresponding to the heat flux, between the molten steel and a solidified shell; and determining a flow speed of the molten steel along the solidified shell based on thus derived convection heat transfer coefficient.

* * * * *